US005994040A

United States Patent [19]

Morishima et al.

[11] Patent Number: 5,994,040

[45] Date of Patent: Nov. 30, 1999

[54] PROCESSING COMPOSITION FOR SILVER HALIDE PHOTOGRAPHIC LIGHT-SENSITIVE MATERIAL, DEVELOPER AND PROCESSING METHOD USING THE SAME

[75] Inventors: Shinnichi Morishima; Kohzaburoh Yamada; Seiji Yamashita; Minoru Sakai; Kouta Fukui; Eiichi Okutsu, all of Kanagawa, Japan

[73] Assignee: Fuji Photo Film Co., Ltd., Kanagawa, Japan

[21] Appl. No.: 08/810,424

[22] Filed: Mar. 4, 1997

[30] Foreign Application Priority Data

| | | | |
|---|---|---|---|
| Mar. 4, 1996 | [JP] | Japan | 8-070908 |
| Sep. 17, 1996 | [JP] | Japan | 8-265076 |
| Sep. 17, 1996 | [JP] | Japan | 8-265085 |

[51] Int. Cl.[6] ..... G03C 5/29

[52] U.S. Cl. ..... 430/436; 430/264; 430/440; 430/441; 430/442; 430/446; 430/478; 430/480; 430/482; 430/483; 430/488

[58] Field of Search ..... 430/478, 480, 430/482, 483, 485, 488, 264, 436, 440, 441, 442, 446

[56] References Cited

U.S. PATENT DOCUMENTS

| | | | |
|---|---|---|---|
| 2,688,549 | 9/1954 | James et al. . | |
| 3,022,168 | 2/1962 | Stjärnkvist et al. . | |
| 3,091,530 | 5/1963 | Green et al. . | |
| 3,723,117 | 3/1973 | Willems . | |
| 3,826,654 | 7/1974 | Weiss et al. . | |
| 4,390,606 | 6/1983 | Gabrielsen et al. . | |
| 4,399,215 | 8/1983 | Wey . | |
| 4,427,762 | 1/1984 | Takahashi et al. . | |
| 5,217,842 | 6/1993 | Kojima et al. | 430/480 |
| 5,236,816 | 8/1993 | Purol et al. . | |
| 5,264,323 | 11/1993 | Purol et al. | 430/480 |
| 5,372,911 | 12/1994 | Obi et al. | 430/480 |
| 5,474,879 | 12/1995 | Fitterman et al. . | |
| 5,503,965 | 4/1996 | Okutsu | 430/483 |
| 5,587,276 | 12/1996 | Katoh | 430/483 |
| 5,648,205 | 7/1997 | Okutsu | 430/483 |

FOREIGN PATENT DOCUMENTS

| | | |
|---|---|---|
| A10573700 | 12/1993 | European Pat. Off. . |
| 49-46939 | 12/1974 | Japan . |
| 432838 | 2/1992 | Japan . |
| 588306 | 4/1993 | Japan . |
| 705986 | 5/1954 | United Kingdom . |
| WO9311456 | 6/1993 | WIPO . |

*Primary Examiner*—Hoa Van Le
*Attorney, Agent, or Firm*—Sughrue, Mion, Zinn, Macpeak & Seas, PLLC

[57] ABSTRACT

A processing composition for silver halide photographic light-sensitive material, which comprises at least one compound represented by the following formula (A), (A-I) or (A-II) and at least one compound represented by the following formula (B):

(A)

(A-I)

(A-II)

(B)

Also disclosed are a developer prepared from the processing composition, and a processing method using the developer.

16 Claims, No Drawings

PROCESSING COMPOSITION FOR SILVER HALIDE PHOTOGRAPHIC LIGHT-SENSITIVE MATERIAL, DEVELOPER AND PROCESSING METHOD USING THE SAME

FIELD OF THE INVENTION

The present invention relates to a processing method of a silver halide photographic light-sensitive material and a developer composition. More specifically, the present invention relates to a method for processing a silver halide photographic light-sensitive material with a developer containing substantially no dihydroxybenzene-base developing agent to form an image.

BACKGROUND OF THE INVENTION

The silver halide photographic light-sensitive material is used over a wide range of fields such as the field of platemaking and the field of medical diagnosis. As the application field extends and is intensified, requirements with respect to the development processing step necessary for forming an image are increased, in particular, a rapid and stable development processing is keenly demanded.

The silver halide photographic light-sensitive material is generally processed after exposure through steps of development, fixing and water washing. The black-and-white developer is commonly an alkaline solution containing a hydroquinone which is a dihydroxybenzene-base compound, as a developing agent, an aminophenol or 3-pyrazolidone as an auxiliary developing agent, and a sulfite. Other than the dihydroxybenzene-base compound, endiols such as an ascorbic acid is known to function as a developing agent and recently attracting an attention as a developing agent free of any ecological or toxicological problem as described above. For example, U.S. Pat. Nos. 2,688,549 and 3,826,654 disclose that an image can be formed under a high alkaline condition at a pH of at least 12 by using an ascorbic acid as a developing agent. However, these image forming methods are not satisfied in view of either rapidity or formation of a high contrast image.

Several attempts have been made to increase contrast in the development system using an ascorbic acid. For example, Zwicky, *J. Phot. Sc.*, vol. 27, p. 185 (1979) discloses that when an ascorbic acid is used as a sole developing agent, a kind of lith effect is provided. However, this system is low in the contrast as compared with the hydroquinone development system. U.S. Pat. No. 3,022,168 discloses that the use of an ascorbic acid as a developing agent and of N-methyl-p-aminophenol as an auxiliary developing agent enables the formation of an image having a high contrast under a relatively low pH condition of from 8 to 9. However, these image forming methods are not satisfied in view of rapidity and in addition, not preferred in view of environmental concern because a large amount of boric acid must be contained in the developer. JP-B-49-46939 (the term "JP-B" as used herein means an "examined Japanese patent publication") and U.S. Pat. No. 5,474,879 disclose a system using a bis quaternary ammonium salt and an ascorbic acid in combination, however, although a development acceleration effect may be provided, almost no effect of increasing the contrast is obtained. JP-A-4-32838 (the term "JP-A" as used herein means an "unexamined published Japanese patent publication") describes a combination effect of a quaternary salt in the system using an ascorbic acid as a developing agent and a p-aminophenol or N-alkyl-p-aminophenol as an auxiliary developing agent, however, the image obtained is not satisfied in the contrast and the reference does not mention improvement in the progress of development at all. JP-A-5-88306 achieves high contrast by using an ascorbic acid as a sole developing agent and keeping the pH of 12.0 or more, however, the developer used is markedly deteriorated by air oxidation and has a large problem in view of stability.

Further, U.S. Pat. No. 3,730,727 discloses an example of a development system capable of providing high sensitivity and reduced in stains and fog with a specific developer using an ascorbic acid and a hydrazine derivative as main components, however, the reference does not mention improvement in the contrast at all.

It is known to process a light-sensitive material containing hydrazine with an ascorbic acid developer and this is disclosed in U.S. Pat. No. 5,236,816 and WO93/11456, however, either technique is insufficient in both the contrast and the rapidity. In the latter case, an amine is contained in the developer to achieve the contrast, and this is not preferred in view of environmental concern. A development processing method using an ascorbic acid preferred in view of toxicology, as a developing agent and capable of providing a high contrast image with rapidity, is being demanded, however, satisfactory contrast had not yet been obtained.

SUMMARY OF THE INVENTION

An object of the present invention is to provide a novel image forming method using a developer not containing a dihydroxybenzene-base compound as a developing agent, more specifically, to provide an ultrahigh contrast negative image with rapidity using a photographic light-sensitive material containing a hydrazine compound.

Other objects and effects of the present invention will be apparent from the following description.

The above-described objects has been achieved by providing:

(1) a processing composition comprising an ascorbic acid represented by the following formula (B) or a derivative thereof, wherein the developer further comprises at least one p-aminophenol represented by the following formula (A), (A-I) or (A-II);

(A)

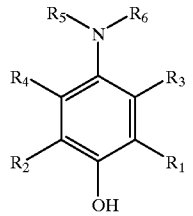

wherein $R_1$, $R_2$, $R_3$ and $R_4$, which may be the same or different, each represents a hydrogen atom or a substituent, and $R_5$ and $R_6$, which may be the same or different, each represents an alkyl group, an alkenyl group, an alkynyl group, an aryl group, an aralkyl group or a heterocyclic group;

(A-I)

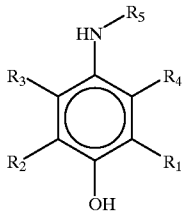

(A-II)

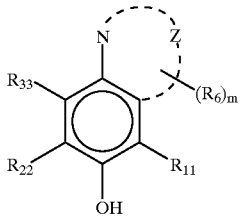

wherein in formulae (A-I) and (A-II), $R_1$, $R_2$, $R_3$, $R_4$, $R_{11}$, $R_{22}$, $R_{33}$ and $R_6$, which may be the same or different, each represents a hydrogen atom or a substitutent, provided that at least one of $R_1$, $R_2$, $R_3$ and $R_4$ represents a substituent; in formula (A-I), $R_5$ represents an alkyl group, an alkenyl group, an alkynyl group, an aryl group or a heterocyclic group; and in formula (A-II), Z represents an atomic group comprising a carbon atom or an oxygen atom, capable of forming a 5- or 6-membered condensed heterocyclic ring together with the nitrogen atom and the benzene ring in formula (A-II), and m represents an integer of from 0 to 4;

(B)

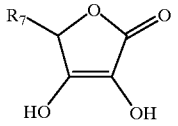

wherein $R_7$ represents a hydrogen atom, an alkyl group, an aryl group or a heterocyclic group;

(2) a developer comprising at least one compound represented by formula (A), (A-I) or (A-II) and at least one compound represented by formula (B);

(3) a processing method comprising developing a silver halide photographic light-sensitive material with a developer comprising an ascorbic acid represented by formula (B) or a derivative thereof, wherein the developer further comprises at least one p-aminophenol represented by formula (A), (A-I) or (A-II).

DETAILED DESCRIPTION OF THE INVENTION

The p-aminophenols represented by formula (A) are described in detail below.

In formula (A), $R_1$, $R_2$, $R_3$ and $R_4$ may be the same or different, and each represents a hydrogen atom or a substituent. Examples of the substituent include an alkyl group, an aryl group, an aralkyl group, a heterocyclic group, a halogen atom, a cyano group, a nitro group, a mercapto group, a hydroxy group, an alkoxy group, an aryloxy group, an alkylthio group, an arylthio group, an acyloxy group, an amino group, an alkylamino group, a carbonamido group, a sulfonamido group, a sulfamoylamino group, a ureido group, a thioureido group, an acyl group, an oxycarbonyl group, a carbamoyl group, a sulfonyl group, a sulfinyl group, a sulfamoyl group, a carboxyl group (including a salt thereof) and a sulfo group (including a salt thereof).

These groups each may be substituted by an alkyl group, an alkenyl group, an alkynyl group, an aryl group, a halogen atom, a cyano group, a nitro group, a hydroxy group, an alkoxy group, an alkylthio group, an amino group, an alkylamino group, an ammonio group, a carbonamido group, a sulfonamido group, a sulfamoylamino group, a ureido group, a thioureido group, a carbamoyl group, a sulfamoyl group, a carboxyl group (including a salt thereof), a sulfo group (including a salt thereof) or other substituents formed by an oxygen atom, a nitrogen atom, a sulfur atom or a carbon atom.

Examples of the substituent represented by $R_1$, $R_2$, $R_3$ or $R_4$ are described in more detail below. The alkyl group is a linear, branched or cyclic alkyl group having from 1 to 10, preferably from 1 to 6 carbon atoms, and examples thereof include methyl, ethyl, propyl, isopropyl, t-butyl, cyclopentyl, cyclohexyl, benzyl, hydroxymethyl, 2-hydroxyethyl, 3-hydroxypropyl, 2,3-dihydroxypropyl, 4-hydroxybutyl, 3,4-dihydroxybutyl, 2-methoxyethyl, 3-methoxypropyl, 2-aminoethyl, 3-aminopropyl, trimethylammoniummethyl, 2-trimethylammoniumethyl, 3-trimethylammoniumpropyl, acetamidomethyl, 2-acetamidoethyl, 3-acetamidopropyl, carboxymethyl, 2-carboxyethyl, 3-carboxypropyl, sulfomethyl, 2-sulfoethyl, 3-sulfopropyl, ureidomethyl, 2-ureidoethyl, 3-ureidopropyl, carbamoylmethyl, 2-carbamoylethyl and 3-carbamoylpropyl. The alkenyl group is a linear, branched or cyclic alkenyl group having from 2 to 10, preferably from 2 to 6 carbon atoms, and examples thereof include ethenyl, 1-propenyl, 2-propenyl, 2-butenyl and 1-butenyl. The alkynyl group is a linear, branched or cyclic alkynyl group having from 2 to 10, preferably from 2 to 6 carbon atoms, and examples thereof include ethynyl, 2-propynyl, 1-propynyl, 2-butynyl and 1-butynyl.

The aryl group is an aryl group having from 6 to 10 carbon atoms and examples thereof include phenyl, naphthyl and p-methoxyphenyl. The aralkyl group is an aralkyl group having from 7 to 10 carbon atoms and examples thereof include benzyl. The heterocyclic group is a 5- or 6-membered, saturated or unsaturated heterocyclic group constituted by a carbon atom, a nitrogen atom, an oxygen atom or a sulfur atom, in which the number of the hetero atom and the kind of the element may be single or in plurality, and examples thereof include 2-furyl, benzofuryl, 2-pyrrolyl, 2-imidazolyl, 1-pyrazolyl, 2-benzotriazolyl, 2-pyridyl, 2-pyrimidyl and 2-thienyl. Examples of the halogen atom include fluorine and chlorine. The alkoxy group is an alkoxy group having from 1 to 10, preferably from 1 to 6 carbon atoms, and examples thereof include methoxy, ethoxy, propoxy, iropropoxy, butoxy, 2-methoxyethoxy and 2-methanesulfonyl-ethoxy. The aryloxy group is an aryloxy group having from 6 to 10 carbon atoms and examples thereof include phenoxy, p-methoxyphenoxy, p-carboxyphenoxy and o-sulfophenoxy. The alkylthio group is an alkylthio group having from 1 to 10, preferably from 1 to 6 carbon atoms, and examples thereof include methylthio and ethylthio. The arylthio group is an arylthio group having from 6 to 10 carbon atoms and examples thereof include phenylthio and 4-methoxyphenylthio. The acyloxy group is an acyloxy group having from 1 to 10, preferably from 1 to 6 carbon atoms, and examples thereof include acetoxy and propanoyloxy.

The alkylamino group is an alkylamino group having from 1 to 10, preferably from 1 to 6 carbon atoms, and examples thereof include methylamino, dimethylamino, diethylamino and 2-hydroxyethylamino. The carbonamido group is a carbonamido group having from 1 to 10, preferably from 1 to 6 carbon atoms, and examples thereof include acetamido and propionamido. The sulfonamido group is a sulfonamido group having from 1 to 10, preferably from 1 to 6 carbon atoms, and examples thereof include methanesulfonamido. The sulfamoylamino group is a sulfamoylamino group having from 0 to 10, preferably from 0 to 6 carbon atoms, and examples thereof include methylsulfamoylamino, dimethylsulfamoylamino and 2-methoxyethylsulfamoylamino. The ureido group is a ureido group having from 1 to 10, preferably from 1 to 6 carbon atoms, and examples thereof include ureido, methylureido, N,N-dimethylureido and N'-hydroxyureido. The thioureido group is a thioureido group having from 1 to 10, preferably from 1 to 6 carbon atoms, and examples thereof include thioureido, methylthioureido and N,N-dimethylthioureido. The acyl group is an acyl group having from 1 to 10, preferably from 1 to 6 carbon atoms, and examples thereof include acetyl and benzoyl. The oxycarbonyl group is an oxycarbonyl group having from 1 to 10, preferably from 1 to 6 carbon atoms, and examples thereof include methoxycarbonyl and ethoxycarobnyl. The carbamoyl group is a carbamoyl group having from 1 to 10, preferably from 1 to 6 carbon atoms, and examples thereof include carbamoyl, N,N-dimethylcarbamoyl and N-ethylcarbamoyl. The sulfonyl group is a sulfonyl group having from 1 to 10, preferably from 1 to 6 carbon atoms, and examples thereof include methanesulfonyl, ethanesulfonyl and 2-chloroethanesulfonyl. The sulfinyl group is a sulfinyl group having from 1 to 10, preferably from 1 to 6 carbon atoms, and examples thereof include methanesulfinyl and ethanesulfinyl. The sulfamoyl group is a sulfamoyl group having from 0 to 10, preferably from 0 to 6 carbon atoms, and examples thereof include sulfamoyl, dimethylsulfamoyl and ethylsulfamoyl.

$R_5$ and $R_6$ in formula (A) may be the same or different, and each represents an alkyl group, an alkenyl group, an alkynyl group, an aryl group, an aralkyl group or a heterocyclic group. The details of the respective groups are the same as described in $R_1$, $R_2$, $R_3$ or $R_4$, respectively. However, when $R_5$ and $R_6$ each is an alkyl group, they may be combined to form a 5- or 6-membered ring together with the nitrogen atom in formula (A), and examples of the heterocyclic ring formed include pyrrolidine, piperidine, piperazine, morpholine and 1-thia-4-azacyclohexane. When at least one of $R_5$ and $R_6$ is an alkyl group and at least one of $R_3$ and $R_4$ is an alkyl group or an alkoxy group, they may be combined to form a condensed heterocyclic ring together with the nitrogen atom and the benzene ring in formula (A), and examples of the 5- or 6-membered ring condensed to the benzene ring include indole, indoline, dihydroquinoline, tetrahydroquinoline and benzoxazine.

Two kinds of the compounds represented by formula (A) may be combined on any carbon atom to form a bis type structure.

Among the compounds represented by formula (A), the compound represented by the following formula (D) is more preferred.

(D)

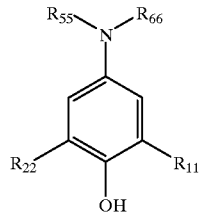

wherein $R_1$, and $R_{22}$ may be the same or different and each represents a hydrogen atom or a substituent; $R_{55}$ and $R_{66}$ may be the same or different and each represents an alkyl group, an aryl group, an aralkyl group or a heterocyclic group.

The preferred combination of $R_{11}$, or $R_{22}$ with $R_{55}$ or $R_{66}$ in formula (D) is described below.

A preferred combination is such that $R_{11}$ and $R_{22}$ each is a hydrogen atom, an alkyl group, a hydroxy group, an alkoxy group, an amino group, an alkylamino group, a carbonamido group, a sulfonamido group, a sulfamoylamino group, a ureido group or a thioureido group, and $R_{55}$ and $R_{66}$ each is an alkyl group. The alkyl group, the alkoxy group and the alkylamino group each includes those substituted by a substituent.

In the above-described combination, $R_{55}$ and $R_{66}$ each is more preferably an unsubstituted alkyl group or an alkyl group substituted by a water-soluble group. Examples of the water-soluble group includes a hydroxy group, an alkoxy group, an amino group, an alkylamino group, an ammonio group, a carbonamido group, a sulfonamido group, a sulfamoylamino group, a ureido group, a carbamoyl group, a sulfamoyl group, a carboxyl group (including a salt thereof) and a sulfo group (including a salt thereof). $R_{55}$ and $R_{66}$ is more preferably an unsubstituted alkyl group or an alkyl group substituted by a hydroxy group, an alkoxy group, an amino group, an alkylamino group, an ammonio group, a carbonamido group, a sulfonamido group or a ureido group.

Among the compounds represented by formula (D), the compound represented by the following formula (E) is most preferred.

(E)

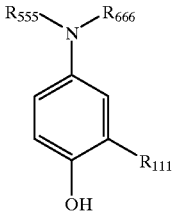

wherein $R_{111}$ represents an alkyl group, a hydroxy group, an alkoxy group, an amino group, an alkylamino group, a carbonamido group, a sulfonamido group, a sulfamoylamino group, a ureido group or a thioureido group, and $R_{555}$ and $R_{666}$ each represents an alkyl group.

In the combination of these groups, $R_{555}$ and $R_{666}$ have the same meaning as that of $R_{55}$ and $R_{66}$ and the preferred range thereof is also the same.

In the compound represented by formula (E), a preferred combination is such that $R_{111}$ is an alkyl group, an alkoxy group, a carbonamido group, a sulfonamido group, a sulfamoylamino group, a ureido group or a thioureido group, and $R_{555}$ and $R_{666}$ each is an alkyl group; a more preferred combination is such that $R_{111}$ is an alkyl group having from 1 to 3 carbon atoms, an alkoxy group having from 1 to 3 carbon atoms, a carbonamido group having from 1 to 3 carbon atoms, a sulfonamido group having from 1 to 3 carbon atoms, a sulfamoylamino group having from 1 to 3 carbon atoms, a ureido group having from 1 to 3 carbon atoms or a thioureido group having from 1 to 3 carbon atoms, and $R_{555}$ and $R_{666}$ each is an alkyl group having from 1 to 3 carbon atoms; and a most preferred combination is such that $R_{111}$ is an alkyl group having from 1 to 3 carbon atoms, an alkoxy group having from 1 to 3 carbon atoms, a carbonamido group having from 1 to 3 carbon atoms, a sulfonamido group having from 1 to 3 carbon atoms, a sulfamoylamino group having from 1 to 3 carbon atoms, a ureido group having from 1 to 3 carbon atoms or a thioureido group having from 1 to 3 carbon atoms, and $R_{555}$ and $R_{666}$ each is an alkyl group having from 1 to 3 carbon atoms, substituted by a methyl group or a hydroxy group.

Specific examples of the compound for use in the present invention are shown below, however, the present invention is by no means limited thereto.

The compound represented by formula (A) is very unstable when it is stored as a free amine, and in general, the compound is preferably produced and stored as an inorganic acid salt or an organic acid salt and, first, formed into a free amine upon the addition to the processing solution. Examples of the inorganic or organic acid for use in forming a salt of the compound represented by formula (A) include hydrochloric acid, hydrobromic acid, sulfuric acid, phosphoric acid, p-toluenesulfonic acid, methanesulfonic acid and naphthalene-1,5-disulfonic acid. The compound is preferably formed into a salt of sulfuric acid or naphthalene-1,5-disulfonic acid, most preferably a salt of naphthalene-1,5-disulfonic acid.

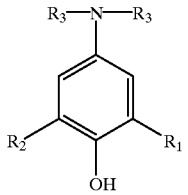

| No. | $R_1$ | $R_2$ | $R_3$ |
|---|---|---|---|
| A-1 | —H | —H | —$CH_3$ |
| A-2 | —$OCH_3$ | " | " |
| A-3 | " | —$OCH_3$ | " |
| A-4 | —$NHCOCH_3$ | —H | " |
| A-5 | " | —$NHCOCH_3$ | " |
| A-6 | —$NHCONHCH_3$ | —H | " |
| A-7 | " | —$NHCONHCH_3$ | " |
| A-8 | —$NHCONH_2$ | —H | " |
| A-9 | " | —$NHCONH_2$ | " |
| A-10 | —$NHSO_2CH_3$ | —H | " |
| A-11 | " | —$NHSO_2CH_3$ | " |
| A-12 | —OH | —H | " |

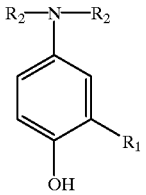

| No. | $R_1$ | $R_2$ |
|---|---|---|
| A-13 | —$NH_2$ | —$CH_3$ |
| A-14 | —$NHSO_2NH_2$ | " |
| A-15 | —$NHCH_3$ | " |
| A-16 | —$NHSO_2N(CH_3)_2$ | " |
| A-17 | —$CH_3$ | " |
| A-18 | —$CH_2N(CH_3)_3$ | " |
| A-19 | —H | —$C_2H_5$ |

-continued

| | | |
|---|---|---|
| A-20 | —$OCH_3$ | " |
| A-21 | —$NHCOCH_3$ | " |
| A-22 | —$NHCONH_2$ | " |
| A-23 | —$NHCSNH_2$ | —$CH_3$ |
| A-24 | —$OCH_2CH_2NHSO_2CH_3$ | —$C_2H_5$ |

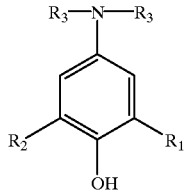

| No. | $R_1$ | $R_2$ | $R_3$ |
|---|---|---|---|
| A-25 | —$CH_3$ | —H | 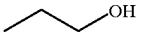 |
| A-26 | —$OCH_3$ | " | " |
| A-27 | " | —$OCH_3$ | " |
| A-28 | —$NHCOCH_3$ | —H | " |
| A-29 | " | —$NHCOCH_3$ | " |
| A-30 | —$NHCONH_2$ | —H | " |
| A-31 | " | —$NHCONH_2$ | " |
| A-32 | —$NHCONHCH_3$ | —H | " |
| A-33 | —$NHSO_2CH_3$ | " | " |
| A-34 | " | " | 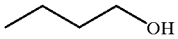 |
| A-35 | —$NHCONHCH_3$ | " | " |
| A-36 | —$NHCONH_2$ | " | " |

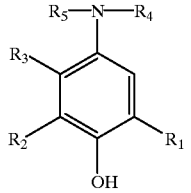

| No. | $R_1$ | $R_2$ | $R_3$ | $R_4$ | $R_5$ |
|---|---|---|---|---|---|
| A-37 | —$NHCOCH_3$ | —H | —H | 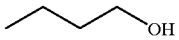 | 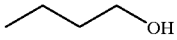 |
| A-38 | —$OCH_3$ | " | " | " | " |
| A-39 | " | —$OCH_3$ | " | " | " |
| A-40 | —H | —H | " | " | " |
| A-41 | " | " | —$CH_3$ | " | " |
| A-42 | " | " | —H | —$CH_3$ | 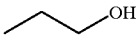 |
| A-43 | —$OCH_3$ | " | " | " | " |
| A-44 | —$NHCOCH_3$ | " | " | " | " |
| A-45 | —$NHCONH_2$ | " | " | " | " |
| A-46 | —$NHSO_2CH_3$ | " | " | " | " |
| A-47 | —$NHCONHCH_3$ | " | " | " | " |
| A-48 | 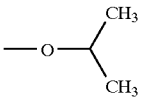 | " | " | 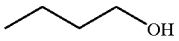 | 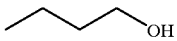 |

-continued
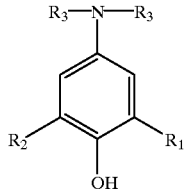
| No. | $R_1$ | $R_2$ |
|---|---|---|
| A-49 | —$CH_3$ | 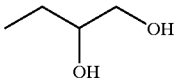 |
| A-50 | 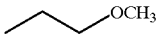 | 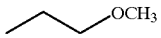 |
| A-51 | 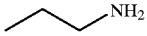 | 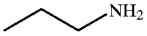 |
| A-52 | 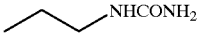 | 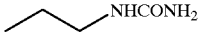 |
| A-53 | —$CH_3$ | 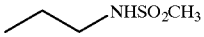 |
| A-54 | 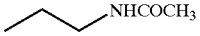 | 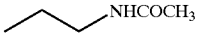 |
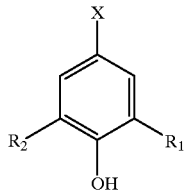
| No. | $R_1$ | $R_2$ | X |
|---|---|---|---|
| A-55 | —H | —H | 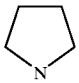 |
| A-56 | —$OCH_3$ | " | " |
| A-57 | " | —$OCH_3$ | " |
| A-58 | —$NHCONH_2$ | —H | " |
| A-59 | —$NHCONHCH_3$ | " | " |
| A-60 | —$NHCOCH_3$ | —H | 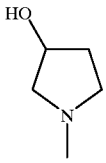 |

-continued
| | | | |
|---|---|---|---|
| A-61 | —$NHSO_2CH_3$ | " | 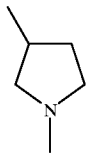 |
| A-62 | —H | " | 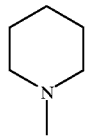 |
| A-63 | —$OCH_3$ | " | " |
| A-64 | " | —$OCH_3$ | " |
| A-65 | —$NHCONH_2$ | —H | 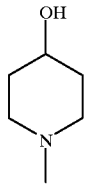 |
| A-66 | —$NHSO_2CH_3$ | " | 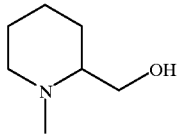 |
| A-67 | —H | " | 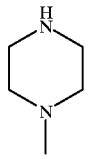 |
| A-68 | —$OCH_3$ | " | " |
| A-69 | " | —$OCH_3$ | " |
| A-70 | —$NHCONHCH_3$ | —H | " |
| A-71 | —$NHSO_2CH_3$ | " | 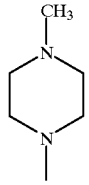 |

-continued
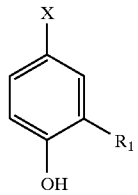
| No. | $R_1$ | X |
|---|---|---|
| A-72 | —H | 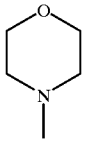 |
| A-73 | —$OCH_3$ | " |
| A-74 | —$NHCONH_2$ | " |
| A-75 | —$NHSO_2CH_3$ | " |
| A-76 | —H | 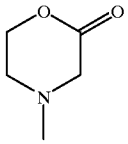 |
| A-77 | —$OCH_3$ | " |
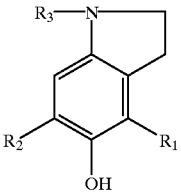
| No. | $R_1$ | $R_2$ | $R_3$ |
|---|---|---|---|
| A-78 | —H | —H | 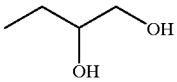 |
| A-79 | —$OCH_3$ | " | " |
| A-80 | —$NHCONH_2$ | " | " |
| A-81 | —$NHSO_2CH_3$ | " | 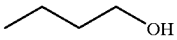 |
| A-82 | —$OCH_3$ | —$OCH_3$ | 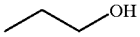 |

-continued
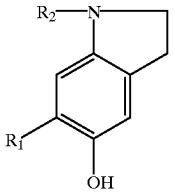
| No. | $R_1$ | $R_2$ |
|---|---|---|
| A-83 | —H | 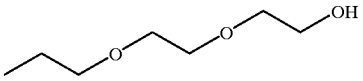 |
| A-84 | —$OCH_3$ | " |
| A-85 | —H | 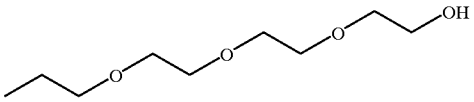 |
| A-86 | —$OCH_3$ | " |
| A-87 | —H | 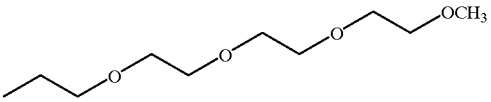 |
| A-88 | —H | 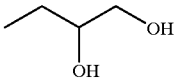 |
| A-89 | 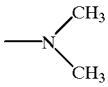 | " |
| A-90 | 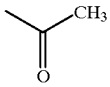 | " |
| A-91 | —$CO_2H$ | —$CH_3$ |
| A-92 | 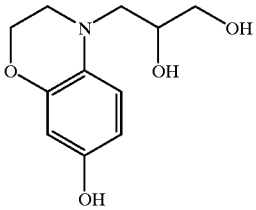 | |
| A-93 | 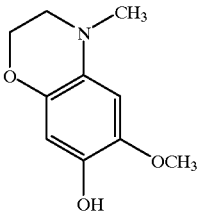 | |

-continued
A-94
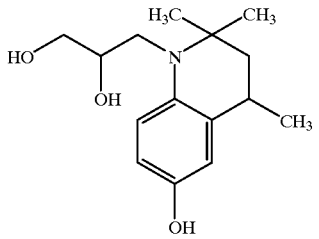
A-95
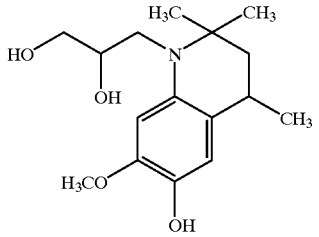
A-96
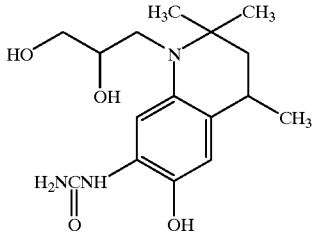
A-97
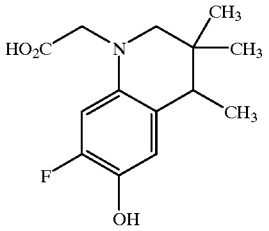
A-98
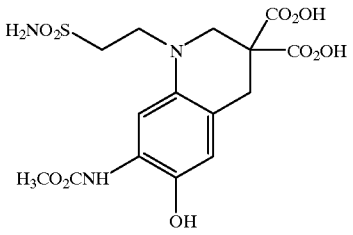

-continued
A-99
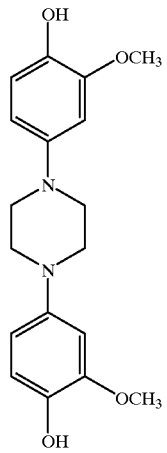
A-100
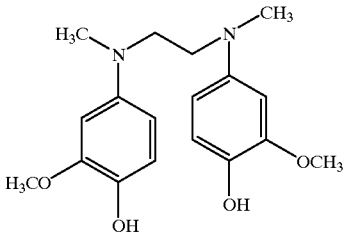
A-101
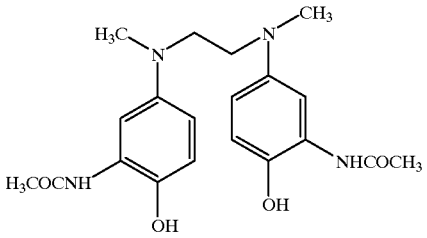
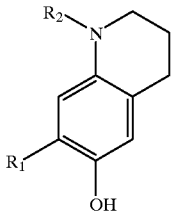
| No. | $R_1$ | $R_2$ |
|---|---|---|
| A-103 | —$OCH_3$ | —$CH_3$ |
| A-104 | —H | 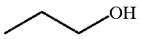 |
| A-105 | " | 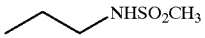 |

-continued
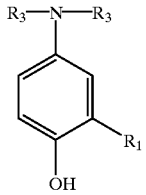
| No. | $R_1$ | $R_2$ | $R_3$ |
|---|---|---|---|
| A-106 | —SH | 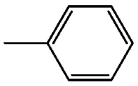 | 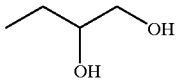 |
| A-107 | $—SCH_3$ | $—CH_3$ | $—CH_3$ |
| A-108 | $—COOCH_3$ | 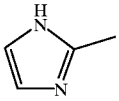 | 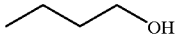 |
| A-109 | $—CONH_2$ | 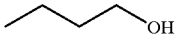 | " |
| A-110 | 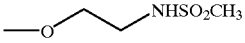 | $—CH_3$ | $—CH_3$ |
| A-111 | $—CH_2OH$ | " | " |
| A-112 | 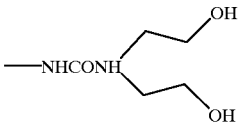 | " | " |
| A-113 | —H | 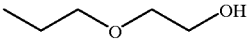 | 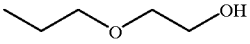 |
| A-114 | $—OCH_3$ | " | " |
| A-115 | 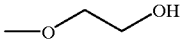 | $—CH_3$ | $—CH_3$ |
| A-116 | 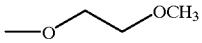 | " | " |
| A-117 | 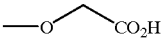 | " | " |
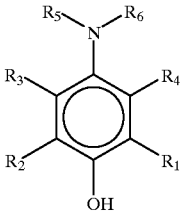
| No. | $R_1$ | $R_2$ | $R_3$ | $R_4$ | $R_5$ | $R_6$ |
|---|---|---|---|---|---|---|
| A-118 | 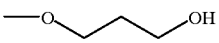 | H | H | H | $—CH_3$ | $—CH_3$ |
| A-119 | 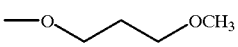 | " | " | " | " | " |
| A-120 | 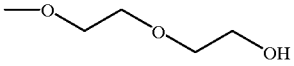 | " | " | " | " | " |

-continued
| | | | | | | |
|---|---|---|---|---|---|---|
| A-121 | 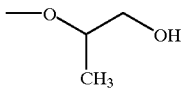 | " | " | " | " | " |
| A-122 | 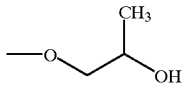 | " | " | " | " | " |
| A-123 | 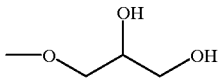 | " | " | " | " | " |
| A-124 | 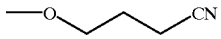 | " | " | " | " | " |
| A-125 | $—OC_2H_5$ | " | " | " | " | " |
| A-126 | 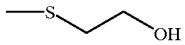 | " | " | " | " | " |
| A-127 | $—C_2H_4OH$ | " | " | " | " | " |
| A-128 | —Cl | " | " | " | " | " |
| A-129 | $—COCH_3$ | " | " | " | " | " |
| A-130 | $—SO_3Na$ | H | H | H | $—CH_3$ | $—CH_3$ |
| A-131 | —COOH | H | H | H | " | " |
| A-132 | $—CH_2OH$ | $—CH_2OH$ | H | H | " | " |
| A-133 | $—CH_3$ | $—CH_3$ | $—CH_3$ | $—CH_3$ | $—C_2H_4OH$ | $—C_2H_4OH$ |
| A-134 | 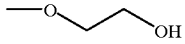 | H | H | H | 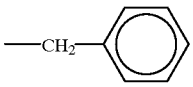 | $—CH_3$ |
| A-135 | 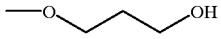 | " | " | " | $—C_2H_4OH$ | " |
| A-136 | 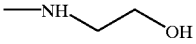 | " | " | " | $—CH_3$ | " |
| A-136 | 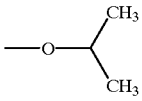 | " | " | " | $—CH_2C{\equiv}CH$ | " |
| A-137 | 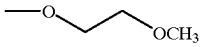 | H | " | " | $—CH_2CH{=}CH_2$ | $—CH_3$ |
| A-138 | | 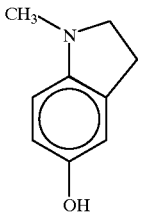 | | | | |
| A-139 | | 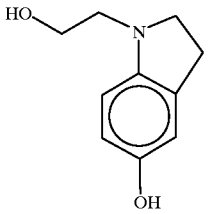 | | | | |

The compound represented by formula (A) can be easily synthesized according to a general synthesis method described, for example, in *Photographic Science and Engineering*, 10, 306 (1966). Further, the following synthesis methods or the method according thereto may also be used.

SYNTHESIS EXAMPLE

According to the following scheme, Compound (6) of the present invention was synthesized.

Scheme 1

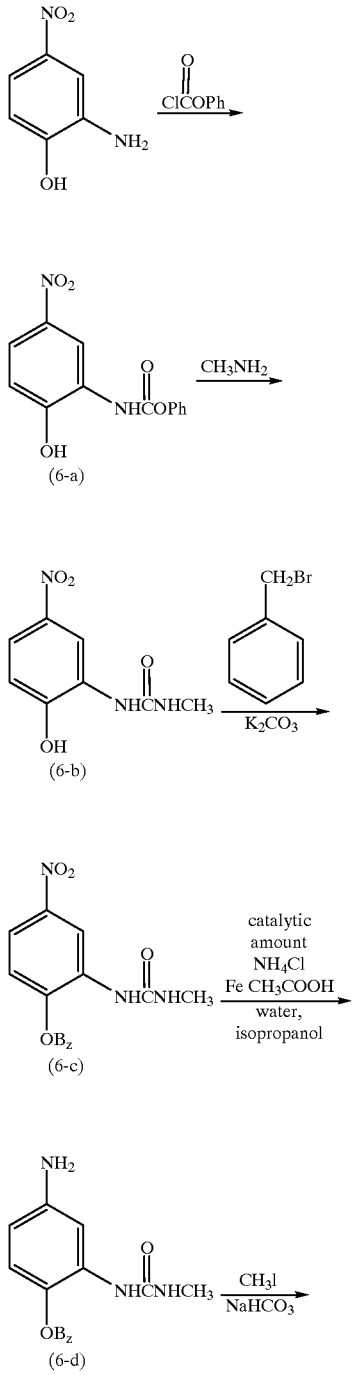

-continued

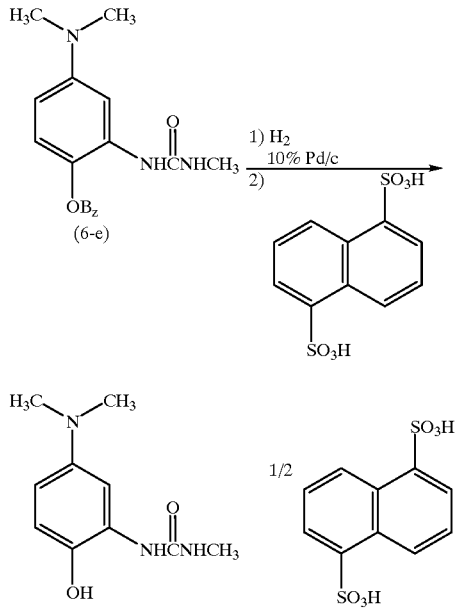

Compound 6

Synthesis of Compound (6-a):

To 61.7 g of 2-amino-4-nitrophenol, 200 ml of diemthylacetamide was added and dissolved, and to the resulting solution, 68.9 g of phenyl chloroformate was added dropwise. The mixture was stirred at room temperature for 3 hours and then poured into 800 ml of 1N hydrochloric acid, and white crystals deposited were collected by filtration and dried under reduced pressure to obtain 103.2 g of Compound (6-a).

Synthesis of Compound (6-b):

To 54.8 g of Compound (6-a), 200 ml of acetonitrile was added and dissolved, and to the resulting solution, 34.4 g of a 40% methylamine-methanol solution was added dropwise. The mixture was stirred at room temperature for 2 hours and then orange crystals deposited were collected by filtration. The orange crystals obtained were dissolved in 400 ml of diemthylacetamide and then poured into 1 l of 1N hydrochloric acid, and the white yellow crystals deposited were collected by filtration and dried under reduced pressure to obtain 38.6 g of Compound (6-b).

Synthesis of Compound (6-c):

To 38.6 g of Compound (6-b), 160 ml of dimethylacetamide and 25.2 g of potassium carbonate were added, and to the mixed solution, 34.4 g of benzylbromide was added dropwise. The mixture was stirred at room temperature for 3 hours and then poured into 800 ml of 1N hydrochloric acid, and white crystals deposited were collected by filtration and dried under reduced pressure to obtain 54.0 g of Compound (6-c).

Synthesis of Compound (6-d):

To 25.4 g of reduced iron and 0.2 g of ammonium chloride, 24 ml of water, 140 ml of isopropanol and 1 ml of acetic acid were added and heated under reflux for 15 minutes, and thereto, 54.0 g of Compound (6-c) was added gradually. After heating the mixture under reflux for 1 hour, insoluble matters were separated by Celite filtration and the solvent was distilled off under reduced pressure. The gray powder crystals obtained were dissolved in ethyl acetate, washed with saturated brine, dried over sodium sulfate, and concentrated to obtain 20.9 g of Compound (6-d).

Synthesis of Compound (6-e):

To 11.4 g of Compound (6-d) and 16.8 g of sodium hydrogencarbonate, 100 ml of dimethylacetamide was added and heated at 80° C. To the mixed solution, 6.3 ml of iodomethane was added dropwise and stirred at 80° C. for 30 minutes. The mixture was cooled to room temperature, extracted with ethyl acetate, washed with water and dried over sodium sulfate. The solvent was distilled off under reduced pressure, and the composition obtained was recrystallized from acetonitrile to obtain 5.1 g of Compound (6-e) as white crystals.

Synthesis of Compound (6):

To 100 ml of methanol, 2.4 g of Compound (6-e) and 0.5 g of a 10% palladium carbon were added, and the mixture was put into contact with hydrogen in an autoclave for 4 hours. The catalyst was separated by filtration using Celite as a filtration aid and the filtrate was added dropwise to a methanol solution containing 1.4 g of 1,5-naphthalenedisulfonic acid tetrahydrate. After distilling off the solvent, ethanol was added and the gray crystal precipitated was separated by filtration to obtain 1.4 g of the objective Compound (6), namely, 1,5-naphthalenedisulfonic acid salt, as white crystals. Melting point: 201° C.

Synthesis of Compound (2):

Compound (2) (amorphous) was synthesized almost in the same manner as Compound (6) except for using 2-methoxy-4-nitrophenol in place of Compound (6-b) in the synthesis of Compound (6).

Synthesis of Compound (4):

Compound (4) (amorphous) was synthesized almost in the same manner as Compound (6) except for using 2-acetamido-4-nitrophenol in place of Compound (6-b) in the synthesis of Compound (6).

Synthesis of Compound (35):

Compound (35-e) was obtained by performing reaction using 3-chloropropanol in place of iodomethane in the synthesis of Compound (6). Thereafter, following the synthesis procedure of Compound (6), the objective Compound (35) (amorphous) was obtained.

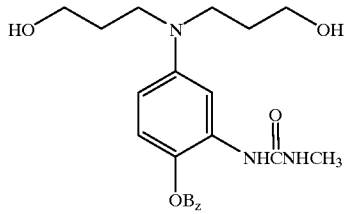

Compound (10) of the present invention was synthesized according to the following scheme.

Scheme 2

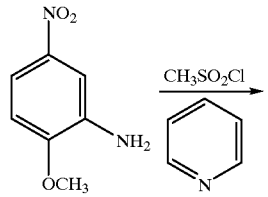

-continued

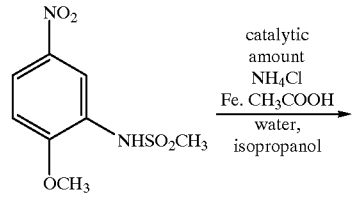

(10-a)

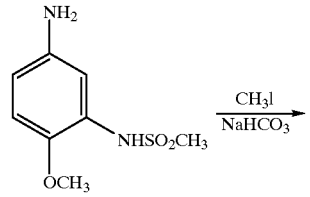

(10-b)

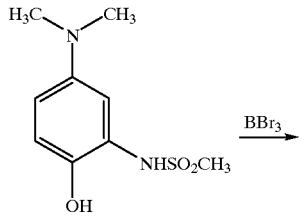

(10-c)

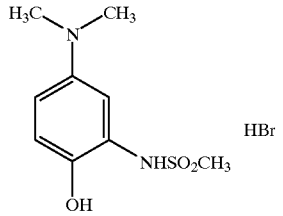

Compound (10)

Synthesis of Compound (10-a):

To 200 ml of dimethylacetamide, 33.6 g of 2-methoxy-4-nitroaniline was dissolved, and thereto, 25.2 g of methanesulfonyl chloride and then 16.2 ml of pyridine were added dropwise at room temperature. After the dropwise addition, the mixture was further stirred for 4 hours, allowed to stand overnight at room temperature and poured into 800 ml of 1N hydrochloric acid, and the milky crystals deposited were collected by filtration and dried under reduced pressure to obtain 32.4 g of Compound (10-a).

Synthesis of Compound (3-b):

To 36.7 g of reduced iron and 0.4 g of ammonium chloride, 36 ml of water, 220 ml of isopropanol and 2 ml of acetic acid were added and heated under reflux for 15 hours, and thereto, 32.4 g of Compound (10-a) was gradually added. After heating the mixture under reflux for 4 hours, insoluble matters were separated by Celite filtration, and the solvent was distilled off under reduced pressure. The gray powder crystals obtained were dissolved in ethyl acetate, washed with saturated brine, dried over sodium sulfate and concentrated to obtain 25.5 g of Compound (10-b).

Synthesis of Compound (10-c):

To 10.8 g of Compound (10-b) and 20.2 g of sodium hydrogencarbonate, 120 ml of dimethylacetamide was added and heated at 80° C. To the mixed solution, 7.5 ml of iodomethane was added dropwise and stirred at 80° C. for 30 minutes. The mixture was cooled to room temperature, extracted with ethyl acetate, washed with water and dried over sodium sulfate. The solvent was distilled off under reduced pressure to obtain 12.1 g of Compound (10-c) as colorless transparent crystals.

Synthesis of Compound (10):

To 100 ml of methylene chloride, 9.2 g of Compound (10-c) was dissolved and ice cooled to −10° C., and thereto, 10.5 ml of boron tribromide dissolved in 40 ml of methylene chloride was added dropwise at −5° C. or lower. After the dropwise addition, the mixture was stirred at room temperature for 3 hours and ice cooled, 50 ml of water was gradually added dropwise, and the white crystals deposited were collected by filtration. The composition obtained was recrystallized from water to obtain 6.1 g of the objective Compound (10), namely, hydrobromate, as white crystals. Melting point: 147° C.

The aminophenol compound represented by formula (A-I) or (A-II) is described in detail below.

In formulae (A-I) and (A-II), $R_1$, $R_2$, $R_3$, $R_4$, $R_{11}$, $R_{22}$, $R_{33}$ and $R_6$ may be the same or different, and each represents a hydrogen atom or a substituent, provided that at least one of $R_1$, $R_2$, $R_3$ and $R_4$ is a substituent. In formula (A-I), $R_5$ represents an alkyl group, an alkenyl group, an alkynyl group, an aryl group or a heterocyclic group. In formula (A-II), Z represents an atomic group comprising a carbon atom or an oxygen atom, capable of forming a 5- or 6-membered condensed heterocyclic ring together with the nitrogen atom and the benzene ring, and m represents an integer of from 0 to 4.

In formulae (A-I) and (A-II), when $R_1$, $R_2$, $R_3$, $R_4$, $R_{11}$, $R_{22}$, $R_{33}$ and $R_6$ each represents a substituent, examples of the substituent include a halogen atom (e.g., fluorine atom, chlorine atom, bromine atom, iodine atom), an alkyl group (including cycloalkyl), an alkenyl group, an alkynyl group, an aryl group, a heterocyclic group, a heterocyclic group containing a quaternized nitrogen atom (e.g, pyridinio), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing an ethylene oxy group or propylene oxy group as a repeating unit), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or heterocyclic)amino group, a nitrogen-containing heterocyclic group (N-substituted), an acylamino group, a sulfonamido group, a ureido group, a thioureido group, an imido group, an (alkoxy or aryloxy) carbonylamino group, a sulfamoylamino group, a semicarbazide group, a thiosemicarbazide group, a hydrazino group, a quaternary ammonio group, an oxamoylamino group, an (alkyl or aryl)sulfonylureido group, an acylureido group, an acylsulfamoylamino group, a nitro group, a mercapto group, an (alkyl, aryl or heterocyclic)thio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, and a group containing a phosphoric acid amido or phosphoric ester structure.

These substituents each may be further substituted by the above-described substituent.

In formulae (A-I) and (A-II), when $R_1$, $R_2$, $R_3$, R4, $R_{11}$, $R_{22}$, $R_{33}$ and $R_6$ each represents a substituent, the substituent is preferably a halogen atom (e.g., fluorine, chlorine), an alkyl group (a linear, branched or cyclic alkyl group having from 1 to 7 carbon atoms, e.g., methyl, ethyl, isopropyl, cyclopropyl, 2-hydroxyethyl, hydroxymethyl, carboxymethyl, aminomethyl), an acyl group (e.g., acetyl, methoxycarbonylacetyl), an alkoxycarbonyl group (e.g., methoxycarbonyl), a carbamoyl group (e.g., unsubstituted carbamoyl, N-methylcarbamoyl), a carboxy group or a salt thereof, a carbazoyl group (e.g., unsubstituted carbazoyl), an oxamoyl group (e.g., unsubstituted oxamoyl), a cyano group, a hydroxy group, an alkoxy group (an alkoxy group having from 1 to 7 carbon atoms, e.g., methoxy, ethoxy, isopropoxy, 2-hydroxyethoxy, 2-methoxyethoxy, 2,3-dihydroxy-propoxy, 2-(2-hydroxyethoxy)ethoxy, 2-methanesulfonylethoxy), an amino group (e.g., methylamino, dimethylamino, 2-hydroxyethylamino, carboxymethylamino), an acylamino group (e.g., acetamido, propionamido), a sulfonamido group (a sulfonamido group having from 1 to 7 carbon atoms, e.g., methanesulfonamido, ethanesulfonamido), a ureido group (e.g., unsubstituted ureido, N-methylureido), a thioureido group (e.g., unsubstituted thioureido, N-methylthioureido), an (alkoxy or aryloxy)carbonylamino group (e.g., methoxycarbonylamino), a sulfamoylamino group (e.g., unsubstituted sulfamoylamino, N'-methylsulfamoylamino), a semicarbazide group (e.g., unsubstituted semicarbazide), an alkylthio group (an alkylthio group having from 1 to 7 carbon atoms, e.g., methylthio, 2-hydroxyethylthio, 3-hydroxyethylthio, 2-(2-hydroxyethoxy)ethylthio), an alkylsulfonyl group (e.g., methanesulfonyl), a sulfo group or a salt thereof, or a sulfamoyl group (e.g., unsubstituted sulfamoyl, N-methylsulfamoyl).

In formula (A-I), $R_5$ represents an alkyl group, an alkenyl group, an alkynyl group, an aryl group or a heterocyclic group. The alkyl group is a linear, branched or cyclic alkyl group having from 1 to 16 carbon atoms, and examples thereof include methyl, ethyl, 3-hydroxypropyl, 2-hydroxypropyl, 2-hydroxyethyl, 2-(2-hydroxyethoxy) ethyl, 2,3-dihydroxypropyl, 2-aminoethyl, benzyl, 2-acetylamino-ethyl, 3-methoxypropyl, 2-methoxyethyl, 1-carboxyethyl, carboxymethyl, 2-methanesulfonylaminoethyl, trimethyl-ammonioethyl, 2-sulfoethyl and 3-carbamoylpropyl. The alkenyl group is an alkenyl group having from 1 to 16 carbon atoms, and examples thereof include vinyl, allyl, styryl and 1-propenyl. The alkynyl group is an alkynyl group having from 1 to 16 carbon atoms, and examples thereof include ethynyl and 1-propynyl. The aryl group is an aryl group having from 1 to 16 carbon atoms, and examples thereof include phenyl and 4-hydroxyphenyl group. The heterocyclic group is a 5- or 6-membered, saturated or unsaturated heterocyclic group having from 1 to 16 carbon atoms, and examples thereof include 2-pyridyl, 2-furyl and 2-imidazolyl.

In formula (A-II), Z represents an atomic group comprising a carbon atom or an oxygen atom, capable of forming a 5- or 6-membered condensed heterocyclic ring together with the nitrogen atom and the benzene ring. Examples of the condensed heterocyclic ring formed include indole, indoline, dihydroquinoline, tetrahydroquinoline and benzoxazine.

In the aminophenol compound represented by formula (A-I) or (A-II), two groups may be combined each other at the site of arbitrary carbon atom directly or through a linking group to form a bis-type structure.

Among those represented by formulae (A-I) and (A-II), preferred aminophenol compounds are described below.

The preferred aminophenol compound among those represented by formula (A-I) is represented by the following formula (A-III) and the preferred aminophenol compound among those represented by formula (A-II) is represented by the following formula (A-IV):

(A-III)

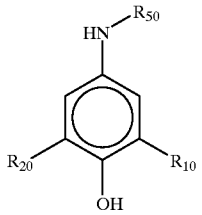

(A-IV)

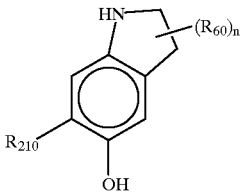

wherein $R_{20}$, $R_{210}$ and $R_{60}$ each represents a hydrogen atom or a substituent, $R_{10}$ represents a substituent, $R_{50}$ represents an alkyl group, an alkenyl group, an alkynyl group, an aryl group or a heterocyclic group, and n represents an integer of from 0 to 4.

The substituent represented by $R_{10}$ is preferably an alkyl group, an alkoxy group, an alkylthio group, a hydroxy group, a carboxy group or a salt thereof, a sulfo group or a salt thereof, an acyl group, a halogen atom, an amino group, an acylamino group, a sulfonamido group, a ureido group, a thioureido group, a sulfamoylamino group, a carbamoyl group, a sulfamoyl group or a sulfonyl group, more preferably an alkyl group, an alkoxy group, an alkylthio group, an acyl group, a halogen atom, an amino group, an acylamino group, a sulfonamido group, a ureido group, a sulfamoylamino group, a carbamoyl group or a sulfamoyl group. These groups each preferably has a total carbon atom number of 7 or less.

The substituent represented by $R_{10}$ is still more preferably an unsubstituted alkyl group, a substituted alkyl group substituted by a water-soluble group, an alkoxy group, an alkylthio group, an amino group, an acylamino group, a sulfonamido group, a ureido group or a sulfamoylamino group, and these groups each preferably has a total carbon atom number of 4 or less. The water-soluble group as used herein includes a hydroxy group, an alkoxy group, an amino group, an ammonio group, an acylamino group, a sulfonamido group, a ureido group, a sulfamoylamino group, a carbamoyl group, a sulfamoyl group, a carboxy group or a salt thereof, and a sulfo group or a salt thereof.

The substituent represented by $R_{10}$ is most preferably an alkoxy group having from 1 to 4 carbon atoms.

When $R_{20}$ and $R_{210}$ each represents a substituent, the preferred range thereof is the same as the preferred range of the substituent represented by $R_{10}$. $R_{20}$ and $R_{210}$ each is more preferably a hydrogen atom.

$R_{60}$ is preferably an alkyl group, an alkoxy group, a hydroxy group, an alkoxy group, a carboxy group (including a salt thereof) or a carbamoyl group, and n is preferably 0, 1 or 2, most preferably 0.

$R_{50}$ is preferably a substituted or unsubstituted alkyl group having a total number of carbon atoms of from 1 to 8, more preferably an unsubstituted alkyl group having a total number of carbon atoms of from 1 to 3 or a substituted alkyl group substituted by a water-soluble group having a total number of carbon atoms of from 1 to 6, and the water-soluble group as used herein includes a hydroxy group, an alkoxy group, an amino group, an ammonio group, an acylamino group, a sulfonamido group, a ureido group, a sulfamoylamino group, a carbamoyl group, a sulfamoyl group, a carboxy group or a salt thereof, and a sulfo group or a salt thereof. $R_{50}$ is still more preferably a methyl group, an ethyl group or a substituted alkyl group substituted by a water-soluble group having a total number of carbon atoms of from 1 to 4.

Among the compounds represented by formulae (A-I) to (A-IV), preferred are the compounds capable of dissolving in an amount of 0.3 mmol or more in 1 l of water (at 20° C.).

Specific examples of the compounds for use in the present invention are shown below, however, the present invention is by no means limited thereto.

The compound represented by formula (A-I) or (A-II) is very unstable when it is stored as a free amine and therefore, the compound is preferably produced and stored as an inorganic acid or organic acid salt thereof and, first, formulated into a free amine when it is added to the processing solution. Examples of the inorganic or organic acid for use in making the compound represented by formula (A-I) or (A-II) into a salt include hydrochloric acid, hydrobromic acid, sulfuric acid, phosphoric acid, p-toluenesulfonic acid, methanesulfonic acid and naphthalene-1,5-disulfonic acid. Among these, a sulfuric acid salt and a naphthalene-1,5-disulfonic acid salt are preferred, and a naphthalene-1,5-disulfonic acid salt is most preferred.

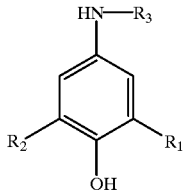

| No. | $R_1$ | $R_2$ | $R_3$ |
|---|---|---|---|
| A'-1 | $—OCH_2CH_2OH$ | —H | $—CH_3$ |
| A'-2 | $—OCH_2CH_2OCH_3$ | " | " |
| A'-3 | $—OCH_3$ | $—OCH_3$ | " |
| A'-4 | $—NHCOCH_3$ | —H | " |
| A'-5 | $—CH_2OH$ | —H | " |

-continued

| | | | |
|---|---|---|---|
| A'-6 | —NHCONHCH$_3$ | —H | " |
| A'-7 | —CH$_2$OH | —CH$_2$OH | " |
| A'-8 | —NHCONH$_2$ | —H | " |
| A'-9 | —O—CH$_2$CH$_2$CH$_2$—OCH$_3$ | —H | " |
| A'-10 | —NHSO$_2$CH$_3$ | —H | " |
| A'-11 | —O—CH$_2$CH$_2$—O—CH$_2$CH$_2$—OH | —H | " |
| A'-12 | —OCH$_3$ | —H | " |

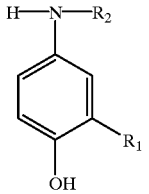

| No. | $R_1$ | $R_2$ |
|---|---|---|
| A'-13 | —N(CH$_3$)$_2$ | —CH$_3$ |
| A'-14 | —NHSO$_2$NH$_2$ | " |
| A'-15 | —O—CH$_2$—CH(OH)—CH$_2$—OH | " |
| A'-16 | —NHSO$_2$N(CH$_3$)$_2$ | " |
| A'-17 | —CH$_3$ | " |
| A'-18 | —CH$_2$—N$^{\oplus}$(CH$_3$)$_2$—CH$_3$ Cl$^{\ominus}$ | " |
| A'-19 | —OCH$_2$CH$_2$OH | —C$_2$H$_5$ |
| A'-20 | —OCH$_2$CH$_2$CH$_3$ | " |
| A'-21 | —S—CH$_2$CH$_2$—OH | —CH$_3$ |
| A'-22 | —Cl | —CH$_3$ |
| A'-23 | —NHCSNH$_2$ | —CH$_3$ |
| A'-24 | —OCH$_2$CH$_2$NHSO$_2$CH$_2$ | —C$_2$H$_5$ |

-continued
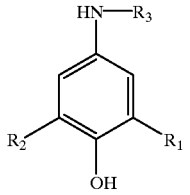
| No. | $R_1$ | $R_2$ | $R_3$ |
|---|---|---|---|
| A'-25 | —$OCH_2CH_2OH$ | —H | 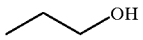 |
| A'-26 | —$OCH_2CH_2OCH_3$ | " | " |
| A'-27 | —$OCH_3$ | H | " |
| A'-28 | —$NHCOCH_3$ | —H | " |
| A'-29 | —$CH_2OH$ | —$CH_2OH$ | 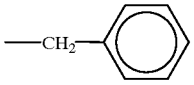 |
| A'-30 | —$NHCONH_2$ | —H | " |
| A'-31 | —$OCH_3$ | —H | 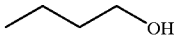 |
| A'-32 | —$NHCONHCH_3$ | —H | " |
| A'-33 | —$NHSO_2CH_3$ | " | " |
| A'-34 | " | " | 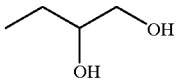 |
| A'-35 | —$OC_2H_5$ | " | " |
| A'-36 | —$SCH_3$ | " | " |
| A'-37 | —$NHCOCH_3$ | —H | 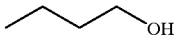 |
| A'-38 | —$OCH_2CH_2OH$ | " | " |
| A'-39 | —$OCH_3$ | —$OCH_3$ | " |
| A'-40 | —$OCH_2CH_2OCH_3$ | —H | " |
| A'-41 | —$COCH_3$ | " | —$CH_3$ |
| A'-42 | —$OCH_2CH_2CH_2OH$ | " | —$CH_3$ |
| A'-43 | —$CH_2COOH$ | " | " |
| A'-44 | 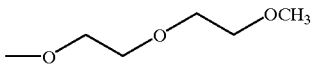 | " | " |
| A'-45 | 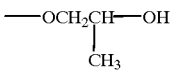 | " | " |
| A'-46 | —COOH | " | " |
| A'-47 | —$SO_3Na$ | " | " |
| A'-48 | 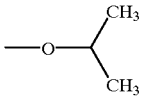 | " | 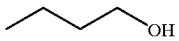 |

-continued
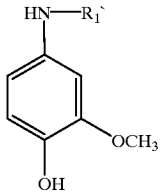
| No. | $R_1$ |
|---|---|
| A'-49 | 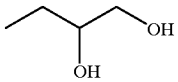 |
| A'-50 | 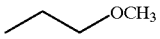 |
| A'-51 | 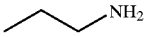 |
| A'-52 | 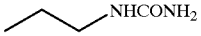 |
| A'-53 | 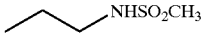 |
| A'-54 | 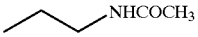 |
| A'-55 | 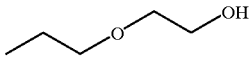 |
| A'-56 | 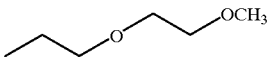 |
| A'-57 | $—C_6H_5$ |
| A'-58 | 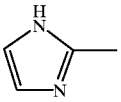 |
| A'-59 | 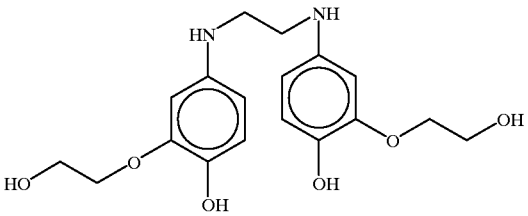 |

-continued
A'-60
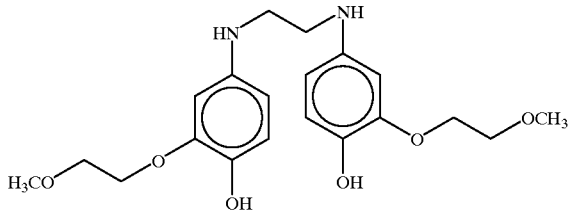
A'-61
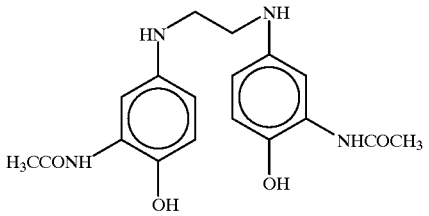
A'-62
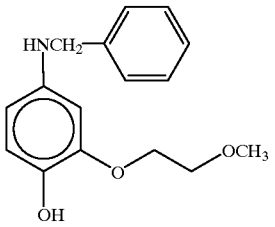
A'-63
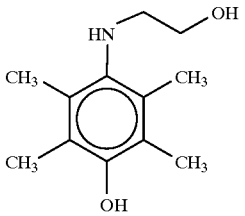
A'-64
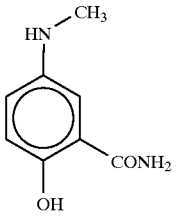
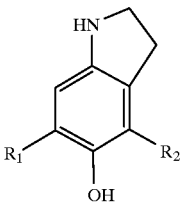
| No. | $R_1$ | $R_2$ |
|---|---|---|
| A'-65 | —$OCH_3$ | —H |
| A'-66 | —$OC_2H_5$ | " |
| A'-67 | —$OCH_2CH_2CH_2OCH_3$ | " |

-continued

| | | |
|---|---|---|
| A'-68 | —$OCH_2CH(OH)CH_2OH$ | " |
| A'-69 | 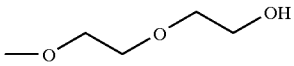 | " |
| A'-70 | —$OCH_2CH(CH_3)OH$ | " |
| A'-71 | 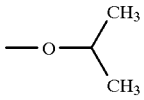 | " |
| A'-72 | 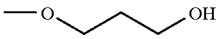 | " |
| A'-73 | —$OCH_3$ | —$OCH_3$ |
| A'-74 | —$NHCONH_2$ | —H |
| A'-75 | —$NHCONHCH_3$ | " |
| A'-76 | —$NHCOCH_3$ | " |
| A'-77 | —$NHSO_2CH_3$ | —H |
| A'-78 | —$NHSO_2NH_2$ | " |
| A'-79 | —$NHCSNH_2$ | " |
| A'-80 | —OH | " |
| A'-81 | —$NH_2$ | " |
| A'-82 | —$NHCH_3$ | " |
| A'-83 | —$SC_2H_4OH$ | " |
| A'-84 | —$CH_3$ | " |
| A'-85 | —$C_2H_5$ | " |
| A'-86 | 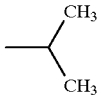 | —H |
| A'-87 | —$CH_2OH$ | " |
| A'-88 | —$CH_2CH_2OH$ | " |
| A'-89 | H | H |
| A'-90 | —$CH_2\overset{+}{N}(CH_3)_3Br^-$ | —H |
| A'-91 | —$OCH_2CH_2OH$ | " |
| A'-92 | —$CH_3$ | —$CH_3$ |
| A'-93 | —$CH_2OH$ | —$CH_2OH$ |
| A'-94 | —$OCH_2CH_2NHSO_2CH_3$ | H |
| A'-95 | —Cl | H |
| A'-96 | —$OCH_2CH_2OCH_3$ | —H |
| A'-97 | —$OCH_2CO_2H$ | " |
| A'-98 | —$COCH_3$ | " |
| A'-99 | —$CONH_2$ | " |
| A'-100 | —$CO_2H$ | " |
| A'-101 | —$NHCONH_2$ | —$NHCONH_2$ |
| A'-102 | —$NHCONHCH_3$ | —$NHCONHCH_3$ |
| A'-103 | —$NHSO_2NHCH_3$ | —H |
| A'-104 | 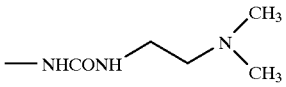 | " |

-continued
| | | |
|---|---|---|
| A'-105 | 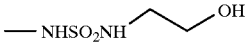 | " |
| A'-106 | 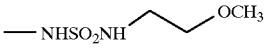 | " |
| A'-107 | 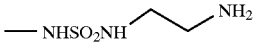 | " |
| A'-108 | 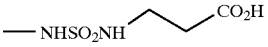 | " |
| A'-109 | 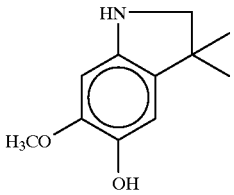 | |
| A'-110 | 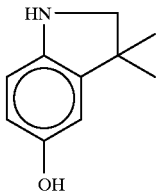 | |
| A'-111 | 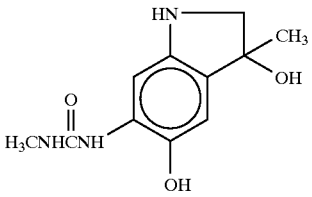 | |
| A'-112 | 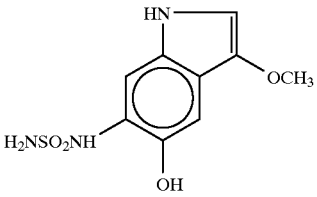 | |
| A'-113 | 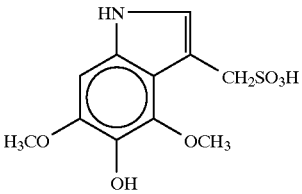 | |

-continued
A'-114
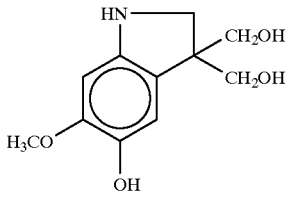
A'-115
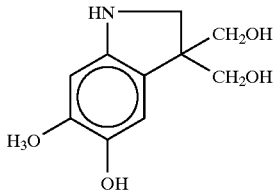
A'-116
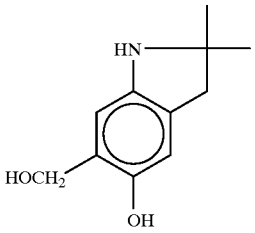
A'-117
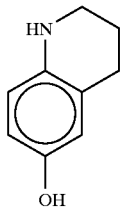
A'-118
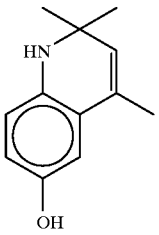
A'-119
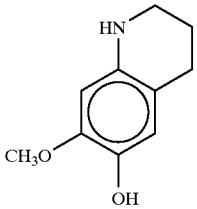

-continued
A'-120
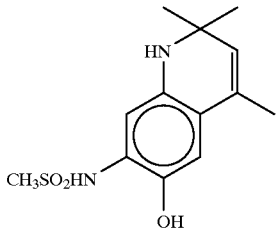
A'-121
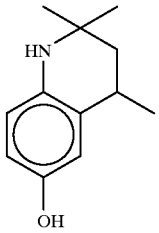
A'-122
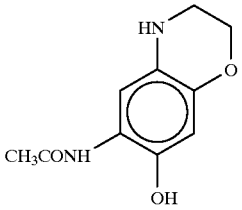
A'-123
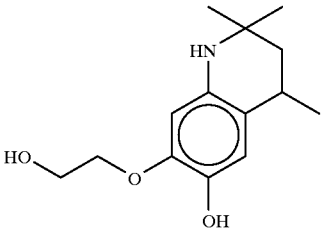
A'-124
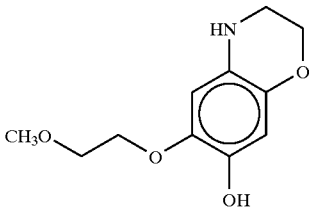
A'-125
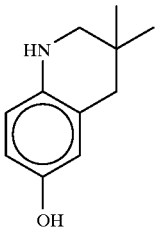

-continued

A'-126

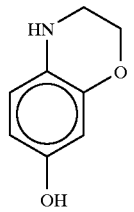

A'-127

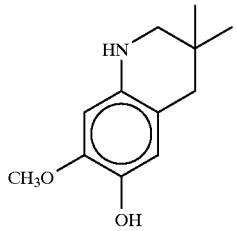

A'-128

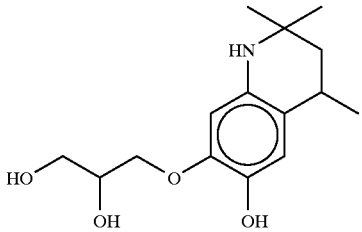

The compounds represented by formulae (A-I) and (A-II) can be easily synthesized according to a general sythesis method described, for example, in *J. Chem. Soc.*, 344 (1966), or *Photographic Science and Engineering*, 10, 306 (1966). Further, the following synthesis methods and a method according thereto may also be used.

SYNTHESIS EXAMPLE

Compound (A'-75) of the present invention was sythesized according to the following scheme.

Scheme 3

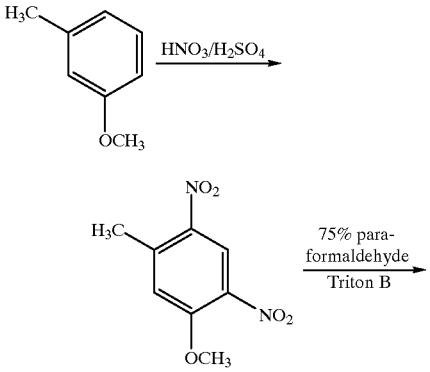

(75a)

-continued

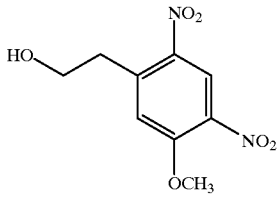

(75b)

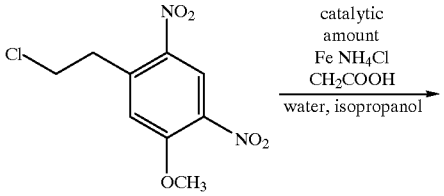

(75c)

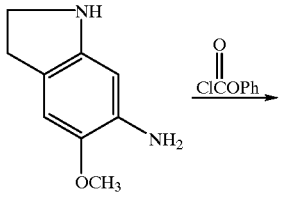

(75d)

-continued

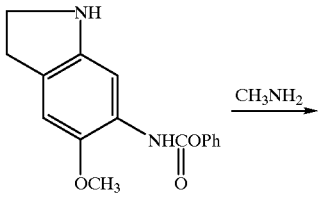

(75e)

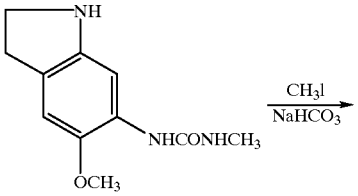

(75f)

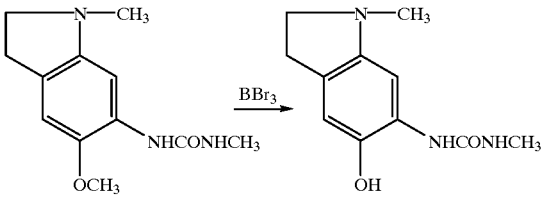

(75e) Compound (A'-75)

Synthesis of Compound (75a):

Concentrated sulfuric acid (90.5 ml) and 50 ml of acetic acid were mixed and cooled to from 0 to −5° C. Thereto, 61.1 g of 3-methylanisole was gradually added dropwise, and then a mixed solution of 61.5 g of nitric acid and 90.5 ml of concentrated sulfuric acid was added dropwise while keeping the temperature at from −10 to −15° C. After completion of the dropwise addition, the temperature was gradually elevated to 0° C., and the reaction solution was poured into 200 ml of ice water and extracted from 500 ml of hexane. The organic layer was rendered neutral by rinsing it with saturated brine, dried over calcium chloride and filtered, and the filtrate was concentrated under reduced pressure to obtain 84.8 g of Compound (75a) as a red brown solid.

Synthesis of Compound (75b):

To 63.6 g of Compound (75a) and 54 g of a 75% paraformaldehyde, 120 ml of dimethyl sulfoxide was added and the mixture was heated at 50° C. Thereto, a 40% ammonium benzyltrimethyl hydroxide-methanol solution (Triton B) was gradually added dropwise. After completion of the dropwise addition, the mixture was reacted at 90° C. for 3 hours, and the reaction solution was poured into 1 l of water and extracted from 1 l of ethyl acetate. The organic layer was rinsed with saturated brine, dried over anhydrous sodium sulfate and filtered, and the filtrate was concentrated under reduced pressure. The concentrate was subjected to separation purification by silica gel column chromatography (developed solvent: hexane/ethyl acetate=4/1) to obtain 14.5 g of Compound (75b) as a yellow solid.

Synthesis of Compound (75c):

To a solution containing 14.5 g of Compound (75b), 27 ml of carbon tetrachloride and 60 ml of acetonitrile, 24 g of triphenylphosphine was added little by little at room temperature, and the mixed solution was stirred as it is. After allowing the solution to stand overnight, 2 ml of methanol was added, then 30 ml of ethyl acetate and 60 ml of hexane were added, the mixture was stirred, the insoluble matter was filtered, and the filtrate was concentrated under reduced pressure to obtain 14.9 g of Compound (75c).

Synthesis of Compound (75d):

To 14.5 g of reduced iron and 0.2 g of ammonium chloride, 15 ml of water, 90 ml of isopropanol and 1 ml of acetic acid were added, and after heating the mixed solution under reflux for 15 minutes, 14.9 g of Compound (75c) was gradually added. The resulting solution was heated under reflux for 8 hours, the insoluble matter was separated by Celite filtration, and the solvent was distilled off under reduced pressure. The gray powder crystals obtained were dissolved in ethyl acetate, rinsed with saturated brine, dried over sodium sulfate and concentrated to obtain 9.0 g of Compound (75d).

Synthesis of Compound (75e):

To 9.0 g of Compound (75d), 50 ml of dimethylacetamide was added and dissolved, and to the resulting solution, 8.6 g of phenyl chloroformate was added dropwise. After stirring at room temperature for 3 hours, the solution was poured into 200 ml of water, and the white crystals deposited were collected by filtration and dried under reduced pressure to obtain 13.5 g of Compound (75e).

Synthesis of Compound (75f):

To 13.5 g of Compound (75e), 50 ml of acetonitrile was added and dissolved, and to the resulting solution, 4.3 g of a 40% methylamine-methanol solution was added dropwise. After stirring at room temperature for 2 hours, the solution was poured into 500 ml of water, and the white yellow crystals deposited were collected by filtration and dried under reduced pressure to obtain 9.6 g of Compound (75f).

Synthesis of Compound (A'-75):

Into 50 ml of methylene chloride, 5.1 g of Compound (75f) was dissolved, and after ice-cooling the solution to −10° C., 5.6 ml of boron tribromide dissolved in 20 ml of methylene chloride was added dropwise at −5° C. or lower. After completion of the dropwise addition, the solution was stirred at room temperature for 3 hours and then ice-cooled, 100 ml of water was gradually added dropwise, and the solution was extracted from methylene chloride. The aqueous layer was rendered neutral by adding thereto sodium hydrogencarbonate little by little, and the pale yellow crystals deposited were collected by filtration and dried under reduced pressure to obtain 2.6 g of Compound (A'-75) as white crystals (amorphous).

Compound (A'-4) of the present invention was sythesized according to the following scheme.

Scheme 4

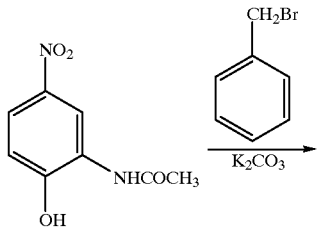

-continued

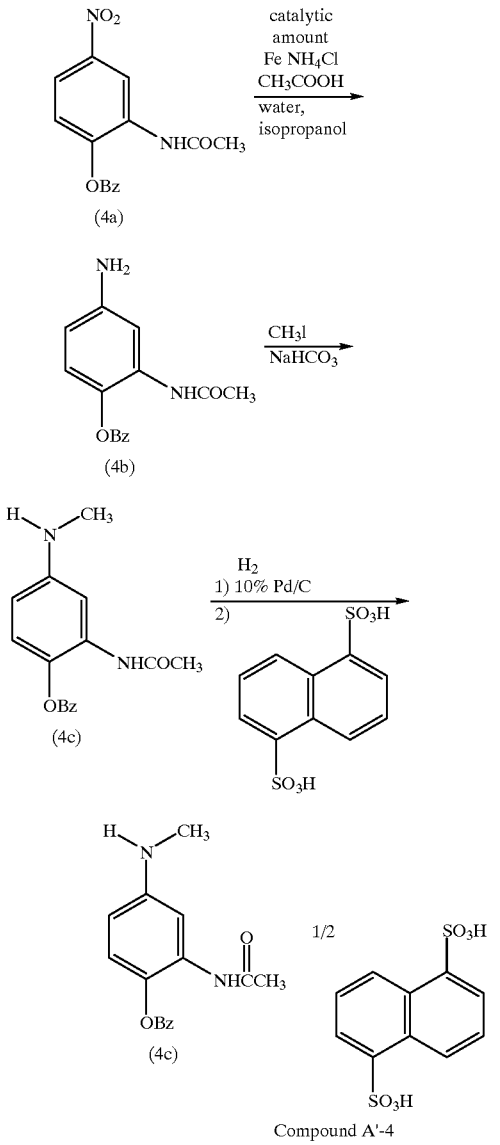

Compound A'-4

Synthesis of Compound (4a):

To 39.2 g of 2-acetamido-4-nitrophenol, 200 ml of dimethylacetamide and 27.6 g of potassium carbonate were added, and to the resulting mixed solution, 37.6 g of benzyl bromide was added dropwise. After stirring at room temperature for 3 hours, the solution was poured into 800 ml of 1N hydrochloric acid, and the white crystals deposited were collected by filtration and dried under reduced pressure to obtain 57.0 g of Compound (4a).

Synthesis of Compound (4b):

To 55.9 g of reduced iron and 0.5 g of ammonium chloride, 53 ml of water, 260 ml of isopropanol and 3 ml of acetic acid were added, and after heating the solution under reflux for 15 minutes, 57.0 g of Compound (4a) was added thereto little by little. After heating the solution under reflux for 1 hour, the insoluble matter was separated by Celite filtration, and the solvent was distilled off under reduced pressure. The gray powder crystals obtained were dissolved in ethyl acetate, rinsed with saturated brine, dried over sodium sulfate and concentrated to obtain 47.7 g of Compound (4b).

Synthesis of Compound (4c):

To 15.1 g of Compound (4b) and 13.8 g of sodium hydrogencarbonate, 100 ml of dimethylacetamide was added, and the solution was heated at 80° C. To the resulting mixed solution, 6.3 ml of iodomethane was added dropwise, and the solution was stirred at 80° C. for 30 minutes. After cooling to room temperature, the solution was extracted from ethyl acetate, washed with water and dried over sodium sulfate. The solvent was distilled off under reduced pressure, and the composition obtained was subjected to separation purification by silica gel column chromatography (developed solvent: hexane/ethyl acetate=4/1) to obtain 4.3 g of Compound (4c) as a yellow oily product.

Synthesis of Compound (A'-4):

To 100 ml of methanol, 4.3 g of Compound (4c) and 0.5 g of a 10% palladium carbon were added, and the mixture was put into contact with hydrogen in an autoclave for 4 hours. The catalyst was separated by filtration using Celite as a filter aid, and the filtrate was added dropwise to a methanol solution containing 2.9 g of 1,5-naphthalene-disulfonic acid tetrahydrate. After distilling off the solvent, ethanol was added, and the gray crystals precipitated were separated by filtration to obtain 2.6 g of 1,5-naphthalene disulfonate, namely, the objective Compound (A'-4), as white crystals.

Synthesis of Compound (A'-37):

In the synthesis of Compound (A'-4), the reaction was performed using 3-chloropropanol in place of iodomethane to obtain Compound (37c). Subsequently, the procedure in the synthesis of Compound (A'-4) was followed and the objective Compound (A'-37) was obtained.

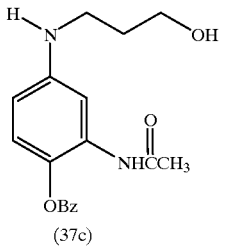

Compound (A'-42) of the present invention was synthesized according to the following scheme.

Scheme 5

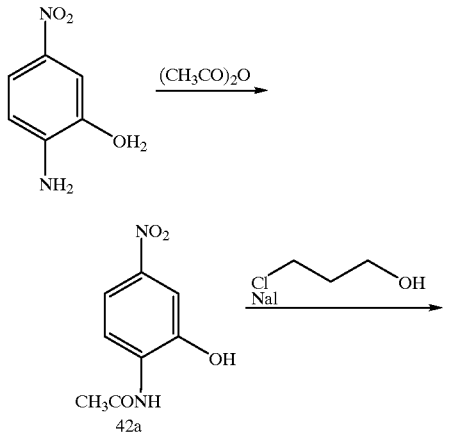

-continued

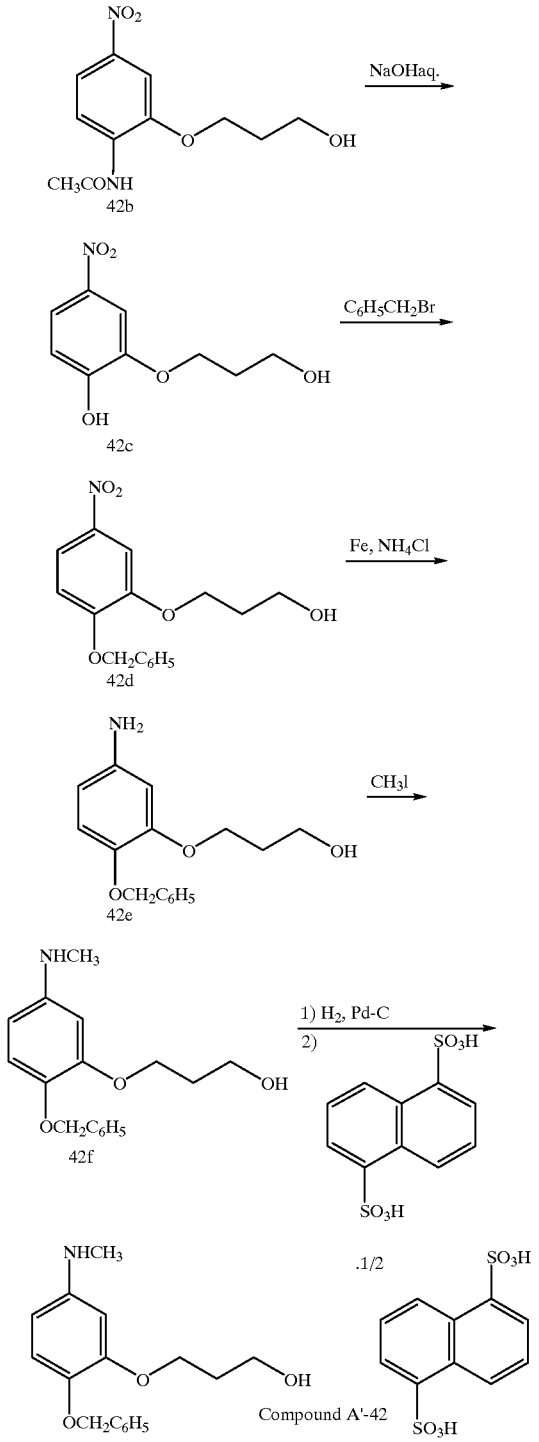

Synthesis of Compound (42a):

To a mixture of 154 g of 2-hydroxy-4-nitroaniline and 460 ml of acetonitrile, 102 g of acetic anhydride was added, and the mixture was heated under reflux for 20 minutes and then allowed to cool, and the crystals deposited were collected by filtration to obtain 153 g of Compound (42a) as yellow crystals.

Synthesis of Compound (42b):

To 500 ml of a dimethylacetamide solution containing 80 g of Compound (42a), 56 g of potassium carbonate, 6.6 g of potassium iodide and 42 g of 3-chloropropanol were added, the mixed solution was stirred at 120° C. for 3 hours, allowed to cool and extracted from ethyl acetate, and the solvent was distilled off to obtain 72 g of Compound (42b).

Synthesis of Compound (42c):

Compound (42b) (72 g) was mixed with 500 ml of an aqueous solution containing 70 g of sodium hydroxide, and the mixed solution was heated under reflux for 4 hours, allowed to cool and rendered acidic with concentrated hydrochloric acid. The crystals produced were collected by filtration to obtain 58 g of Compound (42c).

Synthesis of Compound (42d):

To 300 ml of a dimethylacetamide solution containing 47 g of Compound (42c), 64 g of potassium carbonate and 44 g of benzyl bromide were added, the mixed solution was stirred for 3 hours and extracted from ethyl acetate, and the solvent was distilled off to obtain 51 g of Compound (42d).

Synthesis of Compound (42e):

A mixture of 50 g of reduced iron, 0.5 g of ammonium chloride, 50 ml of water and 300 ml of isopropanol was heated under reflux for 20 minutes, 38 g of Compound (42d) was added thereto, and the solution was continued refluxing as it is for 1 hour. The reaction mixture was filtered through Celite, the solvent was distilled off from the filtrate under reduced pressure, and the residue was dried to a solid to obtain 31 g of Compound (42e).

Synthesis of Compound (42f):

To 150 ml of a dimethylacetamide solution containing 31 g of Compound (42e), one equivalent methyl iodide and one equivalent sodium hydrogencarbonate were added, and after stirring for 4 hours, the solution was extracted from ethyl acetate, the solvent was distilled off, and the oily product obtained was purified by silica gel column chromatography (ethyl acetate/hexane=1/2) to obtain 11 g of Compound (42f).

Synthesis of Compound (A'-42):

To 80 ml of a methanol solution containing 11 g of Compound (42f), 1 g of a 10% Pd-C was added, and using an autoclave, hydrogen gas (about 50 atm) was reacted therewith for 3 hours. Then, the reaction solution was filtered through Celite, 10 g of 1,5-naphthalenesulfonic acid tetrahydrate was added, and the crystals were collected by filtration to obtain 16 g of the objective Compound (A'-42) as white crystals.

The ascorbic acids represented by formula (B) or a derivative thereof are described in detail below.

(B)

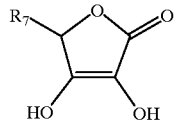

wherein $R_7$ represents a hydrogen atom, an alkyl group, an aryl group or a heterocyclic group.

In the formula, the alkyl group represented by $R_7$ is a linear, branched or cyclic alkyl group. Examples of the aryl group include a phenyl group and a naphthyl group. The heterocyclic group is a 5- or 6-membered heterocyclic group comprising a carbon atom, a nitrogen atom, an oxygen atom or a sulfur atom, and examples thereof include a furyl group, a benzofuryl group, a pyranyl group, a pyrrolyl group, an imidazolyl group, a pyrazolyl group, a triazolyl group, a pyridyl group, a pyrimidyl group, a pyridazyl group, a thienyl group and an isothiazolyl group. These groups each may be substituted by a substituent, and examples of the substituent include an alkyl group, an alkenyl group, an aryl group, a halogen atom, a nitro group, a mercapto group, a hydroxy group, an alkoxy group, an aryloxy group, an alkylthio group, an arylthio group, an acyloxy group, an amino group, an alkylamino group, a carbonamido group, a sulfonamido group, a ureido group, an acyl group, an oxycarbonyl group, a carbamoyl group, a sulfinyloxy group, a carboxyl group (including a salt thereof), a sulfo group (including a salt thereof), a hydroxyamino group and a hydrazino group.

Examples of the substituent are described in more detail. The alkyl group is a linear, branched or cyclic alkyl group having from 1 to 10, preferably from 1 to 6 carbon atoms, which group may be substituted by a group described as the substituent on $R_7$, and examples thereof include methyl, ethyl, propyl, isopropyl, butyl, t-butyl, cyclohexyl and hydroxymethyl. The alkenyl group is a linear or branched alkenyl group having from 2 to 10, preferably from 2 to 6 carbon atoms, which group may be substituted by a group described as the substituent on $R_7$, and examples thereof include ethynyl, propenyl, 3-butenyl and 4-hydroxy-3-butenyl. The aryl group is an aryl group having from 6 to 10 carbon atoms, which group may be substituted by a group described as the substituent on $R_7$, and examples thereof include phenyl, naphthyl and p-methylphenyl. The alkoxy group is an alkoxy group having from 1 to 10, preferably from 1 to 8 carbon atoms, which group may be substituted by a group described as the substituted on $R_7$, and examples thereof include methoxy, ethoxy, propoxy, butoxy, pentyloxy, hexyloxy, octyloxy and 2-methoxyethoxy. The aryloxy group is an aryloxy group having from 6 to 10 carbon atoms, which group may be substituted by a group described as the substituent on $R_7$, and examples thereof include phenoxy, p-hydroxyphenoxy, 3,4-dihydroxyphenoxy, o-carboxyphenoxy and o-sulfophenoxy. The-alkylthio group is an alkylthio group having from 1 to 10, from 1 to 8 carbon atoms, which group may be substituted by a group described as the substituent on $R_7$, and examples thereof include methylthio and octylthio. The arylthio group is an arylthio group having from 6 to 10 carbon atoms, which group may be substituted by a substituent described as the substituent on $R_7$, and examples thereof include phenylthio, 4-hydroxyphenylthio, 4-methoxyphenylthio and 4-butoxyphenylthio. The acyloxy group is an acyloxy group having from 1 to 10, preferably from 1 to 8 carbon atoms, which group may be substituted by a substituent described as the substituent on $R_7$, and examples thereof include acetoxy, propanoyloxy, butanoyloxy, octanoyloxy, carboxyacetoxy and 3-sulfopropanoyloxy.

The alkylamino group is an alkylamino group having from 1 to 6 carbon atoms and examples thereof include methylamino, dimethylamino and diethylamino. The carbonamido group is a carbonamido group having from 1 to 6 carbon atoms and examples thereof include acetamido and propionamido. The sulfonamido group is a sulfonamido group having from 1 to 6 carbon atoms and examples thereof include methanesulfonamido. The ureido group is a ureido group having from 1 to 6 carbon atoms and examples thereof include ureido and methyluredio. The acyl group is an acyl group having from 1 to 6 carbon atoms and examples thereof include acetyl and benzoyl. The oxycarbonyl group is an oxycarbonyl group having from 1 to 8 carbon atoms and examples thereof include methoxycarbonyl and ethoxycarbonyl. The carbamoyl group is a carbamoyl group having from 1 to 6 carbon atoms and examples thereof include carbamoyl and N,N-dimethylcarbamoyl. The sulfinyloxy group is a sulfinyloxy group having from 1 to 6 carbon atoms and examples thereof include methanesulfinyloxy.

These substituents each may be further substituted, if possible.

The alkyl group represented by $R_7$ in formula (B) is preferably an alkyl group having from 1 to 6 carbon atoms, including those substituted by a group described as the substituent on $R_7$, more preferably an alkyl group substituted by a hydroxy group, an alkoxy group, an aryloxy group, an alkylthio group, an arylthio group, an acyloxy group, an amino group, an alkylamino group, an oxycarbonyl group, a carboxyl group (including a salt thereof) or a sulfo group (including a salt thereof), and examples thereof include methyl, ethyl, hydroxymethyl, 1-hydroxyethyl, 1,2-dihydroxyethyl, 1,2-dihydroxypropyl, 1,2,3-trihydroxypropyl, 1,2,3,4-tetrahydroxybutyl, 1,2-dimethoxyethyl, 1,1-dimethoxy-2-hydroxyethyl, 1,2-diethoxyethyl, 1,2-diacetoxyethyl, hydroxycarboxyinethyl, acetoxycarboxymethyl, 1-methylthio-2-hydroxyethyl, 1-phenylthio-2-hydroxymethyl, 1-hydroxy-2-octylthioethyl, 1-hydroxy-2-phenylthioethyl, 1-hydroxy-2-aminoethyl, 1-hydroxy-2-phenoxyethyl and 1-hydroxy-2-sulfoethyl. These substituents each may further be substituted, if possible.

The aryl group represented by $R_7$ in formula (B) is preferably an aryl group having from 6 to 10 carbon atoms, including those substituted by a group described as the substituent on $R_7$, and examples thereof include phenyl, p-methylphenyl, anisyl, p-carboxyphenyl and p-sulfonylphenyl.

The heterocyclic group represented by $R_7$ in formula (B) is preferably a furyl group, a pyridyl group or a triazolyl group, including those substituted by a group described as the substituent on $R_7$, and examples thereof include furyl, 5-methylfuryl, benzofuryl, pyridyl, 5-chloropyridyl, 3-carboxypyridyl, 5-sulfopyridyl and 1-phenyltriazolyl.

$R_7$ in formula (B) is more preferably a hydrogen atom, a methyl group or an ethyl group. These groups each includes those substituted by other substituent. Examples of the substituent include a hydroxy group, an alkoxy group and an acyloxy group, and the alkoxy group and the acyloxy group are preferably an alkoxy group having from 1 to 8 carbon atoms and an acyloxy group having from 1 to 8 carbon atoms, respectively. These substituents each may be further substituted, if possible, and examples of the substituent include an alkenyl group, an aryl group, a hydroxy group, an alkoxy group, a carboxyl group (including a salt thereof), a sulfo group (including a salt thereof), a hydroxyamino group and a hydrazino group.

Among the compounds represented by formula (B), the compound represented by the following formula (I) is most preferred.

(I)

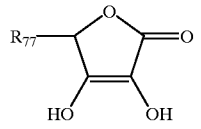

wherein $R_{77}$ represents a group represented by formula (J) or (K):

(J)

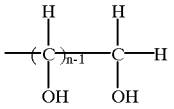

wherein n represents an integer of from 1 to 4;

(K)

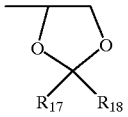

wherein $R_{17}$ and $R_{18}$ may be the same or different, and each represents a hydrogen atom, an alkyl group, an aryl group or an alkenyl group, and the alkyl groups represented by $R_{17}$ and $R_{18}$ may be combined to form a ring structure. The alkyl group, the aryl group and the alkenyl group each include those substituted by other substituent, and examples of the substituent include an alkyl group, an alkenyl group, an aryl group, a halogen atom, a nitro group, a hydroxy group, an alkoxy group, an acyl group, a carboxyl group (including a salt thereof), a sulfo group (including a salt thereof) and a hydroxyamino group.

$R_{17}$ and $R_{18}$ in the compound represented by formula (K) each is preferably a hydrogen atom, an alkyl group having from 1 to 7 carbon atoms, an aryl group having from 6 to 10 carbon atoms or an alkenyl group having from 2 to 7 carbon toms, more preferably a hydrogen atom, an alkyl group having from 1 to 7 carbon atoms or an aryl group having from 6 to 10 carbon atoms, most preferably a hydrogen atom or an alkyl group having from 1 to 7 carbon atoms. The alkyl groups represented by $R_{17}$ and $R_{18}$ may be combined to form a ring structure. More preferably, at least one of $R_{17}$ and $R_{18}$ is not a hydrogen atom. The above-described groups each may have a substituent and examples of the substituent include the substituents described as the substituent on $R_7$ in formula (B), for example, a hydrogen atom, a methyl group, an ethyl group, a propyl group, a butyl group, a phenyl group, a chloromethyl group, a methoxymethyl group, a 2-methoxyethyl group, a 1-hydroxy-2-hydroxyaminoethyl group, 2-carboxyethyl group, and a cyclopentyl ring and a cyclohexyl ring formed by combining the alkyl groups represented by $R_{17}$ and $R_{18}$. These groups each may further be substituted, if possible.

The compound-of formula (B) is a so-called an enol form, however, a keto form resulting from isomerization thereof is substantially the same compound and the compounds obtained by isomerizing a hydrogen atom also fall within the scope of the claim of the present invention.

Specific examples of the compounds for use in the present invention are shown below, however, the present invention is by no means limited thereto.

B-1

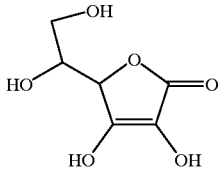

-continued

B-2

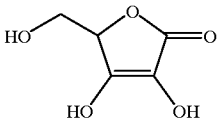

B-3

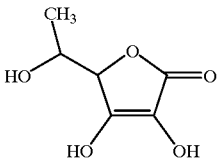

B-4

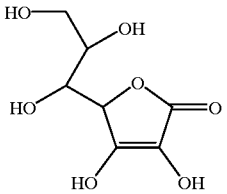

B-5

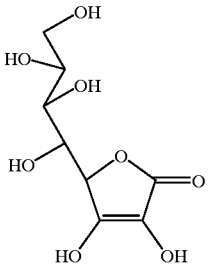

B-6

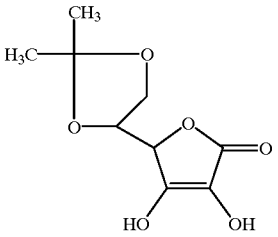

B-7

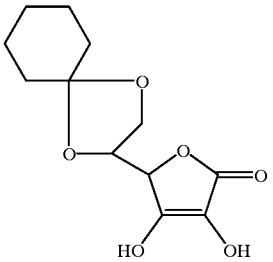

-continued
B-8
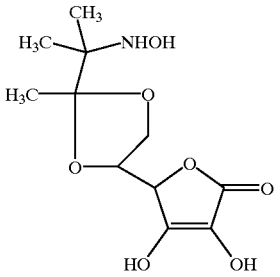
B-9
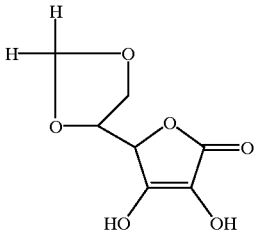
B-10
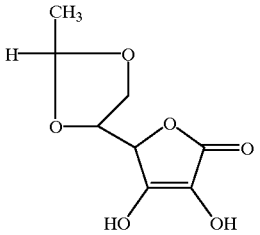
B-11
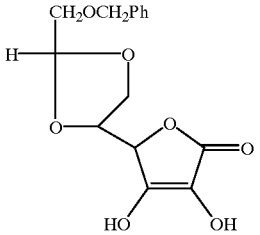
B-12
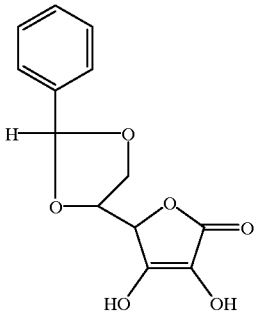
-continued
B-13
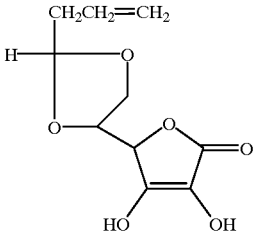
B-14
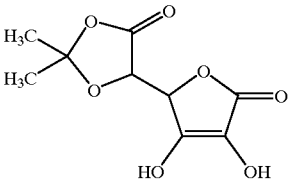
B-15
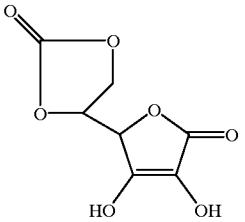
B-16
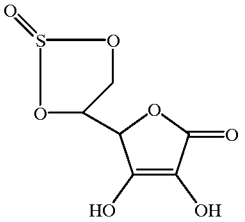
B-17
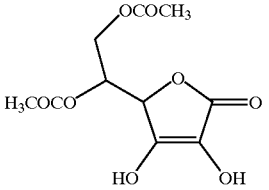
B-18
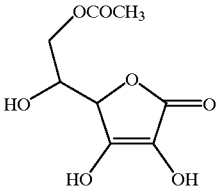
B-19
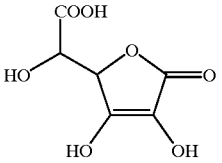

-continued
B-20
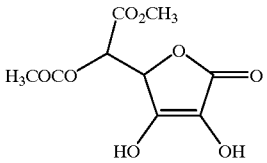
B-21
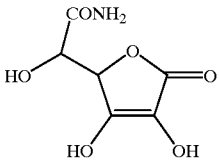
B-22
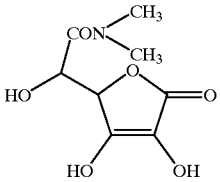
B-23
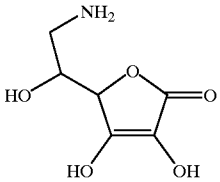
B-24
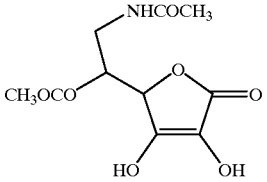
B-25
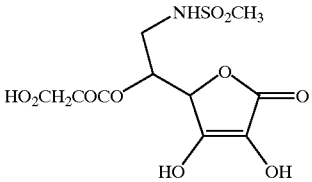
B-26
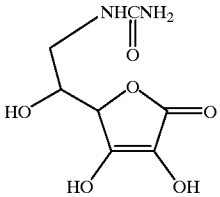
-continued
B-27
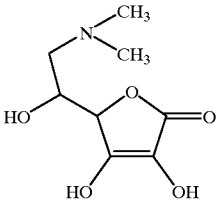
B-28
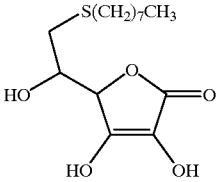
B-29
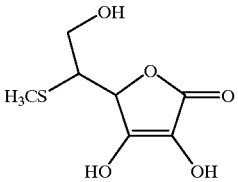
B-30
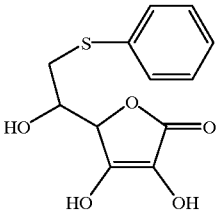
B-31
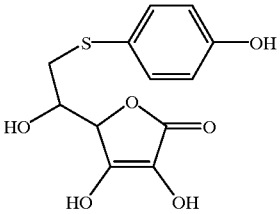
B-32
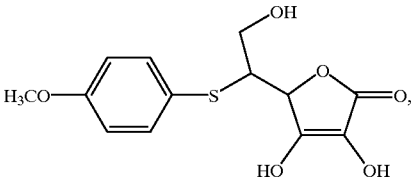
B-33
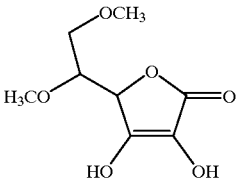

-continued
B-34
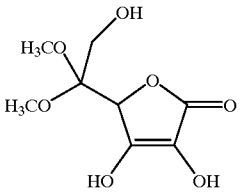
B-35
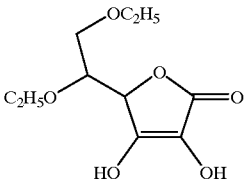
B-36
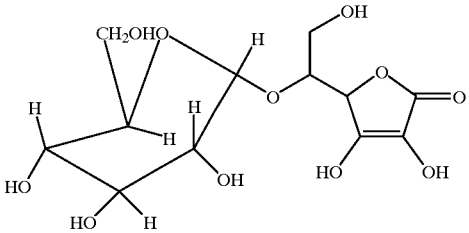
B-37
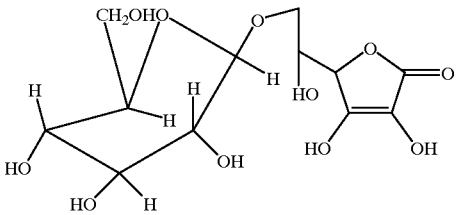
B-38
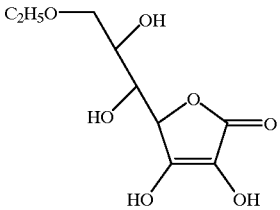
B-39
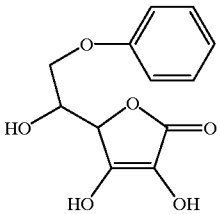
-continued
B-40
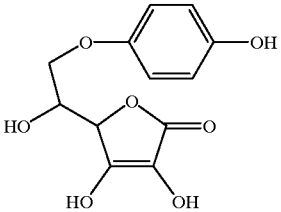
B-41
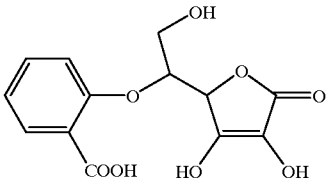
B-42
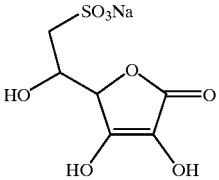
B-43
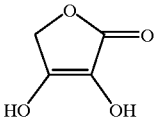
B-44
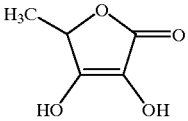
B-45
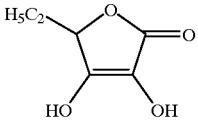
B-46
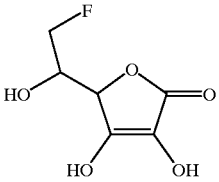
B-47
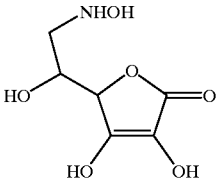

-continued

B-48

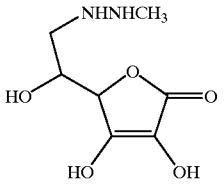

B-49

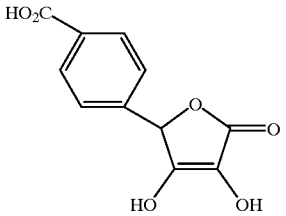

B-50

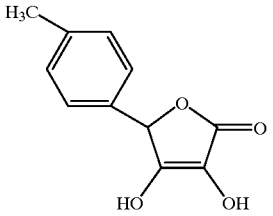

B-51

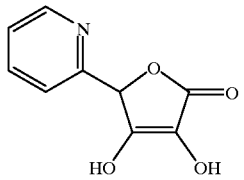

B-52

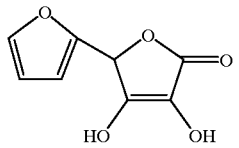

B-53

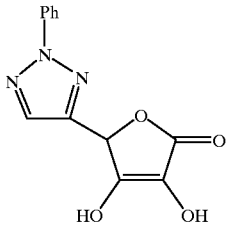

The compound represented by formula (B) can be synthesized according to general synthetic methods described in E.S.H. El. Ashry, A. Moussad, and N. Rashed, *Advances in Heterocyclic Chemistry*, vol. 53, 233–302, JP-A-57-188586, JP-A-64-45383, JP-A-2-288872, JP-A-4-29985, JP-A-4-364182 and JP-A-5-112594.

The ascorbic-acids represented by formula (B) used as a developing agent in the present invention or a derivative thereof may be a free form or in the form of an ammonium salt or an alkali metal salt. The addition amount of the ascorbic acid to the developer is usually from 0.01 to 0.5 mo/l, preferably from 0.05 to 0.3 mol/l, more preferably from 0.05 to 0.2 mol/l.

The p-aminophenols represented by formula (A), (A-I) or (A-II) used as an auxiliary developing agent in the present invention may be used either alone or in combination with other known p-aminophenols or 3-pyrazolidones. Representative examples of the compound for use in combination are shown below, however, the present invention is by no means limited thereto.

| | |
|---|---|
| AP-1 | N-Methyl-p-aminophenol |
| AP-2 | p-Aminophenol |
| AP-3 | N-(β-Hydroxyethyl)-p-aminophenol |
| AP-4 | N-(4-Hydroxyphenyl)glycine |
| AP-5 | 2-Methyl-p-aminophenol |
| AP-6 | p-Benzylaminophenol |
| AP-7 | 2-Methoxy-p-aminophenol |
| P-1 | 1-Phenyl-3-pyrazolidone |
| P-2 | 1-Phenyl-4,4-dimethyl-3-pyrazolidone |
| P-3 | 1-Phenyl-4-methyl-4-hydroxymethyl-3-pyrazolidone |
| P-4 | 1-Phenyl-4,4-dihydroxymethyl-3-pyrazolidone |
| P-5 | 1-Phenyl-5-methyl-3-pyrazolidone |
| P-6 | 1-p-Aminophenyl-4,4-dimethyl-3-pyrazolidone |
| P-7 | 1-p-Tolyl-4,4-dimethyl-3-pyrazolidone |
| P-8 | 1-p-Tolyl-4-methyl-4-hydroxymethyl-3-pyrazolidone |

Among the above-described p-aminophenols for use in combination, preferred are AP-1, AP-3 and AP-7, and among 3-pyrazolidones, preferred are P-2, P-3 and P-8. The p-aminophenols are usually used as a salt such as sulfate, chlorate, sulfite, p-toluenesulfonate, nitrate or naphthalene-1,5-disulfonate.

These compounds may be used in combination of two or more, if desired. The use amount of the auxiliary developing agent is usually from 0.0005 to 0.2 mol/l, preferably from 0.001 to 0.1 mol/l, more preferably from 0.01 to 0.1 mol/l.

In the case of using a developing agent with an auxiliary developing agent, it is most preferred to use the former in an amount of from 0.05 to 0.2 mol/l and the latter in an amount of from 0.01 to 0.1 mol/l.

In the present invention, the processing composition may be either a liquid or a solid (e.g., powder, granule).

The passage "contains substantially no dihydroxybenzenes" as used in the present invention means that the concentration of dihydroxybenzenes in the developer is negligible (for example, $5\times10^{-4}$ mol/l or less) as compared with the amount of the developing agent represented by formula (B) or the amount of the auxiliary developing agent represented by formula (A). The developer of the present invention preferably contains no dihydroxybenzenes at all.

The developer (the development initiating solution and the development replenisher are collectively called a developer, hereinafter the same) for use in developing the light-sensitive material of the present invention may contain a buffer and examples thereof include a carbonate, a boric acid described in JP-A-62-186259, a saccharide (e.g., saccarose) described in JP-A-60-93433, an oxime (e.g., acetoxime), a phenol (e.g., 5-sulfosalicylic acid) or a tertiary phosphate (e.g., sodium salt, potassium salt), with a carbonate and a boric acid being preferably used. The use amount of the buffer, particularly carbonate, is preferably 0.3 mol/l or more, more preferably 0.4 mol/l or more. The upper limit is not so important but it is about 1.5 mol/l.

The developer of the present invention may contain a preservative and examples thereof include a sulfite such as sodium sulfite, potassium sulfite, lithium sulfite, sodium bisulfite, potassium metabisulfite and sodium formaldehyde bisulfite, and a hydroxylamine such as hydroxylamine sulfate, hydroxylamine hydrochloride, monomethylhydroxylamine hydrochloride and diethylhydroxylamine. A sulfite or a hydroxylamine is used in an amount of 0.01 mol/l or more. If a large amount of sulfite is used, it dissolves silver halide emulsion grains to cause silver stains. The sulfite may also increase COD (chemical oxygen demand). Therefore, the addition amount thereof must be small as much as possible and it is preferably 0.5 mol/l or less, more preferably 0.2 mol/l or less, most preferably 0.1 mol/l or less.

Examples of additives other than those described above include a development inhibitor such as sodium bromide and potassium bromide; an organic solvent such as ethylene glycol, diethylene glycol, triethylene glycol and dimethylformamide; a development accelerator such as alkanolamine (e.g., diethanolamine, triethanolamine), imidazole and a derivative thereof; and an antifoggant or a black pepper inhibitor, such as a mercapto-base compound, an indazole-base compound, a benzotriazole-base compound and a benzimidazole-base compound. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazo1-2-yl)thio)butanesulfonate, 5-amino-1,3,4-thiadiazole-2-thiol, methylbenzotriazole, 5-methylbenzotriazole and 2-mercaptobenzotriazole. The antifoggant is usually used in an amount of from 0.01 to 10 mmol, preferably from 0.1 to 2 mmol, per l of the developer.

The developer of the present invention can further contain various organic or inorganic chelating agents in combination. Examples of the in organic chelating agent include sodium tetrapolyphosphate and sodium hexametaphosphate.

Examples of the organic chelating agent which is predominantly used, include an organic carboxylic acid, an aminopolycarboxylic acid, an organic phosphonic acid, an aminophosphonic acid and an organic phosphonocarboxylic acid.

Examples of the organic carboxylic acid include an acrylic acid, an oxalic acid, a malonic acid, a succinic acid, a glutaric acid, an adipic acid, a pimelic acid, an azelaic acid, a sebacic acid, a nonanedicarboxylic acid, a decanedicarboxylic acid, an undecanedicarboxylic acid, a maleic acid, an itaconic acid, a malic acid, a citric acid and a tartaric acid, however, the organic carboxylic acid is not limited thereto.

Examples of the aminopolycarboxylic acid include an iminodiacetic acid, a nitrilotriacetic acid, a nitrilotripropionic acid, an ethylenediaminemonohydroxyethyltriacetic acid, ethylenediaminetetraacetic acid, glycolethertetraacetic acid, 1,2-diaminopropanetetraacetic acid, diethylenetriaminepentaacetic acid, triethylenetetraminehexaacetic acid, 1,3-diamino-2-propanoltetraacetic acid, glycoletherdiaminetetraacetic acid, and the compounds described in JP-A-52-25632, JP-A-55-67747, JP-A-57-102624 and JP-B-53-40900.

Examples of the organic phosphonic acid include hydroxyalkylidenediphosphonic acid described in U.S. Pat. Nos. 3,214,454 and 3,794,591 and German Patent Application (OLS) No. 2,227,639, and the compounds described in *Research Disclosure*, Vol. 181, Item 18170 (May 1979).

Examples of the aminophosphonic acid include aminotris (methylenephosphonic acid), ethylenediaminetetramethylenephosphonic acid, aminotrimethylenephosphonic acid, and the compounds described in *Research Disclosure* (supra), No. 18170, JP-A-57-208554, JP-A-54-61125, JP-A-55-29883 and JP-A-56-97347.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure* (supra), No. 18170.

These chelating agents each may be used in the form of an alkali metal salt or an ammonium salt. The chelating agent is preferably added in an amount of from $1\times10^{-4}$ to $1\times10^{-1}$ mol, more preferably from $1\times10^{-3}$ to $1\times10^{-2}$ mol, per l of the developer.

The developer may contain the compound represented by the following formula (C) as a silver stain inhibitor:

(C)

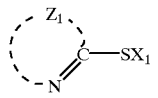

wherein $Z_1$ represents a nonmetallic atom group necessary for forming a substituted or unsubstituted, 5- or 6-membered nitrogen-containing aromatic heterocyclic ring together with the N and C atoms in formula (C), $X_1$ represents a hydrogen atom or a cation, and two kinds of radicals resulting from elimination of any one hydrogen atom from $Z_1$ may be combined to form a bis type structure.

Formula (C) is described in detail below.

$Z_1$ represents a nonmetallic atom group necessary for forming a substituted or unsubstituted 5- or 6-membered nitrogen-containing aromatic heterocyclic ring together with the N and C atoms in formula (C). The 5-membered nitrogen-containing aromatic heterocyclic ring formed by Z and the N and C atoms may be constituted by, in addition to nitrogen, a combination of elements selected from carbon, oxygen and sulfur, or may be further condensed with a hydrocarbon ring or a heterocyclic ring, and examples thereof include pyrazole, imidazole, oxazole, thiazole, triazole, thiadiazole, oxadiazole, indazole, benzimidazole, benzoxazole, benzothiazole, pyrazolotriazole and pyrrolotriazole. The 5-membered nitrogen-containing aromatic heterocyclic ring is preferably triazole, thiadiazole, oxadiazole, benzimidazole, benzoxazole, benzothiazole, pyrazolotriazole or pyrolotriazole, more preferably.triazole, thiadiazole, oxadiazole or benzimidazole, and most preferably triazole.

The 6-membered nitrogen-containing aromatic heterocyclic ring formed by $Z_1$ and the N and C atoms is a monocyclic ring or a ring condensed with a carbon ring or a heterocyclic ring, and examples thereof include pyridine, pyrazine, pyrimidine, pyridazine, triazine, quinoline, isoquinoline, phthalazine, quinoxaline, quinazoline, sinoline, phenanthrizine, phenanthroline, naphthylidine, pteridine, purine, triazopyrimidine, imidazolopyridine, triazolopyridine, imidazolotriazine and triazolotriazine. The 6-membered nitrogen-containing aromatic heterocyclic ring is preferably pyrazine, pyrimidine, pyridazine, triazine, phthalazine, quinoxaline, quinazoline, naphthylidine, pteridine, purine, triazolopyrimidine, imidazolopyridine, triazolopyridine, imidazolotriazine or triazolotriazine, more preferably pyrimidine, pyridazine, triazine, pteridine, purine, triazolopyrimidine, imidazolotriazine or triazolotriazine, and most preferably pyrimidine, triazine or purine.

Examples of the substituent represented by $Z_1$ include a hydrogen atom, a halogen atom and a substituent bonded to the ring through a carbon atom, an oxygen atom, a nitrogen atom or a sulfur atom. Examples of the substituent bonded through a carbon atom include an alkyl group, an alkenyl group, an alkynyl group, an aryl group, a carbamoyl group, an alkoxycarbonyl group, an aryloxycarbonyl group, an acyl group, a carboxyl group, a cyano group and a heterocyclic group; examples of the substituent bonded through an oxygen atom include a hydroxy group, an alkoxy group, an aryloxy group, a heterocyclic oxy group, an acyloxy group, a carbamoyloxy group and a sulfonyloxy group; examples of the substituent bonded through a nitrogen atom include an acylamino group, an amino group, an alkylamino group, an arylamino group, a heterocyclic amino group, a ureido group, a sulfamoylamino group, an alkoxycarbonylamino group, an aryloxycarbonylamino group, a sulfonamido group, an imido group and a heterocyclic group; and examples of the substituent bonded through a sulfur atom include an alkylthio group, an arylthio group, a heterocyclic thio group, a sulfamoyl group, an alkoxysulfonyl group, an aryloxysulfonyl group, a sulfonyl group, a sulfo group, a sulfinyl group and a mercapto group (including a salt thereof). These groups each may further be substituted by a group described as the substituent on $Z_1$. These groups may be present in plurality or, if possible, two groups thereof may be combined to form a ring.

The substituent on $Z_1$ is described in more detail below. Examples of the halogen atom include fluorine, chlorine and bromine; The alkyl group is a linear, branched or cyclic alkyl group having from 1 to 10, preferably from 1 to 5 carbon atoms, and examples thereof include methyl, ethyl, isopropyl, t-butyl, benzyl and cyclopentyl. The alkenyl group is an alkenyl group having from 2 to 10 carbon atoms and examples thereof include vinyl, 1-propenyl, 1-hexenyl and styryl. The alkynyl group is an alkynyl group having from 2 to 10 carbon atoms and examples thereof include ethynyl, 1-butynyl and phenylethynyl. The aryl group is an aryl group having from 6 to 10 carbon atoms and examples thereof include phenyl, naphthyl and p-methoxyphenyl.

The carbamoyl group is a carbamoyl group having from 1 to 8 carbon atoms and examples thereof include carbamoyl, N-ethylcarbamoyl and N-phenylcarbamoyl. The alkoxycarbonyl group is an alkoxycarbonyl group having from 2 to 8 carbon atoms and examples thereof include methoxycarbonyl and benzyloxycarbonyl. The aryloxycarbonyl group is an aryloxycarbonyl group having from 7 to 12 carbon atoms and examples thereof include phenoxycarbonyl. The acyl group is an acyl group having from 1 to 8 carbon atoms and examples thereof include acetyl and benzoyl. Examples of the heterocyclic group bonded through the carbon atom on the ring include a 5- or 6-membered, saturated or unsaturated heterocyclic ring having from 1 to 5 carbon atoms and containing one or more of an oxygen atom, a nitrogen atom and a sulfur atom, in which the number of the hetero atom and the kind of the element may be either single or in plurality, and examples thereof include 2-furyl, 2-thienyl, 2-pyridyl and 2-imidazolyl.

The alkoxy group is an alkoxy group having from 1 to 10, preferably from 1 to 6 carbon atoms, and examples thereof include methoxy, 2-methoxyethoxy and 2-methanesulfonylethoxy. The aryloxy group is an aryloxy group having from 6 to 12 carbon atoms and examples thereof include phenoxy, p-methoxyphenoxy and m-(3-hydroxypropionamido)phenoxy. The heterocyclic oxy group is a 5- or 6-membered, saturated or unsaturated heterocyclic oxy group having from 1 to 5 carbon atoms and containing one or more of an oxygen atom, a nitrogen atom and a sulfur atom, in which the number of the hetero atom and the kind of the element may be either single or in plurality, and examples thereof include 1-phenyltetrazolyl-5-oxy, 2-tetrahydropyranyloxy and 2-pyridyloxy. The acyloxy group is an acyloxy group having from 1 to 10, preferably from 1 to 6 carbon atoms, and examples thereof include acetoxy, benzoyloxy and 4-hydroxybutanoyloxy. The carbamoyloxy group is a carbamoyloxy group having from 1 to 10, preferably from 1 to 6 carbon atoms, and examples thereof include N,N-dimethylcarbamoyloxy, N-butylcarbamoyloxy and N-phenylcarbamoyloxy. The sulfonyloxy group is a sulfonyloxy group having from 1 to 8 carbon atoms and examples thereof include methanesulfonyloxy and benzenesulfonyloxy.

The acylamino group is an acylamino group having from 1 to 10, preferably from 1 to 6 carbon atoms, and examples thereof include acetylamino and benzoylamino. The alkylamino group is an alkylamino group having from 1 to 10, preferably from 1 to 6 carbon atoms, and examples thereof include N,N-dimethylamino, N-(2-hydroxyethyl)amino and N-(3-dimethylaminopropyl)amino. The arylamino group is an arylamino group having from 6 to 10 carbon atoms and examples thereof include anilino and N-methylanilino. The heterocyclic amino group is a 5- or 6-membered, saturated or unsaturated heterocyclic amino group having from 1 to 5 carbon atoms and containing one or more of an oxygen atom, a nitrogen atom and a sulfur atom, in which the number of the hetero atom and the kind of the element may be either single or in plurality, and examples thereof include 2-oxazolylamino, 2-tetrahydropyranylamino and 4-pyridylamino. The ureido group is an ureido group having from 1 to 10, preferably from 1 to 6 carbon atoms, and examples thereof include ureido, methylureido, N,N-diethylureido and 2-methanesulfonamidoethylureido.

The sulfamoylamino group is a sulfamoylamino group having from 0 to 10, preferably from 0 to 5 carbon atoms, and examples thereof include methylsulfamoylamino and 2-methoxyethylsulfamoylamino. The alkoxycarbonylamino group is an alkoxycarbonylamino group having from 2 to 10, preferably from 2 to 6 carbon atoms, and examples thereof include methoxycarbonylamino. The aryloxycarbonylamino group is an aryloxycarbonylamino group having from 7 to 12 carbon atoms and examples thereof include phenoxycarbonylamino and 2,6-dimethoxyphenoxycarbonylamino. The sulfonamido group is a sulfonamido group having from 1 to 10, preferably from 1 to 6 carbon atoms, and examples thereof include methanesulfonamido and p-toluenesulfonamido. The imido group is an imido group having from 4 to 10 carbon atoms and examples thereof include N-succinimido and N-phthalimido. The heterocyclic group bonded through the nitrogen atom of the ring is a 5- or 6-membered heterocyclic ring comprising at least one of a carbon atom, an oxygen atom and a sulfur atom and a nitrogen atom, and examples thereof include pyrrolidino, morpholino and imidazolino.

The alkylthio group is an alkylthio group having from 1 to 10, preferably from 1 to 5 carbon atoms, and examples thereof include methyl thio and 2-carboxyethylthio. The arylthio group is an arylthio group having from 6 to 12 carbon atoms and examples thereof include phenylthio and 2-carboxyphenylthio. The heterocyclic thio group is a 5- or 6-membered, saturated or unsaturated heterocyclic thio group having from 1 to 5 carbon atoms and containing one or more of an oxygen atom, a nitrogen atom and a sulfur atom, in which the number of the hetero atom and the kind of the element may be either single or in plurality, and examples thereof include 2-benzothiazolylthio and 2-pyridylthio.

The sulfamoyl group is a sulfamoyl group having from 0 to 10, preferably from 0 to 6 carbon atoms, and examples thereof include sulfamoyl, methylsulfamoyl and phenylsulfamoyl. The alkoxysulfonyl group is an alkoxysulfonyl group having from 1 to 10, preferably from 1 to 6 carbon atoms, and examples thereof include methoxysulfonyl. The aryloxysulfonyl group is an aryloxysulfonyl group having from 6 to 12, preferably from 6 to 10 carbon atoms, and examples thereof include phenoxysulfonyl. The sulfonyl group is a sulfonyl group having from 1 to 10, preferably from 1 to 6 carbon atoms, and examples thereof include methanesulfonyl and benzenesulfonyl. The sulfinyl group is a sulfinyl group having from 1 to 10, preferably from 1 to 6 carbon atoms, and examples thereof include methanesulfinyl and benzenesulfinyl.

The substituent represented by $Z_1$ is preferably a hydrogen atom, an alkyl group, an aryl group, a carbamoyl group, an acyl group, a cyano group, an alkoxy group, an aryloxy group, an amino group, an acylamino group, a ureido group, a sulfamoylamino group, a sulfonamido group, an alkylthio group, an arylthio group, a sulfamoyl group, a sulfonyl group or a mercapto group, more preferably a hydrogen atom, an alkyl group, an alkoxy group, an aryloxy group, an amino group, an acylamino group, a ureido group, an alkylthio group, a mercapto group, still more preferably a hydrogen atom, an alkyl group, an alkoxy group, an amino group, an alkylthio group or a mercapto group. $Z_1$ is most preferably a group having one or two mercapto groups.

$X_1$ is a hydrogen atom or a cation. Examples of the cation include sodium, potassium, lithium, calcium, ammonium, tetrabutylammonium and triethylammonium. $X_1$ is preferably hydrogen, sodium, potassium or ammonium.

The compound having a bis type structure formed by combining two kinds of radicals resulting from elimination of any one hydrogen atom from compounds represented by formula (C) is preferably represented by the following formula (L):

(L)

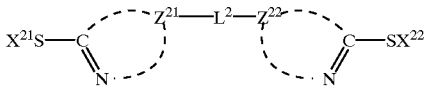

wherein $Z^{21}$ and $Z^{22}$ each represents a group resulting from elimination of one hydrogen atom from $Z^1$ in formula (C), and $X^{21}$ and $X^{22}$ each has the same meaning as $X^1$. The preferred embodiment of these groups is the same as in formula (C). $L^2$ in formula (L) represents a divalent linking group (for example, an alkylene group, an alkenylene group, an alkynylene group, an-arylene group, a divalent heterocyclic group or a group obtained by linking these groups through —O—, —S—, —NH—, —CO— or —$SO_2$— alone or through a group comprising a combination thereof).

Examples of the alkylene group represented by $L^2$ include ethylene, trimethylene, pentamethylene, propylene, 2-buten-1,4-yl, 2-butine-1,4-yl and p-xylylene. Examples of the alkenylene group include ethen-1,2-yl. Examples of the alkynylene group include ethyn-1,2-yl. Examples of the arylene group include phenylene. Examples of the divalent heterocyclic group include furan-1,4-diyl. $L^2$ is preferably an alkylene group, an —NH—(alkylene)—NH— group, an —O—(alkylene)—O— group, an —S—(alkylene)—S— group, an —NH—(alkylene)—CONH—(alkylene)—NH— group or an —NH—(alkylene)—O—(alkylene)—NH— group, more preferably an —NH—(alkylene)—NH— group or an —O—(alkylene)—O— group.

Among the compounds represented by formula (C), preferred are those represented by the following formulae (3) to (10):

(3)

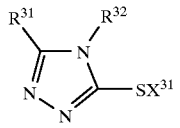

wherein $R^{31}$ have the same meanings as the substituent on $Z^1$ in formula (C) and $X^{31}$ have the same meanings as $X^1$ in formula (C); $R^{31}$ is preferably a hydrogen atom, an alkyl group, an aryl group, a heterocyclic group, a hydroxy group, an amino group which may be substituted, a mercapto group or an alkylthio group, more preferably a hydrogen atom, an alkyl group, a hydroxy group, an amino group which may be substituted or a mercapto group, and most preferably a hydrogen atom, an alkyl group or a mercapto group; $R^{32}$ represents a hydrogen atom, an alkyl group, an aryl group, a heterocyclic group, a hydroxy group or an amino group which may be substituted; and $R^{32}$ is preferably a hydrogen atom, an alkyl group, a hydroxy group or an amino group which may be substituted, more preferably a hydrogen atom or an alkyl group;

(4)

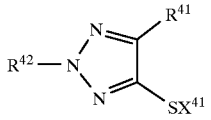

wherein $R^{41}$, $R^{42}$ and $X^{41}$ have the same meanings as $R^{31}$, $R^{32}$ and $X^{31}$ in formula (3), respectively, and their preferred range is also the same;

(5)

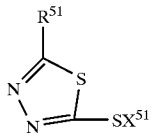

wherein $R^{51}$ and $X^{51}$ have the same meaning as $R^{31}$ and $X^1$ in formula (3), respectively; and $R^{51}$ is preferably a hydrogen atom, an alkyl group, an aryl group, a heterocyclic group, a hydroxy group, an amino group which may be substituted, a mercapto group or an alkylthio group, more preferably an alkyl group, an amino group which may be substituted, a mercapto group or an alkylthio group, and most preferably a mercapto group or an alkylthio group;

(6)

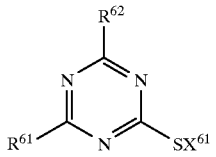

wherein $R^{61}$, $R^{62}$ and $X^{61}$ have the same meanings as R31, $R^{32}$ and $X^{31}$ in formula (3), respectively; $R^{61}$ is preferably a hydrogen atom, an alkyl group, an aryl group, a heterocyclic group, a hydroxy group, an alkoxy group, an amino group which may be substituted, a mercapto group or an alkylthio group, more preferably a hydroxy group, an alkoxy group, an amino group which may be substituted, a mercapto group or an alkylthio group, and most preferably a hydroxy group, an amino group which may be substituted or a mercapto group; and $R^{62}$ is preferably a mercapto group;

(7)

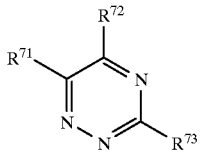

wherein $R^{71}$ and $R^{72}$ each has the same meaning as $R^{61}$ in formula (6) and $R^{73}$ has the same meaning as $R^{62}$ in formula (6), and their preferred range is also the same, provided that at least one of $R^{71}$, $R^{72}$ and $R^{73}$ is a mercapto group; and $R^{73}$ is preferably a mercapto group;

(8)

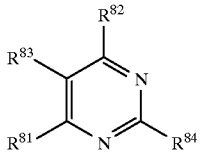

wherein $R^{81}$, $R^{82}$ and $R^{83}$ each has the same meaning as $R^{61}$ in formula (6) and $R^{84}$ has the same meaning as $R^{62}$ in formula (6), and their preferred range is also the same; provided that at least one of $R^{81}$, $R^{82}$, $R^{83}$ and $R^{84}$ is a mercapto group; $R^{83}$ is most preferably an amino group which may be substituted or a hydrogen atom; and $R^{84}$ is preferably a mercapto group;

(9)

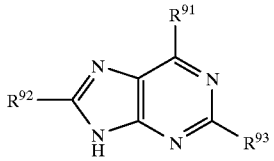

wherein $R^{91}$ and $R^{92}$ each has the same meaning as $R^{61}$ in formula (6) and $R^{93}$ has the same meaning as $R^{62}$ in formula (6), and their preferred range is also the same; provided that at least one of $R^{91}$, $R^{92}$ and $R^{93}$ is a mercapto group, more preferably, $R^{92}$ or $R^{93}$ is a mercapto group;

(10)

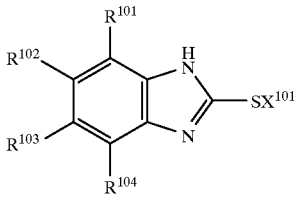

wherein $R^{101}$ to $R^{104}$ each has the same meaning as the substituent on $Z^1$ in formula (C) and $X^{101}$ has the same meaning as $X^1$ in formula (C); $R^{101}$ to $R^{104}$each is preferably a hydrogen atom, a sulfo group, a carboxyl group, a hydroxy group or a sulfamoyl group, more preferably a hydrogen atom or a sulfo group; and $R^{103}$ is most preferably a sulfo group.

Among formulae (3) to (10), formulae (3) and (5) to (9) are more preferred, and formulae (3), (6) and (8) are most preferred.

Specific examples of the compound represented by formula (C) for use in the present invention are shown below, however, the present invention is by no means limited thereto.

D-(1)

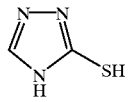

D-(2)

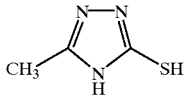

D-(3)

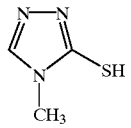

D-(4)

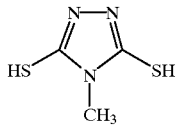

D-(5)

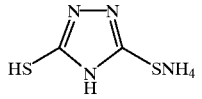

D-(6)

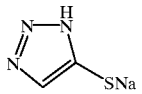

D-(7)

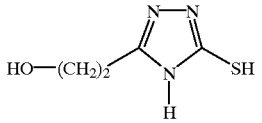

D-(8)

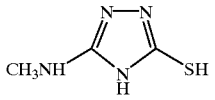

D-(9)

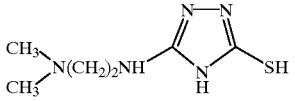

D-(10)

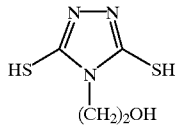

-continued
D-(11)
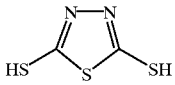
D-(12)
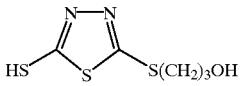
D-(13)
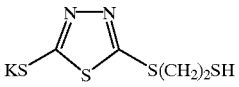
D-(14)
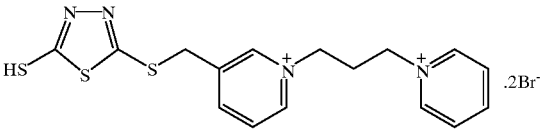
D-(15)
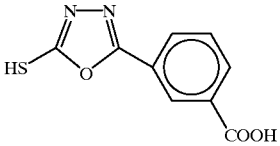
D-(16)
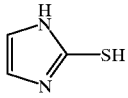
D-(17)
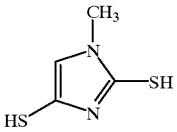
D-(18)
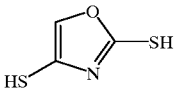
D-(19)
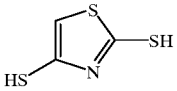
D-(20)
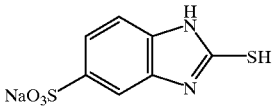
D-(21)
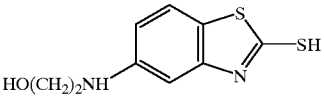
-continued
D-(22)
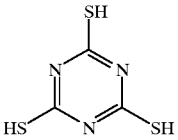
D-(23)
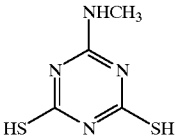
D-(24)
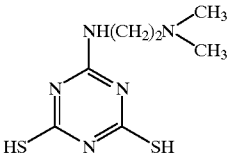
D-(25)
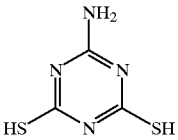
D-(26)
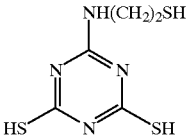
D-(27)
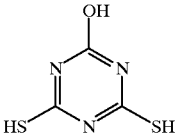
D-(28)
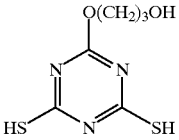
D-(29)
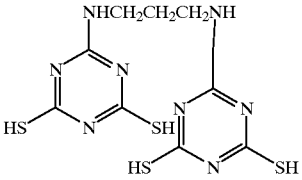

-continued
D-(30)
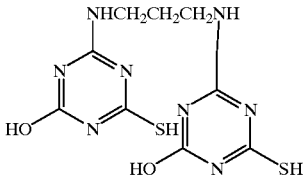
D-(31)
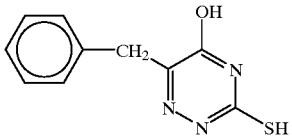
D-(32)
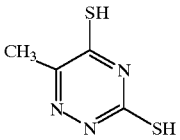
D-(33)
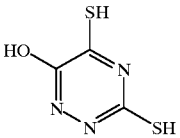
D-(34)
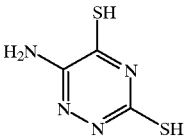
D-(35)
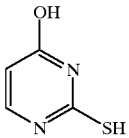
D-(36)
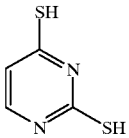
D-(37)
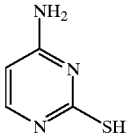
D-(38)
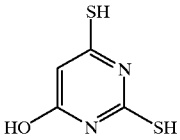
-continued
D-(39)
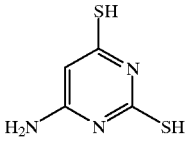
D-(40)
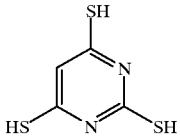
D-(41)
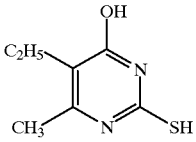
D-(42)
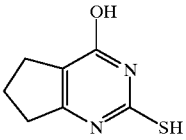
D-(43)
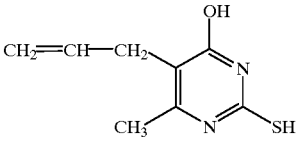
D-(44)
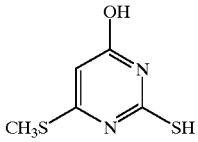
D-(45)
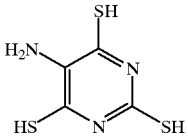
D-(46)
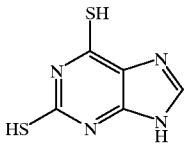
D-(47)
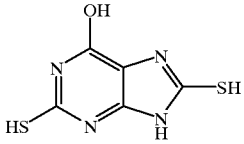

-continued
D-(48)
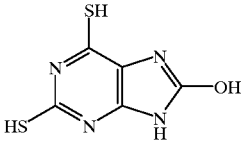
D-(49)
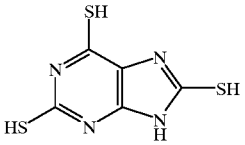
D-(50)
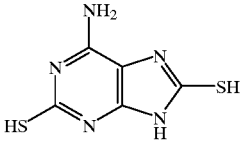
D-(51)
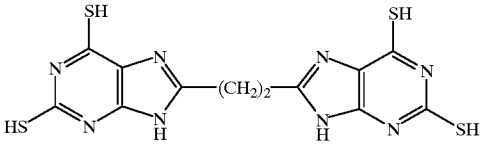
D-(52)
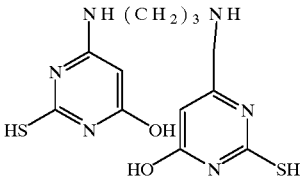
D-(53)
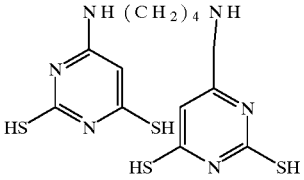
D-(54)
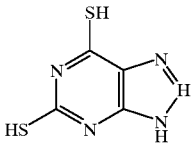
D-(55)
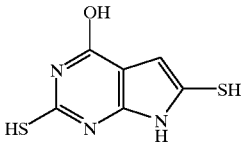
-continued
D-(56)
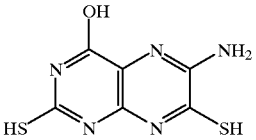
D-(57)
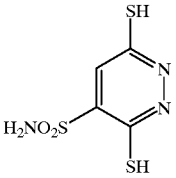
D-(58)
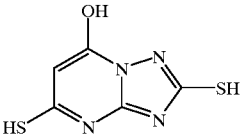
D-(59)
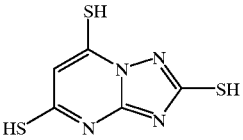
D-(60)
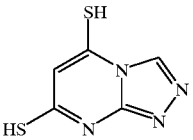
D-(61)
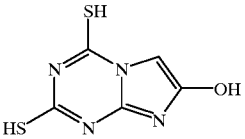
D-(62)
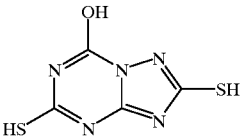
D-(63)
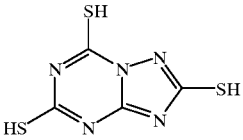
D-(64)
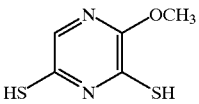

-continued

D-(65)

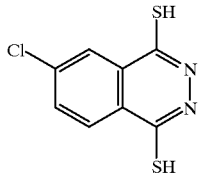

D-(66)

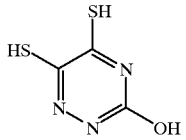

D-(67)

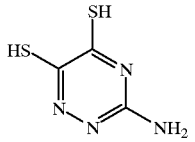

D-(68)

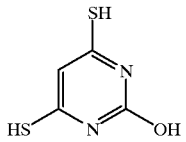

D-(69)

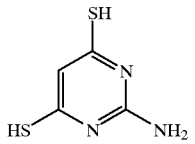

D-(70)

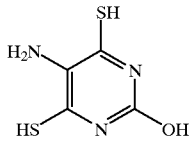

D-(71)

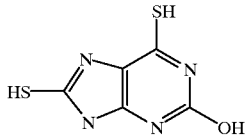

D-(72)

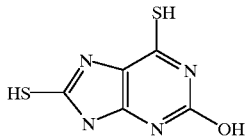

D-(73)

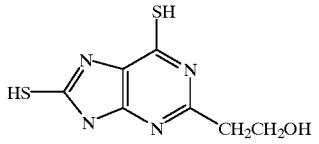

-continued

D-(74)

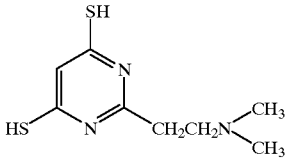

D-(75)

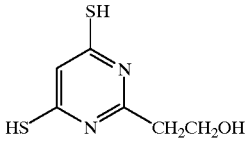

The compound represented by formula (C) of the present invention is described in the following patents and patents and literatures cited therein: JP-A-4-301837, JP-A-5-61159; JP-A-6-230525, JP-A-58-169147, JP-A-62-56959, U.S. Pat. No. 3,212,892, JP-A-3-53244, JP-A-3-282457, JP-A-5-61159, JP-A-5-303179, JP-A-4-362942, JP-B-46-11630, JP-A-6-175302 and JP-A-6-258783.

When the compound represented by formula (C) for use in the present invention is added to a developer, it is added in an amount of preferably from 0.01 to 10 mmol, more preferably from 0.1 to 5 mmol, per l of the developer. When the compound is added to a silver halide light-sensitive material, it is preferably added to a back layer or an uppermost light-insensitive layer such as a protective layer. The addition amount of the compound of the present invention is preferably from $1\times10^{-6}$ to $5\times10^{-3}$ mol, more preferably from $1\times10^{-5}$ to $1\times10^{-3}$ mol, per $m^2$ of the light-sensitive material.

Further, the developer may contain the compound described in JP-A-62-212651 as a development unevenness inhibitor and the compound described in JP-A-61-267759 as a dissolution aid.

The developer may also contain a color toner, a surface active agent, a defoaming agent and a hardening agent, if desired.

The development processing temperature and the development processing time are correlated with each other and they are determined taking account of the entire processing time, however, the development temperature is generally from about 20° C. to about 50° C., preferably from 25 to 45° C., and the development time is from 5 seconds to 2 minutes, preferably from 7 seconds to 1 minute and 30 seconds.

In the present invention, the development initiating solution and the development replenisher both are required to have a property such that "increase in pH caused when 0.1 mol of sodium hydroxide is added to 1 l of the solution, is 0.25 or less". In verifying whether or not a development initiating solution or a development replenisher to be used has this property, the development initiating solution or the development replenisher to be examined is adjusted to have a pH of 10.0, 0.1 mol of sodium hydroxide is added to 1 l of the solution, and the pH at this time is measured. When increase in the pH value is 0.25 or less, it is determined that the solution has the above-described property. In the present invention, a development initiating solution or a development replenisher which shows increase in the pH value upon the above-described test of 0.2 or less is preferably used.

In order to impart the above-described property to the development initiating solution or the development replenisher, a buffer is preferably used. Examples of the buffer include a carbonate, a boric acid described in JP-A-62-186259, saccharides (e.g., saccarose) described in JP-A-60-93433, oximes (e.g., acetoxime), phenols (e.g., 5-sulfosalicylic acid) and tertiary phosphates (e.g., sodium salt, potassium salt), and a carbonate and a boric acid are preferably used. The use amount of a buffer, particularly a carbonate, is preferably 0.3 mol/l or more, more preferably from 0.4 mol/l or more.

In the present invention, the development initiating solution has a pH of from 8.5 to 12.0, preferably from 8.5 to 11.0, and most preferably from 9.4 to 10.5. The development replenisher and the developer in the developing tank on continuous development each has a pH within the above-described range.

The alkali agent for use in the adjustment of the pH may be a usual water-soluble inorganic alkali metal salt (e.g., sodium hydroxide, potassium hydroxide, sodium carbonate, potassium carbonate).

In processing 1 $m^2$ of a silver halide photographic light-sensitive material, the replenishing amount of the developer is 200 ml or less, preferably from 0 to 180 ml, more preferably from 10 to 160 ml.

The development replenisher may have the same composition as the development initiating solution or may have a concentration higher than the initiating solution with respect to the components consumed by the development.

For saving the cost for transportation of processing solutions, the cost for packaging materials and the space for installation, the processing solution are preferably concentrated, and diluted on use. In order to concentrate the developer, it is effective to process the salt components contained in the developer into a potassium salt form.

The fixing solution for use in the fixing step of the present invention is an aqueous solution containing sodium thiosulfate or ammonium thiosulfate and if desired, tartaric acid, citric acid, gluconic acid, boric acid, iminodiacetic acid, 5-sulfosalicylic acid, glucoheptanoic acid, tylon, ethylenediaminetetraacetic acid, diethylenetriaminepentaacetic acid, nitrilotriacetic acid or a salt thereof. In view of environmental conservation in recent years, the fixing solution preferably contains no boric acid.

The fixing agent in the fixing solution for use in the present invention includes sodium thiosulfate and ammonium thiosulfate, and in view of the fixing rate, ammonium thiosulfate is preferred, however, when taken account of environmental conservation in recent years, sodium thiosulfate may be used. The use amount of these known fixing agents may be varied appropriately, however, it is generally from about 0.1 to about 2 mol/l, preferably from 0.2 to 1.5 mol/l.

The fixing solution may contain, if desired, a hardening agent (e.g., water-soluble aluminum compound), a preservative (e.g., sulfite, bisulfite), a pH buffer (e.g., acetic acid), a pH adjusting agent (e.g., ammonia, sulfuric acid), a chelating agent, a surface active agent, a wetting agent or a fixing accelerator.

Examples of the surface active agent include an anionic surface active agent such as sulfated product and sulfonated product, a polyethylene-base surface active agent, and an amphoteric surface active agent described in JP-A-57-6740. A known defoaming agent may also be added. Examples of the wetting agent include alkanolamine and alkylene glycol. Examples of the fixing accelerator include thiourea derivatives described in JP-B-45-35754, JP-B-58-122535 and JP-B-58-122536, alcohols having a triple bond within a molecule, thioether compounds described in U.S. Pat. No. 4,126,459, meso-ionic compounds described in JP-A-4-229860, and the compounds described in JP-A-2-44355.

Examples of the pH buffer include an organic acid such as acetic acid, malic acid, succinic acid, tartaric acid, citric acid, oxalic acid, maleic acid, glycolic acid and adipic acid, and an inorganic buffer such as boric acid, phosphate and sulfite. Among these, preferred are acetic acid, tartaric acid and sulfite.

The pH buffer for use herein is used to prevent increase in the pH value of the fixing agent due to carrying over of the developer, and it is generally used in an amount of from 0.01 to 1.0 mol/l, preferably about from 0.02 to 0.6 mol/l.

The fixing solution may also contain the compound described in JP-A-64-4739 as a dye elution accelerator.

Examples of the hardening agent in the fixing solution for use in the present invention include a water-soluble aluminum salt and a chromium salt. Of these, a water-soluble aluminum salt is preferred and examples thereof include aluminum chloride, aluminum sulfate and potassium alum. The addition amount thereof is preferably from 0.01 to 0.2 mol/l, more preferably from 0.03 to 0.08 mol/l.

The fixing temperature is from about 20° C. to about 50° C., preferably from 25 to 45° C., and the fixing time is from 5 seconds to 1 minute, preferably from 7 to 50 seconds.

The replenishing amount of the fixing solution is 500 ml/$m^2$ or less, preferably 200 ml/$m^2$ or less, based on the light-sensitive material processed.

The light-sensitive material processed through development and fixing is then subjected to water washing or stabilization.

The water washing or stabilization is usually performed using water in an amount of 20 l or less per $m^2$ of the silver halide light-sensitive material and they may also be performed at a replenishing amount of 3 l or less (including 0, namely, standing water washing). In other words, the processing can not only be performed with saved water but also dispense with piping for installation of an automatic developing machine.

As a method for reducing the replenishing amount of washing water, a multi-stage countercurrent system (for example, two stages or three stages) has been known from of old. When the multi-stage countercurrent system is applied to the present invention, the light-sensitive material after fixing is processed gradually toward the correct direction, namely, while coming into contact in sequence with processing solutions unstained with the fixing solution, and as a result, water washing can be performed more efficiently.

When water washing is performed with a small amount of water, a rinsing tank such as squeeze roller or cross-over roller described in JP-A-63-18350 and JP-A-62-28725 is preferably provided. Or, addition of various oxidizing agents or filter filtration may be combined so as to reduce the pollution load which is a problem to be caused in water washing with a small amount of water.

The over-flow solution from the water washing or stabilization bath, which is generated as a result of replenishing water with a fungicide means to the water washing or stabilization bath by the method of the present invention, may be partially or wholly used in the processing solution having fixing ability as the previous processing step thereof as described in JP-A-60-235133.

Also, a water-soluble surface active agent or defoaming agent may be added so as to prevent uneven processing due to bubbling which is liable to occur at the time of water washing with a small amount of water, and/or to prevent a processing agent component adhering to the squeeze roller from transferring onto the processed film.

Further, a dye adsorbent described in JP-A-63-163456 may be provided in the water washing tank so as to prevent stain due to a dye dissolved out from the light-sensitive material.

In some cases, stabilization may be performed following the above-described water washing and an example thereof is the bath containing the compound described in JP-A-2-201357, JP-A-2-132435, JP-A-1-102553 or JP-A-46-44446 used as a final bath of the light-sensitive material.

The stabilizing bath may also contain, if desired, an ammonium compound, a metal compound such as Bi and Al, a fluorescent brightening agent, various chelating agents, a film pH adjusting agent, a hardening agent, a microbicide, a fungicide, an alkanolamine or a surface active agent. Water for use in the water washing or stabilization step may be tap water but deionized water or water subjected to sterilization with a halogen or ultraviolet bactericidal lamp or various oxidizing agents (e.g., ozone, hydrogen peroxide, chlorate) is preferably used. Further, washing water containing the compound described in JP-A-4-39652 or JP-A-5-241309 may also be used.

The temperature and the time in water washing or stabilization are preferably from 0 to 50° C. and from 5 seconds to 2 minutes, respectively.

The processing solution for use in the present invention is preferably stored in a packaging material having a low oxygen permeability described in JP-A-61-73147.

The processing solution for use in the present invention may be formed into powder or a solid. To this effect, a known method may be used but the methods described in JP-A-61-259921, JP-A-4-85533 and JP-A-4-16841 are preferably used. In particular, the method described in JP-A-61-259921 is preferred.

When the replenishing amount is reduced, the contact area of the processing tank with air is preferably made small so as to prevent evaporation or air oxidation of the solution. A roller transportation-type automatic developing machine is described in U.S. Pat. Nos. 3,025,779 and 3,545,971 and in the present invention, it is simply referred to as a roller transportation-type processor. The roller transportation-type processor comprises four processing steps of development, fixing, water washing and drying and it is most preferred that this four-step processing is followed also in the present invention, though use of other steps (for example, stopping) is not rejected. A four-step processing where water washing is replaced by stabilization may also be used.

As a method for reducing the replenishing amount of washing water, a multi-stage countercurrent system (for example, two stages or three stages) has been known from of old, and the replenishing amount of washing water is preferably from 200 to 500 ml per $m^2$ of the light-sensitive material. When the multi-stage countercurrent system is applied to the present invention, the light-sensitive material after fixing is processed gradually toward the correct direction, namely, while coming into contact in sequence with processing solutions unstained with the fixing solution, and as a result, water washing can be performed more efficiently. This effect can be also obtained similarly in the case of an independent multi-stage system (a method of not using countercurrent but supplying a new solution to the multi-stage water washing tank or stabilization bath).

In the method of the present invention, a water scale preventing means may be provided in the water washing or stabilization bath. The water scale preventing means is not particularly restricted and a known means may be used. Examples thereof include a method of adding a fungicide (so-called water scale inhibitor) to the washing water or stabilizing solution, a method of passing electricity through the washing water or stabilizing solution, a method of irradiating ultraviolet rays, infrared rays or far infrared rays, a method of applying magnetic field, a method of performing ultrasonic wave processing, a method of applying heat, and a method of evacuating the tank on standing. The water scale preventing means may be performed according to the processing of the light-sensitive material, may be performed at a predetermined interval irrespective of the use state, or may be performed only in the period of nonprocessing time such as night time.

Also, in view of preventing generation of resistance microbes, it is preferred to perform different water scale preventing means every a predetermined period.

The fungicide is not particularly restricted and a known fungicide may be used. Examples thereof include glutaraldehyde, a chelating agent such as aminopolycarboxylic acid, a cationic surface active agent, an oxidizing agent (e.g., ozone, hydrogen peroxide, sodium hydrochlorite, active halogen, chlorine dioxide, sodium carbonate hydrogen peroxide salt) and mercaptopyridine oxide (e.g., 2-mercaptopyridine-N-oxide), and a sole fungicide may be used or a plurality of fungicides may be used in combination. The fungicide may be added to the washing water or stabilization bath according to the processing, or washing water or stabilizing solution to which the fungicide is previously added may be replenished. The replenishment of fungicide may be performed according to the processing of the light-sensitive material, may be performed at a predetermined interval irrespective of the use state or may be performed only in the period of nonprocessing time such as night time.

Also, in view of preventing generation of resistance microbes, it is preferred to perform different fungicides every a predetermined period.

The electricity may be applied according to the method described in JP-A-3-224685, JP-A-3-224687, JP-A-4-16280 or JP-A-4-18980.

A known water-soluble surface active agent or defoaming agent may be added so as to prevent uneven processing due to bubbling which is liable to occur at the time of water washing with a small amount of water and/or to prevent a processing agent component adhering to the squeeze roller from transferring onto the processed film. Further, a dye adsorbent described in JP-A-63-163456 may be provided in the water washing tank so as to prevent stain due to a dye dissolved out from the light-sensitive material.

The overflow solution from water washing or stabilization bath may be partly or wholly used by mixing with the processing solution having fixing ability as described in JP-A-60-235133. It is preferred in view of natural environmental conservation to reduce the biochemical oxygen demand (BOD), chemical oxygen demand (COD) or iodine consumption before discharge by subjecting the solution to microorganism treatment (a treatment with a filter comprising a porous carrier such as activated carbon or ceramic, having carried thereon sulfur oxidation bacteria, activated sludge process or microorganisms) or oxidation treatment by electrification or with an oxidizing agent, or to reduce silver concentration in waste water by passing the solution through a filter using a polymer having affinity for silver or adding a compound which forms a difficultly soluble silver complex, such as trimercaptotriazine to precipitate silver and then passing the solution through a filter.

In some cases, stabilization may be performed subsequent to the water washing and as one example, a bath containing the compound described in JP-A-2-201357, JP-A-2-132435, JP-A-1-102553 and JP-A-46-44446 may be used as a final bath of the light-sensitive material. The stabilization bath may also contain, if desired, an ammonium compound, a metal compounds such as Bi or Al, a fluorescent brightening agent, various chelating agents, a layer pH adjusting agent, a layer hardening agent, a bactericide, a fungicide, an alkanolamine or a surface active agent.

The additives and the stabilizing agents, such as a fungicide, added to the water washing or stabilization bath may be formed into a solid agent similarly to the above-described development and fixing processing agents.

Waste water of the developer, the fixing solution, the washing water or the stabilizing solution for use in the present invention is preferably burned before disposal. The waste water may also be formed into a concentrated solution or a solid by a concentration apparatus as described, for example, in JP-B-7-83867 and U.S. Pat. No. 5,439,560 and then disposed.

In the case when the replenishing amount of the processing agent is reduced, it is preferred to prevent evaporation or air oxidation of the solution by reducing the contact area of the processing tank with air. A roller transportation-type automatic developing machine is described in U.S. Pat. Nos. 3,025,779 and 3,545,971, and in the present invention, it is referred to simply as a roller transportation-type processor. The roller transportation-type processor comprises four steps of development, fixing, water washing and drying, and it is most preferred to follow this four-step processing also in the present invention, though other steps (e.g., stopping step) are not rejected. A four-step processing where water washing is replaced by stabilization may also be used.

In the development of the present invention, the development time and the fixing time each is 40 seconds or less, preferably from 6 to 35 seconds, and the temperature of each solution is preferably from 25 to 50° C., more preferably from 30 to 40° C. The temperature and the time of the water washing or stabilization bath are preferably from 0 to 50° C. and 40 seconds or less, respectively. According to the method of the present invention, the light-sensitive material after development, fixing and water washing (or stabilization) may be passed through squeeze rollers for squeezing washing water and then dried. The drying is performed at a temperature of from about 40° C. to about 100° C. The drying time may be appropriately varied depending upon the ambient state. The drying method is not particularly restricted and any of known methods may be used, however, hot air drying, drying by a heat roller as disclosed, for example, in JP-A-4-15534, JP-A-5-2256 and JP-A-5-289294, and drying by far infrared rays may be used and a plurality of drying methods may be used in combination.

The photographic light-sensitive material to which the development processing method of the present invention is applied, is not particularly restricted, and a general black-and-white light-sensitive material and also a color light-sensitive material for reversal processing (e.g., color reversal film or paper) may be used. The development processing method of the present invention is particularly preferably used for a photographic light-sensitive material for laser printer to obtain a medical image, a light-sensitive material for printing, a medical direct photographing X-ray light-sensitive material, an indirect photographing X-ray light-sensitive material, a hydrazine nucleation type contrast film, a light-sensitive material for CRT image recording, a microphotographic light-sensitive material, a general black-and-white negative film or a black-and-white printing paper.

The silver halide emulsion is not particularly restricted with regard to the halogen composition and it is obtained by dispersing silver halide such as silver chloride, silver iodide, silver bromide, silver chlorobromide, silver iodobromide or silver chloroiodobromide, into a hydrophilic colloid.

The silver halide emulsion is usually produced by mixing a water-soluble silver salt (e.g., silver nitrate) and a soluble halogen salt by a method well known in the art (e.g., single jet method, double jet method, controlled jet method) in the presence of water and hydrophilic colloid and then subjecting the mixture to physical ripening and chemical ripening such as gold sensitization and/or sulfur sensitization. The silver halide for use in the present invention is not particularly limited with regard to the shape of grain and any of cubic, octahedral and spherical silver halide grains and in addition, tabular silver halide grains having a high aspect ratio described in *Research Disclosure*, 22534 (January 1983), may be used.

The silver halide emulsion for used in the present invention is not particularly limited with regard to the halogen composition, however, in order to achieve the objects of the present invention more effectively, silver chloride, silver chlorobromide and silver chloroiodobromide each having a silver chloride content of 50 mol % or more are preferred. The silver iodide content is preferably less than 5 mol %, more preferably less than 2 mol %.

In the present invention, a light-sensitive material suitable for high illuminance exposure such as scanner exposure or a light-sensitive material for line work photographing contains a rhodium compound so as to achieve high contrast and low fog.

A water-soluble rhodium compound may be used as the rhodium compound for use in the present invention. Examples thereof include rhodium(III) halogenide compounds and rhodium complex salts having-a halogen, an amine or an oxalate as a ligand, such as hexachlororhodium (III) complex salt, hexabromorhodium(III) complex salt, hexaaminerhodium(III) complex salt and trioxalaterhodium (III) complex salt. The rhodium compound is dissolved in water or an appropriate solvent before use, however, a method commonly well used for stabilizing the rhodium compound solution, that is, a method of adding an aqueous hydrogen halogenide solution (e.g., hydrochloric acid, bromic acid, fluoric acid) or halogenated alkali (e.g., KCl, NaCl, KBr, NaBr) may be used. In place of using water-soluble rhodium, separate silver halide grains previously doped with rhodium may be added and dissolved at the time of preparation of silver halide.

The addition amount of the rhodium compound is generally from $1\times10^{-8}$ to $5\times10^{-6}$ mol, preferably from $5\times10^{-8}$ to $1\times10^{-6}$, per mol of silver in the silver halide emulsion.

The rhodium compound may be appropriately added at the time of production of silver halide emulsion grains or at respective stages before coating of the emulsion, however, it is preferably added at the time of emulsion formation and integrated into the silver halide grain.

The photographic emulsion for use in the present invention can be prepared according to the methods described in P. Glafkides, *Chimie et Physique Photographique*, Paul Montel (1967), G. F. Duffin, *Photographic Emulsion Chemistry*, The Focal Press (1966), and V. L. Zelikman et al, *Making and Coating Photographic Emulsion*, The Focal Press (1964).

A soluble silver salt and a soluble halogen salt may be reacted by any of a single double jet method, a double jet method and a combination thereof.

A method of forming grains in the presence of excessive silver ions (so-called reverse mixing method) may also be used. Further, a method of maintaining the pAg in the liquid phase where silver halide is formed, constant, a so-called controlled double jet method, which is one form of the double jet method, may be used. The grains are preferably formed using a so-called silver halide solvent such as ammonia, thioether or tetra-substituted thiourea. The tetra-substituted thiourea compound is more preferred and this is described in JP-A-53-82408 and JP-A-55-77737. Preferred examples of the thiourea compound include tetramethylthiourea and 1,3-dimethyl-2-imidazolidinethione.

In the controlled double jet method and the grain formation method using a silver halide solvent, silver halide emulsion having a regular crystal form and a narrow grain size distribution can be easily prepared, and these are a useful means for preparing silver halide for use in the present invention.

In order to achieve a uniform grain size, it is preferred to rapidly grow grains within the range of not exceeding the critical saturation degree, using a method of changing the addition rate of silver nitrate or halogenated alkali according to the grain growth rate as described in British Patent 1,535,016, JP-B-48-36890 and JP-B-52-16364, or a method of changing the concentration of the aqueous solution as described in British Patent 4,242,445 and JP-A-55-158124.

The emulsion of the present invention is preferably a monodisperse emulsion having a coefficient of variation of 20% or less, more preferably 15% or less.

The grains in the monodisperse silver halide emulsion have an average grain size of 0.5 $\mu$m or less, more preferably from 0.1 to 0.4 $\mu$m.

In the case of an X-ray light-sensitive material, the silver amount of the photographic light-sensitive material is in total on both surfaces of the support, preferably 8.0 g/m$^2$ or less, more preferably 4.0 g/m$^2$ or less. The light-sensitive material may have, if desired, a hydrophilic colloid layer other than a silver halide emulsion layer, and a surface protective layer is preferably provided according to a known method. The gelatin amount on the side having hydrophilic colloid layers including an emulsion layer, is preferably from 2.0 g/m$^2$ to less than 5.0 g/m$^2$, more preferably from 2.5 g/m$^2$ to less than 4.0 g/m$^2$. The light-sensitive material is preferably has a melting time of from 20 to 100 minutes. The melting time is measured according to the method described in JP-A-63-221341.

The silver halide photographic light-sensitive material comprises a support having thereon at least one silver halide emulsion layer, however, in the case of a direct medical X-ray light-sensitive material, as described in JP-A-58-127921, JP-A-59-90841, JP-A-58-111934 and JP-A-61-201235, at least one silver halide emulsion layer is preferably provided on both surfaces of the support.

In addition, the photographic material may have, if desired, an interlayer, a filter layer, an antihalation layer and the like.

The silver amount of the light-sensitive material is preferably from 0.5 to 5 g/m$^2$ (per one surface), more preferably from 1 to 3 g/m$^2$ (per one surface).

In view of suitability for rapid processing, the silver amount preferably does not exceed 5 g/m$^2$ and in order to obtain constant image density and contrast, the silver amount is preferably 0.5 g/m$^2$ or more.

The silver halide grain in an emulsion for use in the X-ray light-sensitive material may have a regular crystal form such as cubic or octahedral form, or may have an irregular crystal form such as spherical, platy or pebble form, or the emulsion may comprise a mixture of grains having various crystal forms.

The composition of silver halide grain may be any of silver iodobromide, silver bromide, silver iodochlorobromide, silver chlorobromide, silver iodochloride and silver chloride, however, in view of high sensitivity and excellent rapid processability, silver iodobromide having a silver iodide content of 0.6 mol % or less, silver iodochlorobromide having a silver chloride content of from 20 mol % to less than 100 mol %, from 50 mol % to less than 99 mol %, and silver chlorobromide are preferred.

Use of tabular grains is a preferred embodiment. With respect to a tabular grain, *Research Disclosure*, vol. 225, Item 22534, 20–58 (January 1983), JP-A-58-127921, JP-A-58-113926, JP-A-58-113927, JP-A-58-113928 and U.S. Pat. No. 4,439,520 may be referred to.

In the case of an X-ray light-sensitive material for use in the present invention, tabular grains having (100) or (111) face as its main plain and having an aspect ratio of 2 or more account for 50% or more, preferably from 60 to 100%, more preferably from 70 to 100% of the entire projected area of silver halide grains in the silver halide emulsion containing at least a dispersion medium and silver halide grains. The term "tabular grain" as used herein means a grain having an aspect ratio (diameter/thickness) of 1 or more. The term "main plain" means a outermost surface of a tabular grain. The tabular grain has a thickness of 0.35 $\mu$m or less, preferably from 0.05 to 0.3 $\mu$m, more preferably 0.05 to 0.25 $\mu$m. The aspect ratio is preferably 2 or more, more preferably from 3 to 30, still more preferably 5 to 20. The term "diameter" as used herein means a diameter of a circle having an area equal to the projected area of the tabular grain and the "thickness" means a distance between two main plains. The Cl content is generally 20 mol % or more, preferably from 30 to 100 mol %, more preferably from 40 to 100 mol %, still more preferably from 50 to 100 mol %.

With respect to the silver halide emulsion for use in the X-ray light-sensitive material, a silver chlorobromide and/or silver chloride tabular grain emulsion is preferred as an environmental correspondence system. Known examples of the silver chlorobromide and/or silver chloride tabular emulsion include, in terms of the crystal habit, an emulsion mainly having (111) faces and an emulsion mainly having (100) faces. The (111) silver chlorobromide tabular emulsion is described and known in JP-B-64-8325, JP-A-64-8326, JP-A-62-111936 and JP-A-62-163046.

The (100) silver chlorobromide tabular emulsion is described in JP-A-51-88017, JP-B-64-8323 and European Patent 0,534,395A1. However, techniques described in JP-A-7-120857, and JP-A-128767 are preferred because of narrow grain size distribution and high sensitivity, and a combination of (100) silver chloride tabular grains with ascorbic acid development described in JP-A-7-168323 is also a preferred embodiment.

By using a tabular silver halide emulsion, stability of photographic properties can be further increased in the running processing according to the present invention. Further, the coated silver amount can be reduced and accordingly, the load in the fixing step and the drying step is lightened, whereby rapid processing can be achieved.

The tabular silver halide emulsion is described in Cugnac and Chateau, *Evolution of the Morphology of Silver Bromide Crystals during Physical Ripening*, Vol. 33, No. 2, pp. 121–125, Science et Industrie Photography (1962), Duffin, *Photographic Emulsion Chemistry*, The Focal Press, New York, pp. 66–72 (1966), A. P. H. Tribvlli and W. F. Smith, *Photographic Journal*, Vol. 80, page 285 (1940), and can be easily prepared by referring to the methods described in JP-A-58-127921, JP-A-58-113927 and JP-A-58-113928.

The silver halide emulsion of the present invention is preferably subjected to chemical sensitization. The chemical sensitization may be performed using a known method such as sulfur sensitization, selenium sensitization, tellurium sensitization or noble metal sensitization, and these sensitization methods may be used individually or in combination. When these sensitization methods are used in combination, a combination of sulfur sensitization and gold sensitization, a combination of sulfur sensitization, selenium sensitization and gold sensitization, and a combination of sulfur sensitization, tellurium sensitization and gold sensitization are preferred.

The sulfur sensitization for use in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The addition amount of the sulfur sensitizer varies depending upon various conditions such as the pH and the temperature at the time of chemical ripening and the size of silver halide grains, however, it is generally from $10^{-7}$ to $10^{-2}$ mol, preferably from $10^{-5}$ to $10^{-3}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-25832, JP-A-4-109240 and JP-A-4-324855, and among these, particularly preferred are the compounds represented by formulae (VIII) and (IX) of JP-A-4-324855.

The tellurium sensitizer for use in the present invention is a compound of forming silver telluride presumed to be a sensitization speck, on the surface or in the inside of a silver halide grain. The formation rate of silver telluride in a silver halide emulsion can be examined by a method described in JP-A-5-313284.

Specific examples of the tellurium sensitizer include the compounds described in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-4-271341, JP-A-4-333043, JP-A-5-303157, *J. Chem. Soc. Chem. Commun.*, 635 (1980), ibid., 1102 (1979), ibid., 645 (1979), *J. Chem. Soc. Perkin. Trans.*, 1, 2191 (1980), S. Patai (compiler), *The Chemistry of Organic Selenium and Tellurium Compounds*, Vol. 1 (1986), and ibid., Vol. 2 (1987). The compounds represented by formulae (II), (III) and (IV) of JP-A-5-313284 are particularly preferred.

The use amount of the selenium sensitizer or the tellurium sensitizer for use in the present invention varies depending upon silver halide grains used or chemical ripening conditions, however, it is generally on the order of from $10^{-8}$ to $10^{-2}$ mol, preferably from $10^{-7}$ to $10^{-3}$ mol, per mol of silver halide. The conditions for chemical sensitization in the present invention are not particularly restricted, however, the pH is from 5 to 8, the pAg is from 6 to 11, preferably from 7 to 10, and the temperature is from 40 to 95° C., preferably from 45 to 85° C.

Examples of the noble metal sensitizer for use in the present invention include gold, platinum, palladium and iridium, and gold sensitization is particularly preferred. Specific examples of the gold sensitizer for use in the present invention include chloroauric acid, potassium chlorate, potassium aurithiocyanate and gold sulfide, and the gold sensitizer is used in an amount of about from $10^{-7}$ to $10^{-2}$ mol per mol of silver halide.

In the silver halide emulsion for use in the present invention, a cadmium salt, a sulfite, a lead salt or a thallium salt may be present together during formation or physical ripening of silver halide grains.

In the present invention, reduction sensitization may be used. Examples of the reduction sensitizer which can be used include stannous salt, amines, formamidinesulfinic acid and silane compounds.

To the silver halide emulsion of the present invention, a thiosulfonic acid compound may be added according to the method described in European Unexamined Patent Publication (EP) 293917.

In the light-sensitive material for use in the present invention, one kind of silver halide emulsion may be used or two or more kinds of sirver halide emulsions (for example, different in the average grain size, different in the halogen composition, different in the crystal habit, or different in chemical sensitization conditions) may be used in combination.

In the present invention, the silver halide emulsion particularly suitable for a dot-to-dot work light-sensitive material comprises silver halide having a silver chloride content of 90 mol % or more, preferably 95 mol % or more, more specifically, silver chlorobromide or silver chloroiodobromide containing from 0 to 10 mol % of silver bromide. If the proportion of silver bromide or silver iodide increases, the safelight safety in a bright room may be worsened or the γ value may be disadvantageously lowered.

The silver halide emulsion for use in the dot-to-dot work light-sensitive material of the present invention preferably contains a transition metal complex and examples of the transition metal include Rh, Ru, Re, Os, Ir and Cr.

Examples of the ligand include a nitrosyl cross-linked ligand, a thionitrosyl cross-linked ligand, a halide ligand (e.g., fluoride, chloride, bromide, iodide, iodide), a cyanide ligand, a cyanate ligand, a thiocyanate ligand, a selenocyanate ligand, a tellurocyanate ligand, an acid ligand and an aquo ligand. When an aquo ligand is present, it preferably occupies one or more of the ligands.

More specifically, the rhodium atom may be incorporated by forming it into a metal salt in any form, such as a single salt or a complex salt, and adding the salt at the time of preparation of grains.

Examples of the rhodium salt include rhodium monochloride, rhodium dichloride, rhodium trichloride and ammonium hexachlororhodate, and preferred are a halogen complex compound of water-soluble trivalent rhodium, such as hexachlororhodium(III) acid and a salt thereof (e.g., ammonium salt, sodium salt, potassium salt).

The addition amount of the water-soluble rhodate is from $1.0\times10^{-6}$ to $1.0\times10^{-3}$, preferably $1.0\times10^{-5}$ to $1.0\times10^{-3}$, more preferably from $5.0\times10^{-5}$ to $5.0\times10^{-4}$ mol, per mol of silver halide.

The following transition metal complexes are also preferred.

1. $[Ru(NO)Cl_5]^{-2}$
2. $[Ru(NO)_2Cl_4]^{-1}$
3. $[Ru(NO)(H_2O)Cl_4]^{-1}$
4. $[Rh(NO)Cl_5]^{-2}$
5. $[Re(NO)CN_5]^{-2}$
6. $[Re(NO)ClCN_4]^{-2}$
7. $[Rh(NO)_2Cl_4]^{-1}$
8. $[Rh(NO)(H_2O)Cl_4]^{-1}$
9. $[Ru(NO)CN_5]^{-2}$
10. $[Ru(NO)Br_5]^{-2}$
11. $[Rh(NS)Cl_5]^{-2}$
12. $[Os(NO)Cl_5]^{-2}$

13. $[Cr(NO)Cl_5]^{-4}$
14. $[Re(NO)Cl_5]^{-1}$
15. $[Os(NS)Cl_4(TeCN)]^{-2}$
16. $[Ru(NS)I_5]^{-2}$
17. $[Re(NS)Cl_4(SeCN)]^{-2}$
18. $[Os(NS)Cl(SCN)_4]^{-2}$
19. $[Ir(NO)Cl_5]^{-2}$

The spectral sensitizing dye for use in the present invention is not particularly restricted.

The addition amount of the sensitizing dye for use in the present invention varies depending upon the shape or size of silver halide grains, however, it is generally from $4\times10^{-6}$ to $8\times10^{-3}$ mol per mol of silver halide. For example, when the silver halide grain size is from 0.2 to 1.3 $\mu$m, the addition amount is preferably from $2\times10^{-7}$ to $3.5\times10^{-6}$ mol, more preferably from $6.5\times10^{-7}$ to $2.0\times10^{-6}$ mol, per 1 $m^2$ of the surface area of silver halide grains.

The light-sensitive silver halide emulsion of the present invention may be spectrally sensitized by a sensitizing dye to blue light, green light, red light or infrared light, each having a relatively long wavelength. Examples of the sensitizing dye which can be used include a cyanine dye, a merocyanine dye, a complex cyanine dye, a complex merocyanine dye, a holopolar cyanine dye, a styryl dye, a hemicyanine dye, an oxonol dye and a hemioxonol dye.

Useful sensitizing dyes for use in the present invention are described, for example, in *Research Disclosure*, Item 17643, IV-A, page 23 (December 1978), ibid., Item 1831-X, page 437 (August 1978), and publications cited therein. In particular, sensitizing dyes having spectral sensitivity suitable for spectral characteristics of various scanner light sources can be advantageously selected.

For example, A) for an argon laser light source, simple merocyanines described in JP-A-60-162247, JP-A-2-48653, U.S. Pat. No. 2,161,331, West German Patent 936,071 and JP-A-5-11389, B) for a helium-neon laser light source, trinuclear cyanine dyes described in JP-A-50-62425, JP-A-54-18726 and JP-A-59-102229, and merocyanine dyes described in JP-A-7-287338, C) for an LED light source and a red semiconductor laser, thiacarbocyanines described in JP-B-48-42172, JP-B-51-9609, JP-B-55-39818, JP-A-62-284343 and JP-A-2-105135, and D) for an infrared semiconductor laser light source, tricarbocyanines described in JP-A-59-191032 and JP-A-60-80841, and dicarbocyanines containing a 4-quinoline nucleus described in JP-A-59-192242 and JP-A-3-67242, formulae (IIIa) and (IIIb), may be advantageously selected.

These sensitizing dyes may be used individually or in combination, and the combination of sensitizing dyes is often used for the purpose of supersensitization. In combination with the sensitizing dye, a dye which itself has no spectral sensitization effect or a material which absorbs substantially no visible light, but exhibits supersensitization may be incorporated into the emulsion.

Useful sensitizing dyes, combinations of dyes which exhibit supersensitization, and materials which show supersensitization are described in *Research Disclosure*, Vol. 176, 17643, page 23, Item IV-J (December 1978).

For the argon laser light source, specifically, Dyes S1-1 to S1-13 described in JP-A-8-278584 are particularly preferably used.

For the helium-neon light source, the sensitizing dyes represented by formula (I) of JP-A-6-75322, page 8, line 1 from the bottom to page 13, line 4 are particularly preferred. Further, the sensitizing dyes represented by formula (I) of JP-A-6-75322 are also preferably used. Specifically, Dyes S2-1 to S2-10 described in JP-A-8-278584 are preferably used. More preferred are Compounds I-1 to I-34 represented by formula (I) of JP-A-7-287338.

For the LED light source and the infrared semiconductor laser, specifically, Dyes S3-1 to S3-8 described in JP-A-8-287584 are particularly preferred.

For the infrared semiconductor laser light source, specifically$_1$ Dyes S4-1 to S4-9 described in JP-A-8-278584 are particularly preferred.

For the white light source in camera work, sensitizing dyes represented by formula (IV) of JP-7-36139 (from page 20, line 14 to page 22, line 23) are preferably used. Specifically, Dyes S5-1 to S5-20 described in JP-A-8-278584 are particularly preferred.

The ultrahigh contrast light-sensitive material for graphic arts used in the processing of the present invention preferably contains a hydrazine nucleating agent and more preferably, additionally contains a nucleation accelerator.

The hydrazine nucleating agent is preferably the compound represented by the following formula (D):

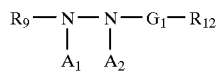

(D)

wherein $R_9$ represents an aliphatic group, an aromatic group or a heterocyclic group, $R_{12}$ represents a hydrogen atom, an alkyl group, an aryl group, a heterocyclic group, an alkoxy group, an aryloxy group, an amino group or a hydrazino group, $G_1$ represents a —CO— group, an —$SO_2$— group, an —SO— group,

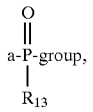

a —CO—CO— group, a thiocarbonyl group or an iminomethylene group, $A_1$ and $A_2$ both represents a hydrogen atom, or one of them represents a hydrogen atom and the other represents a substituted or unsubstituted alkylsulfonyl group, a substituted or unsubstituted arylsulfonyl group or a substituted or unsubstituted acyl group, and $R_{13}$ is selected from the same groups defined for $R_{12}$ and may be different from $R_{12}$.

In formula (D), the aliphatic group represented by $R_9$ is preferably a substituted or unsubstituted, linear, branched or cyclic alkyl group having from 1 to 30 carbon atoms, an alkenyl group or an alkynyl group.

In formula (D), the aromatic group represented by $R_g$ is a monocyclic or bicyclic aryl group and examples thereof include a benzene ring and a naphthalene ring. The heterocyclic group represented by $R_g$ is a monocyclic or bicyclic, aromatic or non-aromatic heterocyclic ring or may form a heteroaryl group by condensing to an aryl group. Examples of the ring include a pyridine ring, a pyrimidine ring, an imidazole ring, a pyrazole ring, a quinoline ring, an isoquinoline ring, a benzimidazole ring, a thiazole ring and a benzothiazole ring.

$R_9$ is particularly preferably an aryl group.

$R_9$ may be substituted and representative examples of the substituent include an alkyl group (including an active methine group), an alkenyl group, an alkynyl group, an aryl group, a group containing a heterocyclic ring, a group containing a heterocyclic ring having a quaternized nitrogen atom (e.g., pyridinio group), a hydroxy group, an alkoxy group (including a group having a repeating unit of an ethylene oxy group or a propylene oxy group), an aryloxy group, an acyloxy group, an acyl group, an alkoxycarbonyl group, an aryloxycarbonyl group, a carbamoyl group, a urethane group, a carboxyl group, an imido group, an amino group, a carbonamido group, a sulfonamido group, a ureido group, a thioureido group, a sulfamoylamino group, a semicarbazide group, a thiosemicarbazide group, a group having a hydrazino group, a group having a quaternary ammonium group, an alkylthio group, an arylthio group, a heterocyclic thio group, a mercapto group, an alkylsulfonyl group, an arylsulfonyl group, an alkylsulfinyl group, an arylsulfinyl group, a sulfo group, a sulfamoyl group, an acylsulfamoyl group, an alkylsulfonylureido group, an arylsulfonylureido group, an alkylsulfonylcarbamoyl group, an arylsulfonylcarbamoyl group, a halogen atom, a cyano group, a nitro group, a group having a phosphoramide or phosphoric ester structure, a group having an acylurea structure, a group containing a selenium atom or a tellurium atom, and a group having a tertiary sulfonium structure or a quaternary sulfonium structure.

Preferred examples of the substituent include a linear, branched or cyclic alkyl group (preferably having from 1 to 20 carbon atoms), an aralkyl group (preferably having from 1 to 20 carbon atoms), an alkoxy group (preferably having from 1 to 20 carbon atoms), a substituted amino group (preferably a substituted amino group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), a carbamoyl group (preferably having from 1 to 30 carbon atoms and a phosphoamide group (preferably having from 1 to 30 carbon atoms).

In formula (D), the alkyl group represented by $R_{12}$ is preferably an alkyl group having from 1 to 10 carbon atoms and the aryl group is preferably a monocyclic or bicyclic aryl group containing, for example, a benzene ring.

The heterocyclic group is a 5- or 6-membered ring compound containing at least one of a nitrogen atom, an oxygen atom and a sulfur atom, and examples thereof include an imidazolyl group, a pyrazolyl group, a triazolyl group, a tetrazolyl group, a pyridyl group, a pyridinio group, a quinolinio group and a quinolinyl group. A pyridyl group or a pyridinio group are particularly preferred.

The alkoxy group is preferably an alkoxy group having from 1 to 8 carbon atoms, the aryloxy group is preferably a monocyclic aryloxy group and the amino group is preferably an unsubstituted amino group, an alkylamino group having from 1 to 10 carbon atoms, an arylamino group or a heterocyclic amino group.

$R_{12}$ may be substituted and preferred substituents include those exemplified as the substituent on $R_9$.

Among the groups represented by $R_{12}$, when $G_1$ is a —CO— group, a hydrogen atom, an alkyl group (e.g., methyl, trifluoromethyl, difluoromethyl, 2-carboxytetrafluoroethyl, pyridiniomethyl, 3-hydroxypropyl, 3-methanesulfonamidopropyl, phenylsulfonyl), an aralkyl group (e.g., o-hydroxybenzyl), an aryl group (e.g., phenyl, 3,5-dichlorophenyl, o-methanesulfonamidophenyl, o-carbamoylphenyl, 4-cyanophenyl, 2-hydroxymethylphenyl) are preferred, and a hydrogen atom and an alkyl group are more preferred.

When $G_1$ is an —$SO_2$— group, $R_{12}$ is preferably an alkyl group (e.g., methyl), an aralkyl group (e.g., o-hydroxybenzyl), an aryl group (e.g., phenyl) or a substituted amino group (e.g., dimethylamino).

When $G_1$ is a —COCO— group, $R_{12}$ is preferably an alkoxy group, an aryloxy group or an amino group, more preferably a substituted amino group (e.g., 2,2,6,6-tetramethylpiperidin-4-ylamino, propylamino, anilino, o-hydroxyanilino, 5-benzo-triazolylamino, N-benzyl-3-pyridinioamino).

$R_{12}$ may be a group which induces a cyclization reaction by cleaving the $G_1$-$R_{12}$ moiety from the remaining molecule to form a cyclic structure containing atoms in the $G_1R_{12}$ moiety and examples thereof include those described, for example, in JP-A-63-29751.

$A_1$ and $A_2$ each is a hydrogen atom, an alkyl- or arylsulfonyl group having 20 or less carbon atoms (preferably, a phenylsulfonyl group or a phenylsulfonyl group substituted so that the sum of Hammett's substituent constants becomes −0.5 or more) or an acyl group having 20 or less carbon atoms (preferably a benzoyl group, a benzoyl group substituted so that the sum of Hammett's substituent constants becomes −0.5 or more, or a linear, branched or cyclic, unsubstituted or substituted aliphatic acyl group (examples of the substituent includes a halogen atom, an ether group, a sulfonamido group, a carbonamido group, a hydroxyl group, a carboxy group, a sulfone group)).

$A_1$ and $A_2$ are most preferably a hydrogen atom.

In formula (D), the substituent of $R_9$ or $R_{12}$ may be further substituted by a substituent and preferred examples of the substituent include those exemplified as the substituent on $R_9$g. Furthermore, the substituent may be substituted in multiple ways such that the substituent, the substituent of the substituent, the substituent of the substituent of the substituent . . . is substituted and examples of the substituents also include those exemplified as the substituent on $R_9$.

In formula (D), $R_9$ or $R_{12}$ may be one having integrated thereinto a ballast group or polymer commonly used in the immobile photographic additives such as a coupler. The ballast group is a group having 8 or more carbon atoms and relatively inactive to the photographic properties and examples thereof include an alkyl group, an aralkyl group, an alkoxy group, a phenyl group, an alkylphenyl group, a phenoxy group and an alkylphenoxy group. Examples of the polymer include those described in JP-A-1-100530.

In formula (D), $R_9$ or $R_{12}$ may be one having integrated thereinto an adsorptive group to silver halide. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercapto heterocyclic group and a triazole group. The absorptive group to silver halide may be formed into a precursor and examples of the precursor include the group described in JP-A-2-285344.

In formula (D), $R_9$ or $R_{12}$ may contain a plurality of hydrazino groups as a substituent. At this time, the compound represented by formula (D) is a polymer with respect to the hydrazino group and specific examples thereof include the compounds described in JP-A-64-86134, JP-A-4-16938 and JP-A-5-197091.

The hydrazine derivative particularly preferred in the present invention is described below.

$R_9$ is preferably a substituted phenyl group and preferably substituted via a sulfonamido group, an acylamino group, a ureido group or a carbamoyl group by a ballast group, an absorptive group to silver halide, a group containing a quaternary ammonio group, a group having a repeating unit of an ethyleneoxy group, an alkylthio group, an arylthio group, a heterocyclic thio group, a group capable of dissociation in an alkaline development processing solution (e.g., carboxyl, sulfo, acylsulfamoyl) or a hydrazino group capable of forming a polymer. $R_9$ is most preferably a phenyl group substituted by a benzenesulfonamido group and the benzenesulfonamido group preferably has any one of the above-described groups as a substituent.

$G_1$ is preferably a —CO— group or a —COCO— group, more preferably a —CO— group. When $G_1$ is a —CO— group, $R_{12}$ is preferably a hydrogen atom, a substituted alkyl group or a substituted aryl group (the substituent is preferably an electron withdrawing group or an o-hydroxymethyl group), and when $G_1$ is a —COCO— group, $R_{12}$ is particularly preferably a substituted amino group.

Specific examples of the compound represented by formula (D) are shown below, however, the present invention is by no means limited to the following compounds.

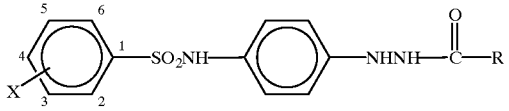
| | X = | R = —H | R = —$C_2F_4$—COOH (or —$C_2F_4$—$COO^{\ominus}K^{\oplus}$) | R = 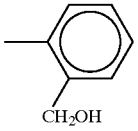 | R = 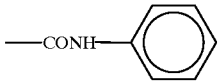 |
|---|---|---|---|---|---|
| D-1 | 3-$NHCOC_9H_{19}$(n) | 1a | 1b | 1c | 1d |
| D-2 | 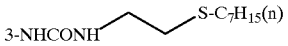 | 2a | 2b | 2c | 2d |
| D-3 | 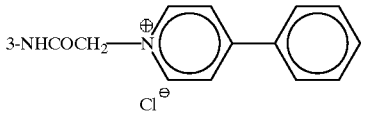 | 3a | 3b | 3c | 3d |
| D-4 | 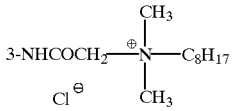 | 4a | 4b | 4c | 4d |
| D-5 | 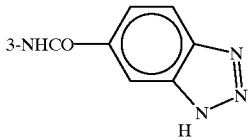 | 5a | 5b | 5c | 5d |
| D-6 | 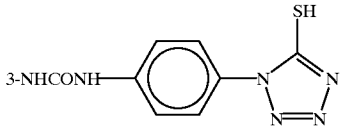 | 6a | 6b | 6c | 6d |
| D-7 | 2,4-$(CH_3)_2$-3-$SC_2H_4$—$(OC_2H_4)_4$—$OC_8H_{17}$ | 7a | 7b | 7c | 7d |

-continued
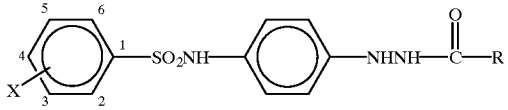
| X = | | R = —H | —$CF_2H$ | —$CH_2$—N⊕ (Cl⊖) | —CONH— NH |
|---|---|---|---|---|---|
| D-8 | 3-$CONHCH_2CH(C_2H_5)C_4H_9$ | 8a | 8e | 8f | 8g |
| D-9 | 6-$OCH_3$-3-$C_5H_{11}$(t) | 9a | 9e | 9f | 9g |
| D-10 | 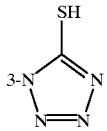 | 10a | 10e | 10f | 10g |
| D-11 | 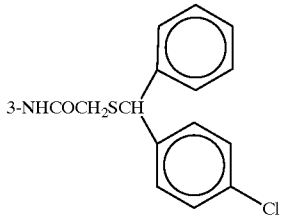 | 11a | 11e | 11f | 11g |
| D-12 | 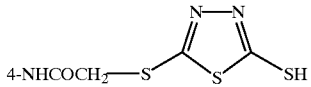 | 12a | 12e | 13f | 13g |
| D-13 | 3-$NHCOCH(CH_2COOH)C_8H_{17}$ | 13a | 13e | 13f | 13g |

-continued
| | | | | | |
|---|---|---|---|---|---|
| D-14 | 3,5—(—CONHCH$_2$CH(C$_2$H$_5$)—C$_4$H$_9$)$_2$ | 14a | 14e | 14f | 14g |
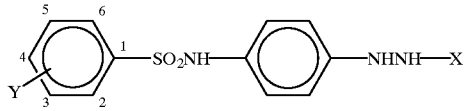
| Y = | X = —CHO | —COCF$_3$ | —SO$_2$CH$_3$ | —P(=O)(OC$_2$H$_5$)$_2$ |
|---|---|---|---|---|
| D-15 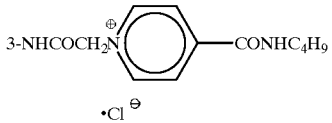 | 15a | 15h | 15i | 15j |
| D-16 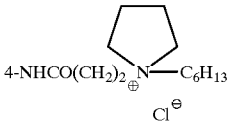 | 16a | 16h | 16i | 16j |
| D-17 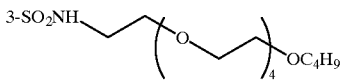 | 17a | 17h | 17i | 17j |
| D-18 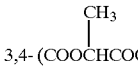 | 18a | 18h | 18i | 18j |
| D-19 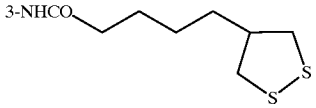 | 19a | 19h | 19i | 19j |
| D-20 3-NHSO$_2$NH—C$_8$H$_{17}$ | 20a | 20h | 20i | 20j |

-continued
| | | | | | |
|---|---|---|---|---|---|
| D-21 | 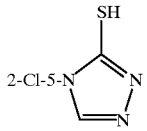 | 21a | 21h | 21i | 21j |
| | | R = | | | |
| | | —H | —$CF_2H$ | 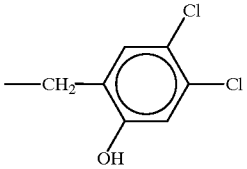 | —$CONHC_3H_7$ |
| D-22 | 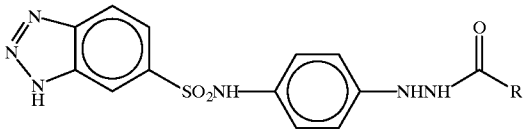 | 22a | 22e | 22k | 22l |
| D-23 | 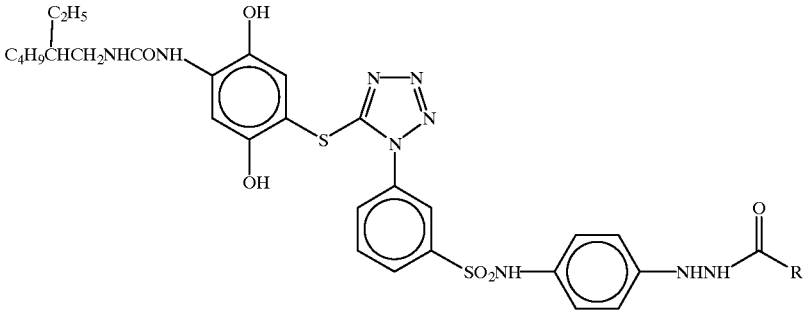 | 23a | 23e | 23k | 23l |

-continued
| | | | | |
|---|---|---|---|---|
| D-24 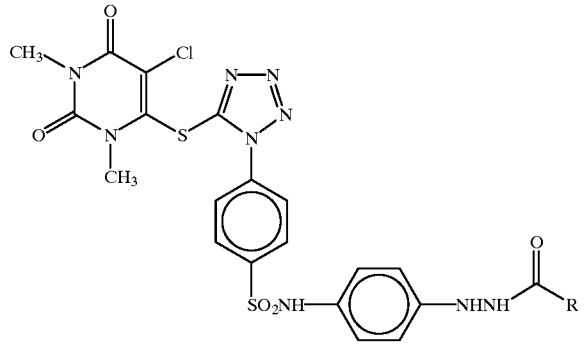 | 24a | 24e | 24k | 24l |
| D-25 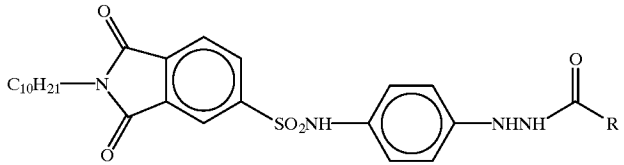 | 25a | 25e | 25k | 25l |
| D-26 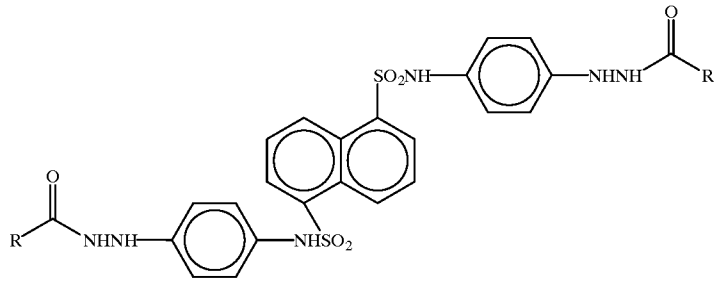 | 26a | 26e | 26k | 26l |

-continued
| | | | | | |
|---|---|---|---|---|---|
| D-27 | 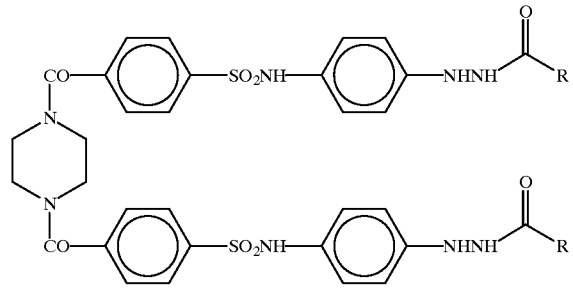 | 27a | 27e | 27k | 27l |
| D-28 | 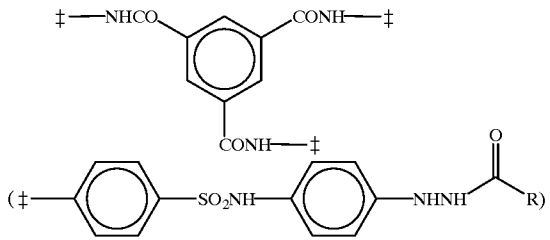 | 28a | 28e | 28k | 28l |
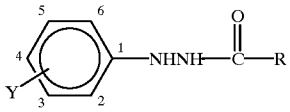
| | R = | | | |
|---|---|---|---|---|
| Y = | —H | —$CH_2OCH_3$ | 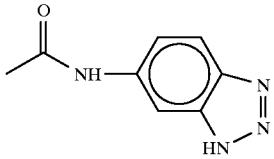 | 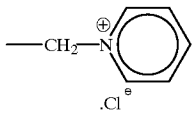 |
| D-29 | 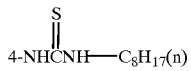 | 29a | 29m | 29n | 29f |

-continued
| | | | | | |
|---|---|---|---|---|---|
| D-30 | 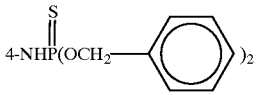 | 30a | 30m | 30n | 30f |
| D-31 | 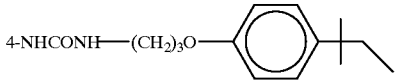 | 31a | 31m | 31n | 31f |
| D-32 | 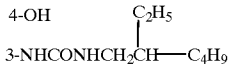 | 32a | 32m | 32n | 32f |
| D-33 | 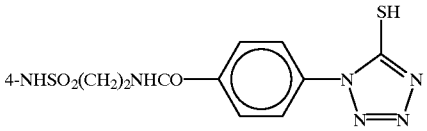 | 33a | 33m | 33n | 33f |
| D-34 | 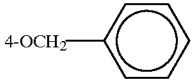 | 34a | 34m | 34n | 34f |
| D-35 | 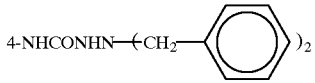 | 35a | 35m | 35n | 35f |

-continued
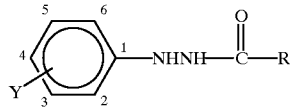
| | Y = | R = —H | —$C_3H_6$—COOH | —$CONHCH_3$ | 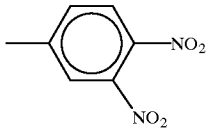 |
|---|---|---|---|---|---|
| D-36 | 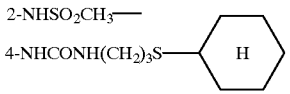 | 36a | 36o | 36p | 36q |
| D-37 | 2-$OCH_3$-4-$NHSO_2C_{12}H_{25}$ | 37a | 37o | 37p | 37q |
| D-38 | 3-$NHCOC_{11}H_{23}$-4-$NHSO_2CF_3$ | 38a | 38o | 38p | 38q |
| D-39 | 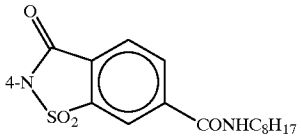 | 39a | 39o | 39p | 39q |
| D-40 | 4-$OCO(CH_2)_2COOC_6H_{13}$ | 40a | 40o | 40p | 40q |
| D-41 | 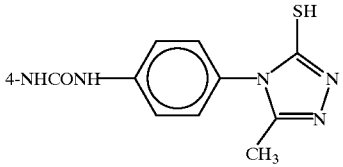 | 41a | 41o | 41p | 41q |
| D-42 | 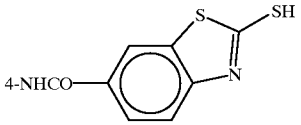 | 42a | 42o | 42p | 42q |

-continued
D-43
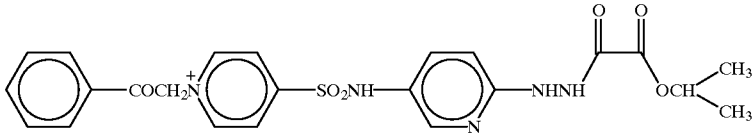
D-44
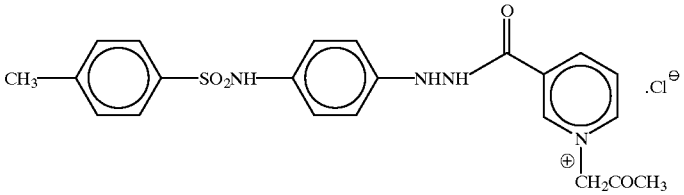
D-45
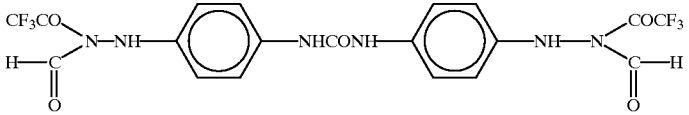
D-46
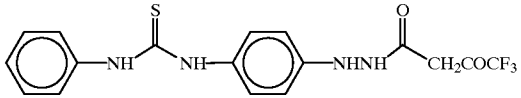
D-47
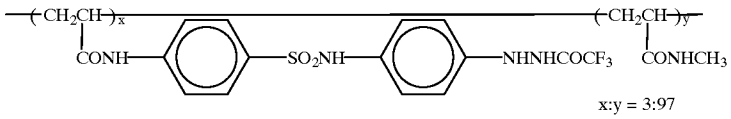
x:y = 3:97
average molecular weighy: about 100,000
D-48
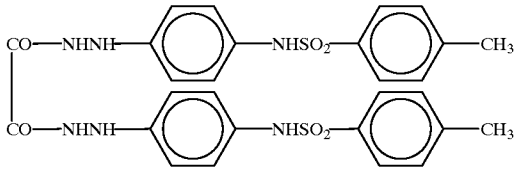

-continued
D-49
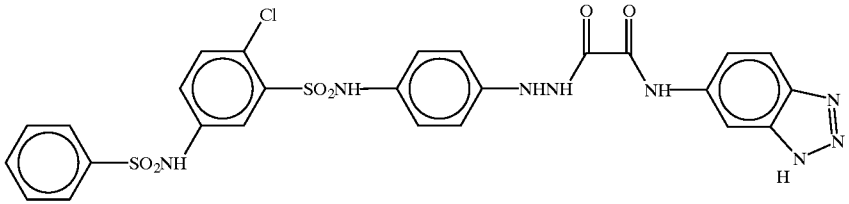
D-50
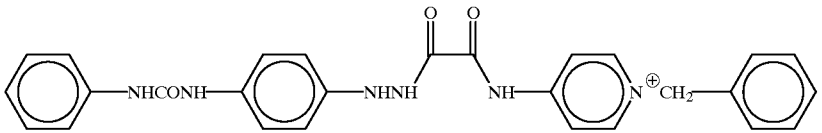
D-51
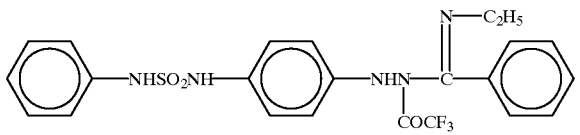
D-52
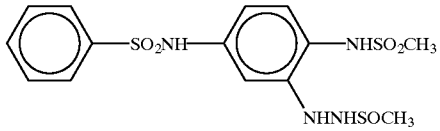
D-53
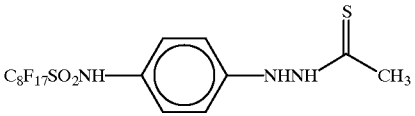

Among the hydrazine derivatives, those represented by formula (X) are more preferred.

$$A—(B)_m \quad (X)$$

wherein A represents a linking group, B represents a group represented by the following formula (X-2), m represents an integer of from 2 to 6, and a plurality of B groups linked to A may be the same or different.

$$—(L_2—Ar_2)_n—L_1—Ar_1—N(A_{10})N(A_{20})—G_1—R_{10} \quad (X\text{-}2)$$

wherein $Ar_1$ and $Ar_2$ each represents an aromatic group or an aromatic heterocyclic group, $L_1$ and $L_2$ each represents a linking group, n represents 0 or 1, $R_{10}$ represents a hydrogen atom or a block group, $G_1$ represents —CO—, —COCO—, —C═S—, —$SO_2$—, —SO—, —PO($R_{30}$)— (wherein $R_{30}$ is selected from the same range as the groups defined for $R_{10}$ and may be different from $R_{10}$), a thiocarbonyl group or an iminomethylene group. $A_{10}$ and $R_{20}$ both represent a hydrogen atom, or one of them represents a hydrogen atom and the other represents a substituted or unsubstituted alkylsulfonyl group, a substituted or unsubstituted arylsulfonyl group, or a substituted or unsubstituted acyl group.

In formula (X-2), the aromatic group represented by $Ar_1$ or $Ar_2$ is a monocyclic or condensed ring arylene group, and examples thereof include a phenylene group and a naphthylene group. The aromatic heterocyclic group represented by $Ar_1$ or $Ar_2$ is a monocyclic or condensed ring aromatic heterocyclic group, and examples thereof include a pyridine ring, a pyrimidine ring, an imidazole ring, a pyrazole ring, a quinoline ring, an isoquinoline ring, a benzimidazole ring, a thiazole ring and a benzothiazole ring.

$Ar_1$ and $Ar_2$ each is preferably an aromatic group, more preferably a phenylene group.

$Ar_1$ and $Ar_2$ each may be substituted and representative examples of the substituent include a halogen atom (e.g., fluorine, chlorine, bromine, iodine), an alkyl group (e.g., aralkyl, cycloalkyl, active methine), an alkenyl group, an alkynyl group, an aryl group, a heterocyclic group, a heterocyclic group containing a quaternized nitrogen atom (e.g., pyridinio), an acyl group, an alkoxycarbonyl group, an aryloxycarbonyl group, a carbamoyl group, a carboxy group and a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing an ethyleneoxy group or propylene oxy group as a repeating unit), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or heterocyclic)amino group, an N-substituted nitrogen-containing heterocyclic group, an acylamino group, a sulfonamido group, a ureido group, a thioureido group, an imido group, an (alkoxy or aryloxy)carbonylamino group, a sulfamoylamino group, a semicarbazide group, a thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group, an (alkyl, aryl or heterocyclic)thio group, an (alkyl or aryl)-sulfonyl group, an (alkyl or aryl)sulfinyl group, a sulfo group and a salt thereof, a sulfamoyl group, an acylsulfamoyl group, a sulfonylsulfamoyl group and a salt thereof, a group containing a phosphoric acid amido or phosphoric ester structure.

These substituents each may further be substituted by the above-described substituent.

Preferred examples of the substituent on $Ar_1$ or $Ar_2$ include an alkyl group having from 1 to 20 carbon atoms, an aralkyl group, a heterocyclic group, a substituted amino group, an acylamino group, a sulfonamido group, a ureido group, a sulfamoylamino group, an imido group, a thioureido group, a phosphoric acid amide group, a hydroxy group, an alkoxy group, an aryloxy group, an acyloxy group, an acyl group, an alkoxycarbonyl group, an aryloxycarbonyl group, a carbamoyl group, a carboxyl group (including a salt thereof), an (alkyl, aryl or heterocyclic)thio group, a sulfo group (including a salt thereof), a sulfamoyl group, a halogen atom, a cyano group and a nitro group.

$Ar_1$ is preferably an unsubstituted phenylene group.

In formula (X-2), $R_{10}$ represents a hydrogen atom or a block group, and the block group specifically represents an alkyl group, an alkenyl group, an alkynyl group, an aryl group, a heterocyclic group, an alkoxy group, an aryloxy group, an amino group or a hydrazino group.

The alkyl group represented by $R_{10}$ is preferably an alkyl group having from 1 to 10 carbon atoms, and examples thereof include a methyl group, a trifluoromethyl group, a difluromethyl group, a 2-carboxytetrafluoroethyl group, a pyridiniomethyl group, a difluoromethoxymethyl group, a difluorocarboxymethyl group, a 3-hydroxypropyl group, a 3-methanesulfonamidopropyl group, a phenylsulfonylmethyl group and an o-hydroxybenzyl group. The alkenyl group is preferably an alkenyl group having from 1 to 10 carbon atoms, and examples thereof include a vinyl group, a 2-ethoxycarbonylvinyl group and a 2-trifluoro-2-methoxycarbonylvinyl group. The alkynyl group is preferably an alkynyl group having from 1 to 10 carbon atoms, and examples thereof include an ethynyl group and 2-methoxycarbonylethynyl group. The aryl group is preferably a monocyclic or condensed ring aryl group, more preferably an aryl group containing a benzene ring, and examples thereof include a phenyl group, a 3,5-dichlorophenyl group, a 2-methanesulfonamidophenyl group, a 2-carbamoylphenyl group, a 4-cyanophenyl group, a 2-hydroxymethylphenyl group.

The heterocyclic group is preferably a 5- or 6-membered, saturated or unsaturated, monocyclic or condensed ring heterocyclic group containing at least one of nitrogen, oxygen and sulfur atoms, and examples thereof include a morpholino group, a piperidino group (N-substituted), an imidazolyl group, an indazolyl group (e.g., 4-nitroindazolyl), a pyrazolyl group, a triazolyl group, a benzoimidazolyl group, a tetrazolyl group, a pyridyl group, a pyridinio group (e.g., N-methyl-3-pyridinio group), a quinolinio group and a quinolyl group. Of these, preferred are piperidino group, a pyridyl group, a pyridinio group and an indazolyl group.

The alkoxy group is preferably an alkoxy group having from 1 to 8 carbon atoms, and examples thereof include a methoxy group, a 2-hydroxyethoxy group and a benzyloxy group. The aryloxy group is preferably a phenoxy group, and the amino group is preferably an unsubstituted amino group, or an alkylamino group, an arylamino group or a saturated or unsaturated heterocyclic amino group (including a nitrogen-containing heterocyclic group containing a quaternized nitrogen atom) each having from 1 to 10 carbon atoms. Examples of the amino group include 2,2,6,6-tetramethylpiperidin-4-ylamino group, a propylamino group, a 2-hydroxyethylamino group, an anilino group, an o-hydroxyanilino group, a 5-benzotriazolylamino group and an N-benzyl-3-pyridinioamino group. The hydrazino group is preferably a substituted or unsubstituted hydrazino group or a substituted or unsubstituted phenylhydrazino group (e.g., 4-benzenesulfonamidophenylhydrazino).

The group represented by $R_{10}$ may be substituted and preferred examples of the substituent are the same as those described as the substituent on $Ar_1$ or $Ar_2$.

In formula (X-2), $R_{10}$ may be one which excites cyclization reaction of cleaving the $G_1$-$R_{10}$ moiety from the remaining molecule to produce a cyclic structure containing the atoms in the -$G_1$-$R_{10}$ moiety, and examples thereof include those described, for example, in JP-A-63-29751.

The group represented by $R_{10}$ is preferably, when $G_1$ is —CO—, a hydrogen atom, an alkyl group, an alkenyl group, an alkenyl group, an aryl group or a heterocyclic group, more preferably a hydrogen atom, an alkyl group or a substituted aryl group (the substituent is preferably an electron-withdrawing group or an o-hydroxymethyl group), and most preferably an alkyl group.

When $G_1$ is —COCO—, the group is preferably an alkoxy group, an aryloxy group or an amino group, more preferably a substituted amino group such as an alkylamino group, an arylamino group and a saturated or unsaturated heterocyclic amino group.

When $G_1$ is —$SO_2$—, $R_{10}$ is preferably an alkyl group, an aryl group or a substituted amino group.

In formula (X-2), $G_1$ is preferably —CO— or —COCO—, more preferably —CO—.

In formula (X-2), $A_{10}$ and $A_{20}$ each is a hydrogen atom, an alkyl or arylsulfonyl group having 20 or less carbon atoms (preferably a phenylsulfonyl group or a phenylsulfonyl group substituted such that the sum of Hammett's substituent constants is −0.5 or more), an acyl group having 20 or less carbon atoms (preferably a benzoyl group, a benzoyl group substituted such that the sum of the Hammett's substituent constants is −0.5 or more, or a linear, branched or cyclic, substituted or unsubstituted aliphatic acyl group (in which examples of the substituent include a halogen atom, an ether group, a sulfonamido group, a carbonamido group, a hydroxy group, a carboxy group and a sulfo group).

$A_{10}$ and $A_{20}$ is most preferably a hydrogen atom.

The hydrazine derivative represented by formula (X) may have integrated thereinto an adsorptive group capable of adsorbing to silver halide. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-a-63-234244, JP-A-63-234245 and JP-A-63-234246, such as an alkylthio group, an arylthio group, a thiourea group, a thioamido group, a mercaptoheterocyclic group and a triazole group. The adsorptive group to silver halide may be formed into a precursor and examples of the precursor include the groups described in JP-A-2-285344.

In formula (X-2), the linking group represented by $L_1$ or $L_2$ is a divalent or trivalent linking group comprising —O—, —S—, —N($R_N$)— (wherein $R_N$ represents a hydrogen atom, an alkyl group, an aryl group or a single bond), —CO—, —C(=S)—, —$SO_2$—, —SO—, —P=O— or an alkylene group individually or in combination, or a single bond. Specific examples of the group comprising a combination of the above-described groups include —CON($R_N$)—, —$SO_2$N($R_N$)—, —COO—, —N($R_N$)CON($R_N$)—, —N($R_N$)CSN($R_N$)—, —N($R_N$)$SO_2$N($R_N$)—, —$SO_2$N($R_N$)CO—, —$SO_2$N($R_N$)CON($R_N$)—, —N($R_N$)COCON($R_N$)—, —CON($R_N$)CO—, —S—(alkylene)—CONH—, —O—(alkylene)—CONH— and —O—(alkylene)—NHCO—. These groups each may be linked at either the right or left site.

In formula (X-2), when the linking group represented by $L_1$ or $L_2$ contains a trivalent or greater valent group, $L_1$ may link two or more of the group represented by —$Ar_1$—N($A_{20}$)N($A_{20}$)-$G_1$-$R_{10}$ in formula (X-2), and $L_2$ may link two or more of the group represented by —$Ar_2$—$L_1$—$Ar_1$-N($A_{10}$)N($A_{20}$)-$G_1$-$R_{10}$ in formula (X-2). Specific examples of the trivalent or greater valent linking group contained in $L_1$ or $L_2$ include an amino group and a branched alkylene group.

In formula (X-2), $L_1$ is preferably —$SO_2$NH—, —NHCONH—, —NHC(=S)NH—, —OH, —S—, —N($R_N$)— or an alkylene group (particularly an active methine group), more preferably —$SO_2$NH—.

$L_2$ is preferably —CO—, —NH—, —$SO_2$—, —CON($R_N$)—, —$SO_2$N($R_N$)—, —COO—, —N($R_N$)CON($R_N$)— or —N($R_N$)CSN($R_N$)—.

In formula (X), the linking group represented by A is a di-, tri-, tetra-, penta- or hexavalent linking group capable of linking from 2 to 6 groups represented by B, comprising —O—, —S—, —N($R_N$')— (wherein $R_N$' represents a hydrogen atom, an alkyl group, an aryl group or a single bond), —$N^+$($R_N$')$_2$— (wherein two $R_N$' groups may be the same or different, or may be combined to have a cyclic form), —CO—, —C(=S)—, —$SO_2$—, —SO—, —P=O—, an alkylene group, a cycloalkylene group, an alkenylene group, an alkynylene group, an arylene group or a heterocyclic group individually or in combination, or a single bond.

The arylene group represents a phenylene group or a condensed polycyclic aromatic group. The heterocyclic group represents a saturated or unsaturated heterocyclic group or may be a nitrogen-containing heterocyclic group containing a quaternized nitrogen atom such as pyridinio group, and specific examples thereof include a 1,4-dioxane ring, a piperazine ring, a 2,4,8,10-tetraoxaspiro-(5,5) undecane ring, a biphthalimide ring, a 1,2,4,5-benzenetetracarboxydiimide ring, a triazine ring and a pyridine ring. Examples of the cycloalkylene group include those containing a cyclopropane ring, a cyclohexane ring, a bicyclohexane ring, a decalin ring or a norbornene ring.

In formula (X), the linking group represented by A may be substituted and examples of the substituent are the same as those described as examples of the substituent on $Ar_1$ or $Ar_2$ in formula (X-2).

In formula (X-2), when n is 0, the linking group represented by A preferably contains at least one of di- to tetra-valent alkylene groups, di- to hexa-valent arylene groups, di- to hexa-valent saturated or unsaturated heterocyclic groups, and di- to hexa-valent nitrogen-containing heterocyclic groups containing a quaternized nitrogen atom such as a pyridinio group, more preferably contains a benzene ring, a naphthalene ring or a heterocyclic group.

Specific examples thereof include the linking groups containing a group described below or a partial structure thereof: benzene ring, naphthalene ring, biphenyl, diphenylmethane, diphenylether, 1,4-diphenoxybenzene, diphenylsulfide, diphenylsulfone, triphenylene ring, benzophenone, anthraquinone, imidazole ring, triazine ring, piperazine ring, pyridinio group or dipyridyl (e.g., bipyridinium group). Of these, those containing a benzene ring, a naphthalene ring, biphenyl, a diphenyl ether, diphenyl sulfide, diphenylsulfone or a triazine ring are preferred, and those containing a benzene ring, a naphthalene ring, biphenyl or a diphenyl ether are most preferred.

In formula (X-2), when n is 1, the linking group represented by A is preferably a group comprising —O—, —S—, —N($R_N$')—(wherein $R_N$' represents a hydrogen atom, an alkyl group, an aryl group or a single bond), —$N^+$($R_N$')$_2$—(wherein two $R_N$' groups may be the same or different, or may be combined to have a cyclic form), —CO—, —C(=S)—, —$SO_2$—, —P=O—, an alkylene group, a cycloalkylene group, an arylene group or a heterocyclic group individually or in combination, or a single bond, more preferably a group comprising —O—, —S—, —N ($R_N$')—, —$N^+$($R_N$')$_2$—, —CO—, —C(=S)—, —$SO_2$—, an alkylene group, a cycloalkylene group or a heterocyclic group individually or in combination, or a single bond.

In formula (X), m represents an integer of from 2 to 6, preferably 2, 3 or 4, more preferably 2 or 3.

Specific examples of the hydrazine derivative represented by formula (X) are shown below, however, the present invention is by no means limited to these compounds.

| | | R = | | | |
|---|---|---|---|---|---|
| | | —H | —$CF_3$ | 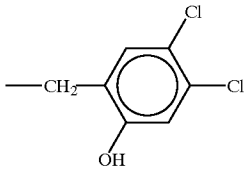 | 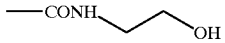 |
| 1 | 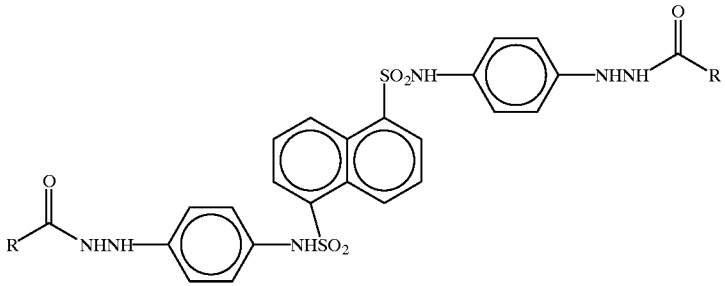 | 1a' | 1c' | 1k' | 1l' |
| 2 | 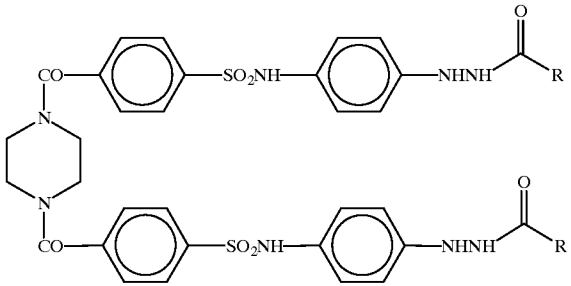 | 2a' | 2c' | 2k' | 2l' |

-continued
| | | | | |
|---|---|---|---|---|
| 3 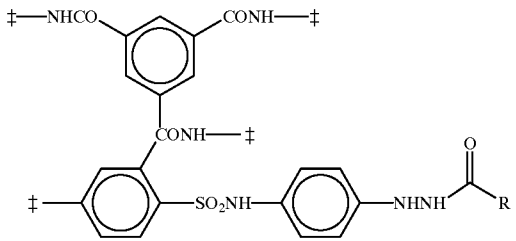 | 3a' | 3c' | 3k' | 3l' |
B = 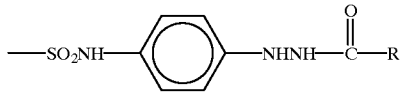
| | R = | | | |
|---|---|---|---|---|
| | —H | —$CF_2H$ | —$CF_3$ | —$CF_2SCH_3$ |
| 4 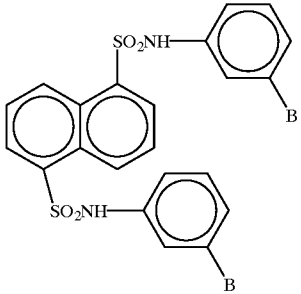 | 4a' | 4e' | 4c' | 4r' |

-continued
| | | | | | |
|---|---|---|---|---|---|
| 5 | 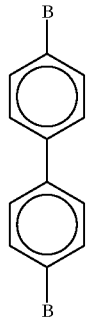 | 5a' | 5e' | 5c' | 5r' |
| 6 | 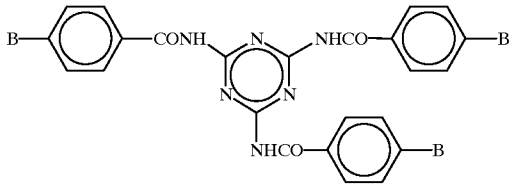 | 6a' | 6e' | 6c' | 6r' |
| 7 | 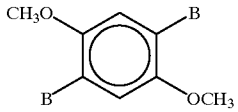 | 7a' | 7e' | 7c' | 7r' |
| 8 | 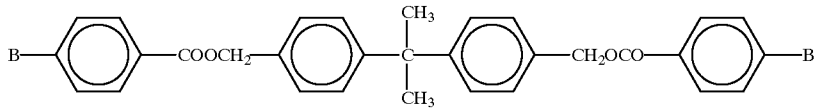 | 8a' | 8e' | 8c' | 8r' |

-continued
B = 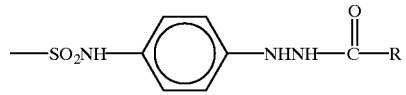
| | R = | | | |
|---|---|---|---|---|
| | —H | —$CF_2H$ | —$CONHCH_3$ | —$CF_2OCH_3$ |
| 9 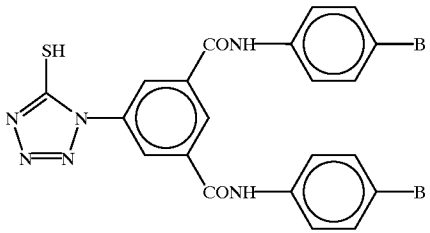 | 9a' | 9e' | 9p' | 9b' |
| 10 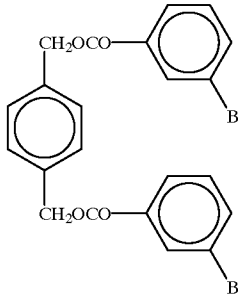 | 10a' | 10e' | 10p' | 10b' |

-continued
| | | R = | | | |
|---|---|---|---|---|---|
| | | —H | —$CF_2H$ | 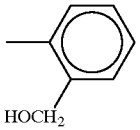 | 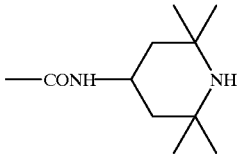 |
| 11 | 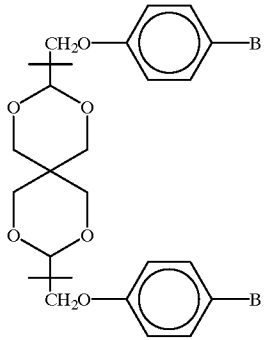 | 11a' | 11e' | 11f' | 11g' |

-continued
B' = 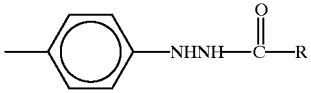
| | | R = | | | |
|---|---|---|---|---|---|
| | | —H | —$CF_2H$ | 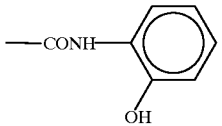 | 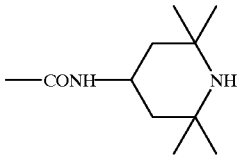 |
| 12 | 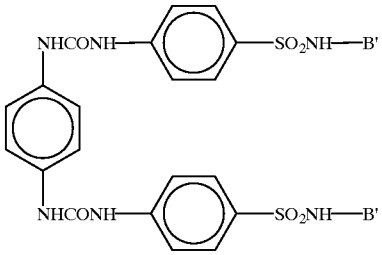 | 12a' | 12e' | 12s' | 12g' |
| 13 | 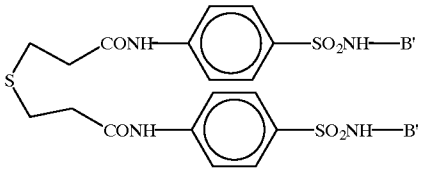 | 13a' | 13e' | 13s' | 13g' |
| 14 | 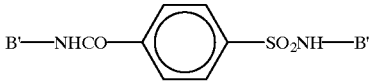 | 14a' | 14e' | 14s' | 14g' |

-continued
15
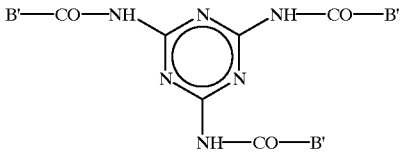
15a' 15e' 15s' 15g'
B' =
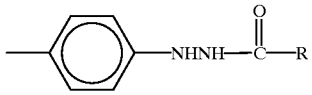
R =
—H —$CF_2H$
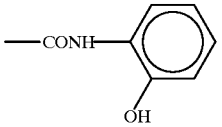
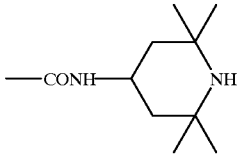
16
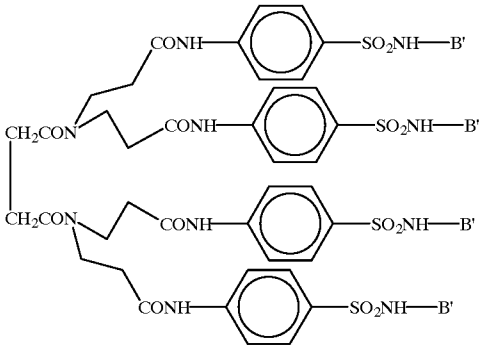
16a' 16e' 16s' 16g'

-continued
17 17a' 17e' 17s' 17g'
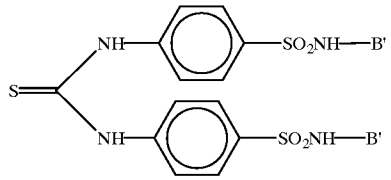
18'
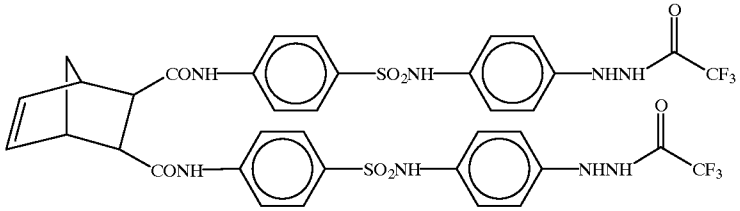
,
19'
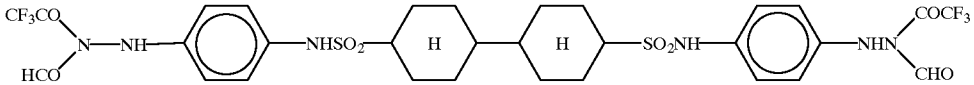
,
20'
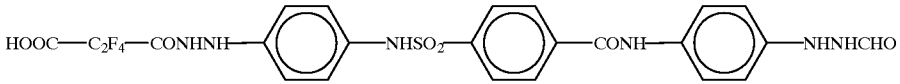
,
21'
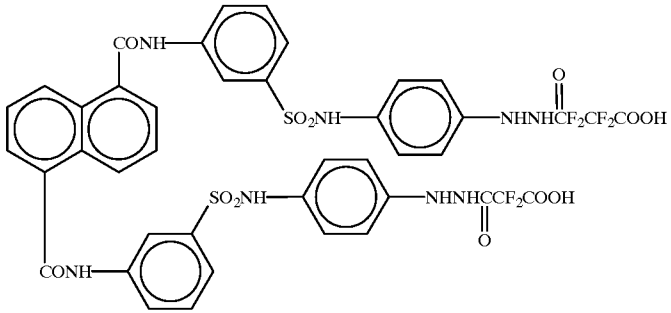
, -continued
22'
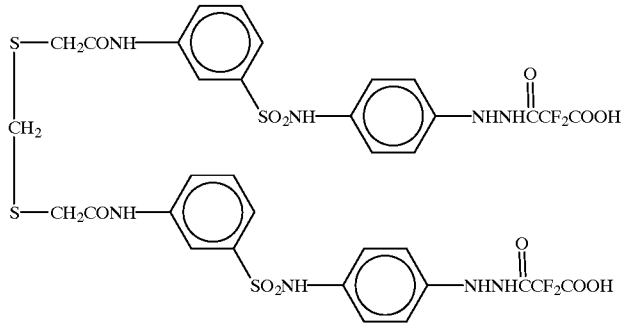
B' = 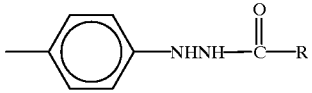
R =
—H —$CF_3$ —$CF_2H$
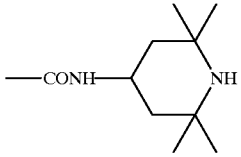
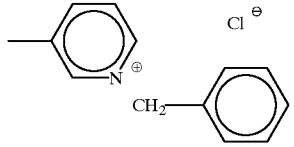
23
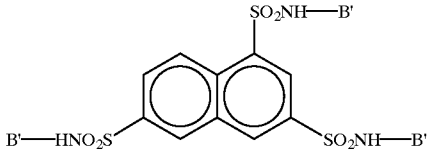
23a' 23c' 23e' 23g' 23d'

-continued
| | | | | | | |
|---|---|---|---|---|---|---|
| 24 | 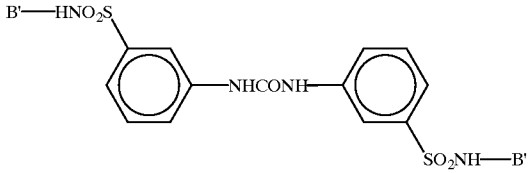 | 24a' | 24c' | 24e' | 24g' | 24d' |
| 25 | 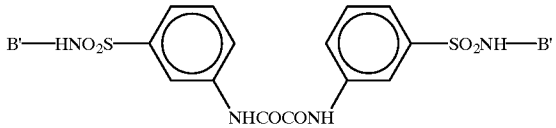 | 25a' | 25c' | 25e' | 25g' | 25d' |
| 26 | 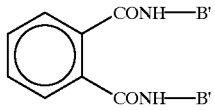 | 26a' | 26c' | 26e' | 26g' | 26d' |
B' = 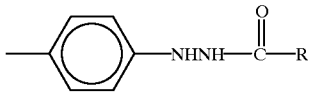
| R = | | | | | |
|---|---|---|---|---|---|
| —H | —$CF_3$ | —$CF_2H$ | —$CONHCH_3$ | 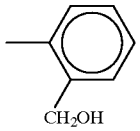 | —$C_2F_4COOH$ |
| | | | | | | |
|---|---|---|---|---|---|---|
| 27 | 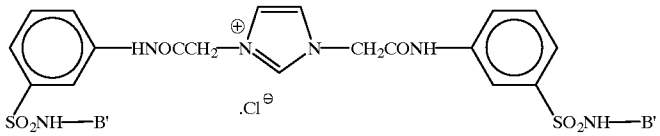 | 27a' | 27c' | 27e' | 27p' | 27f' | 27t' |

-continued
28
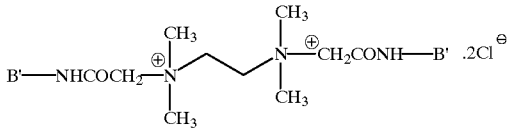
28a' 28c' 28e' 28p' 28f' 28t'
29
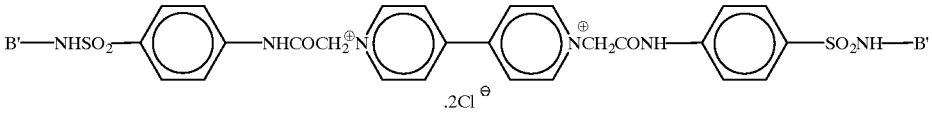
29a' 29c' 29e' 29p' 29f' 29t'
30
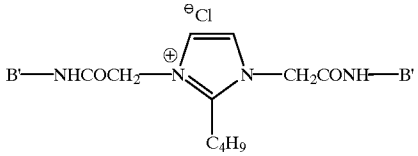
30a' 30c' 30e' 30p' 30f' 30t'
B' =
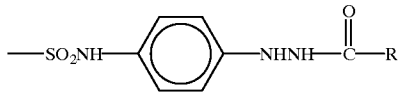
| R = | |
|---|---|
| —H | —$CF_3$ |
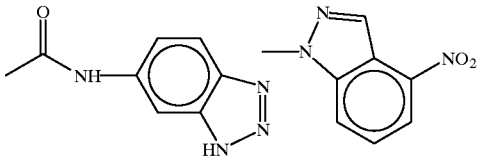
31
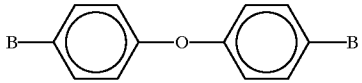
31a' 31c' 31h' 31m'

-continued
| | | | | | |
|---|---|---|---|---|---|
| 32 | 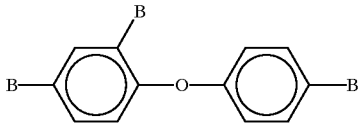 | 32a' | 32c' | 32h' | 32m' |
| 33 | 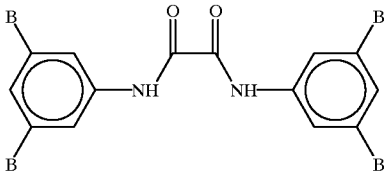 | 33a' | 33c' | 33h' | 33m' |
| 34 | 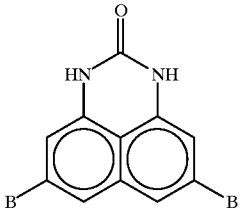 | 34a' | 34c' | 34h' | 34m' |
| 35 | 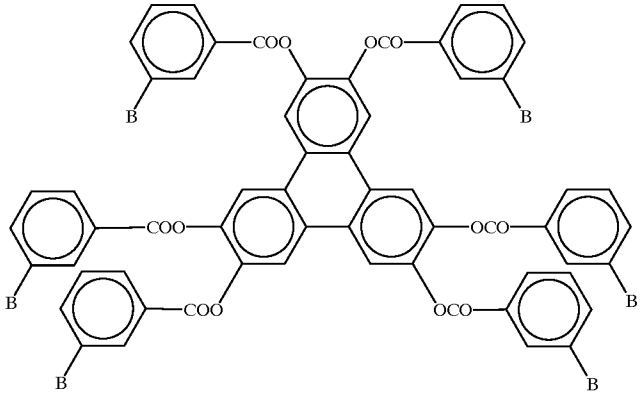 | 35a' | 35c' | 35h' | 35m' |

-continued
| | | R = | | | |
|---|---|---|---|---|---|
| | | —H | 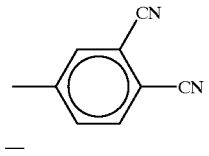 | —$CH_2OCH_3$ | 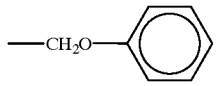 |
| 36 | 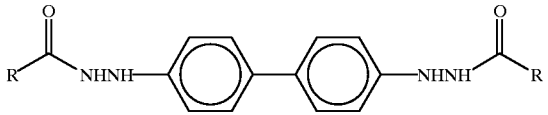 | 36a' | 36n' | 36i' | 36j' |
| 37 | 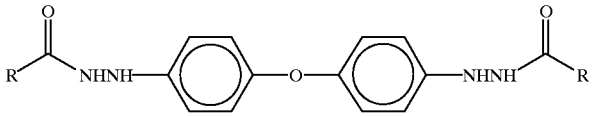 | 37a' | 37n' | 37i' | 37j' |
| 38 | 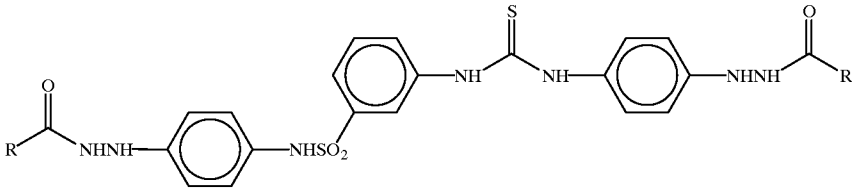 | 38a' | 38n' | 38i' | 38j' |
| 39 | 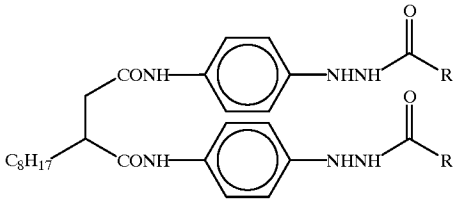 | 39a' | 39n' | 39i' | 39j' |
| 40 | | 40a' | 40n' | 40i' | 40j' |

-continued
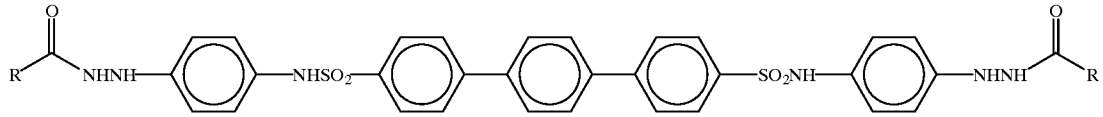
| | R = | | | |
|---|---|---|---|---|
| | —H | —CONH—<br>OH<br>OH | —CF3 | —<br>N<br>N<br>NO2 |
| 41 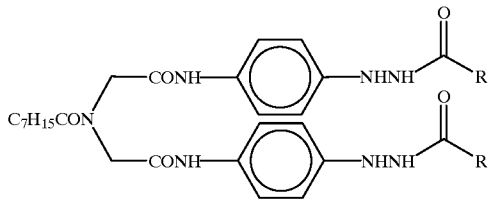 | 41a' | 41q' | 41c' | 41u' |
| 42 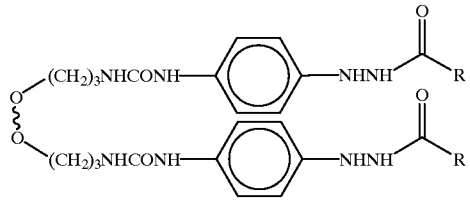 | 42a' | 42q' | 42c' | 42u' |

-continued

| | | | | |
|---|---|---|---|---|
| 43 | 43a' | 43q' | 43c' | 43u' |
| 44 | 44a' | 44q' | 44c' | 44u' |
| 45 | 45a' | 45q' | 45c' | 45u' |

In addition to the above-described compounds, the following hydrazine derivatives may be preferably used as the hydrazine derivative for use in the present invention. The hydrazine derivative for use in the present invention may also be synthesized by various methods described in the patent publications described blow.

The compound represented by Chemcal Formula 1 of JP-B-6-77138, specifically, the compounds described at pages 3 and 4; the compound represented by formula (I) of JP-B-6-93082, specifically, Compounds 1 to 38 described at pages 8 to 18; the compounds represented by formulae (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40; the compounds represented by formulae (1) and (2) of JP-A-6-239520, specifically, Compounds 1-1) to 1-17) and 2-1) described at pages 5 to 7; the compounds represented by Chemcal Formula 2 and Chemcal Formula 3 of JP-A-6-313936, specifically the compounds described at pages 6 to 19; the compound represented by Chemcal Formula 1 of JP-A-6-313951, specifically, the compounds described at pages 3 to 5; the compound represented by formula (I) of JP-A-7-5610, specifically, Compounds I-1 to I-38 described at pages 5 to 10; the compound represented by formula (II) of JP-A-7-77783, specifically, Compounds II-1 to II-102 described at pages 10 to 27; the compounds represented by formulae (H) and (Ha) of JP-A-7-104426, specifically, Compounds H-1 to H-44 described at pages 8 to 15; the compound having in the vicinity of the hydrazine group an anionic group or an anionic group capable of forming an intramolecular hydrogen bonding with the hydrogen atom of the hydrazine.

The hydrazine derivative of the present invention may be dissolved in an appropriate water-miscible organic solvent, such as alcohols (e.g., methanol, ethanol, propanol, fluorinated alcohol), ketones (e.g., acetone, methyl ethyl ketone), dimethylformamide, dimethylsulfoxide or methyl cellosolve.

Also, it may be dissolved by a well-known emulsion-dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion. Further, a hydrazine derivative powder may be dispersed in water using a ball mill, a colloid mill or an ultrasonic wave according to a method known as a solid dispersion method.

The hydrazine nucleating agent of the present invention may be added to any of silver halide emulsion layers and other hydrophilic colloid layers on the silver halide emulsion layer side of the support, however, it is preferably added to a silver halide emulsion layer or a hydrophilic colloid layer adjacent thereto.

The addition amount of the nucleating agent of the present invention is preferably from $1\times10^{-6}$ to $5\times10^{-2}$ mol, more preferably from $1\times10^{-5}$ to $5\times10^{-3}$ mol, most preferably from $2\times10^{-5}$ to $5\times10^{-3}$ mol, per mol of silver halide.

The silver halide photographic light-sensitive material preferably contains in the silver halide emulsion layer or other hydrophilic colloid layer at least one of onium salt compounds represented by the following formulae (E), (F), (G) and (H), and amino compounds, as a nucleation accelerator.

(E)

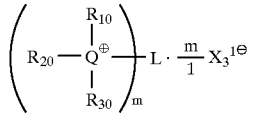

wherein $R_{10}$, $R_{20}$ and $R_{30}$ each represents an alkyl group, a cycloalkyl group, an aralkyl group, an aryl group, an alkenyl group, a cycloalkenyl group, an alkynyl group or a heterocyclic group, Q represents a nitrogen atom or a phosphorus atom, L represents an m-valent organic group which bonds to $Q^+$ through the carbon atom thereof (wherein m represents an integer of from 1 to 4), and $X_3^{1-}$ represents a monovalent counter anion (wherein 1 represents an integer of from 1 to 3), provided that when $R_{10}$, $R_{20}$, $R_{30}$ or L has an anion group as a substituent thereof and forms an inner salt with $Q^+$, $X_3^{1-}$ is not necessary;

(F)

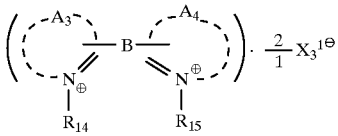

(G)

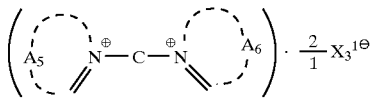

wherein $A_3$, $A_4$, $A_5$ and $A_6$ each represents an organic residue for completing a substituted or unsubstituted, unsaturated heterocyclic ring containing a quaternized nitrogen atom, B and C each represents a divalent linking group constituted by alkylene, arylene, alkenylene, alkynylene, —$SO_2$—, —SO—, —O—, —S—, —N($R_N$)—, —C═O—, —P═O— or a combination thereof (wherein $R_N$ represents a hydrogen atom, an alkyl group, an aryl group or an aralkyl group), $R_{14}$ and $R_{15}$ each represents an alkyl group or an aralkyl group, $X_3^{1-}$ represents a monovalent counter anion (wherein 1 represents an integer of from 1 to 3), provided that when an inner salt can be formed, $X_3^{1-}$ is not necessary;

(H)

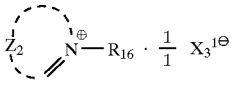

wherein $Z_2$ represents an organic residue for completing a substituted or unsubstituted, unsaturated heterocyclic ring containing a quaternized nitrogen atom, $R_{16}$ represents an alkyl group or an aralkyl group, $X_3^{1-}$ represents a monovalent counter anion (wherein 1 represents an integer of from 1 to 3), provided that when an inner salt can be formed, $X_3^{1-}$ is not necessary.

The onium compounds represented by formulae (E), (F), (G) and (H) for use in the present invention are described in detail below.

Formula (E) is described in detail below.

(E)

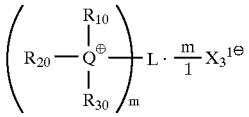

wherein $R_{10}$, $R_{20}$ and $R_{30}$ each represents an alkyl group, a cycloalkyl group, an aralkyl group, an aryl group, an alkenyl group, a cycloalkenyl group, an alkynyl group or a heterocyclic group, and these groups each further may have a substituent. Q represents a phosphorus atom or a nitrogen atom.

L represents an m-valent organic group which bonds to $Q^+$ through the carbon atom thereof (wherein m represents an integer of from 1 to 4). $X_3^{1-}$ represents a monovalent counter anion (wherein 1 represents an integer of from 1 to 3), provided that when $R_{10}$, $R_{20}$, $R_{30}$ or L has an anion group as a substituent thereof and forms an inner salt with $Q^+$, $X_3^{1-}$ is not necessary.

Examples of the group represented by $R_{10}$, $R_{20}$ or $R_{30}$ include a linear or branched alkyl group such as a methyl group, an ethyl group, a propyl group, an isopropyl group, a butyl group, an isobutyl group, a sec-butyl group, a tert-butyl group, an octyl group, a 2-ethylhexyl group, a dodecyl group, a hexadecyl group and an octadecyl group; an aralkyl group such as substituted or unsubstituted benzyl group; a cycloalkyl group such as a cyclopropyl group, a cyclopentyl group and a cyclohexyl group; an aryl group such as a phenyl group, a naphthyl group and a phenathryl group; an alkenyl group such as an allyl group, a vinyl group and a 5-hexenyl group; a cycloalkenyl group such as a cyclopentenyl group and a cyclohexenyl group; an alkynyl group such as a phenylethynyl group; and a heterocyclic group such as a pyridyl group, a quinolyl group, a furyl group, an imidazolyl group, a thiazolyl group, a thiadiazolyl group, a benzotriazolyl group, a benzothiazolyl group, a morphoryl group, a pyrimidyl group and a pyrolidyl group.

Examples of the substituent substituted on these groups include the groups represented by $R_{10}$, $R_{20}$ and $R_{30}$ and in addition, a halogen atom such as a fluorine atom, a chlorine atom, a bromine atom and an iodine atom, a nitro group, an alkylamino group, an arylamino group, an alkoxy group, an aryloxy group, an alkylthio group, an arylthio group, a carbonamido group, a carbamoyl group, a sulfonamido group, a sulfamoyl group, a hydroxyl group, a sulfoxy group, a sulfonyl group, a carboxyl group (including a carboxylate), a sulfonic acid group (including a sulfonate), a cyano group, an oxycarbonyl group-and an acyl group.

Examples of the group represented by L include, when m represents 1, the groups described for $R_{10}$, $R_{20}$ and $R_{30}$, and when m represents an integer of 2 or greater, additionally include a polymethylene group such as a trimethylene group, a tetramethylene group, a hexamethylene group, a pentamethylene group, an octamethylene group and a dodecamethylene group; an arylene group such as a phenylene group, a biphenylene group and a naphthylene group, a polyvalent alkylene group such as a trimethylene methyl group and a tetramethylene methyl group; and a polyvalent arylene group such as a phenylen-1,3,5-toluoyl group and a phenylen-1,2,4,5-tetrayl group.

Examples of the counter anion represented by $X_3^{1-}$ include a halogen ion such as chlorine ion, bromine ion and iodine ion, a carboxylate ion such as acetate ion, oxalate ion, fumarate ion and benzoate ion, a sulfonate ion such as p-toluene sulfonate, methane sulfonate, butane sulfonate and benzene sulfonate, a sulfate ion, a perchlorate ion, a carbonate ion and a nitrate ion.

In formula (E), $R_{10}$, $R_{20}$ and $R_{30}$ each is preferably a group having 20 or less carbon atoms. When Q represents a phosphorus atom, $R_{10}$, $R_{20}$ and $R_{30}$ each is more preferably an aryl group having 15 or less carbon atoms, and when Q represents a nitrogen atom, $R_{10}$, $R_{20}$ and $R_{30}$ each is more preferably an alkyl, aralkyl or aryl group having a total carbon number of 15 or less. m is preferably 1 or 2. When m represents 1, L is preferably a group having 20 or less carbon atoms, more preferably an alkyl, aralkyl or aryl group having 15 or less carbon atoms, and when m represents 2, the divalent organic group represented by L is preferably an alkylene group, an arylene group, an aralkylene group or a group formed by combining such a group with a —CO— group, an —O— group, an —N($R_N$')— group (wherein $R_N$' represents a hydrogen atom or a group having the same meaning as $R_{10}$, $R_{20}$ or $R_{30}$, and when a plurality of the $R_N$' groups are present within the molecule, they may be the same or different or may be combined with each other), an —S— group, an —SO— group or an —$SO_2$— group. When m represents 2, L is preferably a divalent group having a total carbon number of 20 or less, which bonds to $Q^+$ through the carbon atom thereof. When m represents an integer of 2 or greater, $R_{10}$, $R_{20}$ and $R_{30}$ each is present in plurality within the molecule and the plurality of the $R_{10}$, $R_{20}$ or $R_{30}$ groups may be the same or different.

The counter anion represented by $X_3^{1-}$ is preferably a halogen ion, a carboxylate ion, a sulfonate ion or a sulfate ion, and 1 is preferably 1 or 2.

Many of the compounds represented by formula (E) of the present invention are known and commercially available as a reagent. Examples of the general synthesis method include, when Q is a phosphorus atom, a method of reacting a phosphinic acid with an alkylating agent such as a halogenated alkyl or a sulfonic ester and a method of exchanging the counter anion of a phosphonium salt by a usual method, and when Q is a nitrogen atom, a method of reacting a primary, secondary or tertiary amino compound with an alkylating agent such as a halogenated alkyl or a sulfonic ester.

Specific examples of the compound represented by (E) are shown below, however, the present invention is by no means limited to the following compounds.

E-1

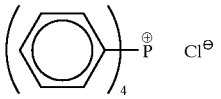

-continued
E-2
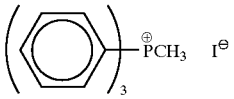
E-3
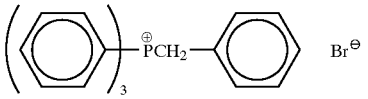
E-4
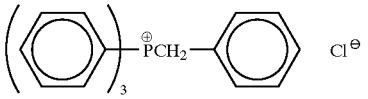
E-5
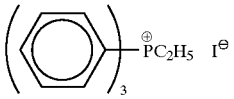
E-6
$(n\text{-}C_4H_9)_4\overset{\oplus}{P}$ $Br^{\ominus}$
E-7
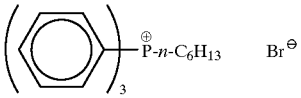
E-8
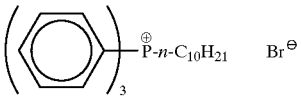
E-9
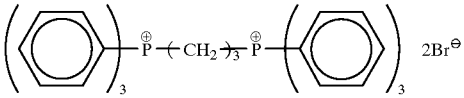
E-10
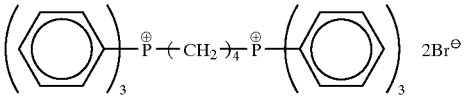
E-11
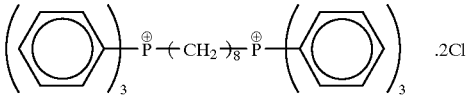
E-12
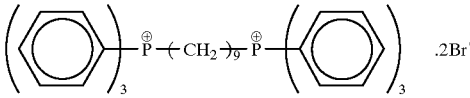
E-13
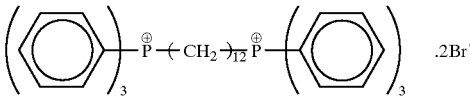
E-14
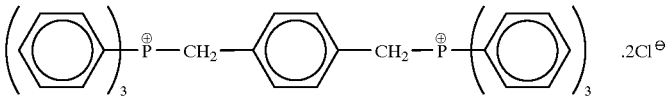
E-15
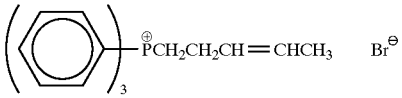

-continued
E-16
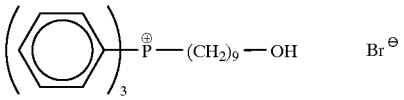
E-17
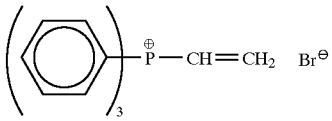
E-18
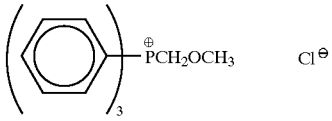
E-19
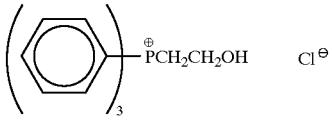
E-20
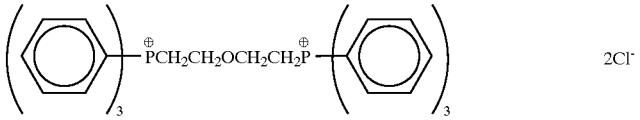
E-21
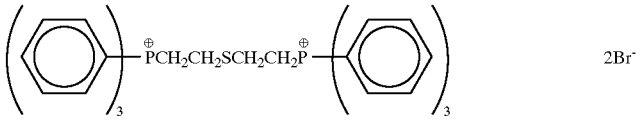
E-22
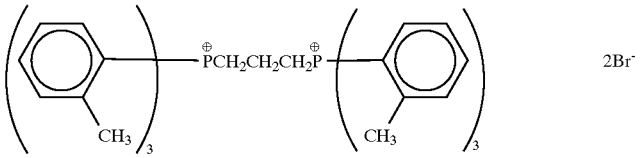
E-23
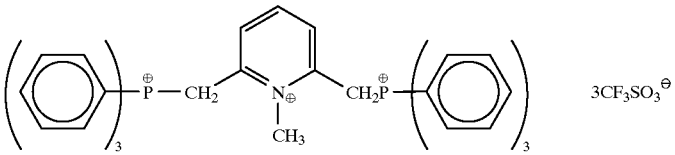
E-24
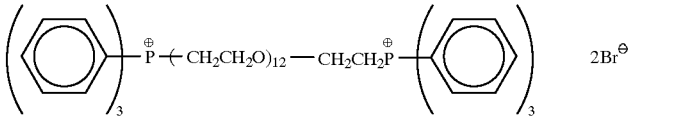
E-25
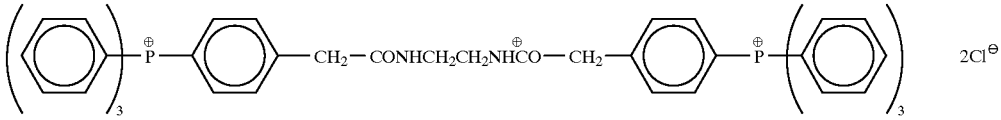
E-26
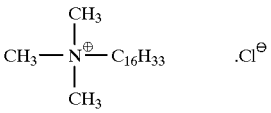

-continued
E-27
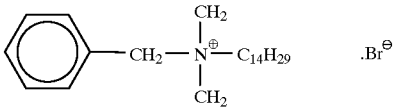
E-28
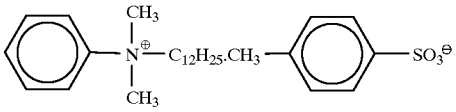
E-29
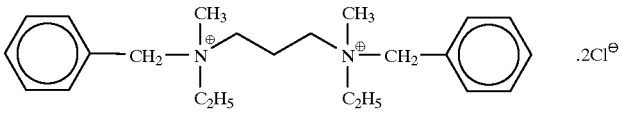
E-30
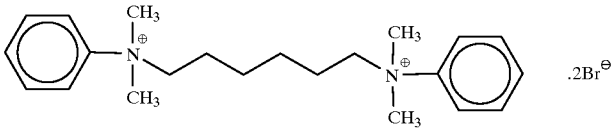
E-31
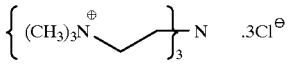
E-32
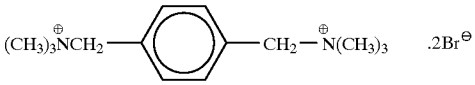
E-33
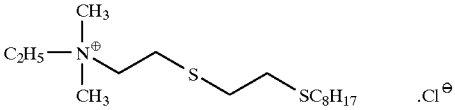
E-34
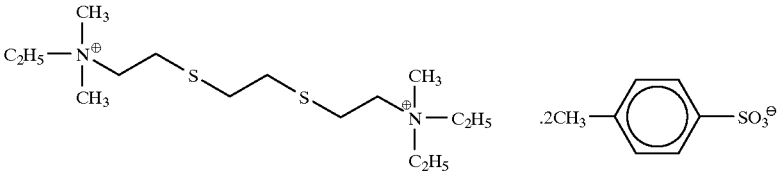
(Tso$^{\ominus}$)
E-35
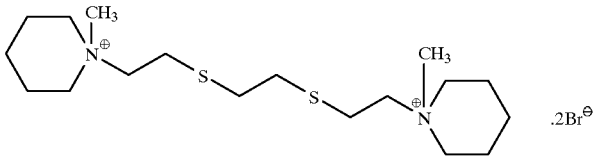
E-36
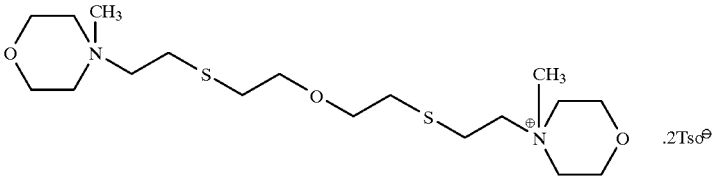
E-37
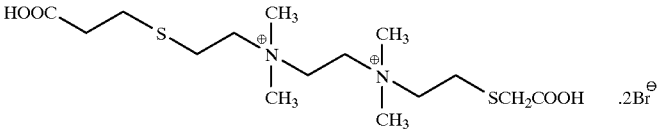

-continued

E-38

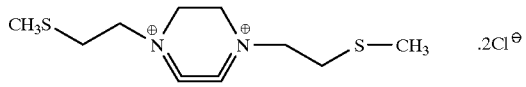

E-39

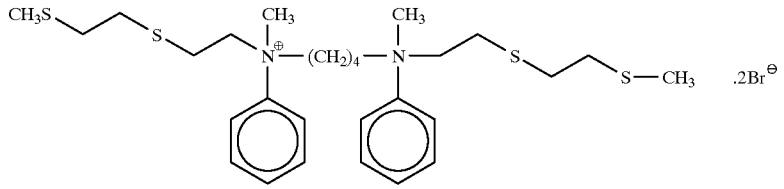

E-40

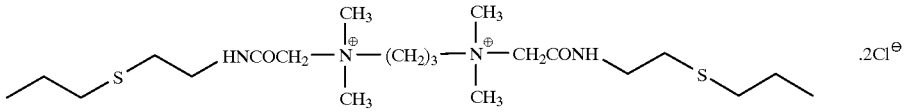

E-41

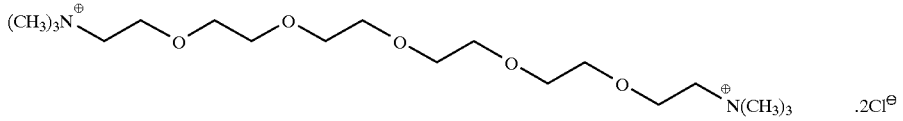

E-42

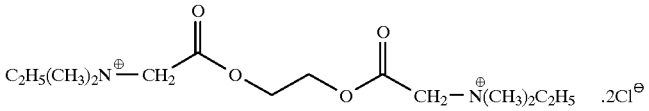

Formulae (F) and (G) are described in detail below.

(F)

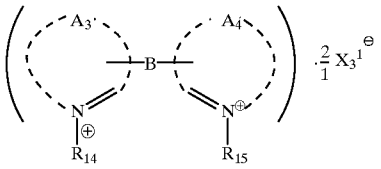

(G)

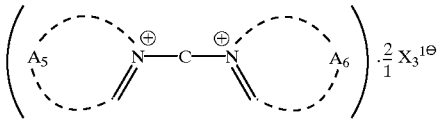

wherein $A_3$, $A_4$, $A_5$ and $A_6$ each represents an organic residue for completing a substituted or unsubstituted, unsaturated heterocyclic ring containing a quaternized nitrogen atom, which may contain a carbon atom, a hydrogen atom, an oxygen atom, a nitrogen atom or a sulfur atom, or may be condensed by a benzene ring. Examples of the unsaturated heterocyclic ring formed by $A_3$, $A_4$, $A_5$ or $A_6$ include a pyridine ring, a quinoline ring, an isoquinoline ring, an imidazole ring, a thiazole ring, a thiadiazole ring, a benzotriazole ring, a benzothiazole ring, a pyrimidine ring and a pyrazole ring. Among these, preferred are a pyridine ring, a quinoline ring and an isoquinoline ring.

The divalent group represented by B or C is preferably a divalent group constituted by alkylene, arylene, alkenylene, alkynylene, —$SO_2$—, —SO—, —O—, —S—, —N($R_N$)—, —C═O— or —P═O—, individually or in combination (wherein $R_N$ represents an alkyl group, an aralkyl group, an aryl group or a hydrogen atom), more preferably a divalent group constituted by alkylene, arylene, —C═O—, —O—, —S— or —N($R_N$)—, individually or in combination.

$R_{14}$ and $R_{15}$, which may be the same or different, each is preferably an alkyl group having from 1 to 20 carbon atoms. The alkyl group may be substituted by a substituent and examples of the substituent include a halogen atom (e.g., chlorine, bromine), a substituted or unsubstituted alkyl group (e.g., methyl, hydroxyethyl), a substituted or unsubstituted aryl group (e.g., phenyl, tolyl, p-chlorophenyl), a substituted or unsubstituted acyl group (e.g., benzoyl, p-bromobenzoyl, acetyl), an alkyloxycarbonyl group, an aryloxycarbonyl group, a sulfo group (including a sulfonate), a carboxy group (including a carboxylate), a hydroxy group, an alkoxy group (e.g., methoxy, ethoxy), an aryloxy group, a carbonamido group, a sulfonamido group, a sulfamoyl group, a carbamoyl group, a ureido group, a thioureido group, an alkylamino group, an arylamino group, a cyano group, a nitro group, an alkylthio group and an arylthio group.

$R_{14}$ and $R_{15}$ each is more preferably an alkyl group having from 1 to 10 carbon atoms. Preferred examples of the substituent include a carbamoyl group, an oxycarbonyl group, an acyl group, an aryl group, a sulfo group (including a sulfonate), a carboxy group (including a carboxylate) and a hydroxy group.

The unsaturated heterocyclic ring formed by $A_3$, $A_4$, $A_5$ or $A_6$ together with the quaternized nitrogen atom may have a substituent. The substituent may be selected from the substituents described above as the substituent on the alkyl group represented by $R_{14}$ or $R_{15}$. The substituent is preferably an aryl group having from 0 to 10 carbon atoms, an alkyl group, a carbamoyl group, an alkylamino group, an arylamino group, an oxycarbonyl group, an alkoxy group, an aryloxy group, an alkylthio group, an arylthio group, a hydroxy group, a carbonamido group, a sulfonamido group, a sulfo group (including a sulfonate) and a carboxy group (including a carboxylate).

The counter anion represented by $X_3^{1-}$ is the same meaning as defined in formula (E), and the preferred range thereof is also the same.

The compounds of the present invention can be easily synthesized by a generally well known method and *Quart. Rev.*, 16, 163 (1962) may be referred to.

Specific examples of the compound represented by formulae (F) and (G) are shown below, however, the present invention is by no means limited thereto.

F-1

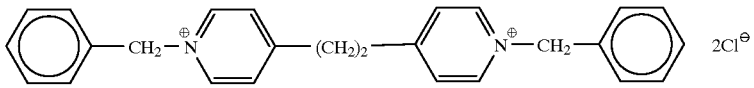

F-2

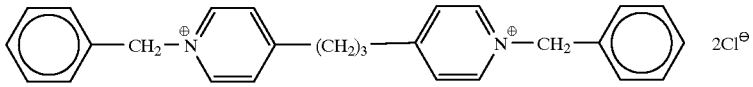

F-3

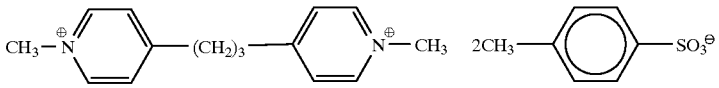

F-4

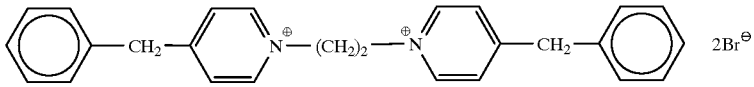

F-5

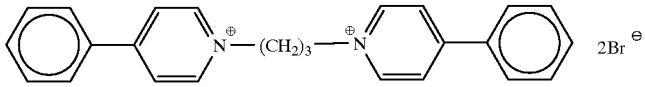

F-6

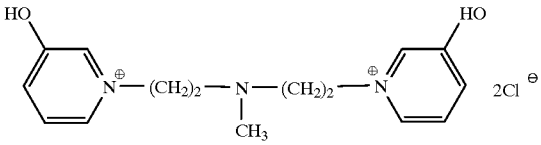

F-7

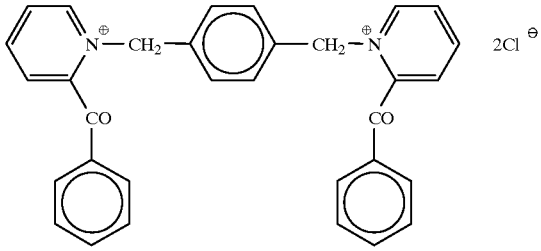

F-8

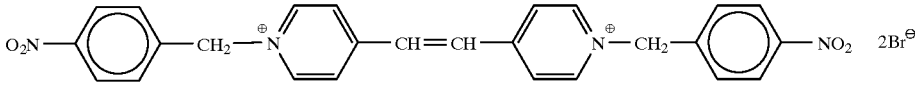

F-9

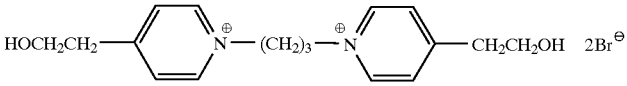

F-10

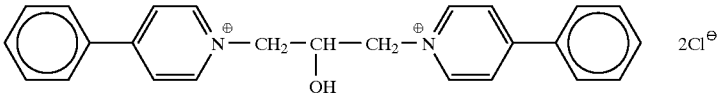

-continued
F-11
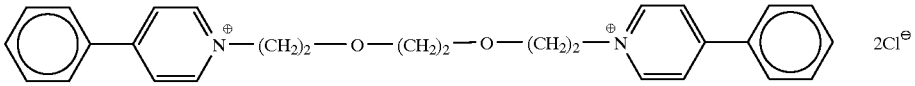
F-12
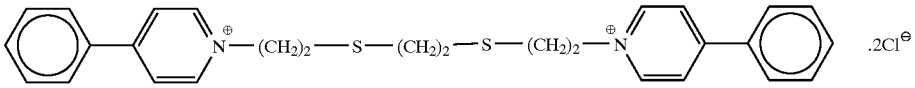
F-13
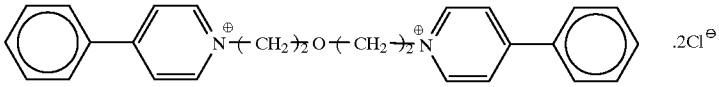
F-14
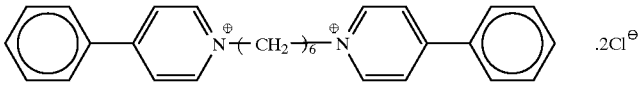
F-15
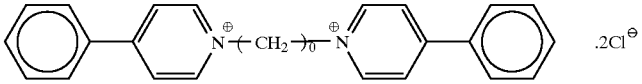
F-16
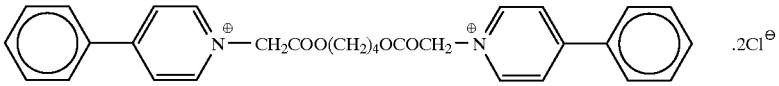
F-17
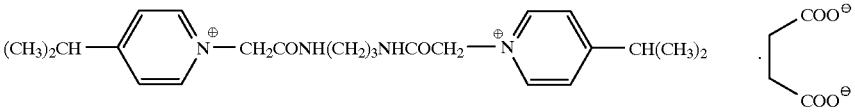
F-18
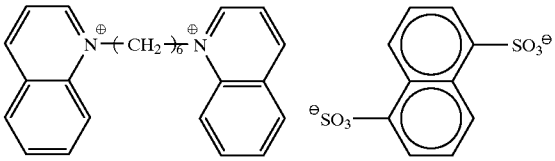
F-19
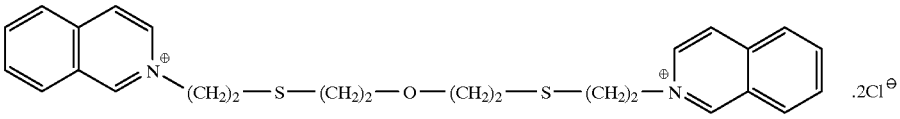
F-20
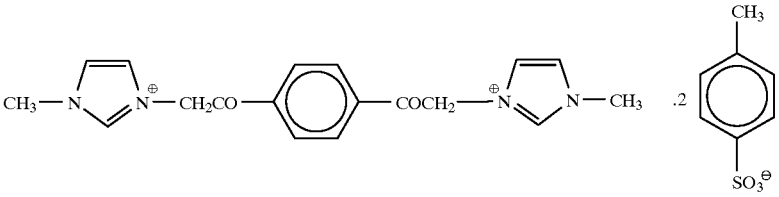
F-21
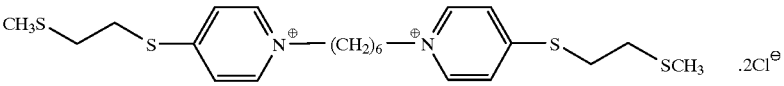

-continued

F-22

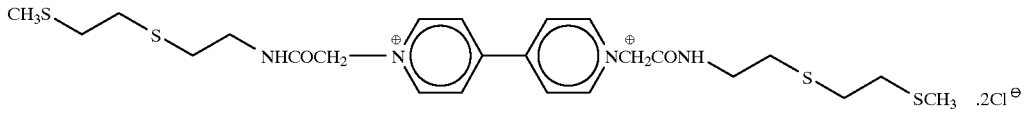

F-23

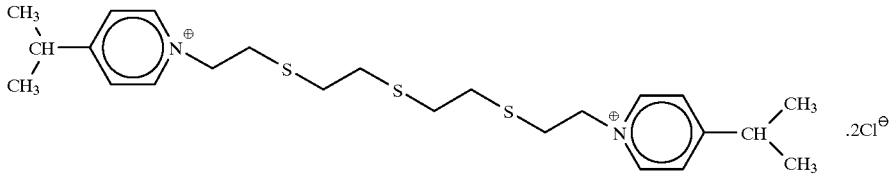

F-24

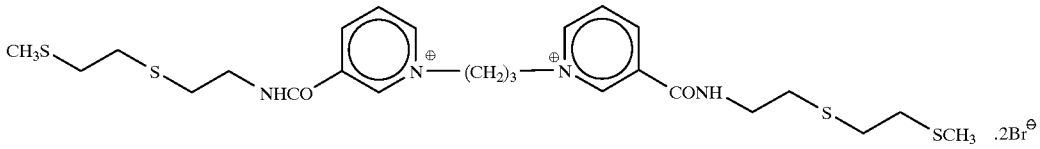

F-25

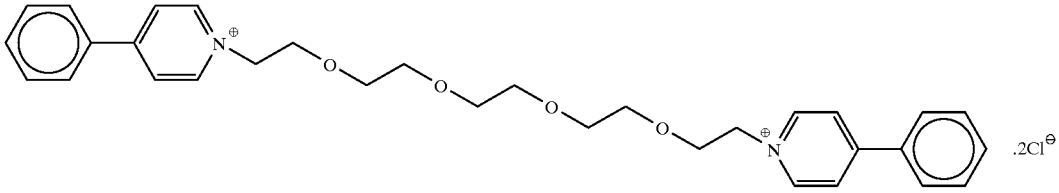

F-26

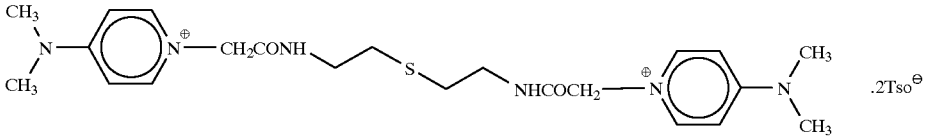

F-27

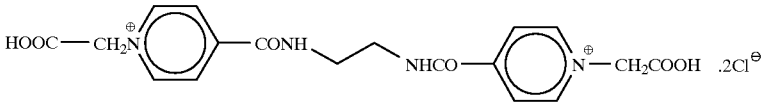

Formula (H) is described in more detail below.

(H)

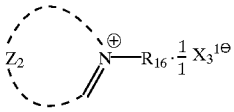

The nitrogen-containing unsaturated heterocyclic ring containing $Z_2$ may contain, in addition to the nitrogen atom, a carbon atom, a hydrogen atom, an oxygen atom or a sulfur atom, may be condensed by a benzene ring, or may have a substituent. Examples of the heterocyclic ring formed include those described as examples of the nitrogen-containing unsaturated heterocyclic ring formed by $A_3$, $A_4$, $A_5$ or A6 in formula (F) or (G). The preferred range is also the same and a pyridine ring, a quinoline ring and an isoquinoline ring are preferred.

When the nitrogen containing unsaturated heterocyclic ring containing $Z_2$ has a substituent, examples of the substituent include those described above as examples of the substituent on the nitrogen-containing unsaturated heterocyclic ring formed by $A_3$, $A_4$, A5 or A6 in formula (F) or (G), and the preferred range is also the same.

$R_{16}$ represents a substituted or unsubstituted, linear, branched or cyclic alkyl or aryl group having from 1 to 20 carbon atoms. Examples of the substituent include those described above as examples of the substituent on the alkyl group represented by $R_{14}$ or $R_{15}$ in formula (F), and the preferred range is also the same.

The counter anion represented by $X_3^{1-}$ has the same meaning as defined in formula (E) and the preferred range is also the same.

The compound represented by formula (H) of the present invention can be easily synthesized by a generally well known method and *Quart. Rev.*, 16, 163 (1962) may be referred to.

Specific examples of the compound represented by formula (H) are shown below, however, the present invention is by no means limited thereto.

H-1
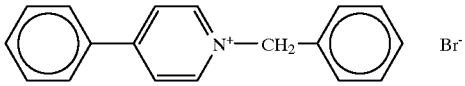
H-2
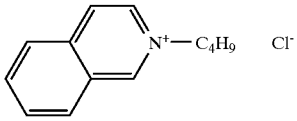
H-3
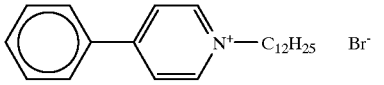
H-4
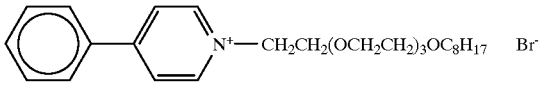
H-5
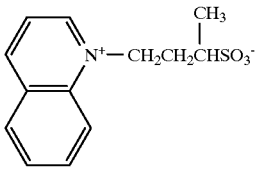
H-6
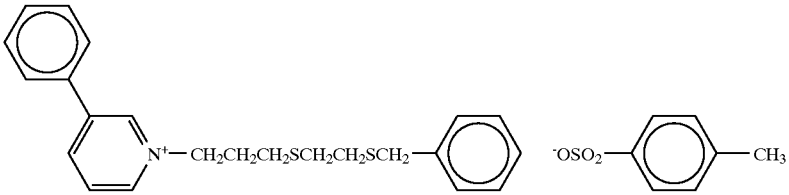
H-7
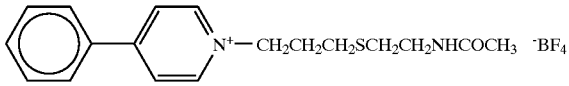
H-8
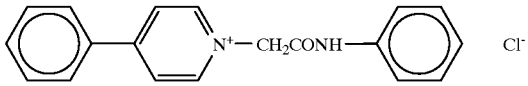
H-9
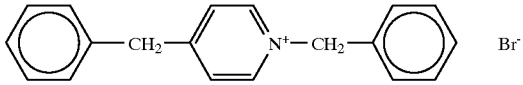
H-10
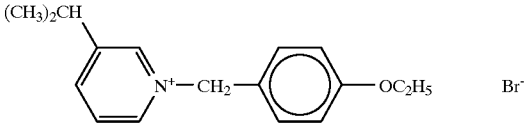
H-11
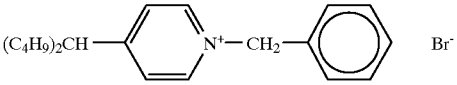
H-12
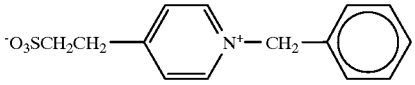

-continued

H-13

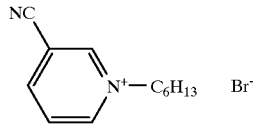

H-14

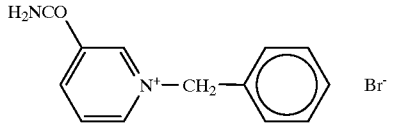

The amino compound which is preferably used as a nucleation accelerator in the present invention, includes the following compounds.

Compounds represented by Chemical Formulae 21, 22 and 3 in JP-A-7-84331, specifically, compounds described at pages 6 to 8; and compounds represented by formula [Na] in JP-A-7-104426, specifically, Compounds Na-1 to Na-22 described at pages 16 to 20.

The nucleation accelerator of the present invention may be dissolved before use in an appropriate water-miscible organic solvent such as an alcohol (e.g., methanol, ethanol, propanol, fluorinated alcohol), a ketone (e.g., acetone, methyl ethyl ketone), dimethylformamide, dimethyl sulfoxide or methyl cellosolve.

Also, the nucleation accelerator of the present invention may be dissolved using an oil such as dibutyl phthalate, tricresyl phosphate, glyceryl triacetate or diethyl phthalate, or an auxiliary solvent such as ethyl acetate or cyclohexanone, by a conventionally known emulsion dispersion method, and mechanically processed into an emulsion dispersion before use. Or, the nucleation accelerator powder may be dispersed in water by means of a ball mill, a colloid mill or ultrasonic waves according to a method known as a solid dispersion method, and used.

The nucleation accelerator of the present invention may be added to any of silver halide emulsion layers and other hydrophilic colloid layers on the silver halide emulsion layer side of a support, however, it is preferably added to a silver halide emulsion layer or a hydrophilic colloid layer adjacent thereto.

The addition-amount of the nucleation accelerator of the present invention is preferably from $1\times10^{-6}$ to $2\times10^{-2}$ mol, more preferably from $1\times10^{-5}$ to $2\times10^{-2}$ mol, most preferably from $2\times10^{-5}$ to $1\times10^{-2}$ mol, per mol of silver halide.

In the ultrahigh contrast system, a redox compound which releases a development inhibitor, may be used. Examples of the redox compound which can be used, include the compounds described in JP-A-2-293736, JP-A-2-308239, JP-A-1-154060 and JP-A-1-205885. The use amount thereof is from $1\times10^{-6}$ to $5\times10^{-2}$ mol, more preferably from $1\times10^{-5}$ to $1\times10^{-2}$ mol, per mol of silver halide.

The light-sensitive material may contain in the photographic emulsion layer or other hydrophilic colloid layer various surface active agents as a coating aid or for the purposes of electrification inhibition, improvement of splipperiness, emulsion dispersion, prevention of adhesion or improvement of photographic characteristics (e.g., development acceleration, high contrast, sensitization).

Examples thereof include nonionic surface active agents such as saponin (steroid-base), alkylene oxide derivatives (e.g., polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene-glycol alkylamines, polyalkylene glycol alkyl amides, polyethylene oxide adducts of silicone), glycidol derivatives (e.g., alkenylsuccinic polyglyceride, alkylphenol polyglyceride), fatty acid esters of polyhydric alcohols and alkyl esters of saccharide; anionic surface active agents containing an acidic group such as a carboxy group, a sulfo group, a phospho group, a sulfuric ester group or a phosphoric ester group, such as alkyl carboxylate, alkyl sulfonate, alkyl benzenesulfonate, alkyl naphthalenesulfonate, alkylsulfuric esters, alkylphosphoric esters, N-acyl-N-alkyltaurines, sulfosuccinic ethers and polyoxyethylene alkylphosphoric esters; amphoteric surface active agents such as amino acids, aminoalkylsulfonic acids, aminoalkylsulfuric acid esters, aminoalkylphosphoric esters, alkylbetaines and aminoxides; and cationic surface active agents such as alkylamine salts, aliphatic and aromatic quaternary ammonium salts, heterocyclic quaternary ammonium salts such as pyridinium and imidazolium, aliphatic and heterocyclic ring-containing phosphonium salts, and aliphatic and heterocyclic ring-containing sulfonium salts.

Gelatin is advantageously used as a binder in the photographic emulsion or a protective colloid, however, other hydrophilic colloid may also be used. Examples thereof include gelatin derivatives, graft polymers of gelatin to other polymer, proteins such as albumin and casein, cellulose derivatives such as hydroxyethyl cellulose, carboxymethyl cellulose and cellulose sulfuric esters, saccharide derivatives such as sodium alginate and starch derivative, and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

The gelatin may be a lime-processed gelatin or an acid-processed gelatin, and a hydrolysate or an enzymolysate of gelatin may also be used.

The X-ray light-sensitive material preferably contains in the emulsion layer or other hydrophilic colloid layer an organic substance which dissolves out during development processing. When the substance which dissolves out is gelatin, the gelatin is preferably such a type as not to participate in the crosslinking reaction of gelatin by a hardening agent, and examples thereof include acetylated gelatin and phthalated gelatin. This gelatin preferably has a small molecular weight. Effective examples of the polymer material other than the gelatin include hydrophilic polymers such as polyacrylamide described in U.S. Pat. No. 3,271,158, polyvinyl alcohol and polyvinyl pyrrolidone, and saccharides such as dextran, saccharose, prulane are also effective. Among these, polyacrylamide and dextran are preferred and polyacrylamide is more preferred. This polymer material has an average molecular weight of preferably 20,000 or less, more preferably 10,000 or less. The effective outflow on processing is from 10 to 50%, preferably from 15 to 30%, of the total weight of organic materials coated other than silver halide grains.

The organic material to be dissolved out on processing may be added to either an emulsion layer or a surface protective layer, however, if the total coated weight of the above-described organic material is the same, it is preferably incorporated into both a surface protective layer and an emulsion layer rather than into only an emulsion layer, more preferably incorporated into only a surface protective layer. In the case of a light-sensitive material comprising multilayer structure emulsion layers, if the coated total amount of the above-described organic material is the same, it is preferably added in a larger amount to the emulsion layer closer to the surface protective layer.

Preferred examples of the antistatic agent include fluorine-containing surface active agents and polymers described in JP-A-62-109044 and JP-A-62-215272, nonionic surface active agents described in JP-A-60-76742, JP-A-60-80846, JP-A-60-80848, JP-A-60-80839, JP-A-60-76741, JP-A-58-208743, JP-A-62-172343, JP-A-62-173459 and JP-A-62-215272, and (nonionic, anionic, cationic and amphoteric) electrically conductive polymers and latexes described in JP-A-57-204540 and JP-A-62-215272. Preferred examples of the inorganic antistatic agent include electrically conductive tin oxide, zinc oxide and complex oxide obtained by doping antimony or the like to these metal oxides, described in JP-A-57-118242.

As the matting agent, fine particles of an organic compound such as a polymethyl methacrylate homopolymer, a methyl methacrylate/methacrylic acid copolymer or starch as described in U.S. Pat. Nos. 2,992,101, 2,701,245, 4,142,894 and 4,396,706, or of an inorganic compound such as silica, titanium dioxide, sulfuric acid and ballium strontium. The particle size is preferably from 1.0 to 10 $\mu$m, more preferably from 2 to 5 $\mu$m.

The silver halide photographic light-sensitive material prepared may contain in a photographic layer or other layer a dye or colloidal silver for purposes of absorbing light in a specific wavelength region, in other words, for preventing halation or irradiation or for controlling spectral composition of light entering into the photographic emulsion layer by providing a filter layer. In the case of a double emulsion film such as direct, medical Roentgen film, a layer for the purpose of crossover cut may be provided under an emulsion layer. Examples of the dye used to this effect include an oxonol dye having a pyrazolone nucleus or a barbituric acid nucleus, an azo dye, an azomethine dye, an anthraquinone dye, an arylidene dye, a styryl dye, a triarylmethane dye, a merocyanine dye and a cyanine dye. The dye is described in more detail below.

Examples of the dye include oxonol dyes having a pyrazolone nucleus, a barbituric nucleus or a barbituric acid nucleus described in British Patents 506,385, 1,177,429, 1,131,884, 1,338,799, 1,385,371, 1,467,214, 1,438,102 and 1,553,516, JP-A-48-85130, JP-A-49-114420, JP-A-52-117123, JP-A-55-161233, JP-A-59-111640, JP-B-39-22069, JP-A-43-13168, JP-A-62-273527, U.S. Pat. Nos. 3,247,127, 3,469,985 and 4,078,933, other oxonol dyes described in U.S. Pat. Nos. 2,533,472 and 3,379,533, British Patent 1,278,621, JP-A-1-134447 and JP-A-1-183652, azo dyes described in British Patents 575,691, 680,631, 599,623, 786,907, 907,125 and 1,045,609, U.S. Pat. No. 4,255,326, JP-A-59-211043, azomethine dyes described in JP-A-50-100116, JP-A-54-118247, British Patents 2,014,598 and 750,031, anthraquinone dyes described in U.S. Pat. No. 2,865,752, arylidene dyes described in U.S. Pat. Nos. 2,538,009, 2,688,541 and 2,538,008, British Patents 584,609 and 1,210,252, JP-A-50-40625, JP-A-51-3623, JP-A-51-10927, JP-A-54-118247, JP-B-48-3286, JP-B-59-37303, and European Patent 280,252, styryl dyes described in JP-B-28-3082, JP-B-44-16594 and JP-B-59-28898, triarylmethane dyes described in British Patents 446,538 and 1,335,422, and JP-A-59-228250, merocyanine dyes described in British Patents 1,075,653, 1,153,341, 1,284,730, 1,475,228 and 1,542,807, and cyanine dyes described in U.S. Pat. Nos. 2,843,486 and 3,294,539, JP-A-62-123454 and JP-A-1-291247.

These dyes are prevented from diffusion by the method described below. For example, a ballast group is incorporated into the dye to render the dye non-diffusible.

Further, a method of letting a hydrophilic polymer having a charge opposite to the anionic dye dissociated be present together as a mordant in the layer to localize the dye in a specific layer by the interaction with the dye molecule, is disclosed, for example, in U.S. Pat. Nos. 2,548,564, 4,124,386 and 3,625,694.

As such a hydrophilic polymer, an anion conversion polymer (i.e., a polymer having a cation group, in which its anion group is converted) is preferred. Examples of the anion conversion polymer include various known quaternary ammonium salt (or phosphonium salt) polymers. The quaternary ammonium salt (or phosphonium salt) polymer is broadly known as a mordant polymer or an antistatic agent polymer and examples thereof include water dispersion latexes described in JP-A-59-166940, U.S. Pat. No. 3,958,995, JP-A-55-142339, JP-A-54-126027, JP-A-54-155835, JP-A-53-30328 and JP-A-54-92274; polyvinyl pyridinium salts described in U.S. Pat. Nos. 2,548,564, 3,148,061 and 3,756,814; water-soluble quaternary ammonium salt polymers described in U.S. Pat. No. 3,709,690; and water-insoluble quaternary ammonium salt polymers described in U.S. Pat. No. 3,898,088.

Further, in order to prevent transfer of the dye from a desired layer to other layer or the processing solution to adversely affect the photographic properties, a cross-linked aqueous polymer latex obtained by copolymerizing a monomer having at least two or more (preferably from 2 to 4) ethylenically unsaturated groups, is preferably used.

A method for dying a specific layer using a water-insoluble dye solid is disclosed in JP-A-56-12639, JP-A-55-155350, JP-A-55-155351, JP-A-63-27838, JP-A-63-197943, JP-A-2-297543, JP-A-3-167546, JP-A-4-127143, European Patent 15,601 and International Patent Publication WO88/04794.

Further, a method for dyeing a specific layer using a metal salt fine particle adsorbed with a dye is disclosed in U.S. Pat. Nos. 2,719,088, 2,496,841 and 2,496,843, and JP-A-60-45237.

The light-sensitive material may contain various compounds so as to prevent fogging or to stabilize photographic capabilities, during preparation, storage or photographic processing of the light-sensitive material. More specifically, a large number of compounds known as an antifoggant or a stabilizer may be added and examples thereof include azoles such as benzothiazolium salts, nitroindazoles, chlorobenzimidazoles, bromobenzimidazoles, mercaptotetrazoles, mercaptothiazoles, mercaptobenzothiazoles, mercaptothiadiazoles, aminotriazoles, benzothiazoles and nitrobenzotriazoles;

mercaptopyrimidines; mercaptotriazines; thioketo compounds, e.g., oxazolinethione; and azaindenes, e.g., triazaindenes, tetrazaindenes (in particular, 4-hydroxy-substituted (1,3,3a,7)tetrazaindenes) and pentazaindenes; benzenethiosulfonic acid; benzenesulfinic acid; and benzenesulfonic acid amide. Among these, preferred are benzotriazoles (e.g., 5-methylbenzotriazole) and nitro-indazoles (e.g., 5-nitroindazole). The compound may also be incorporated into a processing solution. Further, the light-sensitive material may contain a compound which releases a inhibitor into the developer described in JP-A-62-30243, as a stabilizer or for the purpose of preventing black peppers.

The light-sensitive material may contain a developing agent such as a hydroquinone derivative o a phenidone derivative for various purposes, such as a stabilizer or an accelerator.

The photographic light-sensitive material may contain in the photographic emulsion layer or other hydrophilic colloid layer an inorganic or organic hardening agent. Examples thereof include chromium salts (e.g., chromium alum, chromium acetate), aldehydes (e.g., formaldehyde, glutaraldehyde), N-methylol compounds (e.g., dimethylolurea), dioxane derivatives, active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine) and mucohalogen acids (e.g., mucochloric acid), and these may be used either individually or in combination.

The photographic light-sensitive material may contain in a photographic emulsion layer or other hydrophilic colloid layer, a hydroquinone derivative which releases a development inhibitor (so-called DIR-hydroquinone) in correspondence with the density of an image at the time of development.

Specific examples thereof include the compounds described in U.S. Pat. Nos. 3,379,529, 3,620,746, 4,377,634 and 4,332,878, JP-A-49-129536, JP-A-54-67419, JP-A-56-153336, JP-A-56-153342, JP-A-59-278853, JP-A-59-90435, JP-A-59-90436 and JP-A-59-138808.

The light-sensitive material may contain a water-insoluble or difficultly soluble synthetic polymer dispersion for the purpose of achieving dimensional stability. For example, polymers comprising as a monomer component alkyl (meth) acrylate, alkoxyacryl (meth)acrylate, glycidyl (meth) acrylate, individually or in combination, or a mixture thereof with an acrylic acid or a methacrylic acid may be used.

The photographic light-sensitive material preferably contains in a silver halide emulsion layer or other layer a compound having an acid radical. Examples of the compound having an acid radical include organic acids such as salicylic acid, acetic acid and ascorbic acid, and homopolymers and copolymers having a repeating unit of an acid monomer such as acrylic acid, maleic acid or phthalic acid. These compounds are described in JP-A-61-223834, JP-A-61-228437, JP-A-62-25745 and JP-A-62-55642. Among these compounds, more preferred are, as a low molecular compound, an ascorbic acid, and as a high molecular compound, a water dispersing latex of a copolymer comprising an acid monomer such as acrylic acid and a cross-linking monomer having two or more unsaturated groups, such as divinylbenzene.

The thus produced silver halide emulsion is coated on a support such as cellulose acetate film or polyethylene terephthalate film, by a dip coating method, an air knife coating method, a bead coating method, an extrusion doctor coating method or a double-side coating method, and then dried.

Examples of the support for use in the light-sensitive material include paper laminated with α-olefin polymer (e.g., polyethylene, polypropylene, ethylene/butene copolymer) or the like, a flexible support made of synthetic paper and a metal. Among these, polyethylene terephthalate is preferred. The subbing layer which can be used in the present invention, include a subbing processed layer of an organic solvent including polyhydroxybenzenes described in JP-A-49-3972, and an aqueous latex subbing processed layer described in JP-A-49-11118 and JP-A-52-10491. The subbing layer may be usually subjected to chemical or physical surface treatment. Examples of the treatment include surface activation treatments such as treatment with chemicals, mechanical treatment and corona discharge treatment.

In the present invention, a color light-sensitive material can also be used. In this case, various color couplers may be used. The term "color coupler" as used herein means a compound capable of forming a dye upon coupling reaction with an oxidation product of an aromatic primary amine developing agent. Typical examples of useful color couplers include naphthol- and phenol-base compounds, pyrazolone- and pyrazoloazole-base compounds, and open chain or heterocyclic ketomethylene compounds. Specific examples of the cyan, magenta and yellow couplers which can be used in the present invention are described in the patents cited in *Research Disclosure* (*RD*), 17643, Item VII-D (December 1978) and ibid., 18717 (November 1979).

Various additives for use in the light-sensitive material of the present invention are not particularly limited and, for example, those described below may be preferably used:

- polyhydroxybenzene compounds described in JP-A-3-39948, from page 10, right lower column, line 11 to page 12, left lower column, line 5, specifically, Compounds (III)-1 to (III-25);
- compounds having substantially no absorption maximum in the visible region, represented by formula (I) of JP-A-1-118832, specifically, Compounds I-1 to I-26;
- antifoggants described in JP-A-2-103536, from page 17, right lower column, line 19 to page 18, right upper column, line 4;
- polymer latexes described in JP-A-2-103536, page 18, left lower column, lines 12 to 20;
- matting agents, slipping agents and plasticizers described in JP-A-2-103536, page 19, from left upper column, line 15 to right upper column, line 15;
- hardening agents described in JP-A-2-103536, page 18, right upper column, lines 5 to 17;
- compounds having an acid radical described in JP-A-2-103539, from page 18, right lower column line 6 to page 19, left upper column, line 1;
- electrically conductive materials described in JP-A-2-18542, from page 2, left lower column, line 13 to page 3, right upper column, line 7, specifically, metal oxides described at page 2, right lower column, lines 2 to 10, and Electrically Conductive Polymer Compounds P-1 to P-7;
- water-soluble dyes described in JP-A-1-103536, page 17, from right lower column, line 1 to right upper column, line 18;
- solid disperse dyes described in JP-A-2-294638 and JP-A-5-11382;
- surface active agents described in JP-A-2-12236, page 9, from right upper column, line 7 to right lower column, line 3; PEG-base surface active agents described in JP-A-2-103536, page 18, left lower column, lines 4 to 7; fluorine-containing surface active agents described in JP-A-3-39948, from page 12, left lower column, line 6 to page 13, right lower column, line 5, specifically, Compounds VI-1 to VI-15;

redox compounds capable of releasing a development inhibitor when oxidized described in JP-A-5-274816, preferably redox compounds represented by formulae (R-1), (R-2) and (R-3), specifically, Compounds R-1 to R-68; and binders described in JP-A-2-18542, page 3, right lower column, lines 1 to 20.

Examples of the support which can be used in practicing the present invention, include baryta paper, polyethylene-coated paper, polypropylene synthetic paper, glass sheet, cellulose acetate, cellulose nitrate and polyester film such as polyethylene terephthalate. These supports are appropriately selected according to the use purpose of the silver halide photographic light-sensitive material.

The present invention is described in greater detail below with reference to the following Examples, but the invention should not be construed as being limited thereto.

Examples using a light-sensitive material for graphic art are described below.

1. Preparation of Silver Halide Light-Sensitive Material for Evaluation of Capabilities:

Light-Sensitive Material 1 (for Ar laser exposure):

<Preparation of Silver Halide Emulsion>

(Emulsion A)

A silver nitrate aqueous solution and an aqueous halogen salt solution containing potassium bromide, sodium chloride, $K_3IrCl_6$ corresponding to $3.5\times10^{-7}$ mol/mol-Ag and $K_2Rh(H_2O)Cl_5$ corresponding to $2.0\times10^{-7}$ mol/mol-Ag were added to an aqueous gelatin solution containing sodium chloride and 1,3-dimethyl-2-imidazolidinethione, while stirring by a double jet method to prepare silver chlorobromide grains having an average grain size of 0.25 μm and a silver chloride content of 70 mol %.

Thereafter, the grains were washed with water by flocculation in a usual manner, 40 g/mol-Ag of gelatin was added thereto, then 7 mg/mol-Ag of sodium benzenethiosulfonate and 2 mg/mol-Ag of benzenesulfinic acid were further added, and the pH and the pAg were adjusted to 6.0 and 7.5, respectively. Thereto, 1 mg/mol-Ag of Selenium Sensitizer (Se-1), 1 mg/mol-Ag of sodium thiosulfate and 4 mg/mol-Al of chloroauric acid were added to perform chemical sensitization so as to give an optimal sensitivity at 60° C. Then, 150 mg of 4-hydroxy-6-methyl-1,3,3a,7-tetraazaindene as a stabilizer and 100 mg of proxel as an antiseptic were added. The grains obtained were silver chlorobromide cubic grains having an average grain size of 0.25 μm and a silver chloride content of 70 mol % (coefficient of variation: 10%).

Additive for Light-Sensitive Material 1:

Selenium Sensitizer (Se-1)

Selenium Sensitizer (Se-1)

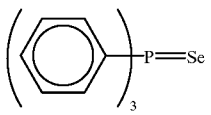

<Preparation of Coated Sample>

On a polyethylene terephthalate film (150 μm) having an undercoat layer (0.5 μm) comprising a vinylidene chloride copolymer, UL, EM, ML and PC layers were coated to prepare a sample having a layer structure of UL, EM, ML and PC from the support side.

The preparation method and the coated amount of each layer are shown below. Each coating solution was adjusted to have an appropriate viscosity by sodium polystyrenesulfonate before coating.

(UL Layer)

Water was added to gelatin and dissolved at 40° C., then Compound (W) was added thereto to have a coverage of 15 mg/m$^2$, further a latex copolymer (butyl acrylate : acrylic acid : 2-acetoacetoxyethyl methacrylate=80:4:16 (by weight)) in an amount of 70 wt % based on gelatin and Compound (B) in an amount of 3.0 wt % based on gelatin were added, and the resulting solution was coated to have a gelatin coverage of 0.3 g/m$^2$.

(EM Layer)

Emulsion A prepared above was dissolved at 40° C., then $4.5\times10^{-4}$ mol/mol-Ag of Sensitizing Dye (S-1), $1.5\times10^{-4}$ mol/mol-Ag of Sensitizing Dye (S-2), $4.5\times10^{-3}$ mol/mol-Ag of KBr, $9.0\times10^{-4}$ mol/mol-Ag of Compound (A), $3.2\times10^{-4}$ mol/mol-Ag of Compound (C), $7.0\times10^{-4}$ mol/mol-Ag of Compound (D), $7.0\times10^{-3}$ mol/mol-Ag of acetic acid, $9.7\times10^{-3}$ mol/mol-Ag of hydroquinone, $1.4\times10^{-4}$ mol/mol-Ag of Hydrazine Compound D-2b, $2.6\times10^{-4}$ mol/mol-Ag of Nucleation Accelerator E-12, 15 wt % on a gelatin basis of polyethyl acrylate latex, 15 wt % on a gelatin basis of latex copolymer (butyl acrylate : acrylic acid : 2-acetoxyethyl methacrylate=80:4:16) and 4 wt % on a gelatin basis of Compound (B) were added thereto, and the resulting solution was coated to have an Ag coverage of 3.2 g/m$^2$.

(ML Layer)

To a gelatin solution, 7 mg/m$^2$ of Compound (E), 15 wt % on a gelatin basis of polyethyl acrylate and 3.5 wt % on a gelatin basis of Compound (B) were added and the resulting solution was coated to have a gelatin coverage of 0.5 g/m$^2$.

(PC Layer)

To a gelatin solution, 40 mg/M$^2$ of an amorphous $SiO_2$ matting agent having an average particle size of 3.5 μm, 20 mg/m$^2$ of silicone oil, 5 mg/M$^2$ of Compound (F) as a coating aid, 25 mg/m$^2$ of sodium dodecylbenzenesulfonate and 20 mg/m $^2$ of Compound (G) were added, and the resulting solution was coated. The gelatin coverage was 0.3 g/m$^2$.

Sensitizing Dye (S-1)

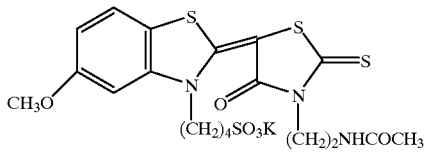

Sensitizing Dye (S-2)

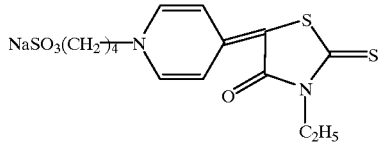

-continued

Compound (w)

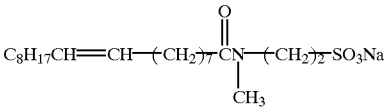

Compound (A)

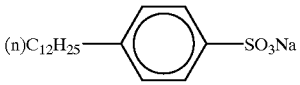

Compound (B)

A 3:1 mixture of n=2 and n=3:

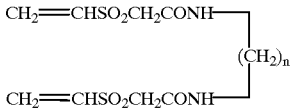

Compound (C)

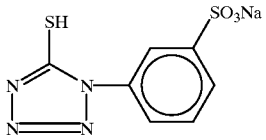

Compound (D)

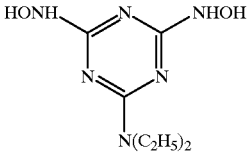

Compound (E)

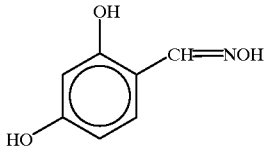

Compound (F)

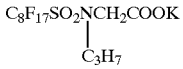

Compound (G)

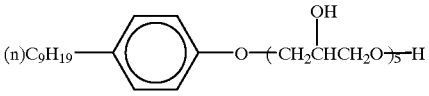

A back layer and a back protective layer each having the following formulation were coated.

(Formulation of Back Layer)

| | | |
|---|---|---|
| Gelatin | 3 | g/m$^2$ |
| Latex: polyethyl acrylate | 2 | g/m$^2$ |
| Surface active agent: Sodium p-dodecylbenzenesulfonate | 40 | mg/m$^2$ |
| Compound (B) | 110 | mg/m$^2$ |
| $SnO_2$/Sb (weight ratio: 90/10, average particle size: 0.20 μm) | 200 | mg/m$^2$ |
| Dye: Mixture of Dye (a), Dye (b) and Dye (c) | | |
| Dye (a) | 70 | mg/m$^2$ |
| Dye (b) | 100 | mg/m$^2$ |
| Dye (c) | 50 | mg/m$^2$ |

Dye (a)

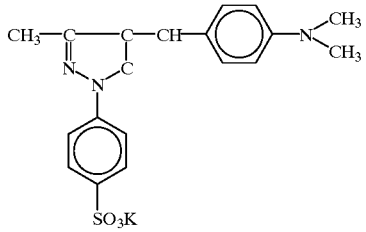

Dye (b)

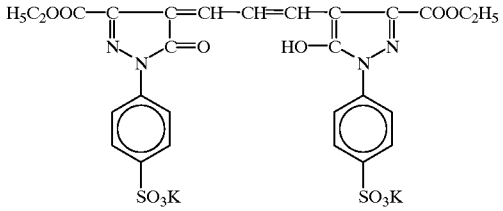

Dye (c)

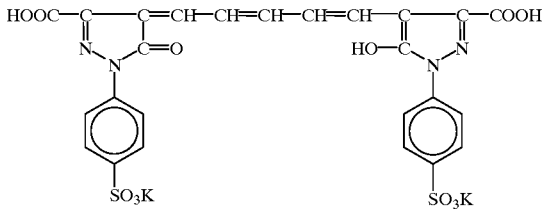

(Back Protective Layer)

| | |
|---|---|
| Gelatin | 0.8 mg/m$^2$ |
| Polymethyl methacrylate fine particles (average particle size: 4.5 μm) | 30 mg/m$^2$ |
| Sodium dihexyl-α-sulfosuccinate | 15 mg/m$^2$ |
| Sodium p-dodecylbenzenesulfonate | 15 mg/m$^2$ |
| Sodium acetate | 40 mg/m$^2$ |

<Preparation of Exposed Sample for Evaluation of Photographic Capabilities>

Exposure was performed to xenon flash light through an interference filter having a peak at 488 nm and a step wedge for a light emission time of $10^{-6}$ second.

<Evaluation of Photographic Capabilities>

1. $S_{1.5}$ (Sensitivity)

The sensitivity is shown by a relative value to −log (reciprocal of an exposure amount necessary for giving OD (optical density) of 1.5). The larger the value, the higher the sensitivity.

2. γ (gradation)

$$\gamma = \text{optical density } (3.0-0.3) \div \Delta \log E$$

wherein ΔlogE is a difference between an exposure amount necessary for giving OD of 3.0 (logE3.0) and an exposure amount necessary for giving OD of 0.3 (logE0.3).

3. D0510 (Dm)

The Dm is shown by the density value obtained when an exposure amount necessary for giving a density of 0.5 was added by 1.0 exposure amount in logE.

Light-Sensitive Material 2 (for He/Ne, LD laser exposure):

<Preparation of Silver Halide Emulsion>

(Emulsion B)

To Solution 1 shown below kept at 38° C. and having a pH of 4.5, Solution 2 and Solution 3 were simultaneously added while stirring over 24 hours to form grains having a size of 0.18 μm. Subsequently, Solution 4 and Solution 5 shown below were added over 8 minutes and then 0.15 g of potassium iodide was added to complete grain formation.

Thereafter, the grains were washed with water by flocculation in a usual manner, 40 g/mol-Ag of gelatin was added, the pH and the pAg were adjusted to 5.2 and 7.5, respectively, and thereto 4 mg/mol-Ag of sodium thiosulfate, 2 mg/mol-Ag of N,N-dimethylselenourea, 10 mg of chloroauric acid, 4 mg/mol-Ag of sodium benzenethiosulfonate and 1 mg/mol-Ag of benzenesulfinic acid were added to perform chemical sensitization so as to have an optimal sensitivity at 55° C.

Further, 50 mg of 4-hydroxy-6-methyl-1,3,3a,7-tetraazaindene as a stabilizer and phenoxy ethanol as an antiseptic in an amount of giving a coverage of 100 ppm were added. The grains obtained finally were silver iodochlorobromide cubic grains having a silver chloride content of 70 mol % and an average grain size of 0.20 μm (coefficient of variation: 9%).

| Solution 1 | | |
|---|---|---|
| Water | 1.0 | l |
| Gelatin | 20 | g |
| Sodium chloride | 2 | g |
| 1,3-Dimethylimidazolidine-2-thione | 20 | mg |
| Sodium benzenethiosulfonate | 3 | mg |
| **Solution 2** | | |
| Water | 600 | ml |
| Silver nitrate | 150 | g |

-continued

| Solution 3 | | |
|---|---|---|
| Water | 600 | ml |
| Sodium chloride | 45 | g |
| Potassium bromide | 21 | g |
| $K_3KrCl_6$ (0.001% aq. soln.) | 15 | ml |
| $(NH_4)_3RhBr_6$ (0.001% aq. soln.) | 1.5 | ml |
| **Solution 4** | | |
| Water | 200 | ml |
| Silver nitrate | 50 | g |
| **Solution 5** | | |
| Water | 2.00 | ml |
| Sodium chloride | 15 | g |
| Potassium bromide | 7 | g |
| $K_4Fe(CN)_6$ | 30 | mg |

<Preparation of Coated Sample>

This sample was prepared in the same manner as the sample for Ar laser except for changing the EM layer of the sample for Ar laser exposure as follows.

(EM Layer)

Emulsion B was dissolved together with gelatin at 40° C., then thereto $3.6\times10^{-3}$ mol/mol-Ag of KBr, $7.6\times10^{-4}$ mol/mol-Ag of 4-hydroxy-6-methyl-1,3,3a,7-tetraazaindene, $2.5\times10^{-4}$ mol/mol-Ag of Sensitizing Dye (S-3) or $3.3\times10^{-5}$ mol/mol-Ag of Sensitizing Dye (S-4), $2.0\times10^{-4}$ mol/mol-Ag of Hydrazine Compound D-2b, $5.7\times10^{-4}$ mol/mol-Ag of Nucleation Accelerator E-12, $2.5\times10^{-4}$ mol/mol-Ag of Compound (H), $5.0\times10^{-4}$ mol/mol-Ag of Compound (C), $1.6\times10^{-3}$ mol/mol-Ag of Compound (D), 15 wt % on a gelatin basis of colloidal silica, 15 wt % on a gelatin basis of polyethyl acrylate latex, 20 wt % on a gelatin basis of a latex copolymer (butyl acrylate : acrylic acid : 2-acetoacetoxyethyl methacrylate=80:4:16) and 4 wt % on a gelatin basis of Compound (B) were added, and the resulting solution was coated to have an Ag coverage of 3.5 g/m$^2$. Compounds (B), (C) and (D) were the same as used in Light-Sensitive Material 1.

Additives for Light-Sensitive Material 2:

Sensitizing Dye (S-3)

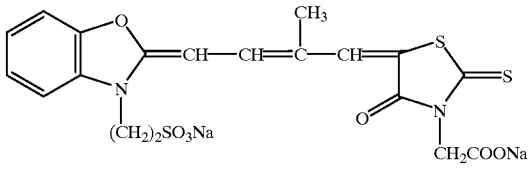

Sensitizing Dye (S-4)

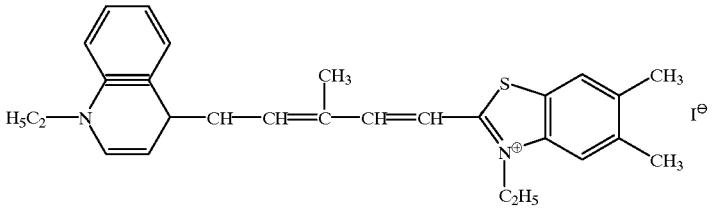

-continued

Compound (H)

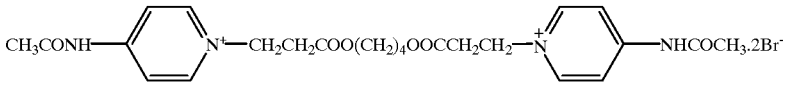

<Preparation of Exposed Sample for Evaluation of Photographic Capabilities>

Exposure was performed to a xenon flash light through an interference filter having a peak at 633 nm or 670 nm and a step wedge for a light emission time of $10^{-6}$ second.

<Evaluation of Photographic Capabilities>

The photographic capabilities were evaluated by γ and D0510 in the same manner as in the light-sensitive material for Ar laser.

Light-Sensitive Material 3 (for camera work):

<Preparation of Silver Halide Emulsion>

(Emulsion C)

To an aqueous 2% gelatin solution containing sodium chloride (0.3%), 1,3-dimethyl-2-midazolidinethione (0.002%) and citric acid (0.05%), 250 ml of an aqueous silver nitrate solution having dissolved therein 64 g of silver nitrate and 250 ml of an aqueous halogen salt solution containing $K_3IrCl_6$ corresponding to $2.0\times10^{-7}$ mol per mol of silver in the finished emulsion and $K_2Rh(H_2O)Cl_5$ corresponding to $1.0\times10^{-7}$ mol per mol of silver in the finished emulsion and having dissolved therein 20 g of potassium bromide and 14 g of sodium chloride, were added while stirring at 38° C. over 12 minutes by a double jet method to perform nucleation formation, thereby obtaining silver chlorobromide grains having an average grain size of 0.16 μm and a silver chloride content of 55 mol %. Subsequently, 300 ml of an aqueous silver nitrate solution having dissolved therein 106 g of silver nitrate and 300 ml of an aqueous halogen salt solution having dissolved therein 28 g of potassium bromide and 26 g of sodium chloride were added by a double jet method over 12 minutes to perform grain formation.

Thereafter, $1.0\times10^{-3}$ mol/mol-Ag of KI was added to perform conversion and the grains were washed with water by flocculation in a usual manner. Then, 40 g/mol-Ag of gelatin was added, the pH and the pAg were adjusted to 6.0 and 7.5, respectively, and 3 mg/mol-Ag of sodium benzenethiosulfonate, 1 mg/mol-Ag of benzenesulfinic acid, 2 mg/mol-Ag of sodium thiosulfate, 2 mg/mol-Ag of Selenium Sensitizer (Se-2) and 8 mg/mol-Ag of chloroauric acid were added to perform chemical sensitization under heating at 60° C. for 70 minutes. Thereafter, 150 mg of 4-hydroxy-6-methyl-1,3,3a,7-tetraazaindene as a stabilizer and 100 mg of proxel as an antiseptic were added, 400 mg of Sensitizing Dye (S-5) was added and after 10 minutes, the temperature was lowered. The grains obtained were silver iodochlorobromide cubic grains having an average grain size of 0.22 μm and a silver chloride content of 60 mol % (coefficient of variation: 10%).

Additive for Light-Sensitive Material 3:

Selenium Sensitizer (Se-2)

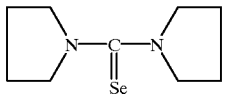

Sensitizing Dye (S-5)

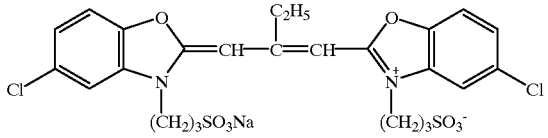

<Preparation of Coated Sample>

On a polyethylene terephthalate film having on both surfaces thereof a moisture-proof undercoat containing vinylidene chloride, coating solutions were coated in the order of EM (silver amount: 2.7 g/m$^2$, gelatin: 1.3 g/m$^2$), PCU (gelatin: 0.5 g/m$^2$) and PCO (gelatin: 0.4 g/m$^2$) from the support side. The sample obtained had a layer surface pH of 5.8 on the emulsion surface.

(EM)

The coating solution for the emulsion layer was prepared by dissolving Emulsion C, adding thereto $2\times10^{-4}$ mol/mol-Ag of a short wave cyanine dye shown below by structural formula (a), $5\times10^{-3}$ mol of potassium bromide, $2\times10^{-4}$ mol-mol-Ag of 1-phenyl-5-mercaptotetrazole, $2\times10^{-4}$ mol/mol-Ag of a mercapto compound shown below by structural formula (b), $3\times10^{-4}$ mol/mol-Ag of a triazine compound shown below by structural formula (c), $3\times10^{-4}$ mol/mol-Ag of Hydrazine Compound D-1b and $4.4\times10^{-4}$ mol/mol-Ag of Compound E-12 as a nucleation accelerator, and further adding thereto hydroquinone, sodium p-dodecylbenzenesulfonate, colloidal silica (Snowtex C produced by Nissan Chemical KK), a polyethyl acrylate dispersion and 1,2-bis(vinylsulfonylacetamide)ethane to give a coated amount of 100 mg/m$^2$, 10 mg/M$^2$, 150 mg/M$^2$, 500 mg/M$^2$ and 80 mg/M$^2$, respectively. The coating solution was adjusted to have a pH of 5.6.

(PCU)

The coating solution was prepared by adding to an aqueous gelatin solution containing proxel as an antiseptic, Compound (d), Compound (e) and a polyethyl acrylate dispersion to give a coated amount of 10 mg/M$^2$, 100 mg/m$^2$ and 300 mg/M$^2$, respectively.

(PCO)

The coating solution was prepared by adding to a gelatin solution containing proxel as an antiseptic, Compound (d), Compound (e), a polyethyl acrylate dispersion to give a coated amount of 10 mg/m$^2$, 100 mg/m$^2$ and 300 mg/m $^2$, respectively and further adding thereto an amorphous $SiO_2$ matting agent having an average grain size of about 3.5 μm, colloidal silica (Snowtex C produced by Nissan Chemical KK), liquid paraffin, fluorine surface active agent shown below by structural formula (f) and sodium p-dodecylbenzenesulfonate to give a coated amount of 50 mg/m$^2$, 100 mg/$^2$, 30 mg/m$^2$, 5 mg/m$^2$ and 30 mg/M$^2$ respectively.

(a)

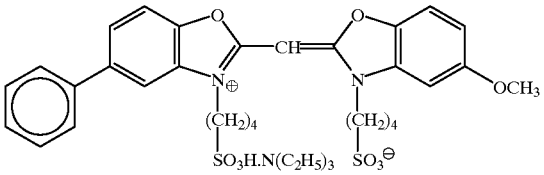

(b)

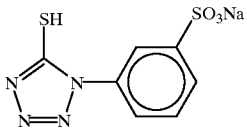

(c)

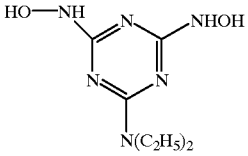

(d)

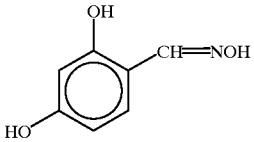

-continued (e)

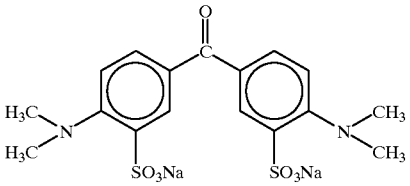

(f)

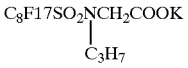

A back layer having the following formulation was coated.

(BC Layer)

| | |
|---|---|
| Gelatin | 1.5 g/m$^2$ |
| Surface active agent: | |
| Sodium p-dodecylbenzenesulfonate | 30 mg/m$^2$ |
| Gelatin hardening agent: | |
| 1,2-bis(vinylsulfonylacetamido)-ethane | 100 mg/m$^2$ |
| Dye: Mixture of the following Dyes (g), (h), (i) and (j) | |
| Dye (g) | 50 mg/m$^2$ |
| Dye (h) | 100 mg/m$^2$ |
| Dye (i) | 30 mg/m$^2$ |
| Dye (j) | 50 mg/m$^2$ |
| Proxel | 1 mg/m$^2$ |

Dyes added to the back layer of Light-Sensitive Material 3:

(g)

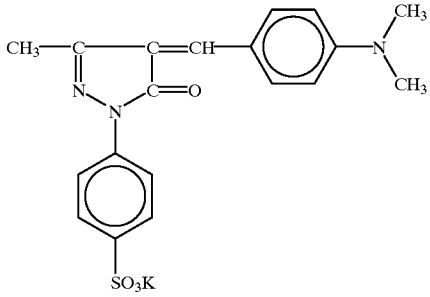

(h)

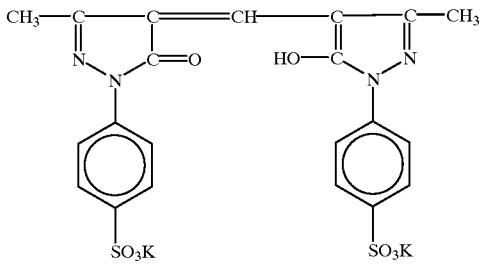

-continued (i)

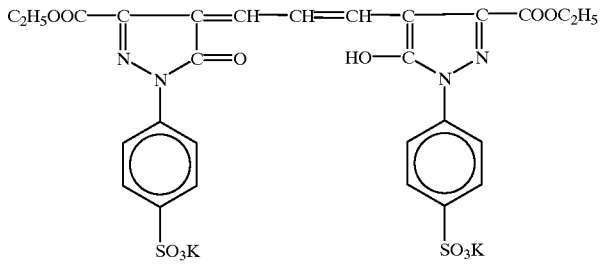

(j)

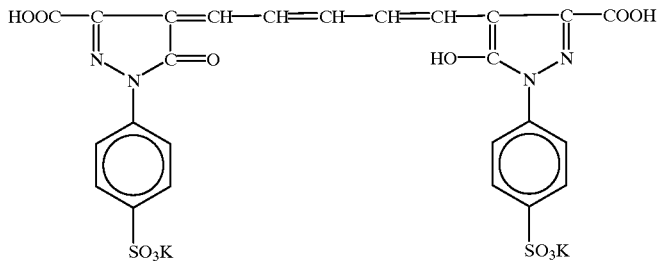

(OC Layer)

| | | |
|---|---|---|
| Gelatin | 1.5 | g/m$^2$ |
| Polymethyl methacrylate fine particles (average particle size: 2.5 μm) | 20 | mg/m$^2$ |
| Sodium p-dodecylbenzenesulfonate | 15 | mg/m$^2$ |
| Sodium dihexyl-α-sulfosuccinate | 15 | mg/m$^2$ |
| Sodium acetate | 50 | mg/m$^2$ |
| Proxel | 1 | mg/m$^2$ |

<Preparation of Exposed Sample for Evaluation of Photographic Capabilities>

Exposure was performed using a tungsten sensitometer through a filter having a color temperature of 3200° K. and a step wedge.

<Evaluation of Photographic Capabilities>

The photographic capabilities were evaluated by γ and D0510 in the same manner as in the light-sensitive material for Ar laser.

Light-Sensitive Material 4 (for dot-to-dot work):

<Preparation of Silver Halide Emulsion>

(Emulsion D)

To an aqueous 1.5% gelatin solution kept at 30° C., containing sodium chloride, $3\times10^{-5}$ mol/mol-Ag of sodium benzenesulfonate and $5\times10^{-3}$ mol/mol-Ag of 4-hydroxy-6-methyl-1,3,3a,7-tetraazaindene and having a pH of 2.0, an aqueous silver nitrate solution and an aqueous sodium chloride solution containing $4.0\times10^{-5}$ mol/mol-Ag of $K_2Ru(NO)Cl_5$ were added by a double jet method at a potential of 95 mV over 3 minutes and 30 seconds to consume a half of the silver amount of the final grain, thereby preparing core grains having a size of 0.10 μm.

Thereafter, an aqueous silver nitrate solution and an aqueous sodium chloride solution containing $4.0\times10^{-5}$ mol/mol-Ag of $K_2Ru(NO)Cl_5$ were added in the same manner as above over 7 minutes to prepare silver chloride grains having an average grain size of 0.13 μm (coefficient of variation: 13%).

The grains were washed with water by a flocculation method well known in the art to remove soluble salts, then gelatin was added, 60 mg/mol-Ag of proxel as an antiseptic was added, the pH and the pAg were adjusted to 5.7 and 7.5, respectively, and further $2\times10^{-5}$ mol/mol-Ag of sodium thiosulfate, $1\times10^{-5}$ mol/mol-Ag of selenium Sensitizer (Se-2) and $4\times10^{-5}$ mol/mol-Ag of chloroauric acid were added to perform chemical sensitization under heating at 65° C. for 60 minutes. Thereafter, $1\times10^{-3}$ mol/mol-Ag of 4-hydroxy-6-methyl-1,3,3a,7-tetraazaindene as a stabilizer was added. The grains obtained finally had a pH of 5.7, a pAg of 7.5 and an Ru content of $4\times10^{-5}$ mol/mol-Ag.

<Preparation of Coated Sample>

(Support and Undercoat Layer)

A first undercoat layer and a second undercoat layer each having the following composition were coated on both surfaces of a biaxially stretched polyethylene terephthalate support (thickness: 100 μm).

(Undercoat First Layer)

| | |
|---|---|
| Core-shell type vinylidene chloride copolymer (1) | 15 g |
| 2,4-Dichloro-6-hydroxy-s-triazine | 0.25 g |
| Polystyrene fine particle (average particle size: 3 μm) | 0.05 g |
| Compound O | 0.20 g |
| Colloidal silica (Snowtex ZL, produced by Nissan Chemical KK, particle size: 70 to 100 μm) | 0.12 g |
| Water to make | 100 g |

Further, the resulting coating solution was adjusted to have a pH of 6 by adding 10 wt % of KOH and coated at a drying temperature of 180° C. for 2 minutes to give a dry thickness of 0.9 μm.

(Undercoat Second Layer)

| | |
|---|---|
| Gelatin | 1 g |
| Methyl cellulose | 0.05 g |
| Compound P | 0.02 g |
| $C_{12}H_{25}O(CH_2CH_2O)_{10}H$ | 0.03 g |
| Compound A | $3.5\times10^{-3}$ g |
| Acetic acid | 0.2 g |
| Water to make | 100 g |

The resulting coating solution was coated at a drying temperature of 170° C. within 2 minutes to give a dry thickness of 0.1 μm, thus, a support having an undercoat layer was prepared.

Additives in Undercoat Layer of Light-Sensitive Material 4:

Core-shell-type vinylidene chloride copolymer (1)

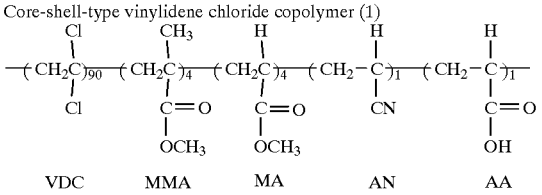

VDC MMA MA AN AA

Core: VDC/MMA/MA (80 wt %)
Shell: VDC/AN/AA (20 wt %)
Average grain size: 70 nm

Compound O

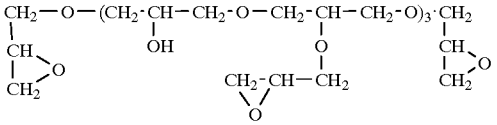

Compound P

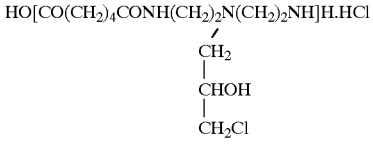

Compound A

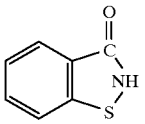

The EM, PC and OC layers were simultaneously coated on the support prepared above to superpose one on another in this order from the support side. The preparation method and the coated amount of each layer are shown below.

(EM)

The following compounds were added to Emulsion D and a silver halide emulsion layer was coated on the support having an undercoat layer prepared above to have a gelatin coated amount of 0.9 g/m$^2$ and a coated silver amount of 2.7 g/m$^2$.

| | | |
|---|---|---|
| 1-Phenyl-5-mercaptotetrazole | 1 | mg/m$^2$ |
| N-Oleyl-N-methyltaurin sodium salt | 10 | mg/m$^2$ |
| Compound B | 10 | mg/m$^2$ |
| Compound C | 8 | mg/m$^2$ |
| Compound D | 15 | mg/m$^2$ |
| n-Butyl acrylate/2-acetoacetoxyethyl methacrylate/acrylic acid copolymer (89/8/3) | 760 | mg/m$^2$ |
| Compound E (hardening agent) | 105 | mg/m$^2$ |
| Sodium polystyrenesulfonate | 57 | mg/m$^2$ |
| Hydrazine Compound D-10e | $3 \times 10^{-5}$ | mol/m$^2$ |
| Nucleation Accelerator F-14 | $3 \times 10^{-5}$ | mol/m$^2$ |

(PC)

The following compounds were added to an aqueous gelatin solution and coated to give a gelatin coated amount of 0.6 g/m$^2$.

| | | |
|---|---|---|
| Gelatin ($Ca^{++}$ content: 2,700 ppm) | 0.6 | g/m$^2$ |
| Sodium p-dodecylbenzenesulfonate | 10 | mg/m$^2$ |
| Sodium polystyrenesulfonate | 6 | mg/m$^2$ |
| Compound A | 1 | mg/m$^2$ |

-continued

| | | |
|---|---|---|
| Compound F | 14 | mg/m$^2$ |
| n-Butyl acrylate/2-acetoacetoxyethyl methacrylate/acrylic acid copolymer (89/8/3) | 250 | mg/m$^2$ |

(OC)

The following compounds were added to an aqueous gelatin solution and coated to give a gelatin coated amount of 0.45 g/m$^2$.

| | | |
|---|---|---|
| Gelatin ($Ca^{++}$ content: 2,700 ppm) | 0.45 | g/m$^2$ |
| Amorphous silica matting agent (average particle size: 3.5 $\mu$m, pore diameter: 25 Å, surface area: 700 m$^2$/g) | 40 | mg/m$^2$ |
| Amorphous silica matting agent (average particle size: 2.5 $\mu$m, pore diameter: 170 Å, surface area: 300 m$^2$/g) | 10 | mg/m$^2$ |
| N-Perfluorooctanesulfonyl-N-propylglycine potassium | 5 | mg/m$^2$ |
| Sodium p-dodecylbenzenesulfonate | 30 | mg/m$^2$ |
| Compound A | 1 | mg/m$^2$ |
| Liquid paraffin | 40 | mg/m$^2$ |
| Solid Disperse Dye $G_1$ | 30 | mg/m$^2$ |
| Solid Disperse Dye $G_2$ | 150 | mg/m$^2$ |
| Sodium polystyrenesulfonate | 4 | mg/m$^2$ |

Additives for EM surface of Light-Sensitive Material 4:

Compound A

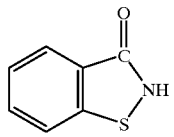

Compound B

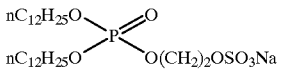

Compound C

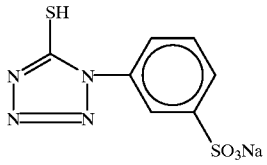

Compound D

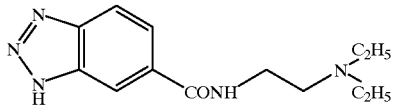

Compound E

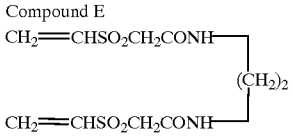

-continued

Compound F

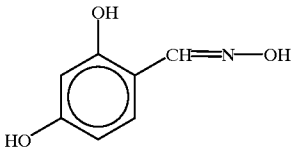

Solid Disperse Dye $G_1$

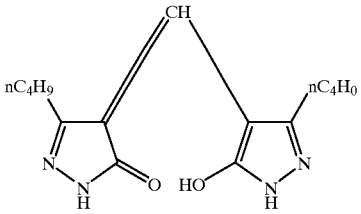

Solid Disperse Dye $G_2$

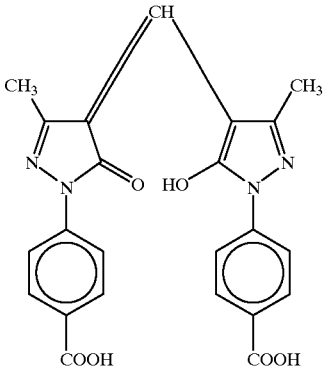

Then, on the opposite surface of the support, the following electrically conductive layer and backing layer (BC) were simultaneously coated.

(Electrically Conductive Layer)

The following compounds were added to an aqueous gelatin solution and coated to give a gelatin coated amount of 0.06 g/m$^2$.

| | | |
|---|---|---|
| $SnO_2$/Sb (9/1 by weight, average particle size: 0.25 μm) | 186 | mg/m$^2$ |
| Gelatin ($Ca^{++}$ content: 3,000 ppm) | 60 | mg/m$^2$ |
| Sodium p-dodecylbenzenesulfonate | 13 | mg/m$^2$ |
| Sodium dihexyl-α-sulfosuccinate | 12 | mg/m$^2$ |
| Sodium polystyrenesulfonate | 10 | mg/m$^2$ |
| Compound A | 1 | mg/m$^2$ |

(BC)

The following compounds were added to an aqueous gelatin solution and coated to give a gelatin coated amount of 1.94 g/m$^2$.

| | | |
|---|---|---|
| Gelatin ($Ca^{++}$ content: 30 ppm) | 1.94 | g/m$^2$ |
| Polymethyl methacrylate fine particle (average particle size: 3.4 μm) | 15 | mg/m$^2$ |
| Compound J | 140 | mg/m$^2$ |
| Compound K | 140 | mg/m$^2$ |
| Compound L | 30 | mg/m$^2$ |
| Compound M | 40 | mg/m$^2$ |
| Sodium p-dodecylbenzenesulfonate | 7 | mg/m$^2$ |
| Sodium dihexyl-α-sulfosuccinate | 29 | mg/m$^2$ |
| Compound N | 5 | mg/m$^2$ |
| N-Perfluorooctanesulfonyl-N-propylglycine potassium | 5 | mg/m$^2$ |
| Sodium sulfate | 150 | mg/m$^2$ |
| Sodium acetate | 40 | mg/m$^2$ |
| Compound E (hardening agent) | 105 | mg/m$^2$ |

Additives for BC surface of Light-Sensitive Material 4

Compound J

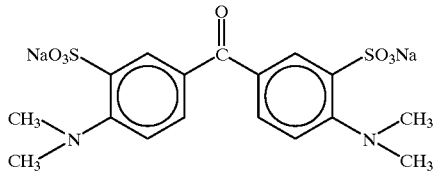

Compound K

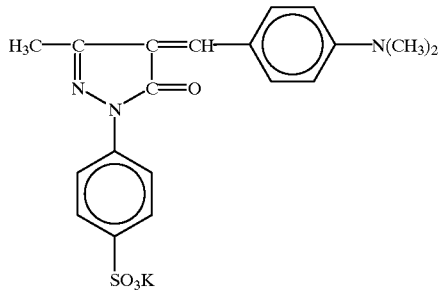

Compound L

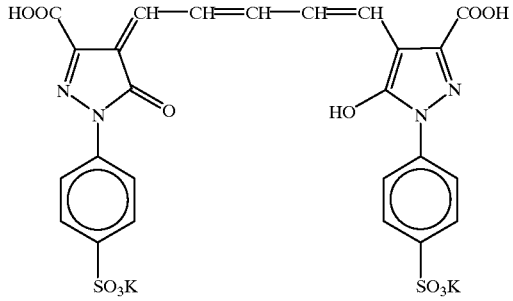

Compound M

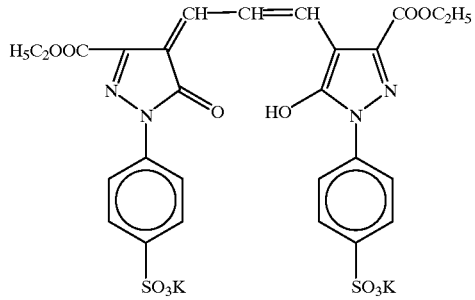

Compound N $C_8F_{17}SO_3Li$

<Preparation of Exposed Sample for Evaluation of Photographic Capabilities>

The thus obtained sample was exposed through a step wedge using a bright room printer P-627FM manufactured by Dainippon Screen Mfg. Co., Ltd.

<Evaluation of Photographic Capabilities>

The photographic capabilities were evaluated by γ and D0510 in the same manner as in the light-sensitive material for Ar laser.

The developer and the fixing solution used in the present invention each had the following formulation.

| Developer | | |
|---|---|---|
| Water | 700 | ml |
| Sodium hydroxide | 2.5 | g |
| Diethylenetriaminepentaacetic acid | 4.0 | g |
| Sodium carbonate monohydrate | 54.0 | g |
| Sodium sulfite | 5.0 | g |
| Sodium erythorbate | 40.0 | g |
| *Monol | 7.5 | g |
| Potassium bromide | 2.0 | g |
| Compound (X) | 0.075 | g |
| Diethylene glycol | 25.0 | g |
| Compound (Y) | 0.72 | g |
| Acetic acid (90%) | 10 | ml |
| pH (adjusted by NaOH or acetic acid) | 9.7 | |
| Water ($H_2O$) to make | 1 | l |

*Monol: N-methyl-p-aminophenol.1/2 sulfate

Additives for Developer A

Compound (X)

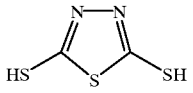

Compound Y

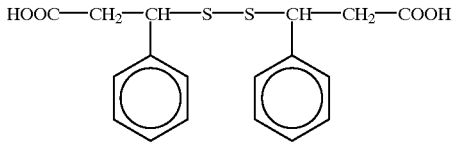

(Formulation of Fixing Solution)

| Fixing Solution A | | |
|---|---|---|
| Ammonium thiosulfate | 359.1 | g |
| Disodium ethylenediaminetetraacetate dihydrate | 0.09 | g |
| Sodium thiosulfate pentahydrate | 32.8 | g |
| Sodium sulfite | 75.0 | g |
| Sodium hydroxide | 37.2 | g |
| glacial acetic acid | 87.3 | g |
| Tartaric acid | 8.76 | g |
| Sodium gluconate | 6.6 | g |
| Aluminum sulfate | 25.3 | g |

-continued

| | | |
|---|---|---|
| pH (adjusted by sulfuric acid or sodium hydroxide) | 5.05 | |
| Water to make | 1 | l |

Water (2 l) was added to 1 l of the solution obtained above on use.

Fixing Solution B

Water was added to the following solid agent and liquid agent to make 10 l, thereby preparing a use solution. The fixing solution having the following formulation was packed, including both-the solid agent part and the liquid agent part, in a container (average wall thickness: 500 μm, width: from 200 to 1,000 μm) formed of a high density polyethylene. After dissolving, the amount of solution was 10 l and the pH was 4.85.

| Solid agent part | |
|---|---|
| Ammonium thiosulfate | 1,200 g |
| Sodium thiosulfate | 150 g |
| Sodium acetate | 400 g |
| Sodium metabisulfite | 200 g |
| Liquid agent part | |
| Aluminum sulfate (27%) | 300 g |
| Sulfuric acid (75%) | 30 g |
| Sodium gluconate | 20 g |
| EDTA | 0.3 g |
| Citric acid | 40 g |

The solid agent part was packed after mixing of the components.

EXAMPLE 1

Developers 2 to 23 were prepared thoroughly in the same manner as in the preparation of Developer 1 except for replacing Monol in Developer 1 with an equimolar amount of the compounds of formula (A) of the present invention.

Light-Sensitive Material 1 and Light-Sensitive Material 3 were developed with these developers. The development was performed in an automatic developing machine FH-710S (manufactured by Fuji Photo Film Co., Ltd.) at 35° C. for 11 seconds or at 35° C. for 30 seconds, and then fixing, water washing and drying were continuously performed. Fixing was performed using Fixing Solution A.

The results obtained are shown in Table 1.

TABLE 1

| | | Light-Sensitive Material 1 | | | Light-Sensitive Material 3 | | | |
|---|---|---|---|---|---|---|---|---|
| Process No. | Formula (A) | D0510 (11") | D0510 (30") | G0330 (30") | D0510 (11") | D0510 (30") | G0330 (30") | Remarks |
| 101 | Monol | 3.50 | 5.38 | 18 | 3.21 | 4.77 | 15 | Comparison |
| 102 | A-1 | 3.89 | 5.38 | 17 | 3.78 | 4.63 | 14 | Invention |
| 103 | A-2 | 4.42 | 5.38 | 22 | 4.57 | 4.74 | 14 | Invention |
| 104 | A-3 | 3.89 | 5.40 | 22 | 3.67 | 4.64 | 20 | Invention |
| 105 | A-116 | 4.54 | 5.38 | 22 | 4.59 | 4.68 | 20 | Invention |
| 106 | A-118 | 4.47 | 5.37 | 22 | 4.61 | 4.65 | 20 | Invention |
| 107 | A-10 | 3.85 | 5.40 | 18 | 3.66 | 4.75 | 18 | Invention |
| 108 | A-120 | 4.46 | 5.37 | 22 | 4.58 | 4.70 | 20 | Invention |
| 109 | A-18 | 3.79 | 5.35 | 20 | 3.68 | 4.70 | 17 | Invention |
| 110 | A-23 | 4.21 | 5.35 | 18 | 4.04 | 4.70 | 17 | Invention |

TABLE 1-continued

| Process No. | Formula (A) | Light-Sensitive Material 1 D0510 (11") | Light-Sensitive Material 1 D0510 (30") | Light-Sensitive Material 1 G0330 (30") | Light-Sensitive Material 3 D0510 (11") | Light-Sensitive Material 3 D0510 (30") | Light-Sensitive Material 3 G0330 (30") | Remarks |
|---|---|---|---|---|---|---|---|---|
| 111 | A-38 | 4.52 | 5.38 | 22 | 4.60 | 4.63 | 20 | Invention |
| 112 | A-4 | 3.95 | 5.40 | 18 | 3.79 | 4.66 | 14 | Invention |
| 113 | A-39 | 4.00 | 5.41 | 17 | 3.80 | 4.60 | 15 | Invention |
| 114 | A-43 | 4.23 | 5.40 | 18 | 4.07 | 4.81 | 15 | Invention |
| 115 | A-100 | 3.90 | 5.35 | 17 | 3.88 | 4.63 | 14 | Invention |
| 116 | A-14 | 3.85 | 5.37 | 17 | 3.67 | 4.63 | 14 | Invention |
| 117 | A-61 | 3.80 | 5.37 | 20 | 3.60 | 4.70 | 19 | Invention |
| 118 | A-64 | 3.95 | 5.33 | 20 | 3.80 | 4.62 | 14 | Invention |
| 119 | A-8 | 4.36 | 5.39 | 20 | 4.25 | 4.71 | 18 | Invention |
| 120 | A-78 | 4.11 | 5.35 | 20 | 4.06 | 4.66 | 16 | Invention |
| 121 | A-95 | 3.90 | 5.30 | 17 | 3.79 | 4.60 | 14 | Invention |
| 122 | A-103 | 3.95 | 5.35 | 19 | 4.00 | 4.65 | 15 | Invention |
| 123 | p-aminophenol | 1.82 | 3.50 | 5 | 1.66 | 3.01 | 7 | Comparison |

It is seen from the results in Table 1 that according to the processing of the present invention, initial development was fast in any process and ultrahigh contrast on a sufficiently high level could be obtained similarly to Process No. 101 for Comparison.

EXAMPLE 2

Light-Sensitive Material 2 was processed in the same manner as in Example 1 using the processing solutions used in Example 1, and as a result, similarly to Example 1, according to the processing of the present invention, initial development was fast and ultrahigh contrast capability was obtained.

EXAMPLE 3

Light-Sensitive Material 4 was processed using the processing solutions used in Example 1 in the same automatic developing machine as in Example 1 at 38° C. for 11 seconds or at 38° C. for 20 seconds, and then continuously subjected to fixing, water washing and drying. The fixing solution used was Fixing Solution A.

The results obtained are shown in Table 2.

TABLE 2

| Process No. | Formula (A) | D0510 (11") | D0510 ("20) | G0330 (20") | Remarks |
|---|---|---|---|---|---|
| 301 | Monol | 2.61 | 5.16 | 15 | Comparison |
| 302 | A-2 | 3.76 | 5.24 | 18 | Invention |
| 303 | A-3 | 3.23 | 5.26 | 21 | " |
| 304 | A-116 | 3.81 | 5.18 | 21 | " |
| 305 | A-10 | 3.22 | 5.20 | 16 | " |
| 306 | A-18 | 3.30 | 5.20 | 16 | " |
| 307 | A-118 | 3.80 | 5.22 | 21 | " |
| 308 | A-4 | 3.35 | 5.25 | 14 | " |
| 309 | A-43 | 3.37 | 5.22 | 15 | " |
| 310 | A-61 | 3.28 | 5.23 | 16 | " |
| 311 | A-8 | 3.64 | 5.23 | 15 | " |
| 312 | A-78 | 3.39 | 5.20 | 15 | " |
| 313 | A-95 | 3.52 | 5.18 | 14 | " |
| 314 | A-103 | 3.38 | 5.25 | 14 | " |

It is seen from the results in Table 2 that also in the processing of the light-sensitive material for dot-to-dot work, according to the processing with the developer of the present invention, initial development was fast and ultrahigh contrast capability could be obtained.

EXAMPLE 4

Processing solutions were prepared by replacing sodium erythorbate in Developer 1 with an equimolar amount of Compound B-6, B-7, B-19, B-23, -37 or B-43 of the present invention and replacing Monol with the compound of formula (A) of the present invention, and Light-Sensitive Materials 1 to 4 were developed with these processing solutions. Then, results similar to those obtained in Examples 1 to 3 were obtained.

EXAMPLE 5

Processings were performed using Fixing Solution B in place of Fixing Solution A in Example 1 and then, results similar to those obtained in Example 1 were obtained.

Examples using an X-ray light-sensitive material are described below.

<Preparation of {100} AgCl Tabular Emulsion A>

Into a reaction vessel, an aqueous gelatin solution (containing 19.5 g of Gelatin 1 (deionized alkali-processed ossein gelatin having a methionine content of about 40 $\mu$mol/g) and 7.8 ml of 1N solution of $HNO_3$, and having a pH of 4.3) and 13 ml of Solution NaCl-1 (an aqueous solution containing 10 g of NaCl per 100 ml thereof) were charged and while keeping the temperature at 40° C., Solution Ag-1 (an aqueous solution containing 20 g of $AgNO_3$ per 100 ml thereof) and Solution X-1 (an aqueous solution containing 7.05 of NaCl per 100 ml thereof) were added simultaneously each in an amount of 15.6 ml at a rate of 62.4 ml/min. After stirring for 3 minutes, Solution Ag-2 (an aqueous solution containing 2 g of $AgNO_3$ per 100 ml thereof) and Solution X-2 (an aqueous solution containing 1.4 g of KBr per 100 ml thereof) were added simultaneously each in an amount of 28.2 ml at a rate of 80.6 ml/min. After stirring for 3 minutes, Solution Ag-1 and Solution X-1 were added simultaneously each in an amount of 46.8 ml at a rate of 62.4 ml/min. After stirring for 2 minutes, 203 ml of an aqueous gelatin solution (containing 11.3 g of acid processed gelatin, 1.3 g of NaCl and 1N solution of NaOH for adjusting the pH at 5.5) was added to give a pCl of 1.8, the temperature was raised to 75° C., the pCl was adjusted to 1.8 and then ripening was performed for 10 minutes. Thereafter, Disulfide Compound A was added in an amount of $1\times10^{-4}$ mol per mol of silver halide and then, an AgCl fine grain emulsion (average grain diameter: 0.1 $\mu$m) was added at a rate, in terms of the addition rate of AgCl, of $2.68\times10^{-2}$ mol/min over 20 minutes. After the addition, the emulsion was ripened for 10 minutes, a precipitant was added, the temperature was lowered to 35° C. and then the emulsion was washed with water by precipitation. An aqueous gelatin solution was added and the pH was adjusted at 60° C. to 6.0.

Disulfide Compound A

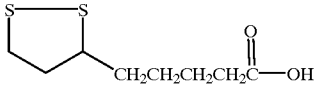

A transmission-type electron microphotographic image (hereinafter referred to as TEM) of a replica of the grain was observed. The resulting emulsion was a high silver chloride {100} face tabular grain containing 0.44 mol % of AgBr on a silver basis. The shape and the characteristic values of the grain are as follows:

(total projected area of tabular grains having an aspect ratio of 1 or more/sum of projected areas of all *Agx* grains) × 100 = $a_1$ = 90%;

(average aspect ratio (average diameter/average thickness) of tabular grains) = $a_2$ = 9.3;

(average diameter of tabular grains) = $a_3$ = 1.67 μm;

and (average thickness) = $a_4$ = 0.18 μm.

<Preparation of (111) AgCl Tabular Emulsion B>

Silver chloride tabular grains were prepared as follows.

| | | |
|---|---|---|
| Solution (1): | | |
| Inactive gelatin | 30 | g |
| Crystal Habit Controlling Agent A | 0.6 | g |
| Crystal Habit Controlling Agent B | 0.4 | g |
| Crystal Habit Controlling Agent A | | |

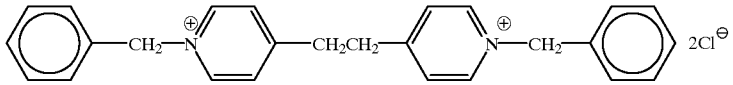

Crystal Habit Controlling Agent B

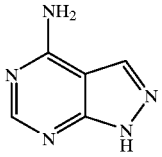

| | | |
|---|---|---|
| NaCl | 4 | g |
| $H_2O$ | 1,750 | ml |
| Solution (2): | | |
| $AgNO_3$ | 7.6 | g |
| $H_2O$ to make | 30 | ml |
| Solution (3): | | |
| NaCl | 2.8 | g |
| $H_2O$ to make | 30 | ml |
| Solution (4): | | |
| $AgNO_3$ | 24.5 | g |
| $H_2O$ to make | 96 | ml |
| Solution (5): | | |
| NaCl | 0.3 | g |
| $H_2O$ to make | 65 | ml |
| Solution (6): | | |
| $AgNO_3$ | 101.9 | g |
| $H_2O$ to make | 400 | ml |
| Solution (7): | | |
| NaCl | 37.6 | g |
| $H_2O$ to make | 400 | ml |

To Solution (1) kept at 35° C., Solution (2) and Solution (3) were added simultaneously at a constant addition rate while stirring over 1 minute and the temperature of the solution was elevated to 70° C. over 15 minutes. At this time, grains corresponding to about 5.7% of all silver amount were formed. Then, Solution (4) and Solution (5)

were added simultaneously at a constant addition rate over 24 minutes and further, Solution (6) and Solution (7) were added and grown over 40 minutes while keeping the addition rate of the silver nitrate solution constant so as to give pCl=10 by a controlled double jet method and as a result, a silver chloride tabular emulsion was obtained.

The emulsion was washed with water and desalted by precipitation, 30 g of gelatin and $H_2O$ were added thereto, 2.0 g of phenoxyethanol and 0.8 g of sodium polystyrenesulfonate as a thickener were added, and the emulsion was redispersed by caustic soda to have a pH of 6.0.

The thus-obtained emulsion was a silver chloride tabular emulsion comprising main planes of (111) face and having $a_1$=90%, $a_3$=1.55 μm, $a_4$=0.18 μm, $a_2$=8.6 and a coefficient of variation of the circle-corresponding projected area diameter of 19%.

<Preparation of {111} AgBr Tabular Emulsion C>

Into a container kept at 550° C. and containing 6.0 g of potassium bromide dissolved in 1 l of water and 7.0 g of a low molecular weight-gelatin having an average molecular weight of 15,000, 37 ml of aqueous silver nitrate solution (silver nitrate: 4.00 g) and 38 ml of an aqueous solution containing 5.9 g of potassium bromide were added while stirring by a double jet method over 37 seconds. Then, 18.6 g of gelatin was added, the temperature was raised to 70° C., and 89 ml of an aqueous silver nitrate solution (silver nitrate: 9.80 g) was added over 22 minutes. Here, 7 ml of an aqueous 25% ammonia solution was added, the emulsion was physically ripened for 10 minutes at the same temperature, and then 6.5 ml of a 100% acetic acid solution was added. Subsequently, an aqueous solution containing 153 g of silver nitrate and an aqueous solution of potassium bromide were added while keeping the pAg at 8.5 by a controlled double jet method over 35 minutes. Then, 15 ml of 2N potassium thiocyanate solution was added. After effecting physical ripening at the same temperature for 5 minutes, the temperature was lowered to 35° C. As a result, monodisperse pure silver bromide tabular grains having $a_1$=95%, $a_3$ (average projected area diameter)=1.50 μm, $a_4$ (thickness)=0.185 μm, $a_2$ (average aspect ratio)=8.1 and a coefficient of variation of the diameter of 18.5% were obtained.

Thereafter, soluble salts were removed by a precipitation method. The temperature was again raised to 40° C., then 30 g of gelatin, 2.35 g of phenoxyethanol and 0.8 g of sodium polystyrenesulfonate as a thickener were added and the pH and the pAg were adjusted to 5.90 and 8.00, respectively, with caustic soda and silver nitrate solution.

<Preparation of {111} AgBrCl Tabular Emulsion D>

Into a reaction vessel, an aqueous gelatin solution (containing 19.5 g of Gelatin 1 (deionized alkali-processed ossein gelatin having a methionine content of about 40 μmol/g) and 7.8 ml of 1N solution of $HNO_3$, and having a pH of 4.3) and 13 ml of Solution NaCl-1 (an aqueous solution containing 10 g of NaCl per 100 ml thereof) were charged and while keeping the temperature at 40° C., Solution Ag-1 (an aqueous solution containing 20 g of $AgNO_3$ per 100 ml thereof) and Solution X-1 (an aqueous solution containing 7.05 of NaCl per 100 ml thereof) were added simultaneously each in an amount of 15.6 ml at a rate of 62.4 ml/min. After stirring for 3 minutes, Solution Ag-2 (an aqueous solution containing 2 g of $AgNO_3$ per 100 ml thereof) and Solution X-2 (an aqueous solution containing 1.4 g of KBr per 100 ml thereof) were added simultaneously each in an amount of 28.2 ml at a rate of 80.6 ml/min. After stirring for 3 minutes, Solution Ag-1 and Solution X-1 were added simultaneously each in an amount of 46.8 ml at a rate of 62.4 ml/min. After stirring for 2 minutes, 203 ml of an aqueous gelatin solution (containing 13 g of Gelatin 1, 1.3 g of NaCl and 1N solution of NaOH for adjusting the pH at 5.5) was added to give a pCl of 1.8, the temperature was raised to 75° C., the pCl was adjusted to 1.8 and then ripening was performed for 10 minutes. Thereafter, Solution Ag-3 (an aqueous solution containing 50 ml of 100% $AgNO_3$ per 100 ml thereof) and Solution X-3 (an aqueous solution containing 23.5 g of NaCl and 71.4 g of KBr per 100 ml thereof) were prepared and grown by setting an addition rate of silver nitrate to $2.68\times10^{-2}$ mol/min by a controlled double jet method at pCl=1.8 for 20 minutes.

After the addition, the emulsion was ripened for 10 minutes, a precipitant was added, the temperature was lowered to 35° C. and then the emulsion was washed with water by precipitation. An aqueous gelatin solution was added thereto and the pH was adjusted at 60° C. to 6.0. A transmission-type electron microphotographic image (hereinafter referred to as TEM) of a replica of the grain was observed. The resulting emulsion was a high silver chloride {100} tabular grain containing about 53 mol % of AgBr on a silver basis. The shape and characteristic values of the grain are as follows:

(total projected area of tabular grains having an aspect ratio of 1 or more/sum of projected areas of all *Agx* grains) × 100 = $a_1$ = 90%;

(average aspect ratio (average diameter/average thickness) of tabular grains) = $a_2$ = 9.3;

(average diameter of tabular grains) = $a_3$ = 1.67 μm;

and (average thickness) = $a_4$ = 0.18 μm.

<Preparation of (111) AgCl Tabular Emulsions E and F>

Silver chloride tabular grains were prepared as follows.

Solution (1):

| | | |
|---|---|---|
| Inactive gelatin | 30 | g |
| Crystal Habit Controlling Agent A | 0.6 | g |
| Crystal Habit Controlling Agent B | 0.4 | g |

Crystal Habit Controlling Agent A

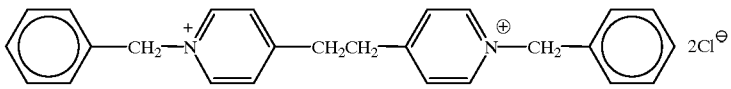

Crystal Habit Controlling Agent B

-continued

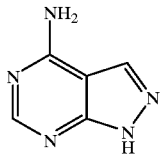

| | | |
|---|---|---|
| NaCl | 4 | g |
| $H_2O$ | 1,750 | ml |
| Solution (2): | | |
| $AgNO_3$ | 7.6 | g |
| $H_2O$ to make | 30 | ml |
| Solution (3): | | |
| NaCl | 2.8 | g |
| $H_2O$ to make | 30 | ml |
| Solution (4): | | |
| $AgNO_3$ | 24.5 | g |
| $H_2O$ to make | 96 | ml |
| Solution (5): | | |
| NaCl | 0.3 | g |
| $H_2O$ to make | 65 | ml |
| Solution (6): | | |
| $AgNO_3$ | 101.9 | g |
| $H_2O$ to make | 400 | ml |
| Solution (7): | | |
| NaCl | 14.4 | g |
| KBr | 47.0 | g |
| $H_2O$ to make | 400 | ml |

To Solution (1) kept at 35° C., Solution (2) and Solution (3) were added simultaneously at a constant addition rate while stirring over 1 minute and the temperature of the solution was elevated to 70° C. over 15 minutes. At this time, grains corresponding to about 5.7% of all silver amount were formed. Then, Disulfide Compound B was added in an amount of $1\times10^{-4}$ mol per mol of silver halide, Solution (4) and Solution (5) were added simultaneously at a constant addition rate over 24 minutes, further Solution (6) and Solution (7) were added and grown over 40 minutes while keeping the addition rate of silver nitrate solution so as to give pCl=0.8 by a controlled double jet method, and as a result, a silver chloride tabular emulsion was obtained.

The emulsion was washed with water and desalted by precipitation, 30 g of gelatin and $H_2O$ were added thereto, 2.0 g of phenoxyethanol and 0.8 g of sodium polystyrenesulfonate as a thickener were added, and the emulsion was redispersed by caustic soda to have a pH of 6.0.

The thus-obtained emulsion was a silver chloride tabular emulsion containing about 50% of Br, comprising main planes of (111) face and having $a_1$=90%, $a_3$=1.55 $\mu$m, $a_4$=0.18 $\mu$m, $a_2$=8.6 and a coefficient of variation of the circle-corresponding projected area diameter of 19%.

A silver chlorobromide tabular emulsion comprising main planes of (111) face was prepared by selecting the growth conditions in the above-described preparation of tabular grains so that the shape of grain, such as aspect ratio and grain size, could be the same as of the original tabular grain and adjusting the KBr content in Solution (7) to have a silver chloride content of 17% or 24%.

<Preparation of Monodisperse Cubic Silver Halide Emulsion G>

Into a container kept at 53° C. and containing 32 g of gelatin dissolved in 1 l of water, 0.3 g of potassium bromide, 5 g of sodium chloride and 46 mg of Compound (I):

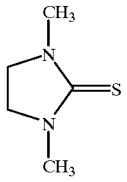

were charged, then 444 ml of an aqueous solution containing 80 g of silver nitrate and 452 ml of an aqueous solution Disulfide Compound B

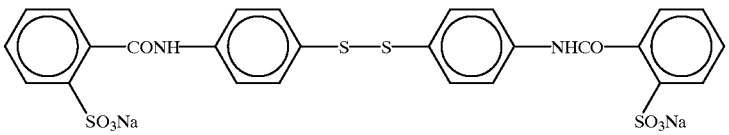

containing 45 g of potassium bromide and 5.5 g of sodium chloride were added by a double jet method over about 20 minutes and thereafter, 400 ml of an aqueous solution containing 80 g of silver nitrate and 415 ml of an aqueous solution containing 46.4 g of potassium bromide, 5.7 g of sodium chloride and potassium hexachloroiridate(III) ($10^{-7}$ mol/mol-Ag) were added by a double jet method over about 25 minutes to obtain a cubic monodisperse silver chlorobromide emulsion (coefficient of variation of the projected area diameter: 10%) having an average grain size (projected area diameter) of 0.34 $\mu$m.

The resulting emulsion was subjected to desalting by a coagulation method, 62 g of gelatin and 1.75 g of phenoxyethanol were added thereto, and then the pH and the pAg were adjusted to 6.5 and 8.5, respectively.

mol-Ag of 4-hydroxy-6-methyl-1,3,3a,7-tetraazaindene, Sensitizing Dye 1 and Sensitizing Dye 2 were added. Further, calcium chloride was added, and $1\times10^{-5}$ mol/mol-Ag of chloroauric acid and $3.0\times10^{-3}$ mol/mol-Ag of potassium thiocyanate were added. Subsequently, sodium thiosulfate ($6\times10^{-6}$ mol/mol-Ag) and Selenium Compound I ($4\times10^{-6}$ mol/mol-Ag) were added. After 3 minutes, a nucleic acid (0.5 mol/mol-Ag) was added. After 40 minutes, water-soluble Mercapto Compound 1 was added and the emulsion was cooled to 35° C.

Thus, the preparation (chemical ripening) of the emulsion was completed.

Thiosulfonic Acid Compound-I $C_2H_5SO_2SNa$

Sensitizing Dye-1

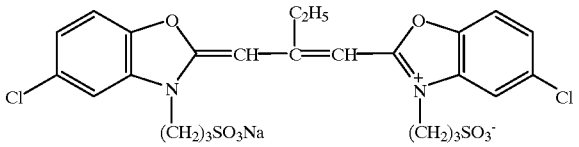

1 x $10^{-3}$ mol/mol-Ag

Sensitizing Dye-2

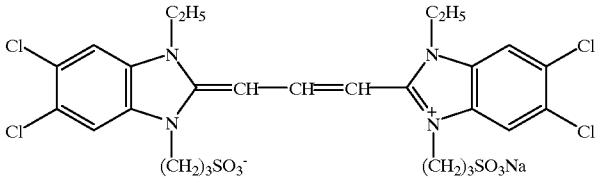

1 x $10^{-5}$ mol/mol-Ag

Selenium Compound I

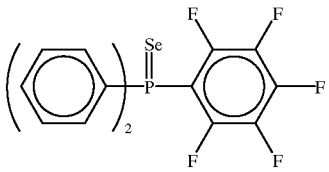

Water-soluble Mercapto Compound I

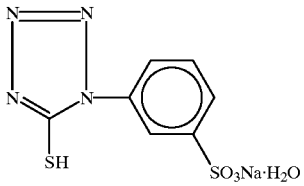

<Chemical Sensitization>

Grains prepared as described above each was subjected to chemical sensitization while stirring and keeping the temperature at 60° C. First, Thiosulfonic Acid Compound-I was added in an amount of $10^{-4}$ mol per mol of silver halide. Then, AgBr fine grains each having a diameter of 0.10 $\mu$m were added in an amount of 1.0 mol % based on the total silver amount, after 5 minutes, a 1% KI solution was added in an amount of $10^{-3}$ mol per mol of silver halide, and further after 3 minutes, $1\times10^{-6}$ mol/mol-Ag of thiourea dioxide was added. The state was kept as it is for 22 minutes to effect reduction sensitization. Thereafter, $3\times10^{-4}$ mol/

<Preparation of Emulsion Coated Layer>

An emulsion coating solution was prepared by adding following chemicals to the emulsion subjected to chemical sensitization. The addition amount of chemicals is per mol of silver halide.

| | | |
|---|---|---|
| Gelatin (including gelatin in emulsion) | 111 | g |
| Dextran (average molecular weight: 39,000) | 21.5 | g |
| Sodium polyacrylate (average molecular weight: 400,000) | 5.1 | g |
| Sodium polystyrenesulfonate | 1.2 | g |

-continued

| | | |
|---|---|---|
| (average molecular weight: 600,000) | | |
| Potassium iodide | 78 | mg |
| Hardener: | | |
| The addition amount was controlled so that 1,2-bis(vinylsulfonylacetamido)ethane had a swelling ratio of 230%. | | |
| Compound 1 | 42.1 | mg |
| Compound 2 | 10.3 | g |
| Compound 3 | 0.11 | g |
| Compound 4 | 8.5 | mg |
| Compound 5 | 0.43 | g |
| pH adjusted with NaOH | 6.1 | |

Compound 1

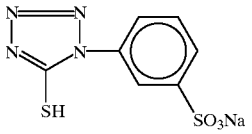

Compound 2

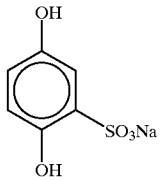

Compound 3

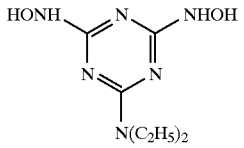

Compound 4

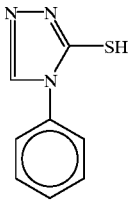

Compound 5

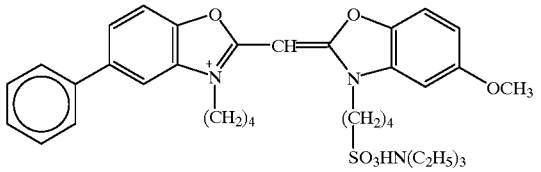

To the coating solution prepared above, Dye Emulsified Product I was added to have a Dye I coverage of 10 mg/m$^2$ per one surface.

Dye I

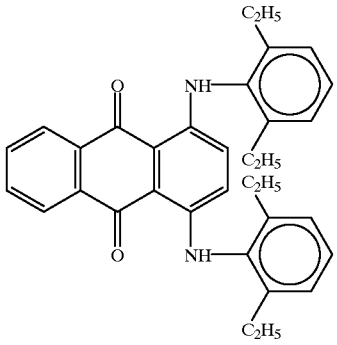

<Preparation of Dye Emulsified Product a>

The compound prepared above (60 g), 62.8 g of 2,4-diamylphenol, 62.8 g of dicylohexyl phthalate and 333 g of ethyl acetate were dissolved at 60° C. Then, 65 ml of a 5% aqueous solution of sodium dodecylbenzenesulfonate, 94 g of gelatin and 581 ml of water were added, and emulsion-dispersed by a dissolver at 60° C. for 30 minutes. Thereafter, 2 g of methyl p-hydroxybenzoate and 6 l of water were added, and the temperature was lowered to 40° C. The resulting solution was concentrated until the total weight was reduced to 2 kg using Ultrafiltration Labo Module ACP1050 manufactured by Asahi Chemical Industry Co., Ltd. and thereto, 1 g of methyl p-hydroxybenzoate was added to obtain Dye Emulsified Product a.

<Preparation of Coating Solution for Surface Protective Layer>

The coating solution for the surface protective layer was prepared to give a coating amount of each component as described below.

| | | |
|---|---|---|
| Gelatin | 0.780 | g/m$^2$ |
| Sodium polyacrylate (average molecular weight: 400,000) | 0.025 | g/m$^2$ |
| Sodium polystyrenesulfonate (average molecular weight: 600,000) | 0.0012 | g/m$^2$ |
| Polymethyl methacrylate (average particle size: 3.7 μm) | 0.072 | g/m$^2$ |
| Compound 6 | 0.018 | g/m$^2$ |
| Compound 7 | 0.037 | g/m$^2$ |
| Compound 8 | 0.0068 | g/m$^2$ |
| Compound 9 | 0.0032 | g/m$^2$ |
| Compound 10 | 0.0012 | g/m$^2$ |
| Compound 11 | 0.0022 | g/m$^2$ |
| Compound 12 | 0.030 | g/m$^2$ |
| Proxel | 0.0010 | g/m$^2$ |
| pH adjusted with NaOH | 6.8 | |

Compound 6

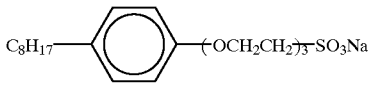

Compound 7

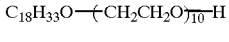

Compound 8

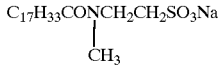

-continued

Compound 9

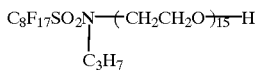

Compound 10

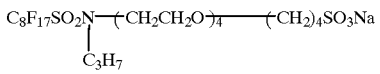

Compound 11

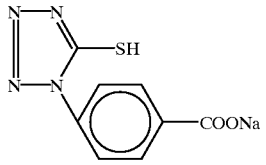

Compound 12

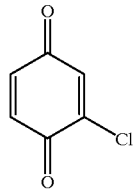

<Preparation of Support>

Preparation of Support for Comparison:

(1) Preparation of Dye Dispersion B for Undercoat Layer

The following Dye Compound II was subjected to ball mill treatment according to the method described in JP-A-63-197943.

Dye Compound II:

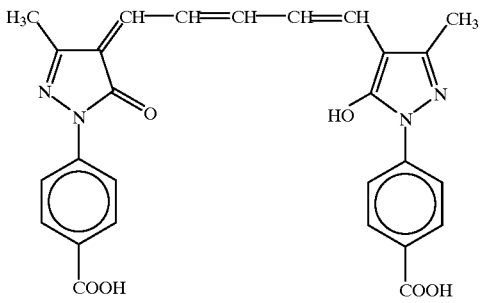

Into 2 l-volume ball mill, 434 ml of water and 791 ml of a 6.7% aqueous solution of a surface active agent Triton X200 (trademark) (TX-2000 (trademark)) were charged. To the resulting solution, 20 g of the Dye was added. Then, 400 ml of zirconium oxide ($ZrO_2$) beads (size: 2 ml) were added and the content was crushed for 4 days. Thereafter, 160 g of a 12.5% gelatin was added. After defoaming, $ZrO_2$ beads were removed by filtration. When the resulting dye dispersion was observed, the crushed dye had a wide particle size distribution of from 0.05 to 1.15 μm and the average particle size was 0.37 μm.

Dye particles having a size of 0.9 μm or more were removed by centrifugal separation. Thus, Dye Dispersion d was obtained.

(2) Preparation of Support

A biaxially stretched polyethylene terephthalate film having a thickness of 175 μm was subjected to surface treatment with corona discharge and thereon, the first undercoating solution having the following composition was coated by a wire convertor to give a coated amount of 4.9 ml/$m^2$ and dried at 185° C. for 1 minute.

On the opposite surface, the first undercoat layer was provided in the same manner. Dye Compounds 1, 3 and 4 were incorporated each in an amount of 0.04 wt % into polyethylene terephthalate used.

| | |
|---|---|
| Butadiene-styrene copolymer latex solution (butadiene having solid content of 40%/styrene = 31/69 by weight) | 158 ml |
| 2,4-Dichloro-6-hydroxy-s-triazine sodium salt 4% solution | 41 ml |
| Distilled water | 801 ml |

*The latex solution contained Compound 13 as an emulsion-dispersing agent in an amount of 0.4 wt % based on the latex solid content.

Dye Compound 1

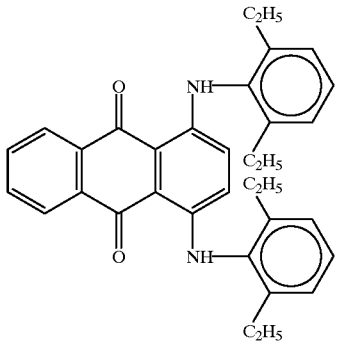

Dye Compound 3

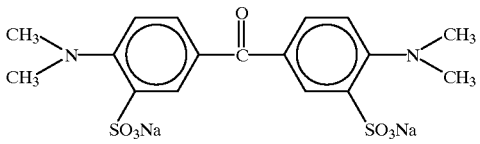

Dye Compound 4

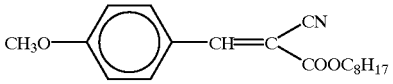

(Emulsion-Dispersing Agent) Compound 13

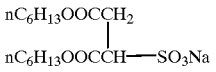

(contained in an amount of 0.4 wt % based on the latex solid content)

(3) Coating of Undercoat Layer

On the above-described first undercoat layer provided on both surfaces of the film, the second undercoat layer having the following composition was coated on each surface by a wire bar coder method to give the coated amount shown below and then dried at 155° C.

| | |
|---|---|
| Gelatin | 80 mg/m$^2$ |
| Dye Compound II (as dye solid content) | 8 mg/m$^2$ |
| Compound 14 | 1.8 mg/m$^2$ |
| Compound 12 | 0.27 mg/m$^2$ |
| Matting Agent: | |
| polymethyl methacrylate having an average particle size of 2.5 $\mu$m | 2.5 mg/m$^2$ |

Compound 14

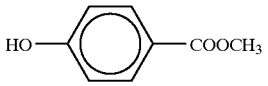

<Preparation of Photographic Material>

On both surfaces of the thus prepared support, the emulsion layer and the surface protective layer prepared above were coated in combination by a co-extrusion method. The coated silver amount was 1.4 g/m$^2$ per one surface. In this way, Samples 1 to 7 were prepared.

Each of the photographic materials obtained was measured on the swelling rate according to the method described in JP-A-58-111933 and then, the swelling rate was 180%.

<Evaluation of Photographic Capabilities>

Each of the light-sensitive materials prepared above was exposed to light from both surfaces for 0.05 second using Fuji Grenex Screen, HR-4 Screen or HG-M Screen manufactured by Fuji Photo Film Co., Ltd., or UV Super Rapid Screen manufactured by Du Pont. After exposure, each sample was subjected to TP processing in CEPROS-30 manufactured by Fuji Photo Film Co., Ltd. using the following developer and fixing solution, and evaluated on the sensitivity. The sensitivity was shown by a reciprocal of the ratio of the exposure amount necessary for giving a density of 1.0 in addition to fog, taking Sample 1 as a standard.

<Preparation of Concentrated Developer>

Concentrated Developer A comprising sodium erythorbate developing agent was prepared according to the following formulation.

| | | |
|---|---|---|
| Diethylenetriaminepentaacetic acid | 8.0 | g |
| Sodium sulfite | 20.0 | g |
| Sodium carbonate monohydrate | 52.0 | g |
| Potassium carbonate | 55.0 | g |
| Sodium erythorbate | 60.0 | g |
| 4-Hydroxymethyl-4-methyl-1-phenyl-3-pyrazolidone | 13.2 | g |
| 3,3'-Diphenyl-3,3'-dithiopropionic acid | 1.44 | g |
| Diethylene glycol | 50.0 | g |
| Compound 15 | 10 | g |
| Water to make | 1 | l |
| pH adjusted by sodium hydroxide | 10.1 | |

Compound 15

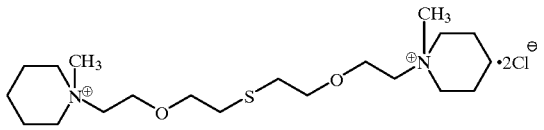

<Preparation of Development Replenisher>

The concentrated developer prepared above was two-fold diluted and used as a development replenisher.

<Preparation of Development Mother Solution>

The concentrated developer prepared above (2 l) was diluted with water to make 4 l, a starter solution having the following composition was added in an amount of 55 ml per l of the diluted developer, and the resulting developer having a pH of 9.5 was used as the development mother solution.

Starter Solution:

| | |
|---|---|
| Potassium bromide | 11.1 g |
| Acetic acid | 10.8 g |
| Water to make | 55 ml |

<Preparation of Concentrated Fixing Solution>

A concentrated fixing solution having the following formulation was prepared.

| | |
|---|---|
| Water | 0.5 l |
| Ethylenediaminetetraacetic acid dihydrate | 0.05 g |
| Sodium thiosulfate | 200 g |
| Sodium bisulfite | 98.0 g |
| Sodium hydroxide | 2.9 g |
| pH was adjusted with NaOH to 5.2 and water was added to make 1 l. | |

<Preparation of Fixing Replenisher>

The concentrated fixing-solution prepared above was two-fold diluted and used as a fixing replenisher.

<Preparation of Fixing Mother Solution>

The concentrated fixing solution prepared above (2 l was diluted with water to make 4 l. The pH was 5.4.

<Processing Procedure of Photographic Material>

Each sample was processed using the development mother solution and the fixing mother solution, prepared above, while supplying the development replenisher and the fixing replenisher each in an amount of 65 ml per m$^2$ of the light-sensitive material.

| Step | Temperature | Processing Time |
|---|---|---|
| Development | 35° C. | 8 seconds |
| Fixing | 35° C. | 8 seconds |
| Water washing | 25° C. | 7 seconds |
| Drying | 55° C. | 6 seconds |

EXAMPLE 6

Developers 2 to 23 were prepared thoroughly in the same manner as the above-described concentrated developer except for replacing 4-hydroxymethyl-4-methyl-1-phenyl-3-pyrazolidone in the concentrated developer with an equimolar amount of the compound of formula (A) of the present invention.

Coated Sample 1 prepared above was developed with these developers. The development was performed in an automatic developing machine CEPROS 30 (manufactured by Fuji Photo Film Co., Ltd.) at 35° C. for 8 seconds, and subsequently, fixing, water washing and drying were continuously performed. The fixing solution used was the fixing solution prepared above. The results obtained are shown in Table 3.

TABLE 3

| Process No. | Formula (A) | Sensitivity | Fog | Remarks |
|---|---|---|---|---|
| 601 | 4-hydroxymethyl-4-methyl-1-phenyl-3-pyrazolidone | 100 | 0.15 | Comparison |
| 602 | A-1 | 120 | 0.14 | Invention |
| 603 | A-2 | 150 | 0.13 | " |
| 604 | A-3 | 120 | 0.13 | " |

TABLE 3-continued

| Process No. | Formula (A) | Sensitivity | Fog | Remarks |
|---|---|---|---|---|
| 605 | A-116 | 170 | 0.14 | " |
| 606 | A-118 | 170 | 0.12 | " |
| 607 | A-10 | 120 | 0.14 | " |
| 608 | A-120 | 170 | 0.12 | " |
| 609 | A-18 | 120 | 0.14 | " |
| 610 | A-23 | 150 | 0.13 | " |
| 611 | A-38 | 170 | 0.14 | " |
| 612 | A-4 | 140 | 0.15 | " |
| 613 | A-39 | 150 | 0.12 | " |
| 614 | A-43 | 130 | 0.14 | " |
| 615 | A-100 | 130 | 0.10 | " |
| 616 | A-14 | 120 | 0.14 | " |
| 617 | A-61 | 120 | 0.13 | " |
| 618 | A-64 | 170 | 0.11 | " |
| 619 | A-8 | 150 | 0.12 | " |
| 620 | A-78 | 130 | 0.13 | " |
| 621 | A-95 | 130 | 0.11 | " |
| 622 | A-103 | 150 | 0.12 | " |
| 623 | p-aminophenol | 70 | 0.14 | Comparison |

It is seen from the results in Table 22 that according to the processing of the present invention, excellent photographic capabilities could be obtained in rapid processing.

EXAMPLE 7

Each of Coated Samples 2 to 7 prepared above was developed with the processing solutions used in Example 6 in the same manner as in Example 6 and as a result, similarly to Example 6, according to the process of the present invention, excellent photographic capabilities such as high sensitivity and low fogging could be obtained in rapid processing.

EXAMPLE 8

Processing solutions were prepared by replacing sodium erythorbate in the processing solution used in Example 6 with an equimolar amount of Compound B-6, B-7, B-19, B-23, B-37 or B-43 of the present invention and replacing Monol with the compound of formula (A), and each of Coated Samples 2 to 7 was developed with these processing solutions. Then, results similar to those obtained in Examples 6 and 7 were obtained.

EXAMPLE 9

<Preparation of Emulsion E>

| | | |
|---|---|---|
| Solution 1: | | |
| Water | 1 | l |
| Gelatin | 20 | g |
| Sodium chloride | 3.0 | g |
| 1,3-Dimethylimidazolidine-2-thione | 20 | mg |
| Sodium benzenethiosulfonate | 8 | mg |
| Solution 2: | | |
| Water | 0.4 | l |
| Silver nitrate | 100 | g |
| Solution 3: | | |
| Water | 0.4 | l |
| Sodium chloride | 27.1 | g |
| Potassium bromide | 21.0 | g |
| Ammonium hexachloroiridate(III) (0.001% aqueous solution) | 20 | ml |
| Potassium hexachlororhodate(III) (0.001% aqueous solution) | 6 | ml |

To Solution 1 kept at 42° C. and a pH of 4.5, Solution 2 and Solution 3 were simultaneously added over 15 minutes while stirring to form core grains. Thereto, Solution 4 and Solution 5 shown below were added over 15 minutes. Further, 0.15 g of potassium iodide was added and the grain formation was completed.

| | | |
|---|---|---|
| Solution 4: | | |
| Water | 0.4 | l |
| Sodium nitrate | 100 | g |
| Solution 5: | | |
| Water | 0.4 | l |
| Sodium chloride | 27.1 | g |
| Potassium bromide | 21.0 | g |
| Potassium hexacyanoferrate(II) (0.1% aqueous solution) | 10 | ml |

The emulsion obtained was washed with water by a flocculation method according to a usual method and thereto, 40 g of gelatin was added.

The pH and the pAg were adjusted to 5.7 and 7.5, respectively, and 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to perform chemical sensitization to give an optimal sensitivity at 55° C.

Further, 100 mg of 4-hydroxy-6-methyl-1,3,3a,7-tetrazaindene as a stabilizer and phenoxyethanol as an antiseptic were added and finally, Silver Chloroiodobromide Cubic Emulsion E having a silver chloride content of 70 mol % and an average grain size of 0.25 $\mu$m was obtained.

Preparation of Coated Sample:

To Emulsion E, $^{3.8\times10-4}$ mol/mol-Ag of Sensitizing Dye (S-3) was added to effect spectral sensitization. Then, $3.4\times10^{-4}$ mol/mol-Ag of KBr, $3.2\times10^{-4}$ mol/mol-Ag of Compound (C), $8.0\times10^{-4}$ mol/mol-Ag of Compound (D), $1.2\times10^{-2}$ mol/mol-Ag of hydroquinone, $3.0\times10^{-3}$ mol/mol-Ag of citric acid, $1.0\times10^{-4}$ mol/mol-Ag of Hydrazine Compound (D-2b), $6.0\times10^{-4}$ mol/mol-Ag of Nucleation Accelerator E-12, 35 wt % on a gelatin basis of polyethyl acrylate latex, 20 wt % on a gelatin basis of colloidal silica having a particle size of 10 m$\mu$, and 4 wt % on a gelatin basis of Compound (B) were added. The resulting mixture was coated on a polyester support to have an Ag coverage of 3.7 g/m$^2$ and a gelatin coverage of 1.6 g/m$^2$. Further, a protective upper layer and a protective lower layer each having the following composition were coated thereon, and a UL layer having the following composition was coated thereunder.

| | | |
|---|---|---|
| (Protective Upper Layer) | | |
| Gelatin | 0.3 | g/m$^2$ |
| Silica matting agent having an average particle size of 3.5 $\mu$m | 25 | mg/m$^2$ |
| Compound-14 (gelatin dispersion) | 20 | mg/m$^2$ |
| Colloidal silica having a particle size of from 10 to 20 $\mu$m | 30 | mg/m$^2$ |
| Compound (F) | 5 | mg/m$^2$ |
| Sodium dodecylbenzenesulfonate | 20 | mg/m$^2$ |
| Compound (G) | 20 | mg/m$^2$ |
| (Protective Lower Layer) | | |
| Gelatin | 0.5 | g/m$^2$ |
| Compound (H) | 15 | mg/m$^2$ |
| 1,5-Dihydroxy-2-benzaldoxime | 10 | mg/m$^2$ |
| Polyethyl acrylate latex | 150 | mg/m$^2$ |
| (UL Layer) | | |
| Gelatin | 0.5 | g/m$^2$ |
| Polyethyl acrylate latex | 150 | mg/m$^2$ |

-continued

| | | |
|---|---|---|
| Compound (B) | 40 | mg/m$^2$ |
| Compound 15 | 10 | mg/m$^2$ |

The support of the sample used in this Example had a back layer and an electrically conductive layer each having the following composition.

| (Back Layer) | | |
|---|---|---|
| Gelatin | 3.3 | g/m$^2$ |
| Sodium dodecylbenzenesulfonate | 80 | mg/m$^2$ |
| Dye (a) | 40 | mg/m$^2$ |
| Dye (b) | 20 | mg/m$^2$ |
| Dye (c) | 90 | mg/m$^2$ |
| 1,3-Divinylsulfonyl-2-propanol | 60 | mg/m$^2$ |

-continued

| | | |
|---|---|---|
| Polymethyl methacrylate fine particle (average particle size: 6.5 $\mu$m) | 30 | mg/m$^2$ |
| Compound (B) | 120 | mg/m$^2$ |
| (Electrically Conductive Layer) | | |
| Gelatin | 0.1 | g/m$^2$ |
| Sodium dodecylbenzenesulfonate | 20 | mg/m$^2$ |
| $SnO_2$/Sb (9/1 by weight, average particle size: 0.25 $\mu$m) | 200 | mg/m$^2$ |

Compounds C, B, F and G and Dyes (a), (b) and (c) were the same as those used in Light-Sensitive Material 1, respectively, and Sensitizing Dye (S-3) and Compound H were the same as those used in Light-Sensitive Material 2, respectively. Hydrazine Compound (D-2b), Nucleation Accelerator E-12, Compounds 14 and 15 are shown below.

Compound 14

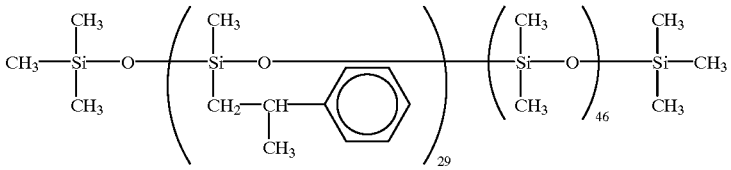

Compound 15

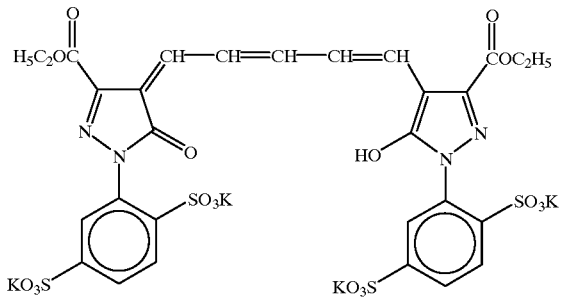

Hydrazine Compound (D-2b)

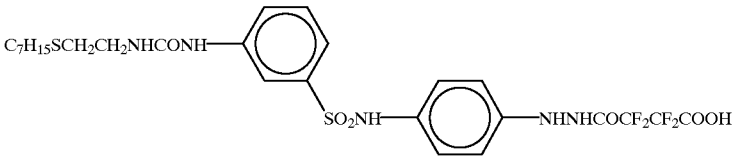

Nucleation Accelerator E-12

$(\phi)_3\text{-}P^{\cdot}\text{-}(CH_2)_9\text{-}P^{\cdot}(\phi)_3\cdot 2Br^{\ominus}$

TABLE 4

| Composition of Developer<br>Composition of Developer (Water was added to make 1 l. The pH was adjusted by using sodium hydroxide and acetic acid.) | No. | | | | | | |
|---|---|---|---|---|---|---|---|
| | 1 | 2 | 3 | 4 | 5 | 6 | 7 |
| Diethylenetriamine pentaacetic acid (g) | 2 | 2 | 2 | 2 | 2 | 2 | 2 |

TABLE 4-continued

| Composition of Developer<br>Composition of Developer (Water was added to make 1 l. The pH was adjusted by using sodium hydroxide and acetic acid.) | No. | | | | | | |
|---|---|---|---|---|---|---|---|
| | 1 | 2 | 3 | 4 | 5 | 6 | 7 |
| Potassium carbonate (g) | 33 | 33 | 33 | 33 | 33 | 33 | 33 |
| Sodium carbonate (g) | 28 | 28 | 28 | 28 | 28 | 28 | 28 |
| Sodium hydrogencarbonate (g) | 25 | 25 | 25 | 25 | 25 | 25 | 25 |
| Sodium erythorbate (g) | 45 | 45 | 45 | 45 | 45 | 45 | 45 |
| N-Methyl-p-aminophenol (g) | 7.5 | — | — | — | — | 1 | — |
| Compound (A-2) (g) | — | 1 | — | — | — | — | — |
| Compound (A-116) (g) | — | — | 1 | — | — | — | 1 |
| Compound (A-118) (g) | — | — | — | 1 | — | — | — |
| Compound (A-119) (g) | — | — | — | — | 1 | — | — |
| KBr (g) | 2 | 2 | 2 | 2 | 2 | 2 | 2 |
| 5-Methylbenzotriazole (g) | 0.004 | 0.004 | 0.004 | 0.004 | 0.004 | 0.004 | 0.004 |
| 1-Phenyl-5-mercapto-tetrazole (g) | 0.02 | 0.02 | 0.02 | 0.02 | 0.02 | 0.02 | 0.02 |
| Sodium sulfite (g) | 2 | 2 | 2 | 2 | 2 | 2 | 2 |
| pH | 9.7 | 9.7 | 9.7 | 9.7 | 9.7 | 9.7 | 10.6 |
| Container coloration after thermo | 2 | 4 | 4 | 4 | 4 | 4 | 3 |
| Remarks | Comparison | Invention | Invention | Invention | Invention | Comparison | Invention |

| | | |
|---|---|---|
| Ammonium thiosulfate | 360 | g |
| Disodium ethylenediaminetetraacetate dihydrate | 0.09 | g |
| Sodium sulfate pentahydrate | 33.0 | g |
| Sodium metasulfite | 57.0 | g |
| Sodium hydroxide | 37.2 | g |
| Acetic acid (100%) | 90.0 | g |
| Tartaric acid | 8.7 | g |
| Sodium gluconate | 5.1 | g |
| Aluminum sulfate | 25.2 | g |
| pH | 4.85 | |

The fixing solution was diluted on use by 2 parts of water per 1 part of the above-described concentrated solution. The solution used had a pH of 4.8.

The evaluation was performed according to the following methods.

With respect to the container coloration after thermo of the developer, the developer prepared was stored at 60° C. in a 100 ml-size poly bottle (construction material: polyethylene) airtightly closed with a stopper, and the container coloration of the poly bottle was examined and evaluated by a sensory rating of from point 1 to point 5. As the higher the point is, the less the coloration is, and the practically tolerable level is point 4 or higher. The results obtained are shown in Table 4.

For evaluating the photographic properties, the samples prepared each was exposed to a xenon flash light for a light emission time of $10^{-5}$ sec using an optical wedge through an interference filter having a peak at 633 nm. The sensitivity is shown as a relative value taking the reciprocal of the exposure amount necessary for obtaining a density of 1.5 on processing with Developer No. 1 shown in Table 19, as 100. The larger the value is, the higher the sensitivity is. The gradation (gamma) was obtained according to the following formula. The larger the value obtained is, the higher contrast the photographic property is.

$$*\text{gamma} = (3.0 - 0.3) / [\log(\text{exposure amount necessary for giving a density of } 3.0) - \log(\text{exposure amount necessary for giving a density of } 3.0)]$$

The evaluation results are shown in Table 5.

TABLE 5

| No. | Developer No. | Sensitivity | Gradation | Remarks |
|---|---|---|---|---|
| 1 | 1 | 100 | 22.0 | Comparison |
| 2 | 2 | 103 | 22.5 | Invention |
| 3 | 3 | 102 | 22.3 | Invention |
| 4 | 4 | 100 | 22.1 | Invention |
| 5 | 5 | 102 | 22.0 | Invention |
| 6 | 6 | 80 | 7.9 | Comparison |
| 7 | 7 | 108 | 27.0 | Comparison |

In case of the combination of the compounds of the present invention, the sensitivity is good and an ultrahigh contrast image can be obtained without undergoing any coloration of the container. When N-methyl-p-aminophenol is used, an ultrahigh contrast image and a good result with respect to the container coloration cannot be achieved at the same time.

EXAMPLE 10

Using the light-sensitive material, the developers and the fixing solution used in Example 9, a running test was performed in FG-520AG manufactured by Fuji Photo Film Co., Ltd. The running conditions were such that 16 sheets of each sample in a full size (50.8×61.0 cm) subjected to half expose were processed per day and assuming that 1 round running consists of 6 day operation and 1 day leisure, 6 rounds were done. For the evaluation of photographic properties, each sample was exposed in the same manner as in Example 9. The fixing solution was replenished during the running in an amount of 1.5 times the replenishing amount of developer.

The processing was performed under the conditions such that the development time was 20 seconds, the development temperature was 35° C. and the fixing temperature was 34° C. The mother solution was the developer used in Example 1 as it is and the pH of the replenisher was adjusted as shown in Table 27. The sensitivity of the running fatigue solution is required in practice to fall within the range of from 95 to 105.

With respect to the dot quality after running, a 50% plain net having 100 lines was output on the coated light-sensitive material using a color scanner SG-608 with helium light source, manufactured by Dainippon Screen Mfg. Co., Ltd. The taillessness of dots was visually evaluated through a magnifier of 200 times. The evaluation results are shown in the table below by a 5 point method of from 5 (good) to 1 (bad). The rating of point 3 or higher is necessary for practical use. The evaluation results are shown in Table 6.

TABLE 6

| No. | pH of Replenisher | Developer No. | Replenishing Amount of Developer ($ml/m^2$) | Fresh Sensitivity | Fresh Gradation | After Running Sensitivity | After Running Gradation | Dot Quality | Remarks |
|---|---|---|---|---|---|---|---|---|---|
| 8 | 9.7 | 1 | 160 | 100 | 22.0 | 95 | 18.4 | 3.0 | Comparison |
| 9 | 9.7 | 3 | 160 | 102 | 22.3 | 95 | 18.8 | 4.5 | Invention |
| 10 | 9.7 | 4 | 160 | 100 | 22.1 | 96 | 18.7 | 4.5 | Invention |
| 11 | 10.1 | 1 | 80 | 100 | 22.0 | 95 | 18.5 | 2.5 | Comparison |
| 12 | 10.1 | 2 | 80 | 103 | 22.5 | 96 | 19.2 | 4.0 | Invention |
| 13 | 10.1 | 4 | 80 | 100 | 22.1 | 95 | 18.8 | 4.0 | Invention |

In case of using the compounds of the present invention in combination, even in the running processing, fluctuation in the photographic properties is small and the dot quality is good. Particularly, when low replenishment is made, stable processability can be obtained by raising the pH of the replenisher.

EXAMPLE 11

A solid dispersion of a hydrazide compound as a nucleating agent was prepared as follows and used.

A 25% aqueous solution of Demole SNB (produced by Kao Corporation) was prepared. Then, to 1 g of a hydrazine compound, 1.2 g of the Demole SNB aqueous solution and 59 g of water were added and mixed to form a slurry. The resulting slurry was placed in a disperser (1/16 gallon, a sand grinder mill manufactured by Imex K. K.) and dispersed using 200 g of glass beads having a diameter of from 0.8 to 1.2 mm as media for 10 hours. Then, an aqueous gelating solution was added thereto and mixed to have a hydrazine compound concentration of 1% and a gelatin concentration of 5%, and 2,000 ppm on a gelatin basis of proxel as an antiseptic was added. Finally, an ascorbic acid was added to adjust the pH to 5.0.

A light-sensitive material using the solid dispersion of a hydrazide compound was examined in the same manner as in Example 10 and similar results were obtained.

EXAMPLE 12

Processing Solutions 1202, 1203, 1204, 1205, 1206, 1207, 1208, 1209, 1210, 1211, 1212, 1213, 1214, 1215, 1216, 1217, 1218, 1219, 1220 and 1222 each was prepared in the same manner as Processing Solution No. 101 in Example 1 except for replacing the Monol used with an equimolar amount of A'-4, A'-8, A'-1, A'-2, A'-3, A'-7, A'-89, A'-11, A'-24, A'-12, A'-10, A'-59, A'-62, A'-14, A'-18, A'-65, A'-21, A'-128, A'-26, A'-22 or A'-31, respectively. Using these solutions, development was performed in the same manner as in Example 1. Then, almost the same results were obtained, for Processing Solution

1202,as in the case of using Processing Solution 102; for Processing Solution 1203, as in the case of using Processing Solution 103; for Processing Solution 1204, as in the case of using Processing Solution 104; for Processing Solution 1205, as in the case of using Processing Solution 105; for Processing Solution 1206, as in the case of using Processing Solution 106; for Processing Solution 1207, as in the case of using Processing Solution 107; for Processing Solution 1208, as in the case of using Processing Solution 108; for Processing Solution 1209, as in the case of using Processing Solution 109; for Processing Solution 1210, as in the case of using Processing Solution 110; for Processing Solution 1211, as in the case of using Processing Solution 111; for Processing Solution 1212, as in the case of using Processing Solution 112; for Processing Solution 1213, as in the case of using Processing Solution 113; for Processing Solution 1214, as in the case of using Processing Solution 114; for Processing Solution 1215, as in the case of using Processing Solution 115; for Processing Solution 1216, as in the case of using Processing Solution 116; for Processing Solution 1217, as in the case of using Processing Solution 117; for Processing Solution 1218, as in the case of using Processing Solution 118; for Processing Solution 1219, as in the case of using Processing Solution 119; for Processing Solution 1220, as in the case of using Processing Solution 120; for Processing Solution 1221, as in the case of using Processing Solution 121; and for Processing Solution 1222, as in the case of using Processing Solution 122.

EXAMPLE 13

The following developer was prepared.

| Composition of Developer: | | |
|---|---|---|
| Developing agent shown in Table 19 | | |
| Aminophenol derivative shown in Table 19 | | |
| Diethylenetriaminepentaacetic acid | 2 | g |
| Potassium carbonate | 33 | g |
| Sodium carbonate | 28 | g |
| Sodium hydrogencarbonate | 25 | g |
| KBr | 0.2 | g |
| 5-Methylbenzotriazole | 0.004 | g |
| 1-Phenyl-5-mercaptotetrazole | 0.02 | g |
| Sodium sulfite | 2 | g |

Water was added to make 1 l, and the pH was adjusted to 9.7.

TABLE 7

| Developer No. | Developing Agent (g/l) | | Aminophenol Derivative (g/l) | | Remarks |
|---|---|---|---|---|---|
| 1 | hydroquinone | 23 | N-methyl-p-aminophenol | 7.5 | Comparison |
| 2 | sodium erythorbate | 45 | N-methyl-p-aminophenol | 7.5 | Comparison |
| 3 | hydroquinone | 23 | A-115 | 3.6 | Invention |
| 4 | hydroquinone | 23 | A-2 | 3.6 | Invention |
| 5 | hydroquinone | 23 | A-139 | 5.0 | Invention |
| 6 | sodium erythorbate | 45 | A-115 | 3.6 | Invention |
| 7 | sodium erythorbate | 45 | A-2 | 3.6 | Invention |
| 8 | sodium erythorbate | 45 | A-139 | 5.0 | Invention |
| 9 | sodium erythorbate | 45 | A-3 | 3.0 | Invention |
| | | | A-128 | 0.6 | |
| 10 | sodium erythorbate | 45 | A-115 | 1.0 | Invention |
| | | | AM-1 | 2.5 | |

AM-1

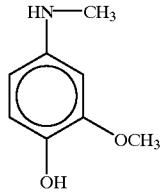

A solid dispersion of each of Hydrazine Derivatives 1c', 5e' and 25c' was prepared as follows.

<Preparation of Solid Dispersion of Hydrazine Compound>

A 25% aqueous solution of Demole SNB (produced by Kao Corporation) was prepared. To 1 g of a hydrazine derivative, 1.2 g of the Demole SNB aqueous solution prepared above and 59 g of water were added and mixed to form a slurry. The resulting slurry was placed in a disperser (1/16 gallon, a sand grinder mill manufactured by Imex K. K.) and dispersed using 170 g of glass beads having a diameter of from 0.8 to 1.2 mm as media for 15 hours. Then, an aqueous gelatin solution was added thereto and mixed to have a hydrazine compound concentration of 1% and a gelatin concentration of 5%, and 2,000 ppm on a gelatin basis of proxel as an antiseptic was added. Finally, an ascorbic acid was added to adjust the pH to 5.0. The solid dispersion obtained had an average particle size of about 0.3 μm.

A light-sensitive material was prepared as follows.

<Preparation of Emulsion>

| | | |
|---|---|---|
| Solution 1: | | |
| Water | 1 | l |
| Gelatin | 20 | g |
| Sodium chloride | 3.0 | g |
| 1,3-Dimethylimidazolidine-2-thione | 20 | mg |
| Sodium benzenethiosulfonate | 8 | mg |
| Solution 2: | | |
| Water | 400 | ml |
| Silver nitrate | 100 | g |
| Solution 3: | | |
| Water | 400 | ml |
| Sodium chloride | 27.1 | g |
| Potassium bromide | 21.0 | g |
| Ammonium hexachloroiridate(III) (0.001% aqueous solution) | 20 | ml |
| Potassium hexachlororhodate(III) (0.001% aqueous solution) | 6 | ml |

To Solution 1 kept at 42° C. and a pH of 4.5, Solution 2 and Solution 3 were simultaneously added over 15 minutes while stirring to form core grains. Thereto, Solution 4 and Solution 5 shown below were added over 15 minutes. Further, 0.15 g of potassium iodide was added and the grain formation was completed.

| | | |
|---|---|---|
| Solution 4: | | |
| Water | 400 | ml |
| Sodium nitrate | 100 | g |
| Solution 5: | | |
| Water | 400 | ml |
| Sodium chloride | 27.1 | g |
| Potassium bromide | 21.0 | g |
| Potassium hexacyanoferrate(II) (0.1% aqueous solution) | 10 | ml |

The emulsion obtained was washed with water by a flocculation method according to a usual method and thereto, 40 g of gelatin was added.

The pH and the pAg were adjusted to 5.7 and 7.5, respectively, and 1.0 mg of sodium thiosulfate, 4.0 mg of chloroauric acid, 1.5 mg of triphenylphosphine selenide, 8 mg of sodium benzenethiosulfonate and 2 mg of sodium benzenethiosulfinate were added to perform chemical sensitization to give an optimal sensitivity at 55° C.

Further, 100 mg of 4-hydroxy-6-methyl-1,3,3a,7-tetrazaindene as a stabilizer and phenoxyethanol as an antiseptic were added and finally, Silver Chloroiodobromide Cubic Emulsion A having a silver chloride content of 70 mol % and an average grain size of 0.25 μm was obtained.

<Preparation of Coated Sample>

To the emulsion obtained above, $3.8\times10^{-4}$ mol/mol-Ag of Sensitizing Dye (1) was added to effect spectral sensitization. Then, $3.4\times10^{-4}$ mol/mol-Ag of KBr, $3.2\times10^{-4}$ mol/mol-Ag of Compound (1), $8.0\times10^{-4}$ mol/mol-Ag of Compound (2), $1.2\times10^{-2}$ mol/mol-Ag of hydroquinone, $3.0\times10^{-3}$ mol/mol-Ag of citric acid, $1.0\times10^{-4}$ mol/mol-Ag of a hydrazine compound shown in Table 20, $6.0\times10^{-4}$ mol/mol-Ag of Compound (4), 35 wt % on a gelatin basis of polyethyl acrylate latex, 20 wt % on a gelatin basis of colloidal silica having a particle size of 10 mμ, and 4 wt % on a gelatin basis of Compound (5) were added. The resulting mixture was coated on a polyester support to have an Ag coverage of 2.5 g/m$^2$ and a gelatin coverage of 1.2 g/m$^2$. Further, a protective upper layer and a protective lower layer each having the following composition were coated thereon, and a UL layer having the following composition was coated thereunder.

| (Protective Upper Layer) | | |
|---|---|---|
| Gelatin | 0.3 | g/m$^2$ |
| Silica matting agent having an average particle size of 3.5 μm | 25 | mg/m$^2$ |
| Compound (6) (gelatin dispersion) | 20 | mg/m$^2$ |
| Colloidal silica having a particle size of from 10 to 20 μm | 30 | mg/m$^2$ |
| Compound (7) | 5 | mg/m$^2$ |
| Sodium dodecylbenzenesulfonate | 20 | mg/m$^2$ |
| Compound (8) | 20 | mg/m$^2$ |

-continued

| (Protective Lower Layer) | | |
|---|---|---|
| Gelatin | 0.5 | g/m$^2$ |
| Compound (9) | 15 | mg/m$^2$ |
| 1,5-Dihydroxy-2-benzaldoxime | 10 | mg/m$^2$ |
| Polyethyl acrylate latex | 150 | mg/m$^2$ |
| (UL Layer) | | |
| Gelatin | 0.5 | g/m$^2$ |
| Polyethyl acrylate latex | 150 | mg/m$^2$ |
| Compound (5) | 40 | mg/m$^2$ |
| Compound (10) | 10 | mg/m$^2$ |

The support of the sample used in this Example had a back layer and an electrically conductive layer each having the following composition.

| (Back Layer) | | |
|---|---|---|
| Gelatin | 3.3 | g/m$^2$ |
| Sodium dodecylbenzenesulfonate | 80 | mg/m$^2$ |
| Compound (11) | 40 | mg/m$^2$ |
| Compound (12) | 20 | mg/m$^2$ |
| Compound (13) | 90 | mg/m$^2$ |
| 1,3-Divinylsulfonyl-2-propanol | 60 | mg/m$^2$ |
| Polymethyl methacrylate fine particle (average particle size: 6.5 μm) | 30 | mg/m$^2$ |
| Compound (5) | 120 | mg/m$^2$ |
| (Electrically Conductive Layer) | | |
| Gelatin | 0.1 | g/m$^2$ |
| Sodium dodecylbenzenesulfonate | 20 | mg/m$^2$ |
| $SnO_2$/Sb (9/1 by weight, average particle size: 0.25 μm) | 200 | mg/m$^2$ |

Sensitizing Dye (1)

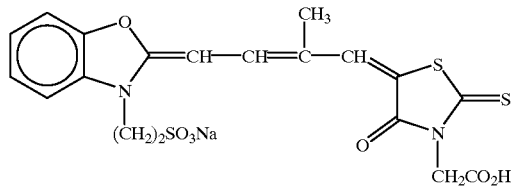

Compound (1)

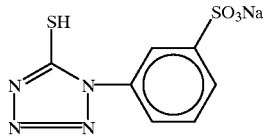

Compound (2)

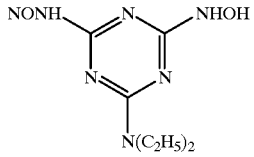

Hydrazine Compound H

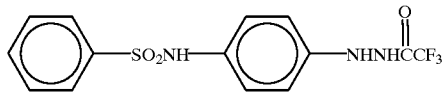

-continued
Compound (4)
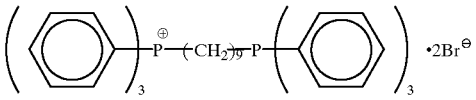
Compound (5)
A 3:1 mixture of n = 2 and n = 3:
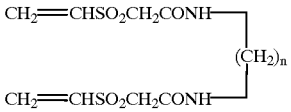
Compound (6)
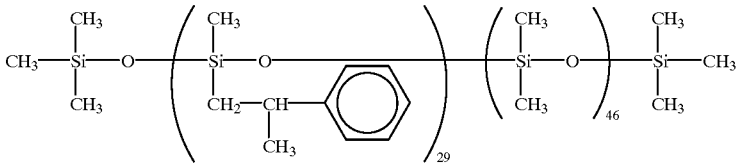
Compound (7)
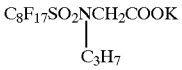
Compound (8)
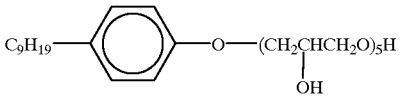
Compound (9)
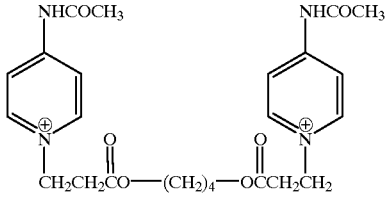
Compound (10)
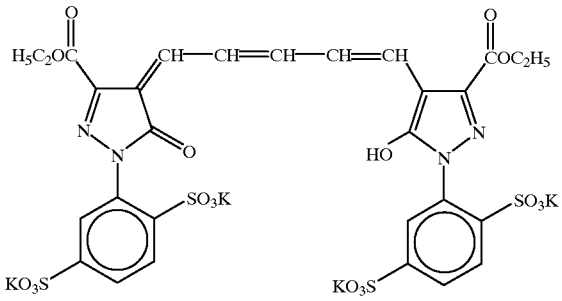
Compound (11)

-continued

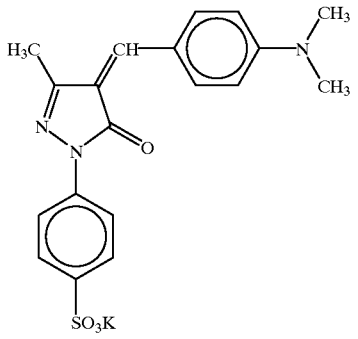

Compound (12)

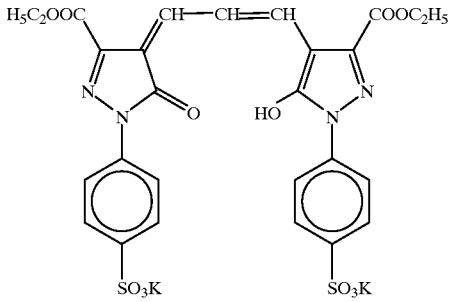

Compound (13)

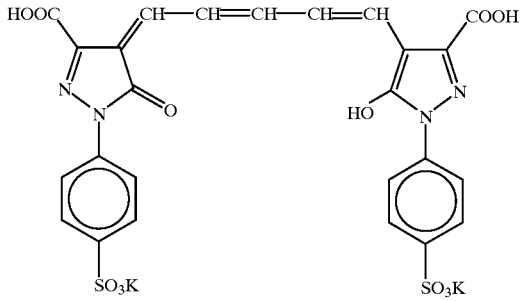

TABLE 8

| Light-Sensitive No. | Hydrazine Derivative No. | Addition Method of Hydrazine Derivative |
|---|---|---|
| A | Hydrazine Compound H | dissolved in methanol before addition |
| B | 1c' | dissolved in methanol before addition |
| C | 1c' | added as a solid dispersion |
| D | 5e' | added as a solid dispersion |
| E | 25c' | added as a solid dispersion |

<Evaluation>

(1) Exposure, Development

Each of the samples prepared above was exposed to a xenon flash light for a light emission time of $10^{-5}$ sec using a stepwedge through an interference filter having a peak at 633 nm, developed with the developer prepared above at 34° C. for 15 seconds in an automatic developing machine AP-560, manufactured by Fuji Photo Film Col, Ltd., and then subjected to fixing, water washing and drying.

The fixing solution used had the following formulation.

| Fixing Solution | | |
|---|---|---|
| Ammonium thiosulfate | 120 | g |
| Disodium ethylenediaminetetraacetate dihydrate | 0.03 | g |
| Sodium sulfate pentahydrate | 11 | g |
| Sodium metasulfite | 19 | g |
| Sodium hydroxide | 12.4 | g |
| Acetic acid (100%) | 30 | g |
| Tartaric acid | 2.9 | g |
| Sodium gluconate | 1.7 | g |
| Aluminium sulfate | 8.4 | g |
| pH | 4.8 | |

(2) Evaluation (Gamma)

As an index (gamma) for the contrast of an image, a point of (fog+density of 0.1) and point of (fog+density of 3.0) on a characteristic curve was connected by a straight line, and the gradient of the straight line obtained was expressed as the gamma value. That is, gamma=(3.0−0.1)/[log(exposure amount necessary for giving a density of 3.0)-log(exposure amount necessary for giving a density of 0.1)], and the larger the gamma value is, the higher contrast the photographic property is. If the gamma value is less than 15, the image can hardly endure practical use. The gamma value is preferably 20 or more.

(3) Practical Dmax

The practical Dmax was defined as the density on a solid area when test steps (16 steps) were output while varying the LS value (light step value) at 175 lines/inch using a color scanner SG-608 with helium-neon light source, manufactured by Dainippon Screen Mfg. Co., Ltd., and exposed at the LS value where the dots in 8th step became 49%. The halftone percentage was determined by means of Macbeth TD904. If the practical Dmax is 4.0 or less, the image can hardly endure the practical used. The practical Dmax is preferably 4.5 or more.

(4) Evaluation of Linear Reproduction Test steps (16 steps) were output at 175 lines/inch using a color scanner SG-608 with helium-neon light source, manufactured by Dainippon Screen Mfg., Co., Ltd., and developed under the above-described processing conditions, and the halftone percentages at the 1st step and the 15th step were measured when the dots at 8th step became 49%. As the closer to 5% the 1st step is and as the closer to 92% the 15th step is, the more excellent the linearity. The halftone percentage was determined by means of Macbeth TD 904. If the 1st step is less than 3% or the 15th step exceeds 94%, the image cannot be endurable in practical use.

(5) Evaluation of Taillessness of Dots

A 50% plain net having 100 lines was output on the coated light-sensitive material using a color scanner M-656 with argon light source, manufactured by Crossfield KK, the light-sensitive material was developed under the above-described conditions, and the taillessness of dots was visually evaluated through a magnifier of 200 times. The evaluation results are shown in the table below by a 5 point method of from 5 (good) to 1 (bad). The rating of point 3 or higher is necessary for practical use.

The evaluation results are shown in Table 9.

TABLE 9

| Test No. | Developer No. | Light-Sensitive No. | Gamma | Practical Dm | Linearity 1st Step (%) | Linearity 15th Step (%) | Taillessness of Dots | Remarks |
|---|---|---|---|---|---|---|---|---|
| 1-1 | 1 | A | 14 | 3.4 | 4 | 93 | 1 | Comparison |
| 1-2 | 1 | B | 14 | 3.7 | 4 | 93 | 2 | Comparison |
| 1-3 | 2 | A | 16 | 3.8 | 3 | 94 | 3 | Invention |
| 1-4 | 2 | B | 17 | 3.9 | 3 | 94 | 4 | Invention |
| 1-5 | 3 | A | 16 | 3.6 | 3 | 94 | 3 | Invention |
| 1-6 | 3 | B | 18 | 4.1 | 4 | 93 | 3 | Invention |
| 1-7 | 3 | C | 15 | 4.2 | 4 | 93 | 3 | Invention |
| 1-8 | 4 | C | 16 | 4.1 | 4 | 93 | 3 | Invention |
| 1-9 | 5 | C | 16 | 4.2 | 4 | 93 | 3 | Invention |
| 1-10 | 6 | A | 17 | 3.6 | 3 | 94 | 3 | Comparison |
| 1-11 | 6 | B | 20 | 4.5 | 4 | 93 | 4 | Invention |
| 1-12 | 6 | C | 21 | 4.6 | 4 | 93 | 4 | Invention |
| 1-13 | 6 | D | 20 | 4.6 | 4 | 93 | 4 | Invention |
| 1-14 | 6 | E | 22 | 4.5 | 4 | 93 | 4 | Invention |
| 1-15 | 7 | C | 21 | 4.6 | 4 | 93 | 4 | Invention |
| 1-16 | 8 | C | 20 | 4.5 | 4 | 93 | 4 | Invention |
| 1-17 | 9 | B | 22 | 4.7 | 4 | 93 | 5 | Invention |
| 1-18 | 9 | C | 21 | 4.7 | 5 | 92 | 5 | Invention |
| 1-19 | 9 | D | 22 | 4.8 | 5 | 92 | 5 | Invention |
| 1-20 | 9 | E | 20 | 4.7 | 5 | 92 | 5 | Invention |
| 1-21 | 10 | C | 21 | 4.8 | 5 | 92 | 5 | Invention |

<Results>

When the light-sensitive material containing the hydrazine derivative of the present invention and the developer of the present invention are combined, a scanner light-sensitive material satisfied in all capabilities of ultrahigh contrast, practical Dmax, linear reproducibility and taillessness of dots can be uniquely obtained.

By using a p-aminophenol having a specific structure represented by formula (A) of the present invention in a developer comprising an ascorbic acid represented by formula (B) or a derivative thereof, an image having high sensitivity and good quality can be provided in rapid processing. In particular, an ultrahigh contrast negative image can be provided in rapid processing by processing a photographic light-sensitive material containing a hydrazine compound with the developer of the present invention.

While the invention has been described in detail and with reference to specific examples thereof, it will be apparent to one skilled in the art that various changes and modifications can be made therein without departing from the spirit and scope thereof.

What is claimed is:

1. A processing composition for silver halide photographic light-sensitive material, which comprises at least one compound represented by the following formula (A), (A-I) or (A-II) and at least one compound represented by the following formula (B):

(A)

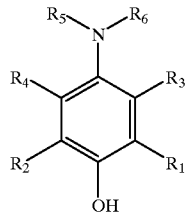

wherein $R_1$, $R_2$, $R_3$ and $R_4$, which may be the same or different, each represents a hydrogen atom or a substituent, and $R_5$ and $R_6$, which may be the same or different, each represents an alkyl group, an alkenyl group, an alkynyl group, an aryl group, an aralkyl group or a heterocyclic group;

(A-I)

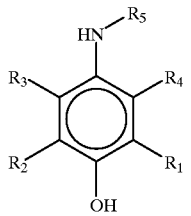

wherein in formulae (A-I) and (A-II), $R_1$, $R_2$, $R_3$, $R_4$, $R_{11}$, $R_{22}$, $R_{33}$ and $R_6$, which may be the same or different, each represents a hydrogen atom or a substituent, provided that at least one of $R_1$, $R_2$, $R_3$ and $R_4$ represents an alkoxy group; in formula (A-I), $R_5$ represents an alkyl group, an aryl group, an aralkyl group or a heterocyclic group; and in formula (A-II), Z represents an atomic group comprising a carbon atom or an oxygen atom, capable of forming a 5- or 6-membered condensed heterocyclic ring together with the nitrogen atom and the benzene ring, and m represents an integer of from 0 to 4;

(A-II)

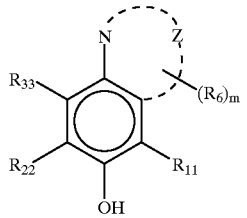

wherein $R_7$ represents a hydrogen atom, an alkyl group, an aryl group or a heterocyclic group.

2. The processing composition as claimed in claim 1, which contains substantially no dihydroxybenzene-base developing agent.

3. The processing composition as claimed in claim 1, which contains at least one compound represented by the following formula (C):

(C)

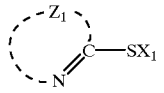

wherein $Z_1$ represents a nonmetallic atom group necessary for forming a substituted or unsubstituted, 5- or 6-membered nitrogen-containing aromatic heterocyclic ring together with the N and C atoms, $X_1$ represents a hydrogen atom or a cation, and two kinds of radicals resulting from elimination of any one hydrogen atom from $Z_1$ may be combined to form a bis type structure.

4. A developer for silver halide photographic light-sensitive material, which comprises at least one compound represented by the following formula (A), (A-I) or (A-II) and at least one compound represented by the following formula (B):

(A)

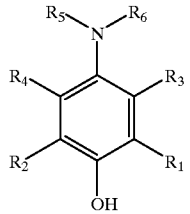

wherein $R_1$, $R_2$, $R_3$ and $R_4$, which may be the same or different, each represents a hydrogen atom or a substituent, and $R_5$ and $R_6$, which may be the same or different, each represents an alkyl group, an alkenyl group, an alkynyl group, an aryl group, an aralkyl group or a heterocyclic group;

(A-I)

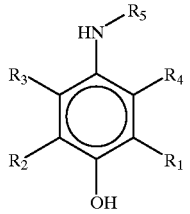

wherein in formulae (A-I) and (A-II), $R_1$, $R_2$, $R_3$, $R_4$, $R_{11}$, $R_{22}$, $R_{33}$ and $R_6$, which may be the same or different, each represents a hydrogen atom or a substituent, provided that at least one of $R_1$, $R_2$, $R_3$ and $R_4$ represents an alkoxy group; in formula (A-I), $R_5$ represents an alkyl group, an aryl group, an aralkyl group or a heterocyclic group; and in formula (A-II), Z represents an atomic group comprising a carbon atom or an oxygen atom, capable of forming a 5- or 6-membered condensed heterocyclic ring together with the nitrogen atom and the benzene ring, and m represents an integer of from 0 to 4;

(A-II)

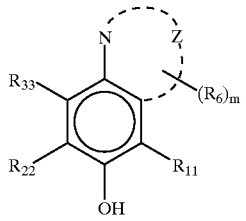

wherein $R_7$ represents a hydrogen atom, an alkyl group, an aryl group or a heterocyclic group.

5. The developer as claimed in claim 4, which contains substantially no dihydroxybenzene-base developing agent.

6. The developer as claimed in claim 4, which contains at least one compound represented by the following formula (C):

(C)

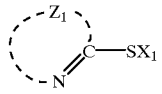

wherein $Z_1$ represents a nonmetallic atom group necessary for forming a substituted or unsubstituted, 5- or 6-membered nitrogen-containing aromatic heterocyclic ring together with the N and C atoms, $X_1$ represents a hydrogen atom or a cation, and two kinds of radicals resulting from elimination of any one hydrogen atom from $Z_1$ may be combined to form a bis type structure.

7. A processing method of a silver halide photographic light-sensitive material, which comprises developing an exposed silver halide photographic light-sensitive material with a developer, wherein the developer comprises at least one compound represented by the following formula (A), (A-I) or (A-II) and at least one compound represented by the following formula (B):

(A)

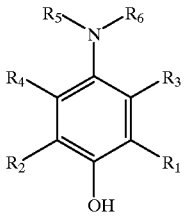

wherein $R_1$, $R_2$, $R_3$ and $R_4$, which may be the same or different, each represents a hydrogen atom or a substituent, and $R_5$ and $R_6$, which may be the same or different, each represents an alkyl group, an alkenyl group, an alkynyl group, an aryl group, an aralkyl group or a heterocyclic group;

(A-I)

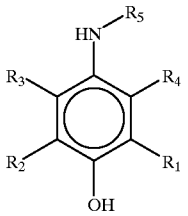

(A-II)

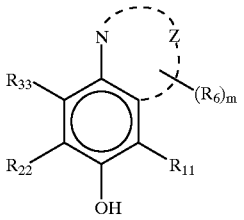

wherein in formulae (A-I) and (A-II), $R_1$, $R_2$, $R_3$, $R_4$, $R_{11}$, $R_{22}$, $R_{33}$ and $R_6$, which may be the same or different, each represents a hydrogen atom or a substituent, provided that at least one of $R_1$, $R_2$, $R_3$ and $R_4$ represents an alkoxy group; in formula (A-I), $R_5$ represents an alkyl group, an aryl group, an aralkyl group or a heterocyclic group; and in formula (A-II), Z represents an atomic group comprising a carbon atom or an oxygen atom, capable of forming a 5- or 6-membered condensed heterocyclic ring together with the nitrogen atom and the benzene ring, and m represents an integer of from 0 to 4;

(B)

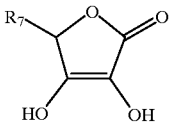

wherein $R_7$ represents a hydrogen atom, an alkyl group, an aryl group or a heterocyclic group.

8. The processing method as claimed in claim 7, wherein the developer has a pH of from 9.0 to 10.5.

9. The processing method as claimed in claim 7, wherein the developer has a carbonate concentration of 0.3 mol/l or more.

10. The processing method as claimed in claim 7, wherein the developer has a sulfite concentration of 0.1 mol/l or less.

11. The processing method as claimed in claim 7, wherein the replenishing amount of the developer is 180 ml/$m^2$ or less.

12. The processing method as claimed in claim 7, wherein the developer replenisher has a pH 0.3 higher than the pH of the developer mother solution.

13. The processing method as claimed in claim 7, wherein the silver halide photographic light-sensitive material comprises a silver halide emulsion layer and other hydrophilic colloid layers, at least one of the silver halide emulsion layer and other hydrophilic colloid layers containing a hydrazine nucleating agent.

14. The processing method as claimed in claim 13, wherein at least one of the silver halide emulsion layer and other hydrophilic colloid layers contains a nucleation accelerator.

15. The processing method as claimed in claim 7, wherein the silver halide photographic light-sensitive material comprises a silver halide emulsion layer containing silver halide grains of which from 50 to 100% of the total projected area are occupied by tabular grains having an aspect ratio of from 3 to 30.

16. The processing method as claimed in claim 15, wherein at least 50 mol % of the silver halide grains contained in the silver halide emulsion layer of the silver halide photographic light-sensitive material are silver chloride.

* * * * *